US012220016B1

(12) United States Patent
Bologna et al.

(10) Patent No.: US 12,220,016 B1
(45) Date of Patent: Feb. 11, 2025

(54) PROTECTIVE SPORTS HELMET WITH ADVANCED VISOR SYSTEM, LOWER CHIN BAR ASSEMBLY AND ENERGY ATTENUATION SYSTEM

(71) Applicant: Riddell, Inc., Des Plaines, IL (US)

(72) Inventors: Vittorio Bologna, Des Plaines, IL (US); Joseph Levene, Des Plaines, IL (US); Murphy Gillogly, Des Plaines, IL (US); Bradshaw Baldonado, Des Plaines, IL (US); Thad M. Ide, Des Plaines, IL (US)

(73) Assignee: Riddell, Inc., Des Plaines, IL (US)

( * ) Notice: Subject to any disclaimer, the term of this patent is extended or adjusted under 35 U.S.C. 154(b) by 457 days.

(21) Appl. No.: 17/327,641

(22) Filed: May 21, 2021

Related U.S. Application Data

(60) Provisional application No. 63/188,836, filed on May 14, 2021, provisional application No. 63/157,337, (Continued)

(51) Int. Cl.
*A42B 3/22* (2006.01)
*A42B 3/06* (2006.01)
*A42B 3/20* (2006.01)

(52) U.S. Cl.
CPC ..... *A42B 3/221* (2013.01); *A42B 3/06* (2013.01); *A42B 3/205* (2013.01)

(58) Field of Classification Search
CPC ..... A42B 3/221; A42B 3/06; A42B 3/205
(Continued)

(56) References Cited

U.S. PATENT DOCUMENTS 4,689,836 A * 9/1987 Vitaloni ..... A42B 3/222 2/9
6,212,689 B1 * 4/2001 Lee ..... A42B 3/326 2/424

(Continued)

OTHER PUBLICATIONS

Bologna Vittorio et al. Protective Recreational Sports Helmet With Components Additively Manufactured To Manage Impact Forces, WO 2020107005 A1,Nov. 21, 2019 (Year: 2019).*

*Primary Examiner* — Khaled Annis
(74) *Attorney, Agent, or Firm* — Barnes & Thornburg LLP

(57) ABSTRACT

An innovative protective football helmet includes a durable shell having an impact attenuation system, a visor system with a visor, a lower chin bar assembly, and internal impact attenuation assembly. The connection of the visor to the shell is "tool-less," meaning that no unique tool is required for coupling or removing the visor system. The visor system is not coupled to the lower chin bar assembly, which allows the visor to independently flex and independently elastically deform relative to the chin bar assembly. The visor is configured to match a substantial extent of the frontal shell region, thus the visor does not need to be substantially deformed during the installation process, which eliminates the introduction of additional stresses on the visor during the installation process. The visor also replaces a significant upper extent of a conventional facemask that is both heavy and costly to manufacture. Due to the design of the helmet and visor system, there is a significant increase in the player's field of view through the frontal helmet opening and the visor. This increase in the field of view provides greater situational awareness for the player and allows the player to reduce the amount of head rotation necessary to see objects or other players when the player is engaged in playing the sport.

22 Claims, 104 Drawing Sheets

Related U.S. Application Data filed on Mar. 5, 2021, provisional application No. 63/079,476, filed on Sep. 16, 2020.

(58) Field of Classification Search
USPC ..... 2/424
See application file for complete search history.

(56) References Cited

U.S. PATENT DOCUMENTS

| | | | | |
|---|---|---|---|---|
| 6,237,161 | B1 * | 5/2001 | Lee | A42B 3/326 2/424 |
| 6,928,662 | B2 * | 8/2005 | Fournier | A62B 18/00 128/201.24 |
| 8,082,600 | B2 * | 12/2011 | Morin | A42B 3/326 2/424 |
| 10,568,380 | B2 * | 2/2020 | Salvetti | A42B 3/125 |
| 10,736,374 | B2 * | 8/2020 | An | A42B 3/326 |
| 10,786,032 | B2 * | 9/2020 | Hunt | A42B 3/223 |
| 10,869,521 | B2 * | 12/2020 | Kim, II | A42B 3/227 |
| 11,026,467 | B2 * | 6/2021 | Durham | A42B 3/062 |
| 11,412,807 | B2 * | 8/2022 | Jwa | A42B 3/205 |
| 11,696,613 | B2 * | 7/2023 | Liao | A42B 3/205 2/424 |
| 2003/0182716 | A1 * | 10/2003 | Wu | A42B 3/326 2/424 |
| 2007/0124851 | A1 * | 6/2007 | Pyo | A42B 3/222 2/424 |
| 2007/0250993 | A1 * | 11/2007 | Schimpf | A42B 3/326 2/424 |
| 2008/0216215 | A1 * | 9/2008 | Lee | A42B 3/326 2/10 |
| 2011/0302701 | A1 * | 12/2011 | Kuo | A42B 3/326 2/424 |
| 2013/0318691 | A1 * | 12/2013 | Krick | A42B 3/221 2/10 |
| 2014/0352020 | A1 * | 12/2014 | Isobe | A42B 3/223 2/9 |
| 2015/0040299 | A1 * | 2/2015 | Guay | A42B 3/222 2/422 |
| 2016/0029734 | A1 * | 2/2016 | Kurpjuweit | A42B 3/205 2/427 |
| 2017/0318893 | A1 * | 11/2017 | Durham | A42B 3/125 |
| 2018/0103710 | A1 * | 4/2018 | Kim | A42B 3/326 |
| 2018/0213877 | A1 * | 8/2018 | Liao | A42B 3/225 |
| 2020/0113268 | A1 * | 4/2020 | Liao | A42B 3/223 |
| 2020/0178639 | A1 * | 6/2020 | Jwa | A42B 3/205 |
| 2021/0274877 | A1 * | 9/2021 | Liao | A42B 3/223 |
| 2024/0081463 | A1 * | 3/2024 | Lee | A42B 3/326 |

* cited by examiner

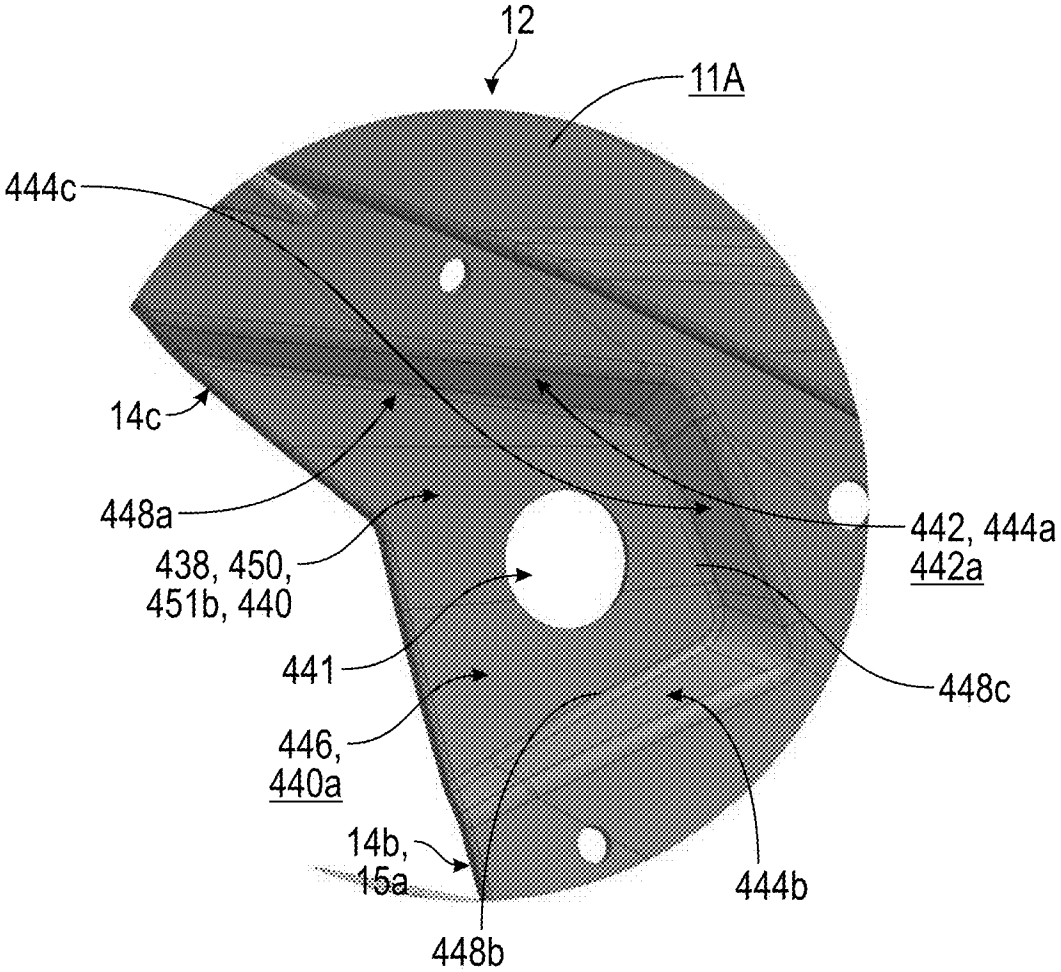
FIG. 45A
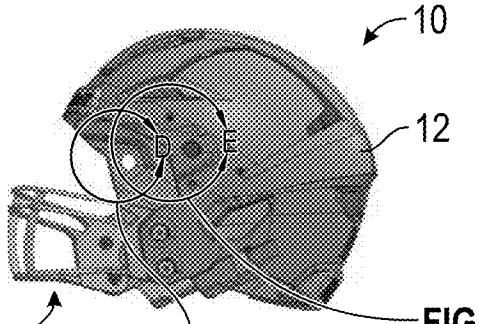
FIG. 45B
FIG. 45A
FIG. 44

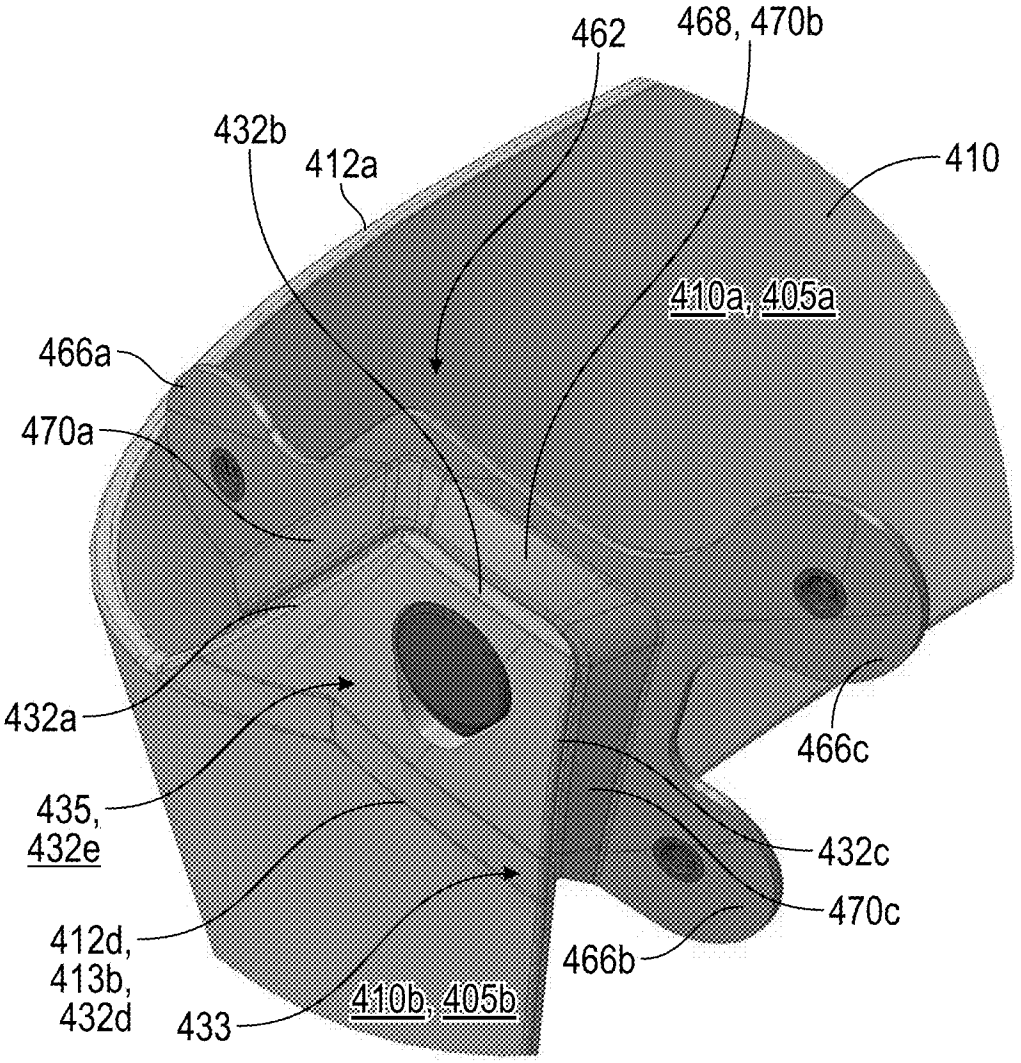
FIG. 48B
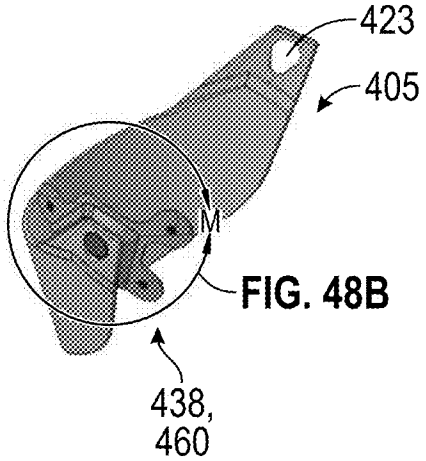
FIG. 48B
FIG. 48A

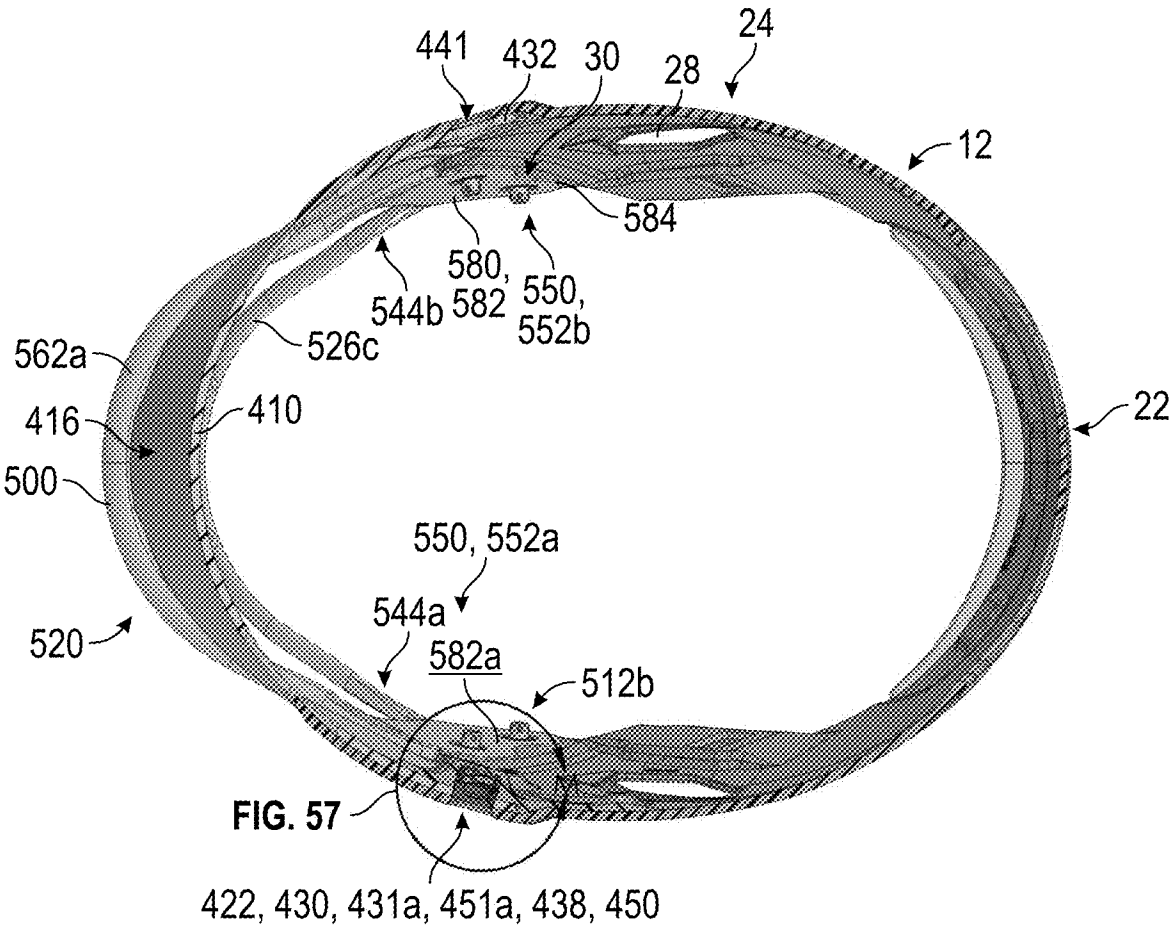
FIG. 56
FIG. 57
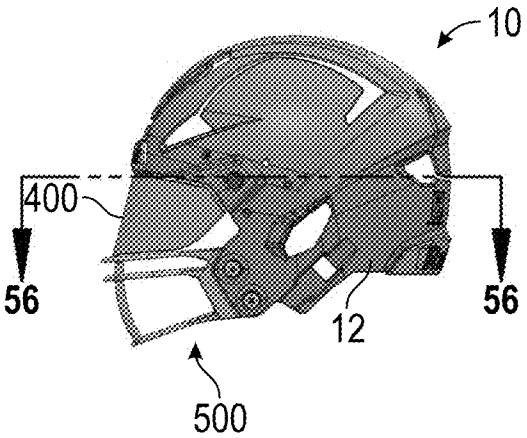
FIG. 55

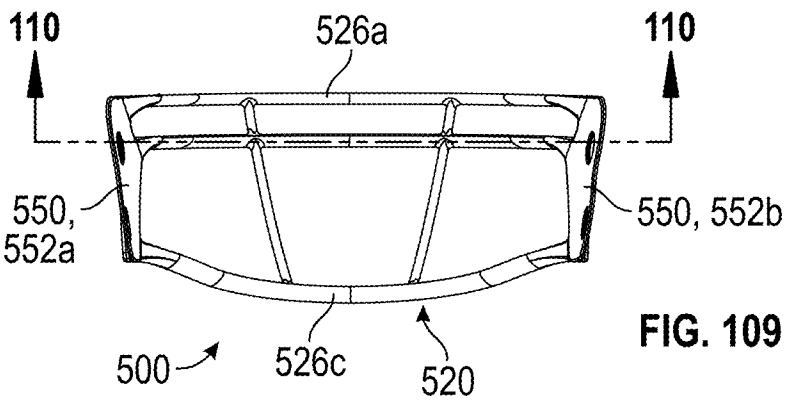
FIG. 109
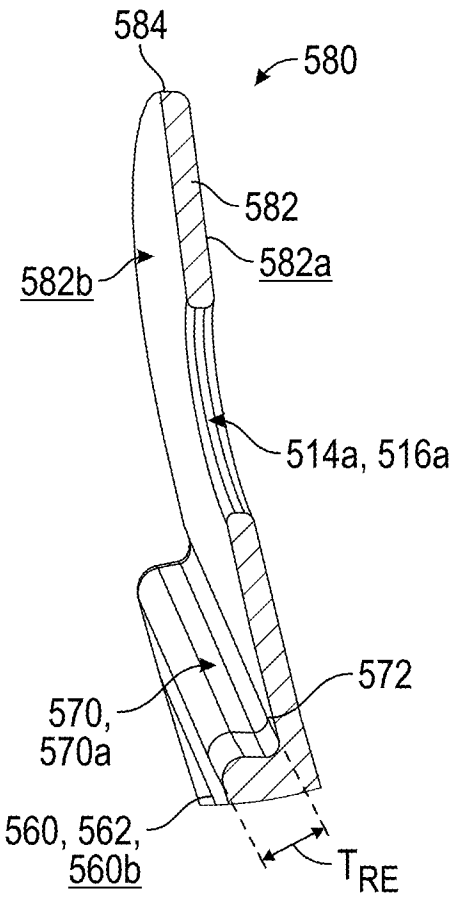
FIG. 110B
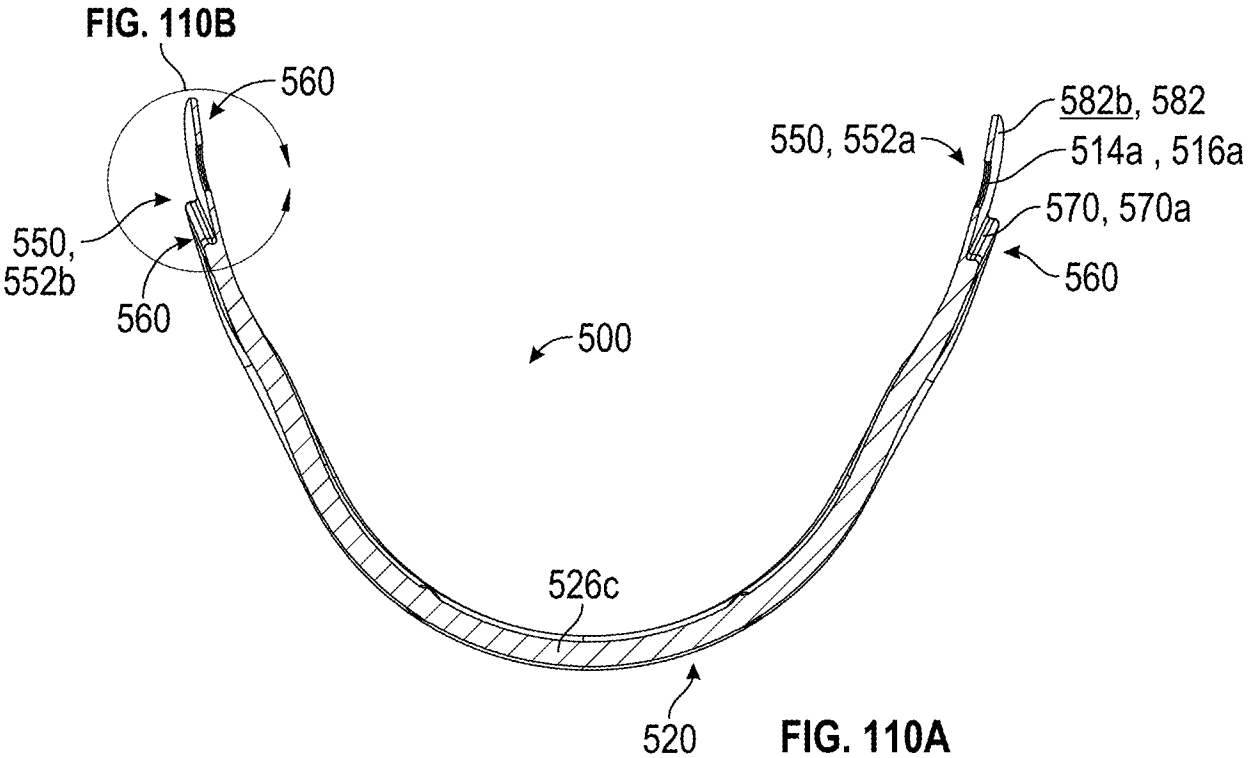
FIG. 110A
FIG. 110B

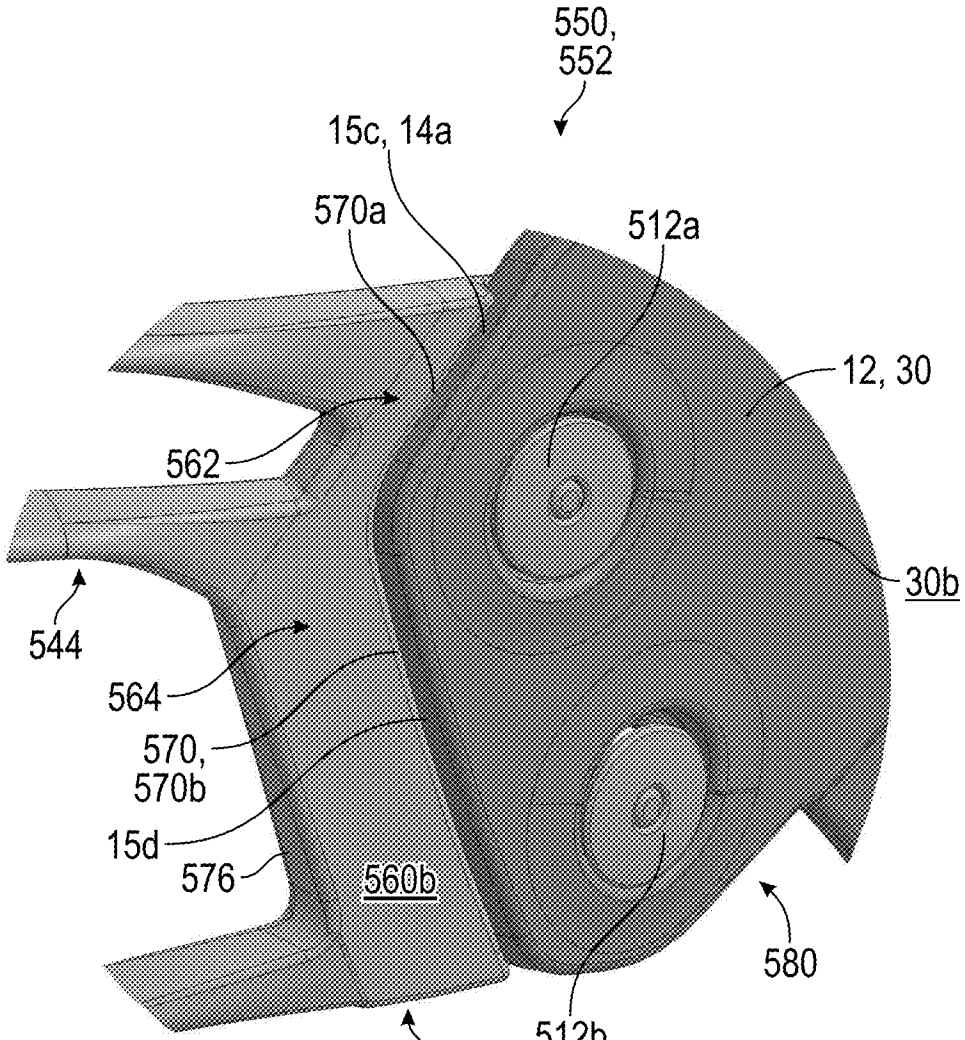
FIG. 112
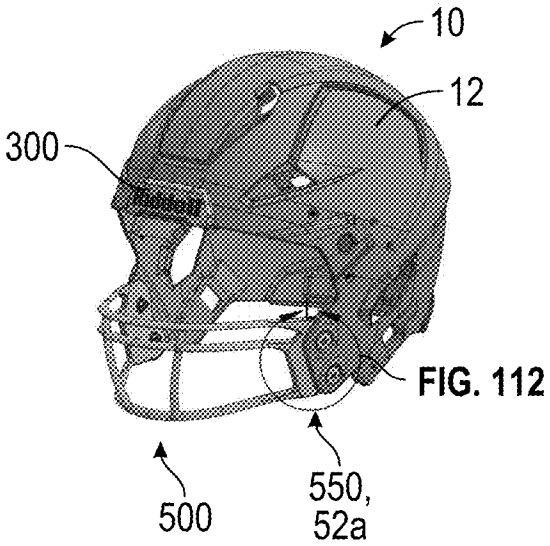
FIG. 112
FIG. 111

PROTECTIVE SPORTS HELMET WITH ADVANCED VISOR SYSTEM, LOWER CHIN BAR ASSEMBLY AND ENERGY ATTENUATION SYSTEM

PRIORITY CLAIM

This application claims the benefit of U.S. Provisional Application Ser. Nos. 63/079,476, 63/157,337, and 63/188,836.

CROSS-REFERENCE TO OTHER APPLICATIONS

U.S. Provisional Application Ser. No. 63/188,836, entitled "Protective Sports Helmet with Advanced Visor System, Lower Chin Bar Assembly and Energy Attenuation System," filed on May 14, 2021, the disclosure of these are hereby incorporated by reference in their entirety for all purposes.

U.S. Provisional Application Ser. No. 63/157,337, entitled "Protective Sports Helmet with Advanced Visor System, Lower Chin Bar Assembly and Energy Attenuation System," filed on Mar. 5, 2021, the disclosure of these are hereby incorporated by reference in their entirety for all purposes.

U.S. Provisional Application Ser. No. 63/079,476, entitled "Protective Sports Helmet with Visor System, Lower Chin Bar Assembly and Energy Attenuation System," filed on Sep. 16, 2020, the disclosure of these are hereby incorporated by reference in their entirety for all purposes.

U.S. patent application Ser. No. 16/691,436, entitled "Football helmet with components additively manufactured to manage impact forces," filed on Nov. 21, 2019, PCT Patent Application Serial No. PCT/US19/62697, entitled "Protective sports helmet with components additively manufactured to manage impact forces." filed on Nov. 21, 2019, PCT Patent Application Serial No. PCT/US19/62700, entitled "Protective recreational sports helmet with components additively manufactured to manage impact forces," filed on Nov. 21, 2019, and U.S. Provisional Patent Application Ser. No. 62/770,453, entitled "Football Helmet With Components Additively Manufactured To Optimize The Management Of Energy From Impact Forces," filed on Nov. 21, 2018, the disclosure of these are hereby incorporated by reference in their entirety for all purposes.

U.S. Design patent application Ser. No. 29/671,111, entitled "Energy attenuation Assembly of a Protective Sports Helmet," filed on Nov. 22, 2018, the disclosure of which is hereby incorporated by reference in its entirety for all purposes.

U.S. patent application Ser. No. 16/543,371 entitled "System And Method For Designing And Manufacturing A Protective Helmet Tailored To A Selected Group Of Helmet Wearers," filed on Aug. 16, 2019, and U.S. Provisional Patent Application Ser. No. 62/719,130 entitled "System and Methods for Designing and Manufacturing a Protective Sports Helmet Based on Statistical Analysis of Player Head Shapes," filed on Aug. 16, 2018, the disclosure of these are hereby incorporated by reference in their entirety for all purposes.

U.S. patent application Ser. No. 16/712,879, entitled "Systems and methods for providing training opportunities based on data collected from monitoring a physiological parameter of persons engaged in physical activity," filed on Dec. 12, 2019, PCT Patent Application Serial No. PCT/US19/66084, entitled "Systems and methods for providing training opportunities based on data collected from monitoring a physiological parameter of persons engaged in physical activity," filed on Dec. 12, 2019, and U.S. Provisional Patent Application Ser. No. 62/778,559, entitled "Systems And Methods For Providing Training Opportunities Based On Data Collected From Monitoring A Physiological Parameter Of Persons Engaged In Physical Activity," filed on Dec. 12, 2018, the disclosure of these are hereby incorporated by reference in their entirety for all purposes.

U.S. patent application Ser. No. 15/655,490 entitled "System And Methods For Designing And Manufacturing A Bespoke Protective Sports Helmet," filed on Jul. 20, 2017, and U.S. Provisional Patent Application Ser. No. 62/364,629 entitled "System And Methods For Designing And Manufacturing A Bespoke Protective Sports Helmet That Provides Improved Comfort And Fit To The Player Wearing The Helmet," filed on Jul. 20, 2016, the disclosure of these are hereby incorporated by reference in their entirety for all purposes.

U.S. Pat. No. 10,159,296 entitled "System and Method for Custom Forming a Protective Helmet for a Customers Head," filed on Jan. 15, 2014, U.S. Provisional Patent Application Ser. No. 61/754,469 entitled "System and method for custom forming sports equipment for a user's body part," filed Jan. 18, 2013, U.S. Provisional Patent Application Ser. No. 61/812,666 entitled "System and Method for Custom Forming a Protective Helmet for a User's Head," filed Apr. 16, 2013, U.S. Provisional Patent Application Ser. No. 61/875,603 entitled "Method and System for Creating a Consistent Test Line within Current Standards with Variable Custom Headforms," filed Sep. 9, 2013, and U.S. Provisional Patent Application Ser. No. 61/883,087 entitled "System and Method for Custom Forming a Protective Helmet for a Wearer's Head," filed Sep. 26, 2013, the disclosure of these are hereby incorporated by reference in their entirety for all purposes.

U.S. Pat. No. 9,314,063 entitled "Football Helmet with Impact Attenuation System," filed on Feb. 12, 2014, and U.S. Provisional Patent Application Ser. No. 61/763,802 entitled "Protective Sports Helmet with Engineered Energy Dispersion System," filed on Feb. 12, 2013, the disclosure of these are hereby incorporated by reference in its entirety for all purposes.

U.S. Design Pat. D850,011 entitled "Energy Attenuation Assembly of a Protective Sports Helmet," filed on Jul. 20, 2017, U.S. Design Pat. D850,012 entitled "Energy Attenuation Assembly of a Protective Sports Helmet," filed on Jul. 20, 2017, and U.S. Design Pat. D850,013 entitled "Energy Attenuation Assembly of a Protective Sports Helmet," filed on Jul. 20, 2017, the disclosure of these are hereby incorporated by reference in their entirety for all purposes.

U.S. Design Pat. D603,099 entitled "Sports Helmet," filed on Oct. 8, 2008, U.S. Design Pat. D764,716 entitled "Football Helmet," filed on Feb. 12, 2014, and U.S. Pat. No. 9,289,024 entitled "Protective Sports Helmet," filed on May 2, 2011, the disclosure of these are hereby incorporated by reference in their entirety for all purposes.

TECHNICAL FIELD

The invention relates to a protective sports helmet, such as an American football ("football") helmet, that is worn by a player during the play of a contact sports and including (i) a shell having an impact attenuation system purposely engineered to adjust a specific portion of the helmet's behavior in response to an impact or series of impacts received by the helmet, (ii) a visor system, and (iii) a lower chin bar assembly. The visor system spans a substantial extent of the frontal opening of the shell, through which the players looks into the field of view, and includes a main body and a visor attachment system. The visor attachment system is configured to removably secure the visor to the helmet without requiring the use of a separate tool and without distorting the optics of the visor system for the benefit of the player wearing the helmet.

BACKGROUND OF THE INVENTION

Helmets for contact sports, such as those used in football, hockey, and lacrosse, typically include a rigid outer shell, an internal pad assembly coupled to an interior surface of the shell, a faceguard or face mask, and a chin protector or strap that removably secures the helmet on the wearer's head. Conventional sports helmets may include ribs, ridges, and/or corrugations formed in the helmet shell, along with numerous openings in the shell. These openings can be configured to receive fasteners or attached mechanisms for coupling components to the shell. These components include the faceguard, the chinstrap, and the energy attenuation assembly. These openings in the shell can also include: (i) car hole apertures to improve hearing and (ii) ventilation apertures to enhance ventilation while the helmet is on the wearer's head.

In conventional helmets, the size, shape, and location of these openings are designed to minimize any structural weakness in the shell that may result from removing material from the shell to form these openings. The various ribs, ridges, and corrugations found in conventional sports helmets often function to increase shell stiffness, especially in the shell regions that include these features. The helmet's performance is complicated by the inclusion of the combination of multiple shell openings and ribs, ridges, and/or corrugations.

Some conventional football helmets allow for the connection of aftermarket shields, such as those marketed by Oakley. A separate tool (e.g., a screw driver) is required to fixedly connect the aftermarket shields to an extent of the faceguard, wherein said connection is achieved by a combination of bulky mechanical clips and fasteners that extend through an aperture formed in the shield, namely the lower region of the shield. To make this fixed connection between the aftermarket shield and the extent of the faceguard, a user normally inserts an upper extent of the visor between the faceguard and a frontal extent of the shell and then deforms the shield to match the contour of the faceguard in order to secure the shield to the faceguard using the mechanical clips. This installation procedure undesirably deforms the optics of the shield and does not secure any extent of the visor directly to the helmet shell; instead, the shield is connected to the faceguard. The securement method and positional relationship of the shield, faceguard and shell requires that the shield be removed from the helmet when the faceguard is removed from the helmet, which can occur in the event that the faceguard is damaged and needs to be replaced or the player is injured and requires medical attention. Accordingly, there is an unmet need for an improved protective sports helmet.

The description provided in the background section should not be assumed to be prior art merely because it is mentioned in or associated with the background section. The background section may include information that describes one or more aspects of the subject of technology.

BRIEF DESCRIPTION OF THE DRAWINGS

The drawing figures depict one or more implementations in accord with the present teachings, by way of example only, not by way of limitation. The figures, like reference numerals, refer to the same or similar elements.

FIG. 44 is a perspective view of the protective sports helmet of FIG. 1, wherein the visor system has been omitted to show an extent of the helmet-based engagement means;

FIG. 45*a* is a zoomed-in view of area A of FIG. 44;

FIG. 48*a* is a rear perspective view of an extent of the visor system of FIG. 30, showing the visor and the helmet-based engagement means;

FIG. 48*b* is a zoomed-in view of area C of FIG. 48*a*, showing an extent of the visor system of FIG. 30, showing the visor and the helmet-based engagement means;

FIG. 55 is a left side view of the protective sports helmet of FIG. 1;

FIG. 56 is a cross-sectional view of the protective sports helmet taken along line 56-56 of FIG. 55;

FIG. 59 is a cross-sectional view of the protective sports helmet taken along line 59-59 of

FIG. 58;

FIG. 109 is a rear view of the lower chin bar assembly of FIG. 100;

FIG. 110*a* is a cross-sectional view of the lower chin bar assembly taken along line 110-110 of FIG. 109;

FIG. 110*b* is a zoomed-in view of area H the lower chin bar assembly of FIG. 110*a;*

FIG. 111 is a frontal perspective view of the protective sports helmet of FIG. 1;

FIG. 112 is a zoomed-in view of area I the helmet of FIG. 111;

Figure 114A:
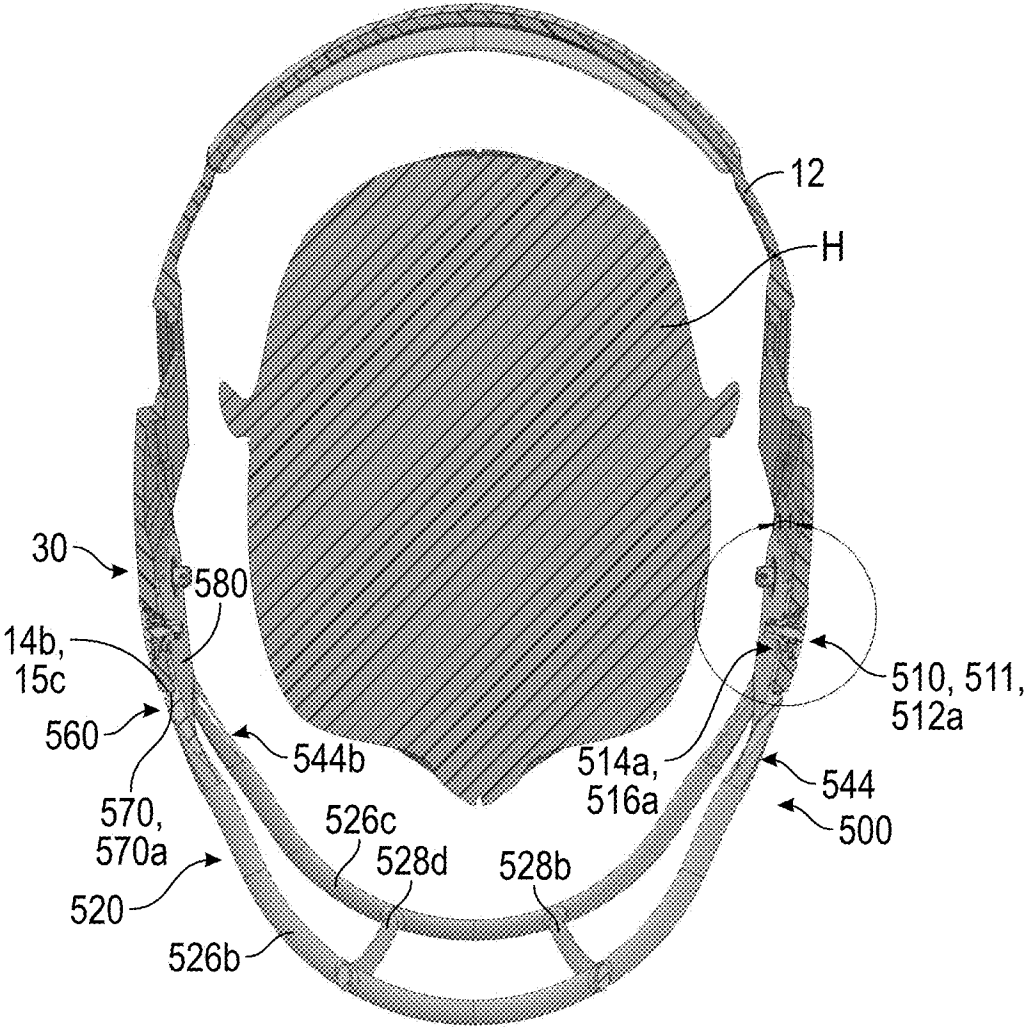
FIG. 114*a* is a cross-sectional view of the protective sports helmet taken along line 114-114 of FIG. 113.
Figure 113:
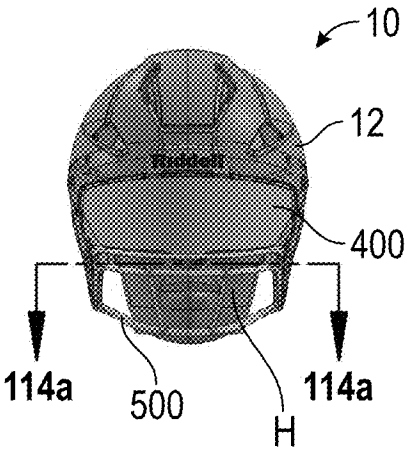
FIG. 113 is a front view of the protective sports helmet of FIG. 1.
Figure 114B:
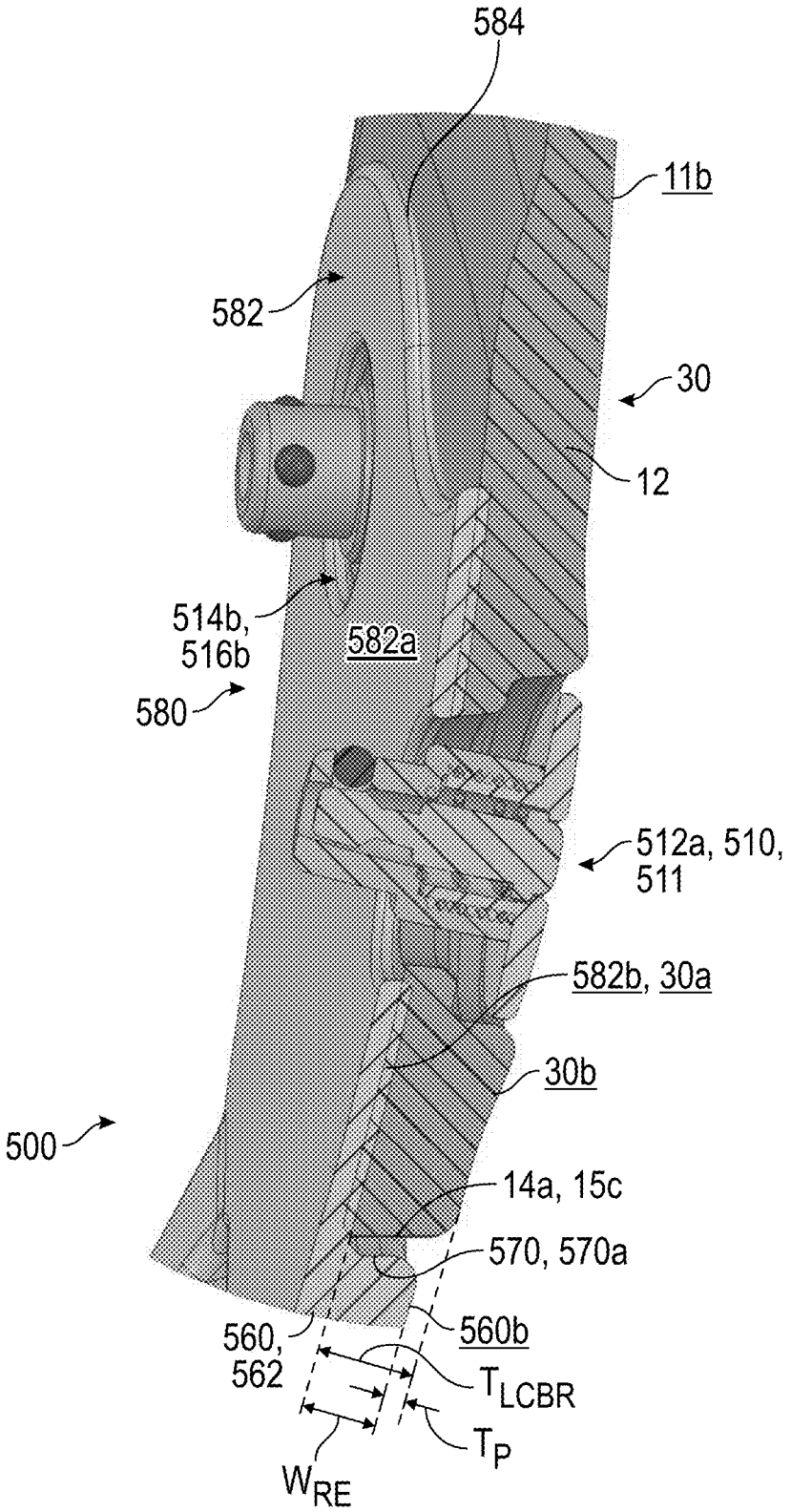

FIG. 114*b* is a zoomed-in view of area J of the helmet of FIG. 114*a;*

Figure 1:
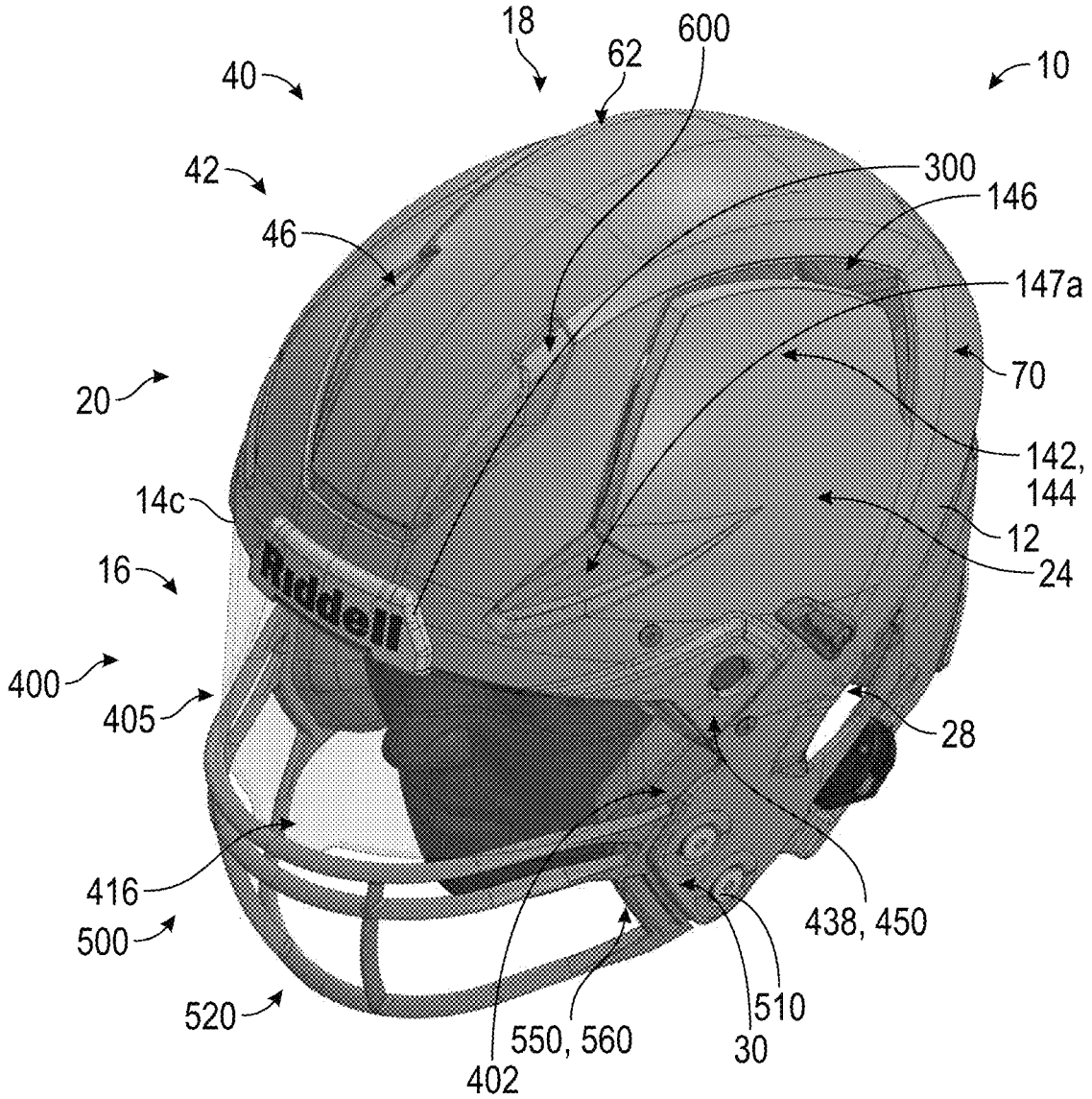
FIG. 1 is a perspective view of an inventive protective sports helmet, which includes a helmet shell, a visor system, and a lower chin bar assembly, wherein the visor system is in a connected position $P_C$.
Figure 3:
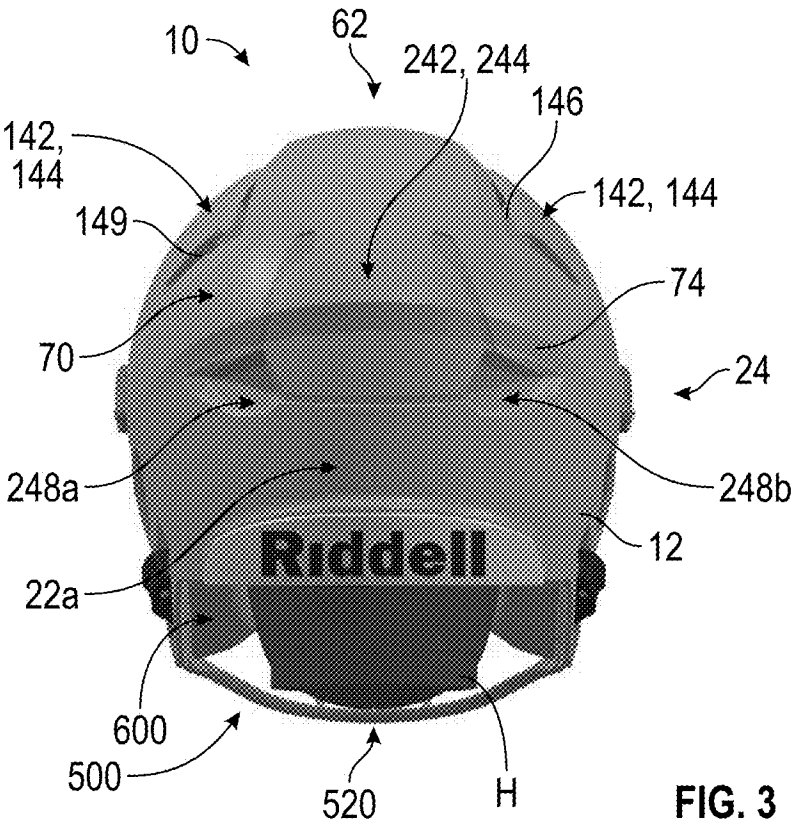
FIG. 3 is a rear view of the protective sports helmet of FIG. 1.
Figure 2:
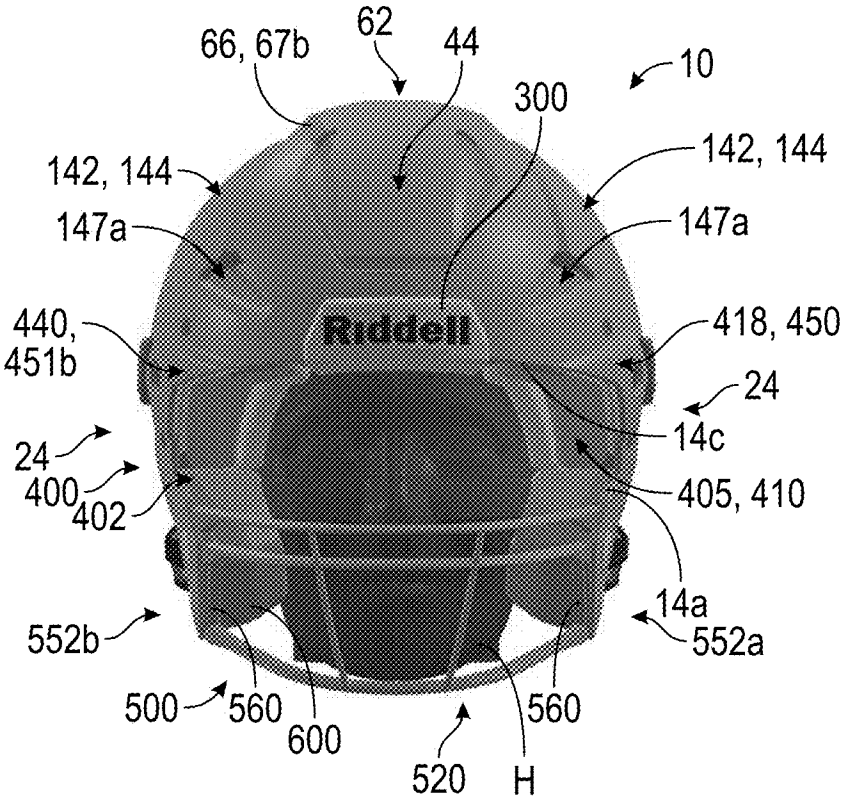
FIG. 2 is a front view of the protective sports helmet of FIG. 1.
Figure 4:
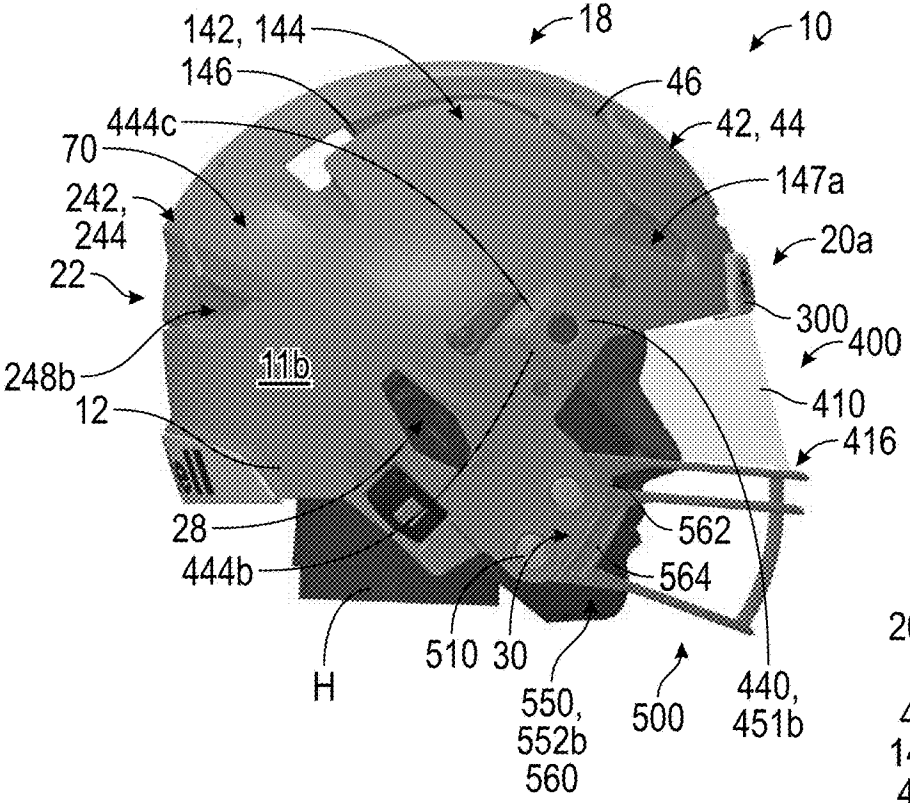
FIG. 4 is a right side view of the protective sports helmet of FIG. 1.
Figure 5:
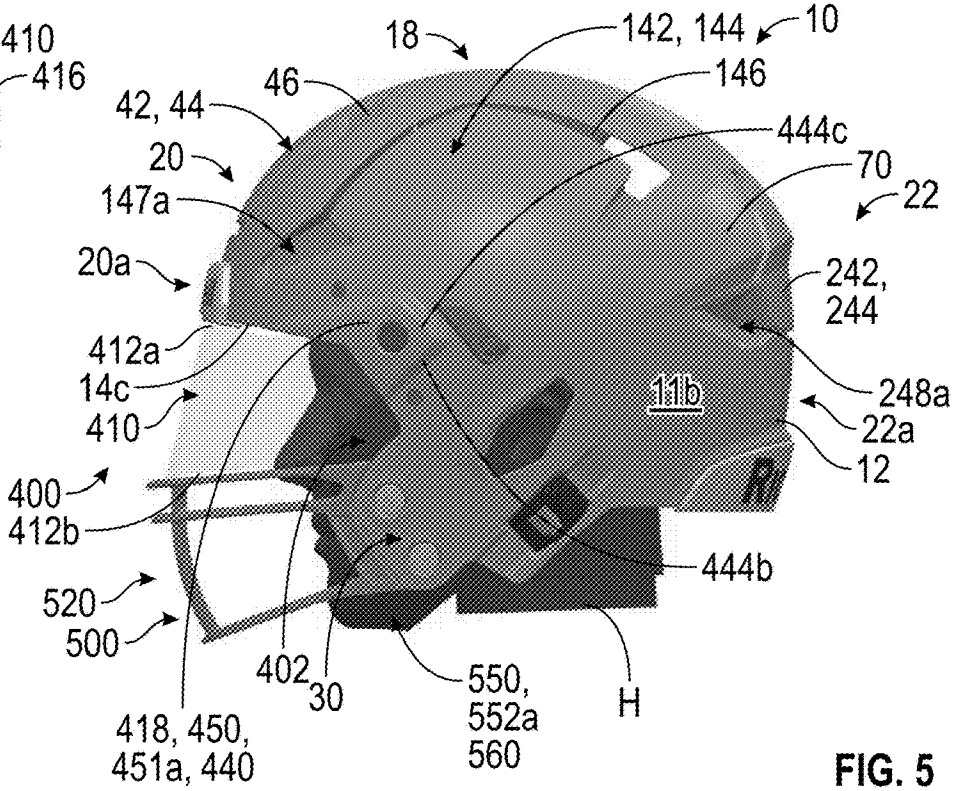
FIG. 5 is a left side view of the protective sports helmet of FIG. 1.
Figure 7:
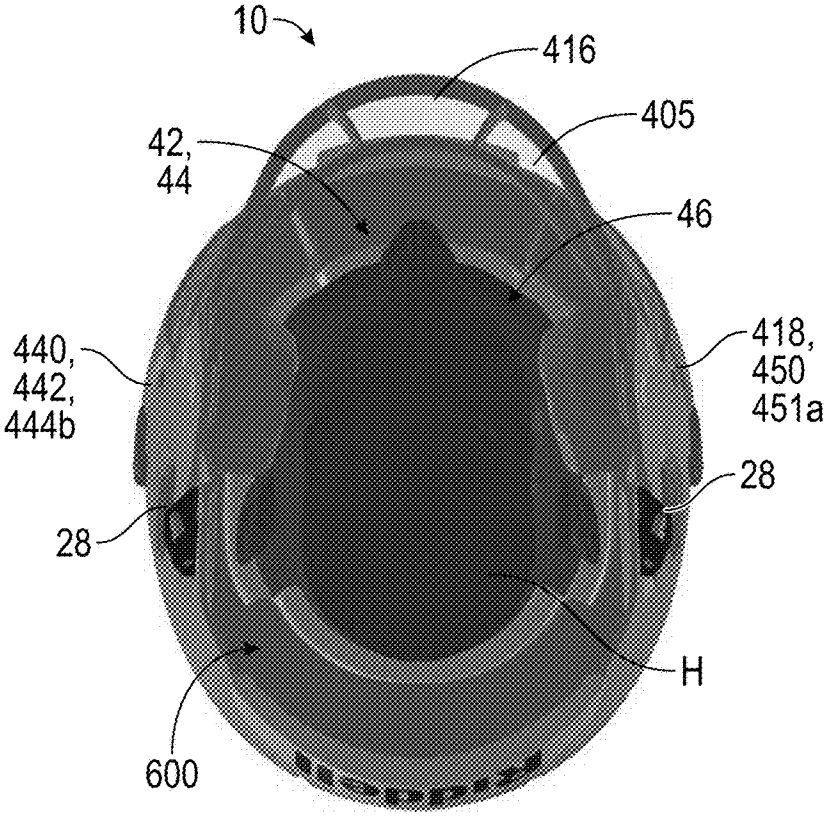
FIG. 7 is a bottom view of the protective sports helmet of FIG. 1.
Figure 6:
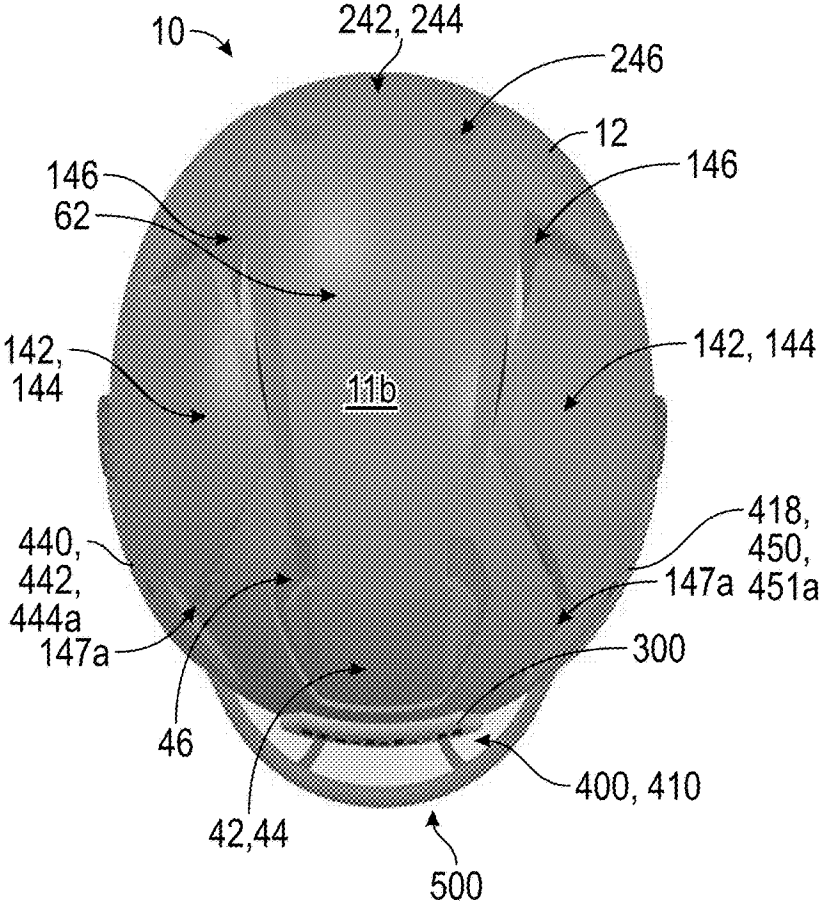
FIG. 6 is a top view of the protective sports helmet of FIG. 1.
Figure 8:
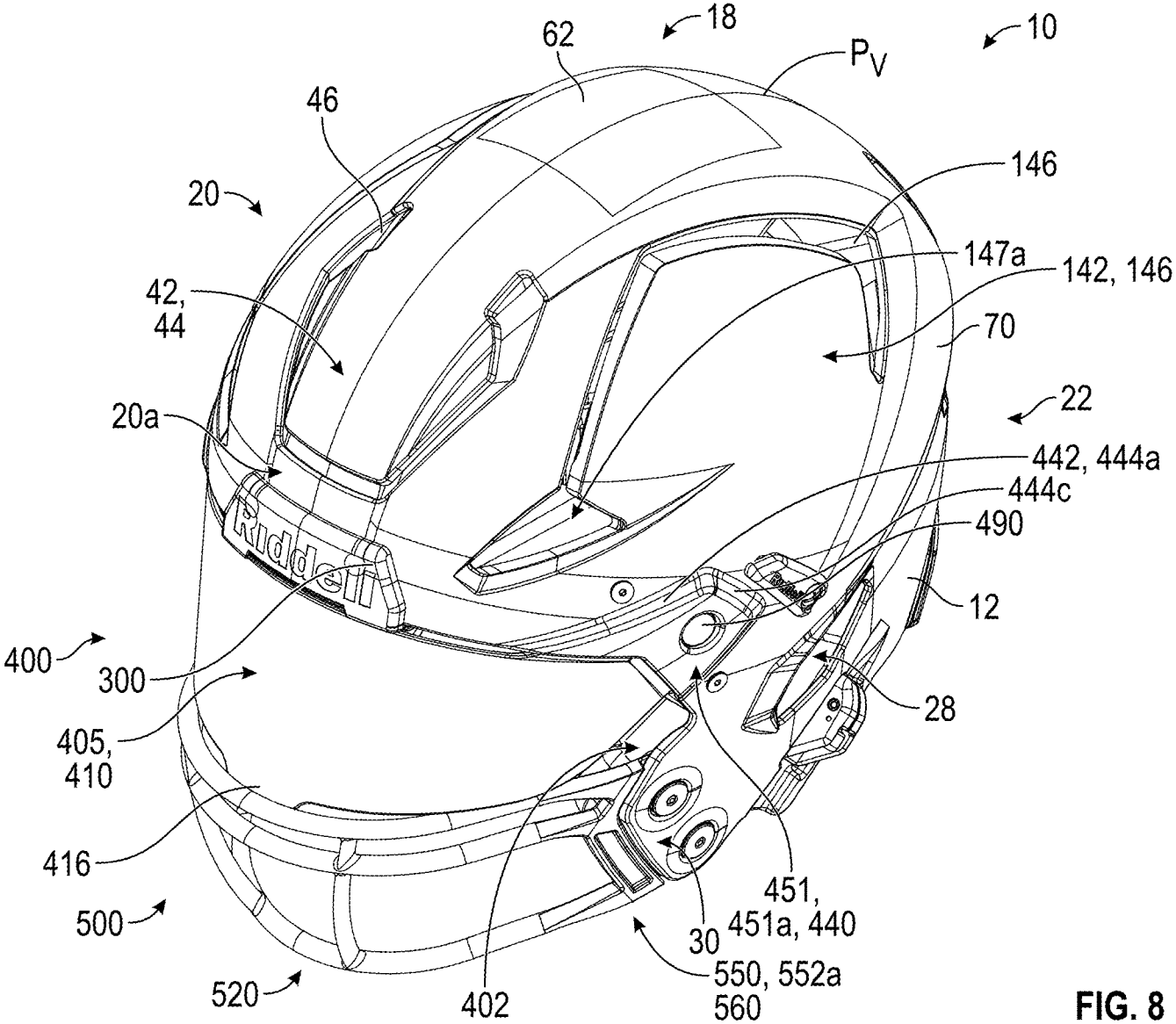
FIG. 8 is a perspective view of the protective sports helmet of FIG. 1, wherein the helmet is shown in a line drawing format.
Figure 10:
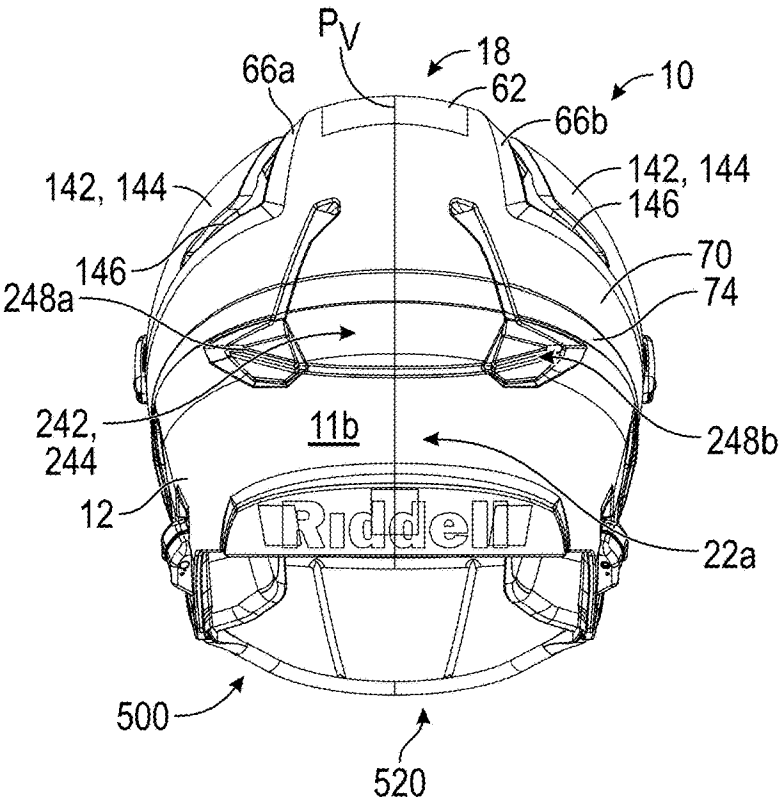
FIG. 10 is a rear view of the protective sports helmet of FIG. 8.
Figure 9:
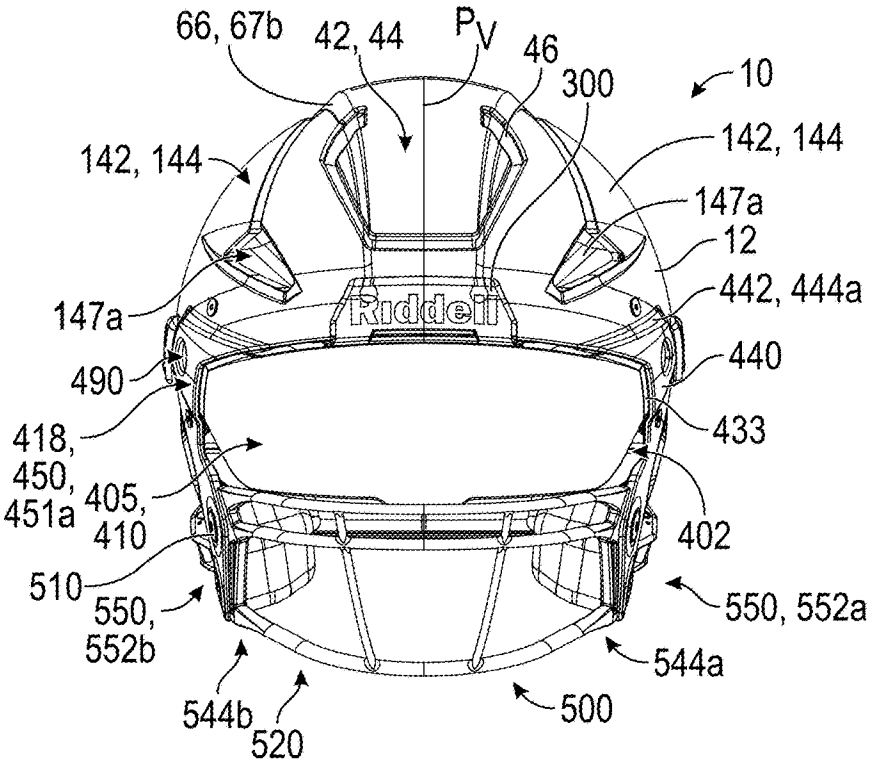
FIG. 9 is a front view of the protective sports helmet of FIG. 8.
Figure 116:
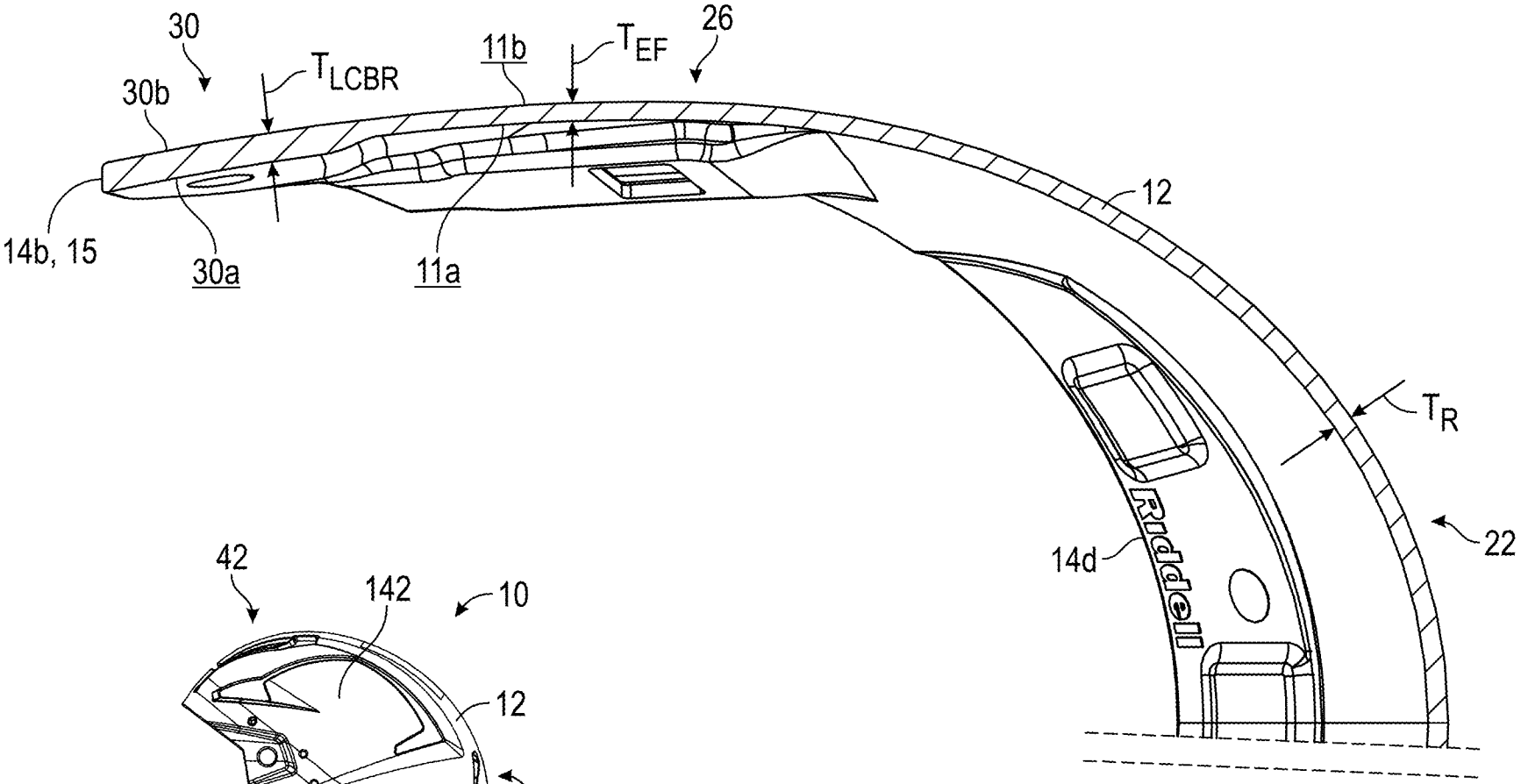
Figure 115:
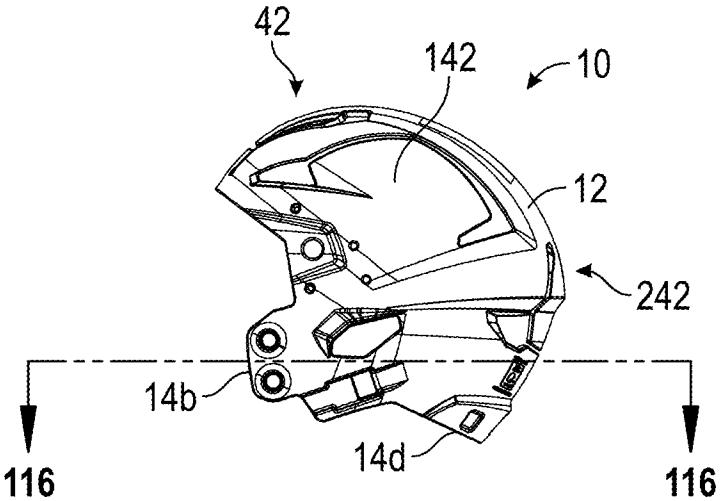
Figure 117:
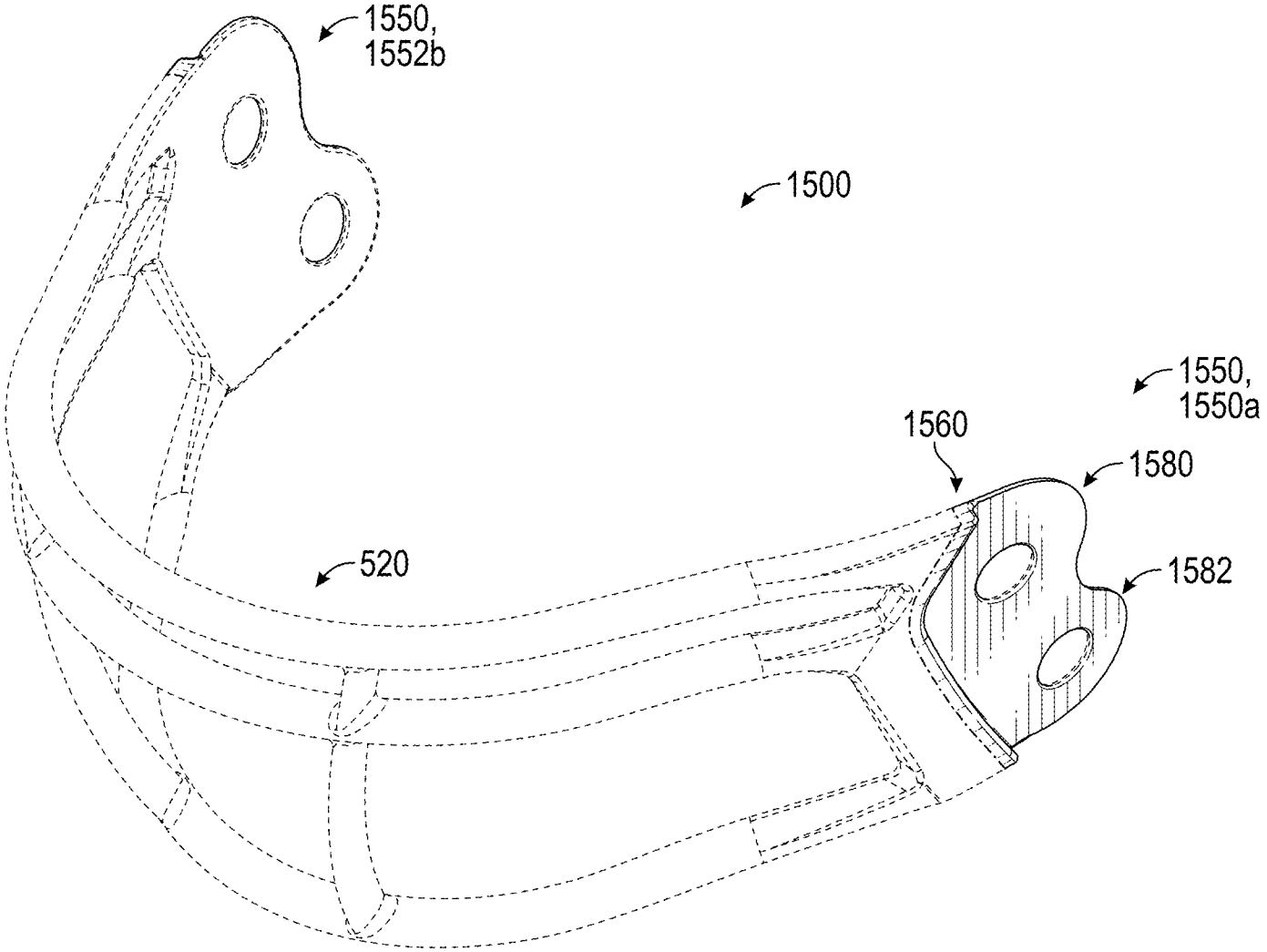
Figure 118:
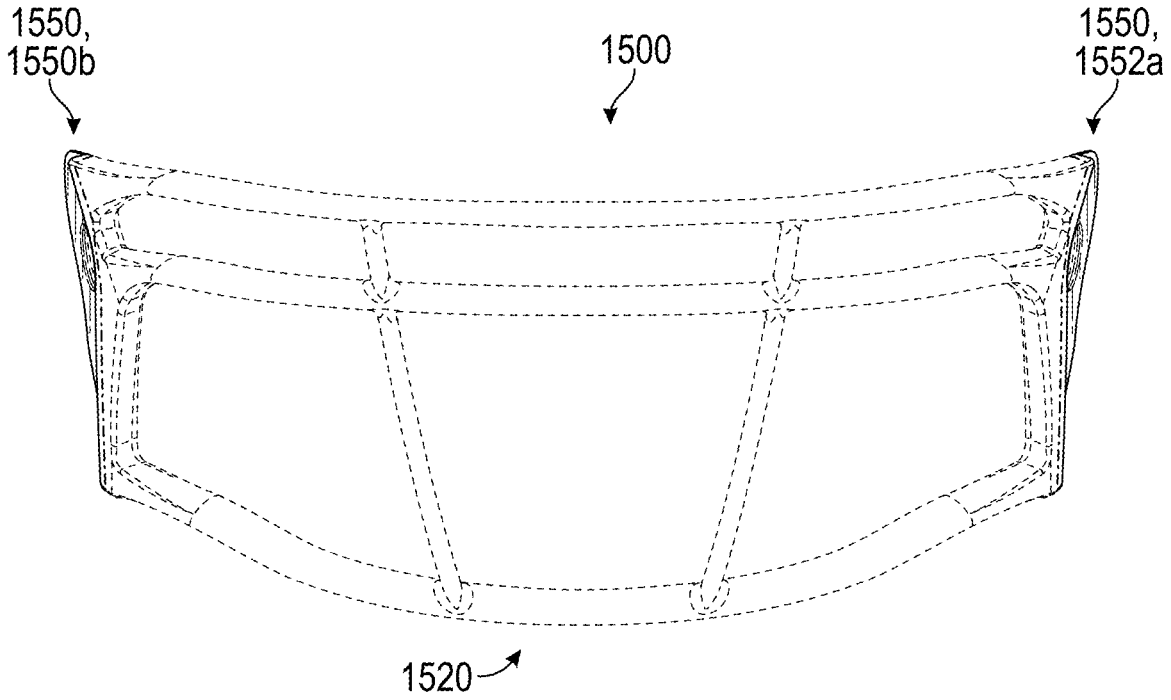
Figure 119:
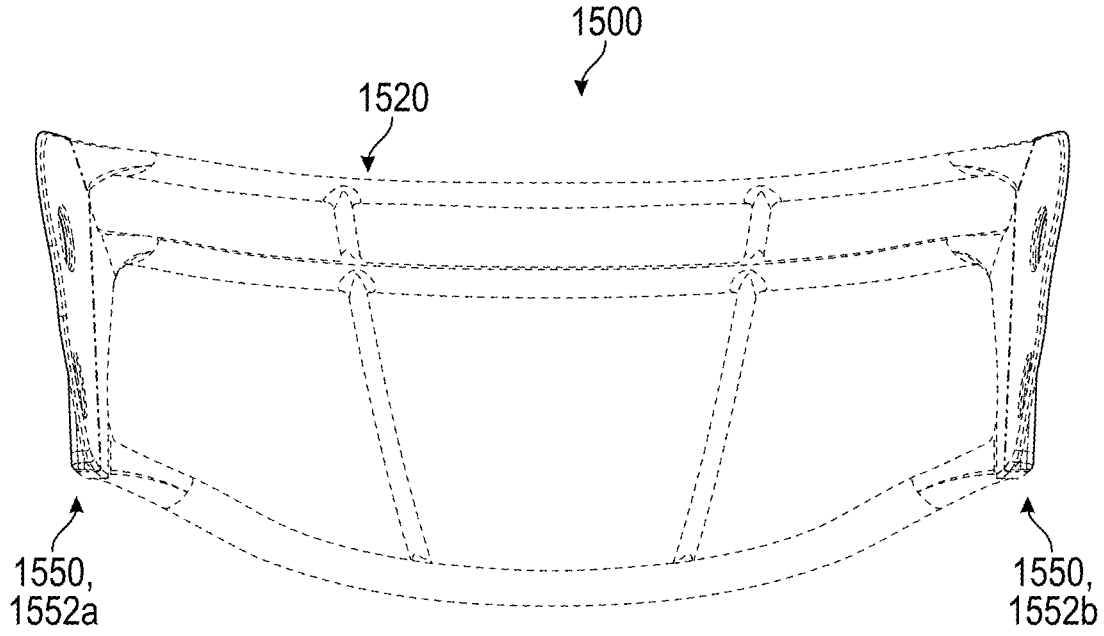
Figure 120:
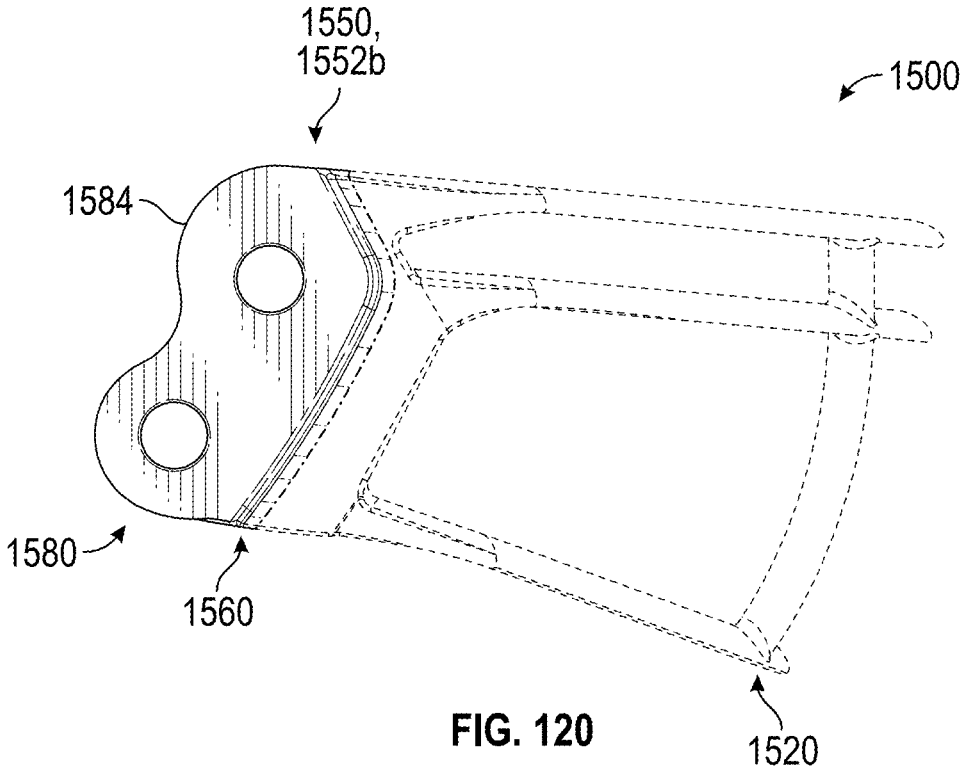
Figure 121:
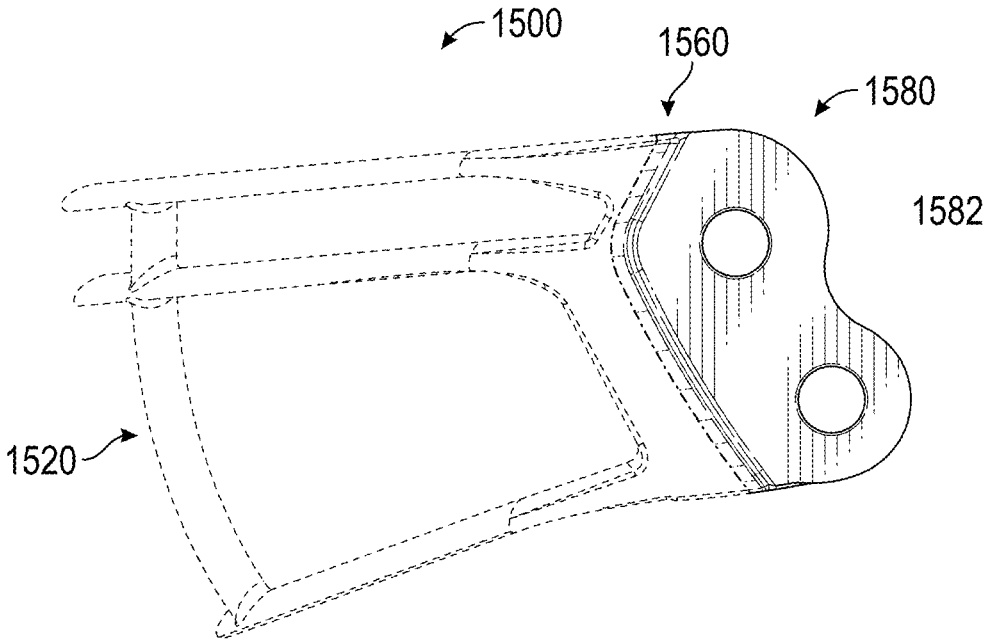
Figure 122:
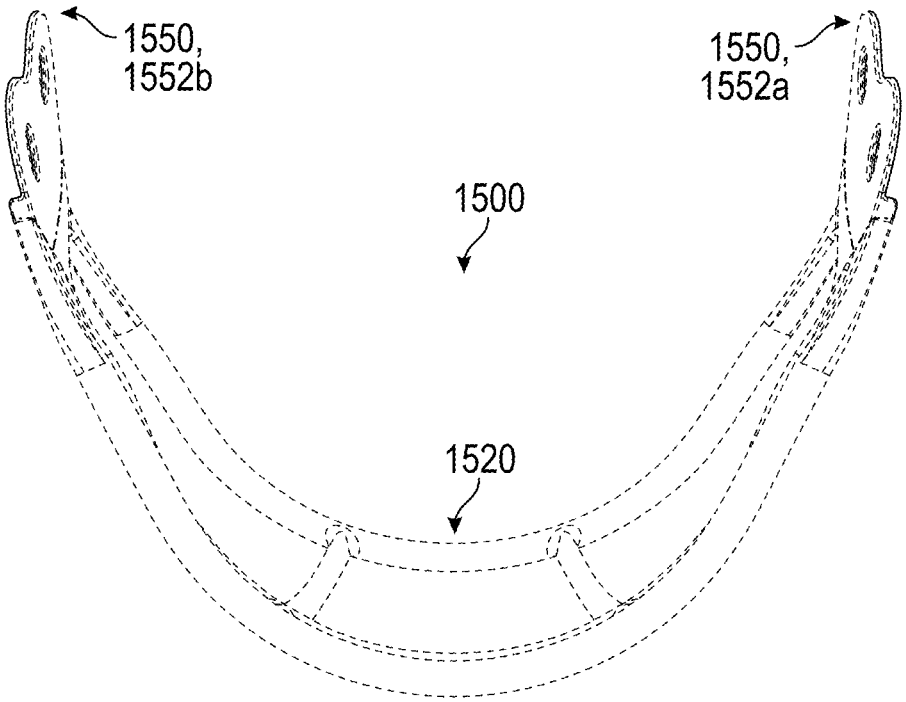
Figure 123:
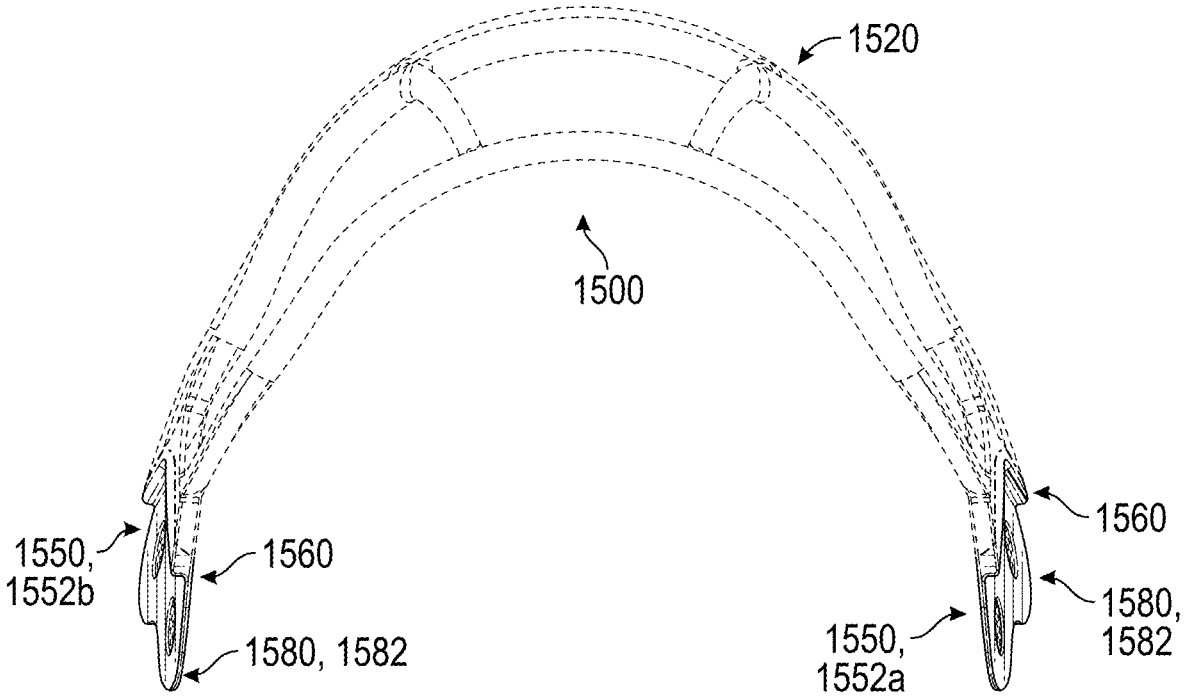
Figure 125:
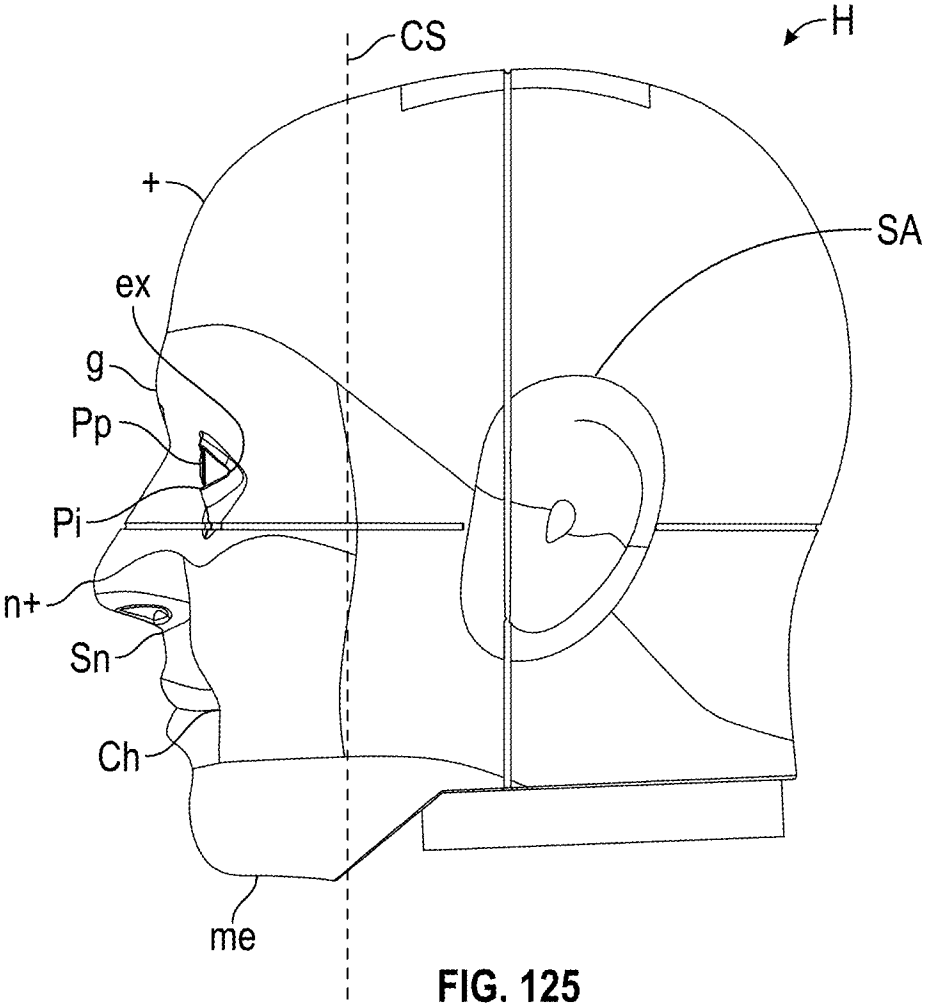
Figure 124:
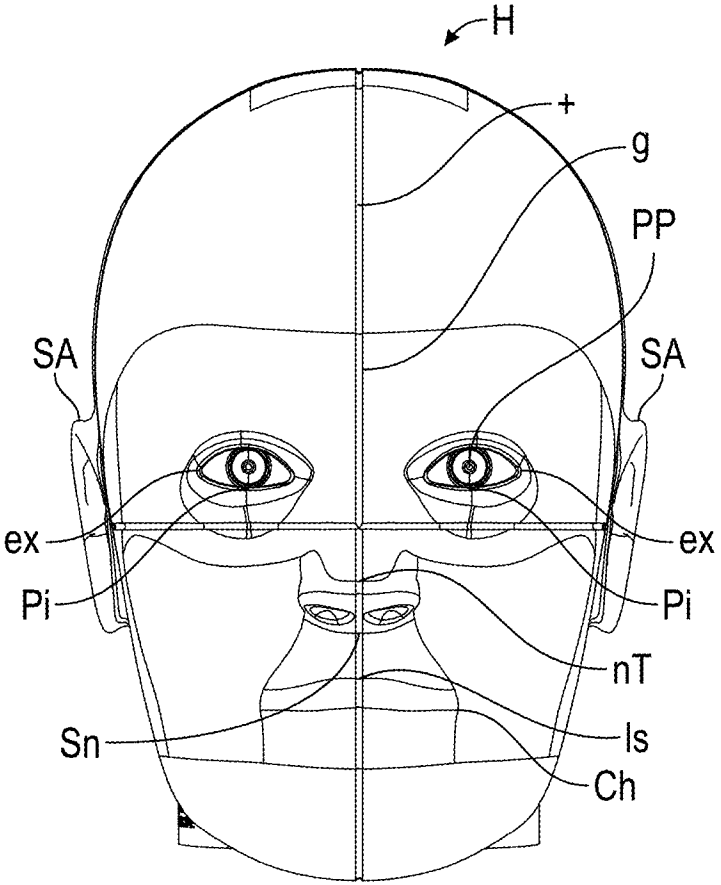
Figure 126:
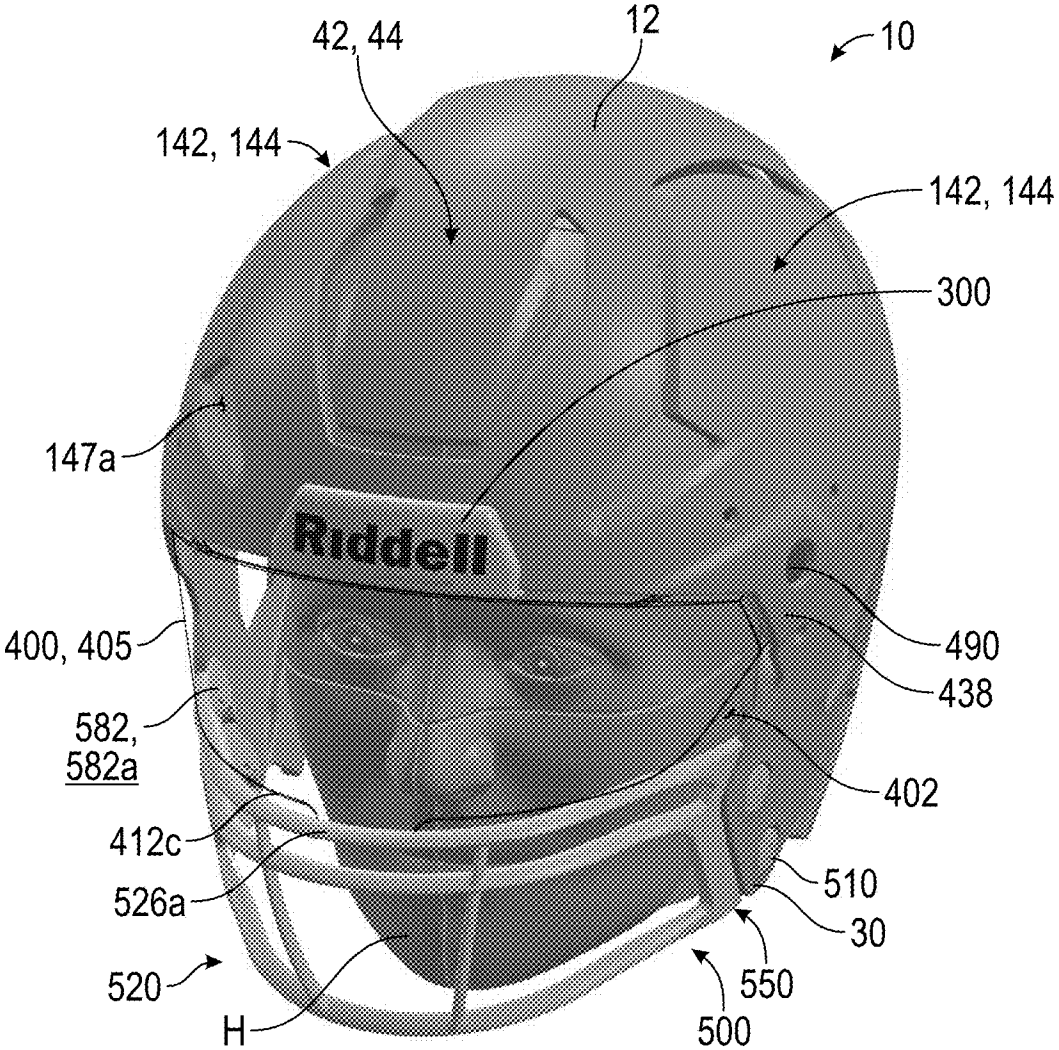
Figure 127A:
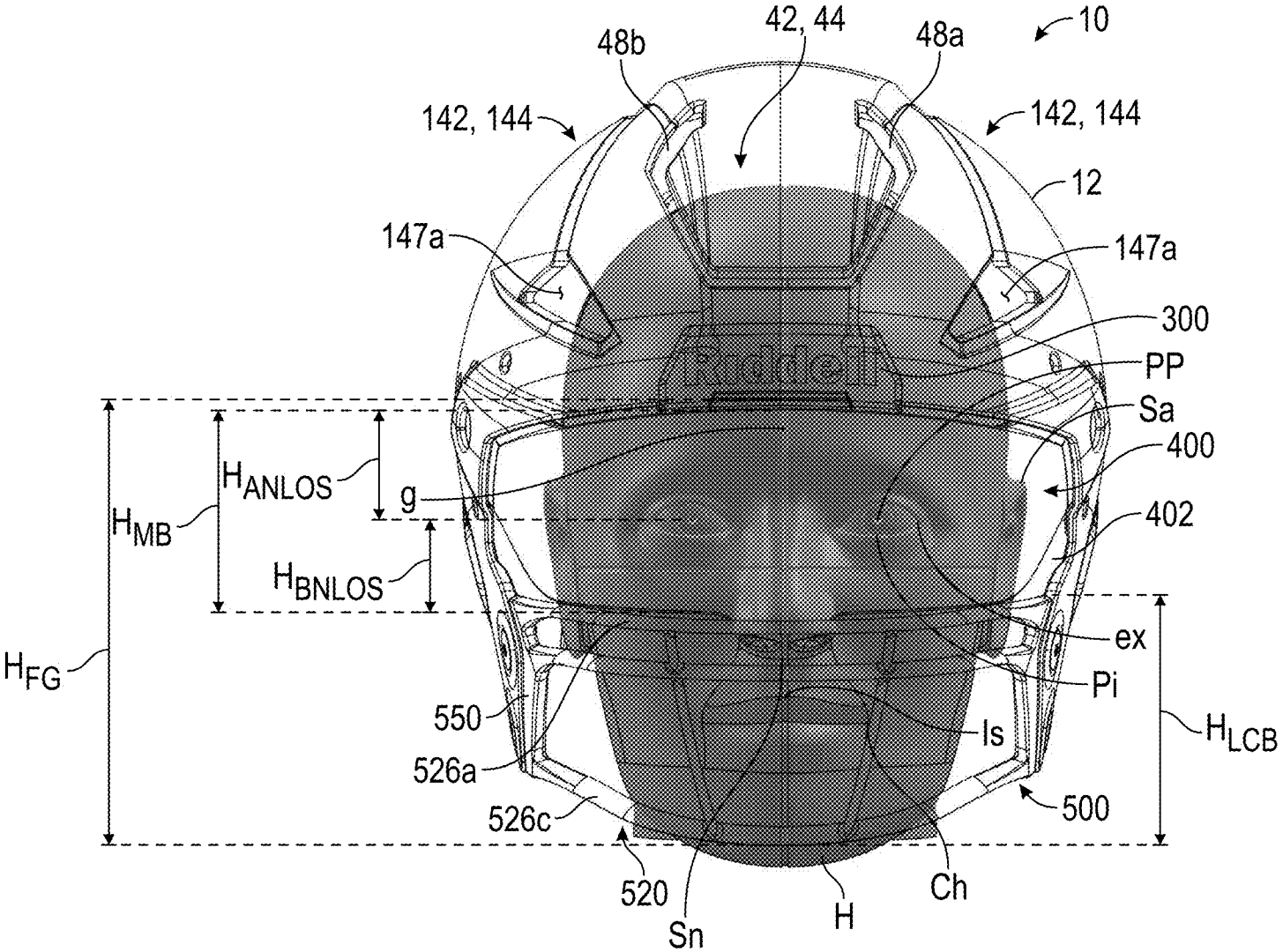
Figure 127B:
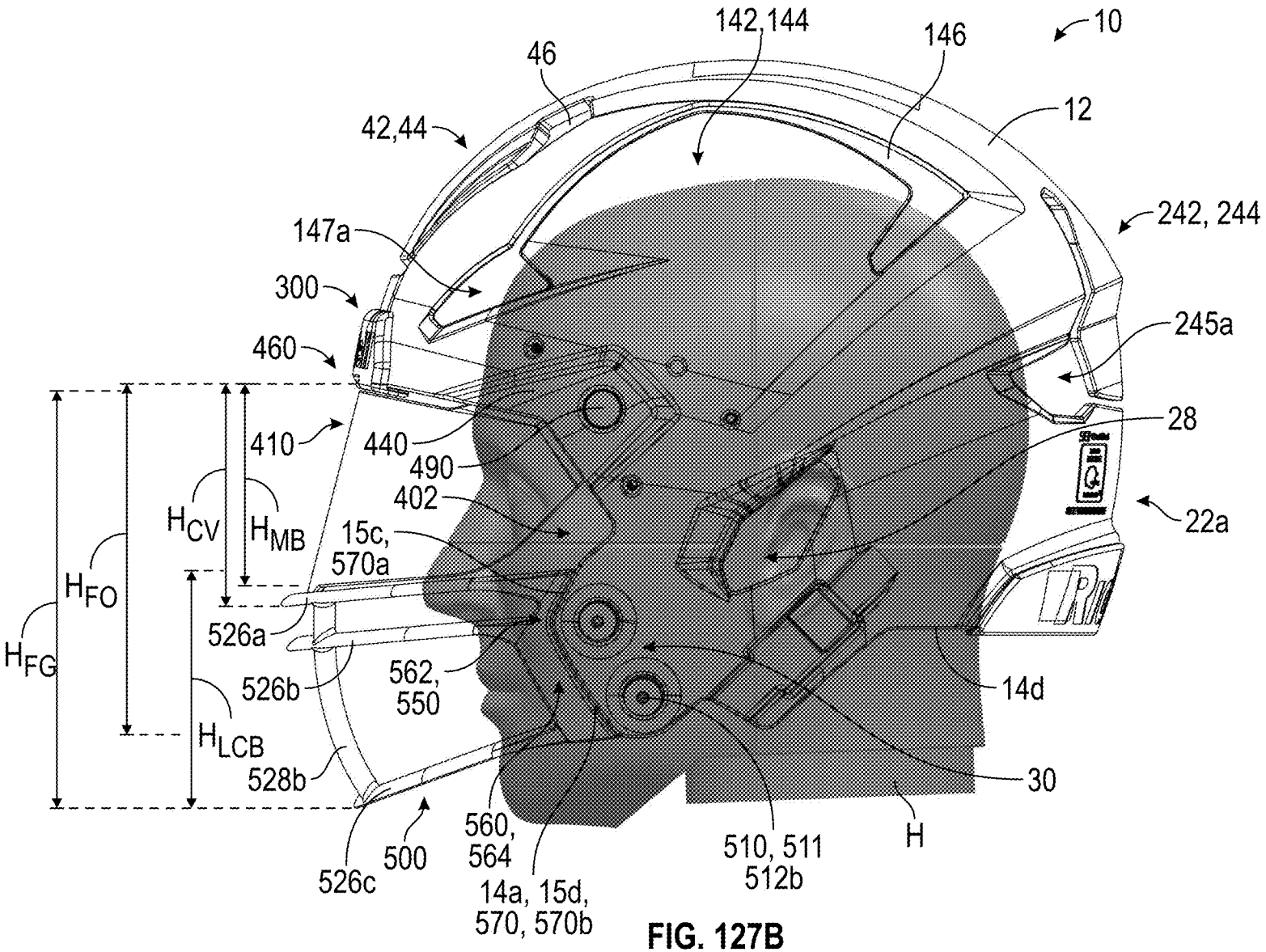
Figure 129:
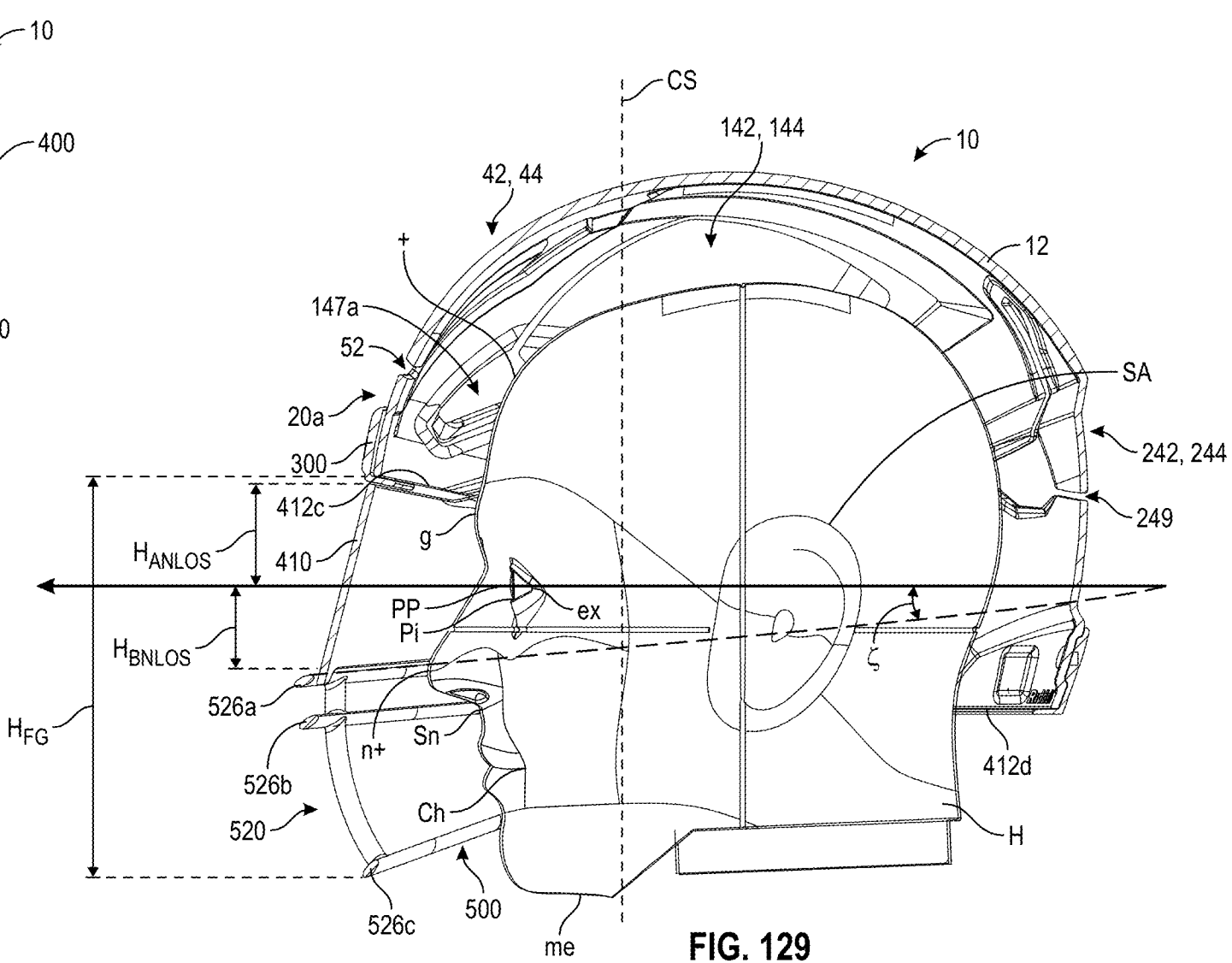
Figure 128:
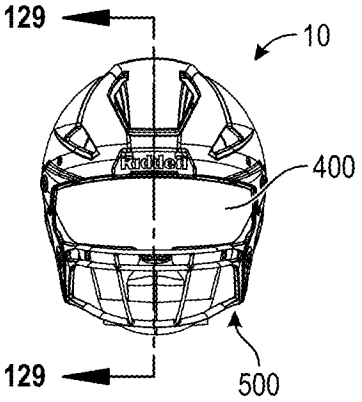
Figure 130:
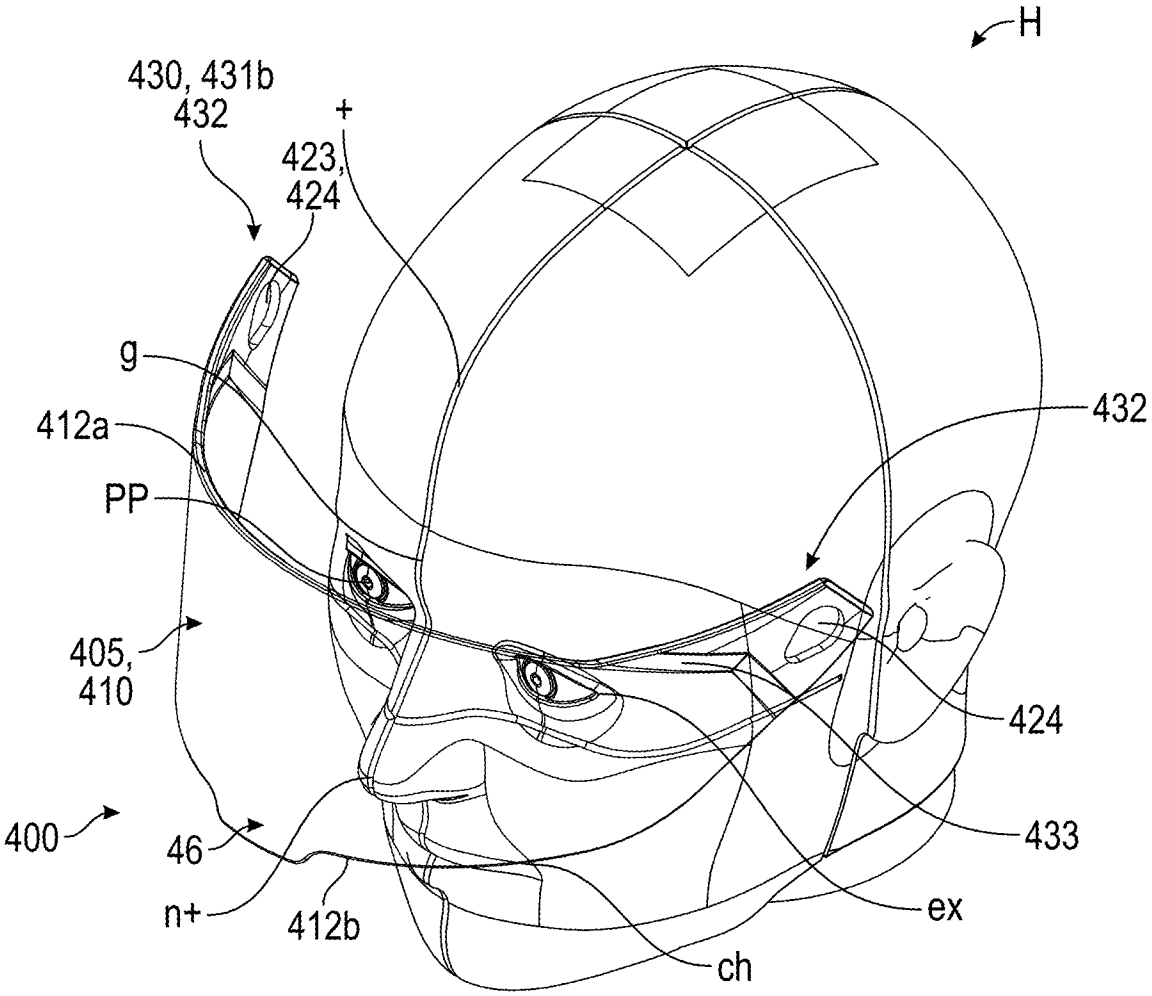
Figure 131:
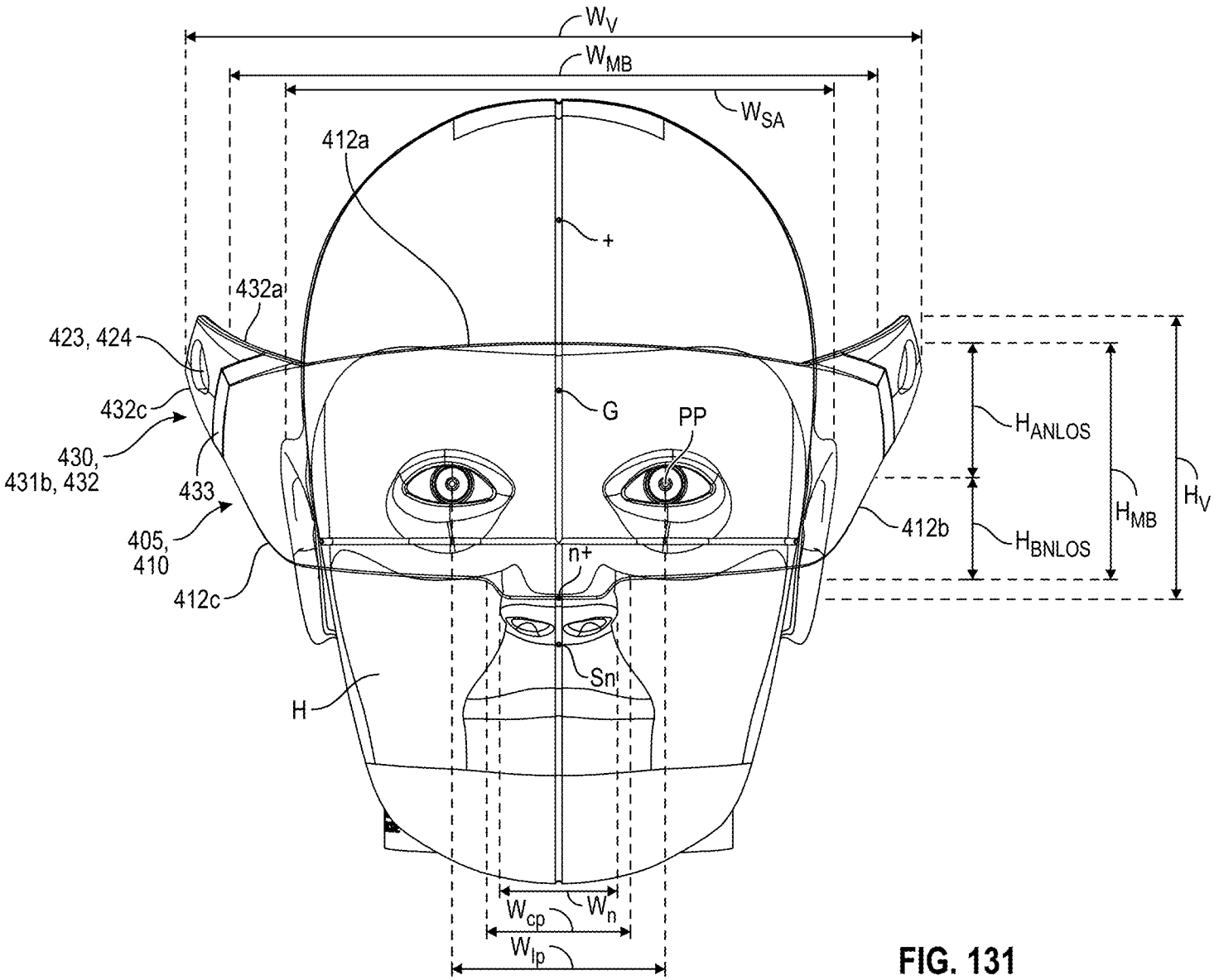
Figure 132A:
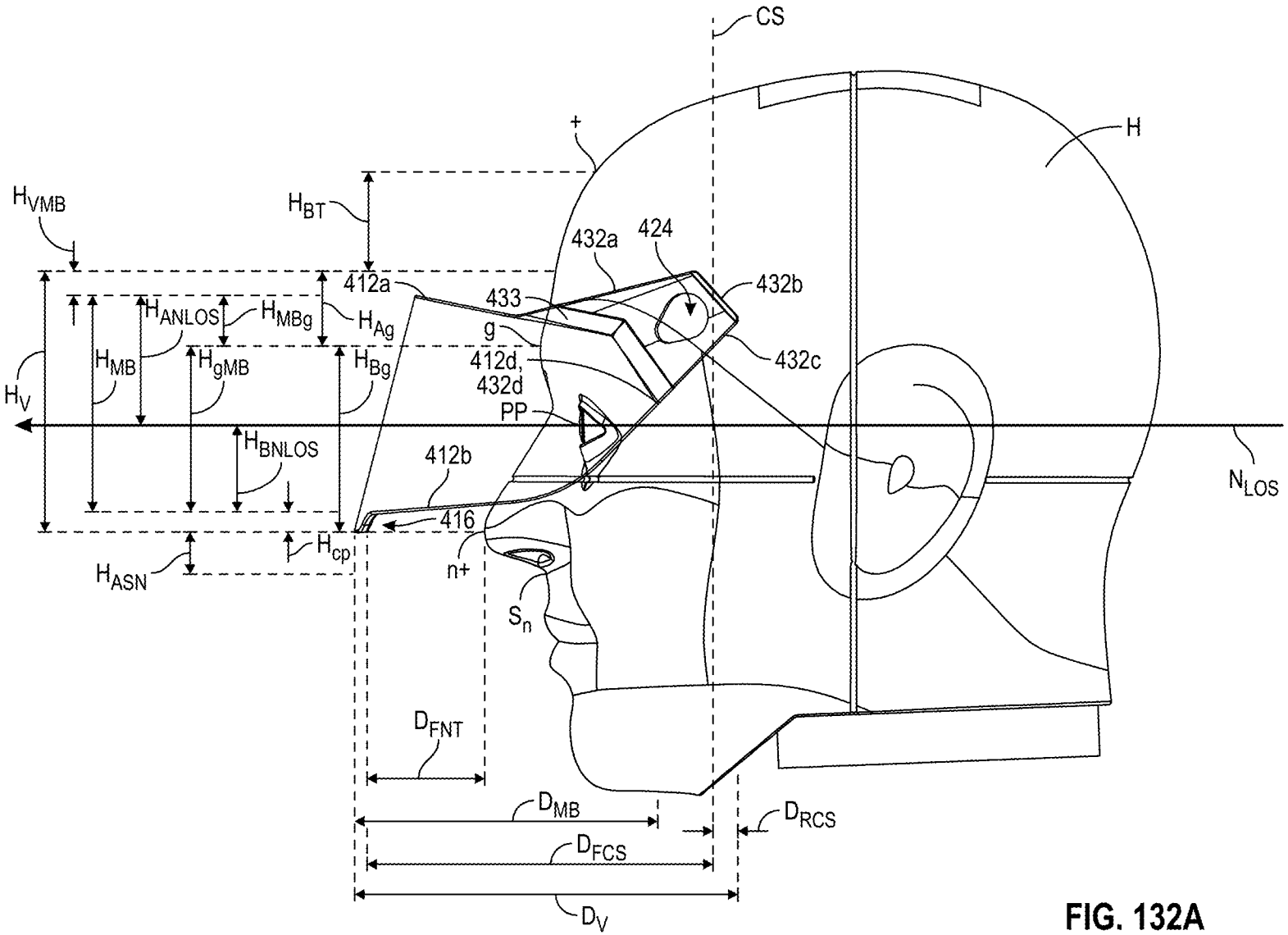
Figure 132B:
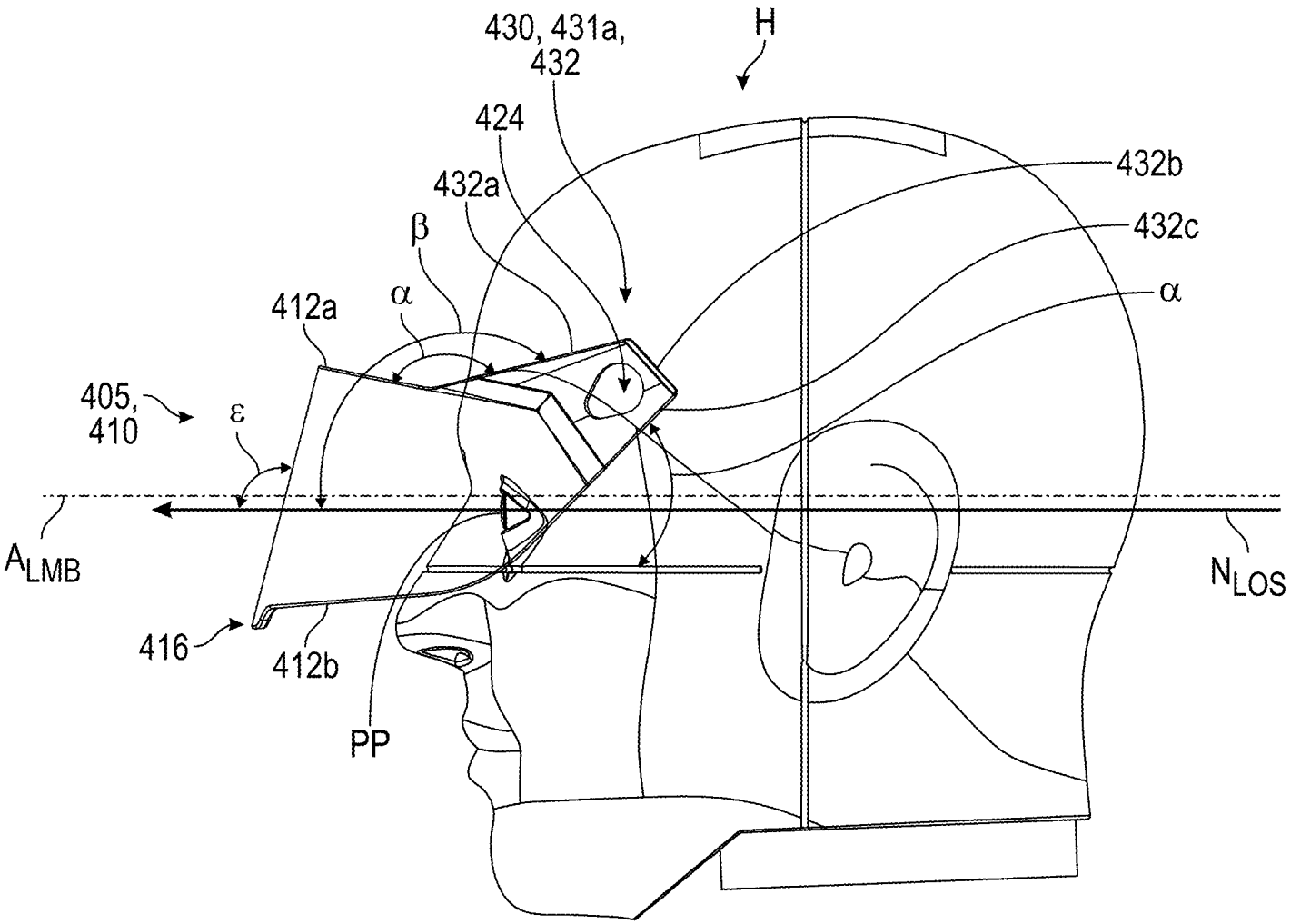
Figure 133:
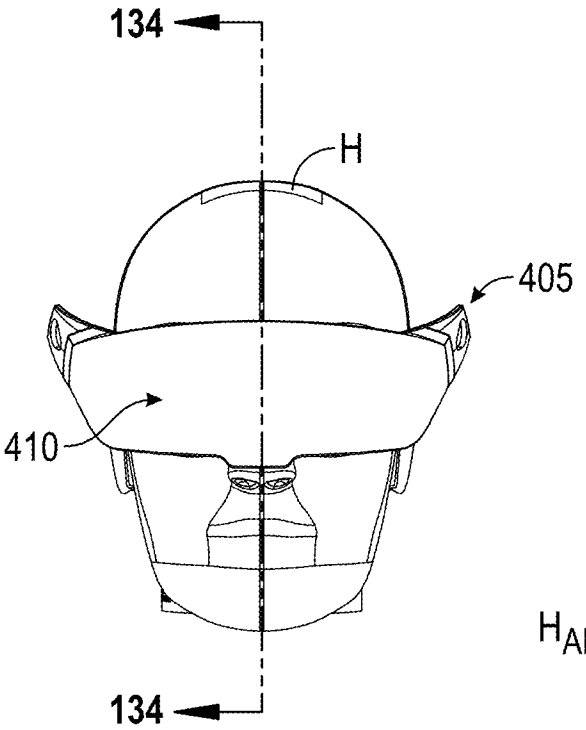
Figure 134:
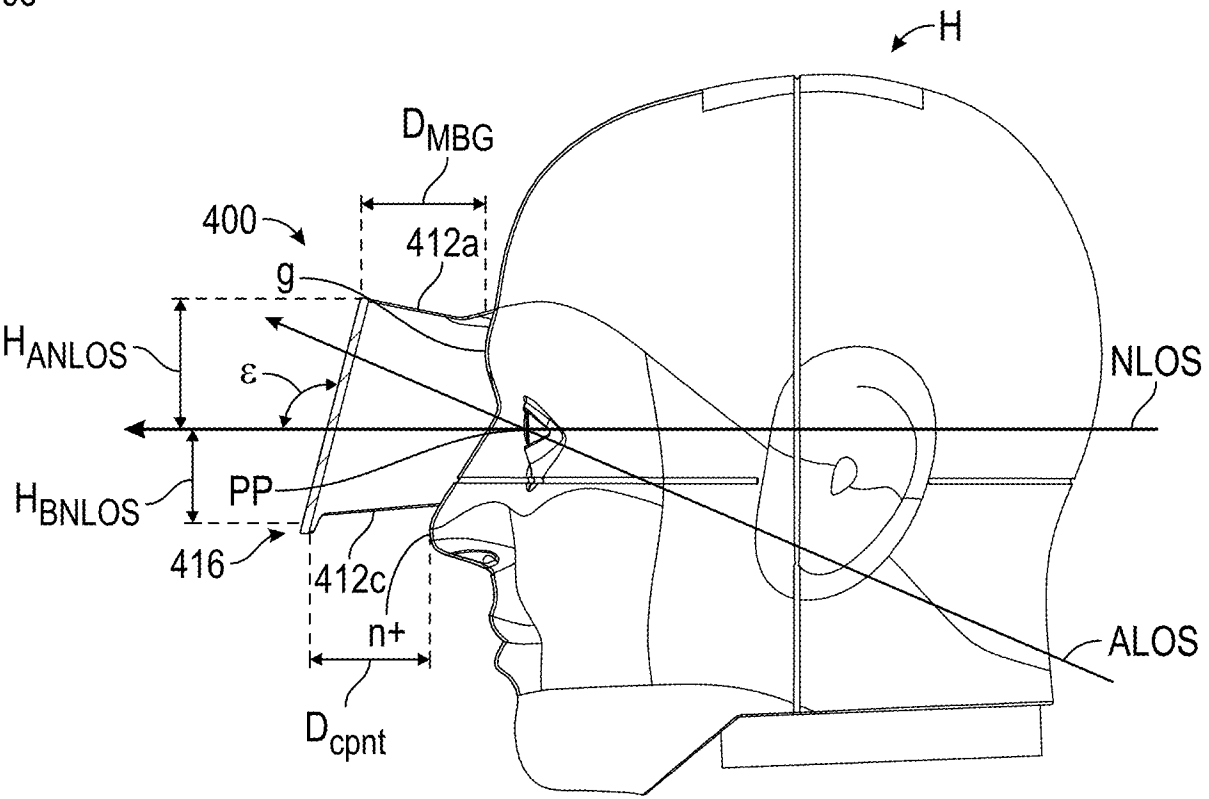
Figure 135B:
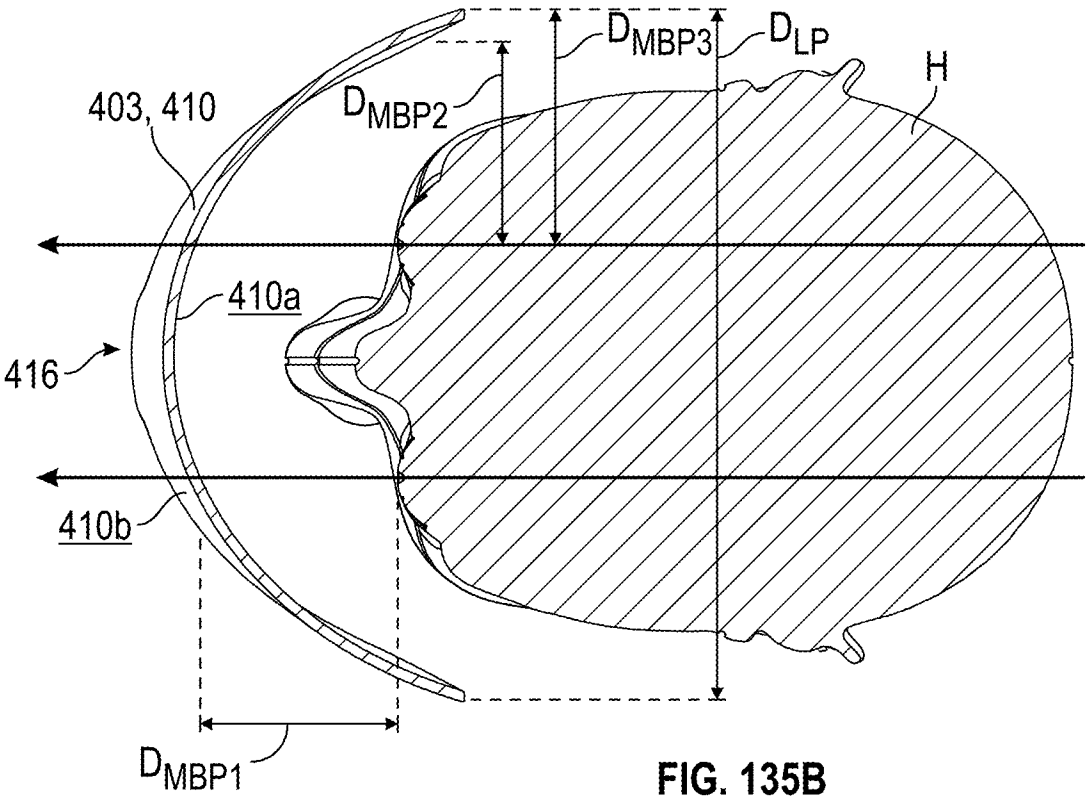
Figure 135A:
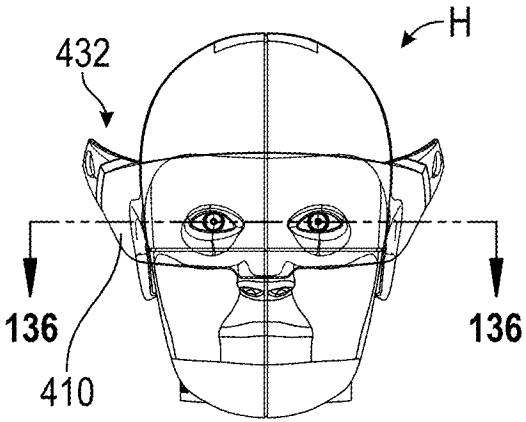

FIG. 115 is a rotated side view of the helmet shell of FIG. 1;

FIG. 116 is a cross-sectional view of the protective sports helmet taken along line 116-116 of FIG. 115, wherein the left half of the shell has been omitted;

FIG. 117 is a perspective view of a second embodiment of a lower chin bar assembly of the protective sports helmet;

FIG. 118 is a front view of the lower chin bar assembly of FIG. 117;

FIG. 119 is a rear view of the lower chin bar assembly of FIG. 117;

FIG. 120 is a right side view of the lower chin bar assembly of FIG. 117;

FIG. 121 is a left side view of the lower chin bar assembly of FIG. 117;

FIG. 122 is a top view of the lower chin bar assembly of FIG. 117;

FIG. 123 is a bottom view of the lower chin bar assembly of FIG. 117;

FIG. 124 is a front view of a headform that is representative of the player's head;

FIG. 125 is a left side view of the headform of FIG. 116;

FIG. 126 is a perspective view of the protective sports helmet of FIG. 1 positioned on the headform of FIG. 124;

FIG. 127*a* is a front view of the protective sports helmet and the headform of FIG. 126;

FIG. 127*b* is a side view of the protective sports helmet and the headform of FIG. 126;

FIG. 128 is a front view of the protective sports helmet of FIG. 1;

FIG. 129 is a cross-sectional view of the protective sports helmet taken along line 129-129 line of FIG. 128, with the headform located within the helmet;

FIG. 130 is a perspective view of the helmet of FIG. 126 showing the headform and the visor, as the helmet shell and the lower chin bar assembly have been omitted from view;

FIG. 131 is a front view of the headform and the visor of FIG. 130;

FIG. 132*a*-132*b* are left side views of the headform and the visor of FIG. 130;

FIG. 133 is a front view of the headform and the visor of FIG. 130;

FIG. 134 is a partial cross-sectional view of the visor taken along line 126-126 line of FIG. 125, showing the relative positioning of the visor and the headform;

FIG. 135*a* is a front view of the headform and the visor of FIG. 130;

FIG. 135*b* is a cross-sectional view of the headform and the visor taken along line 135-135 line of FIG. 135*a;*

Figure 136:
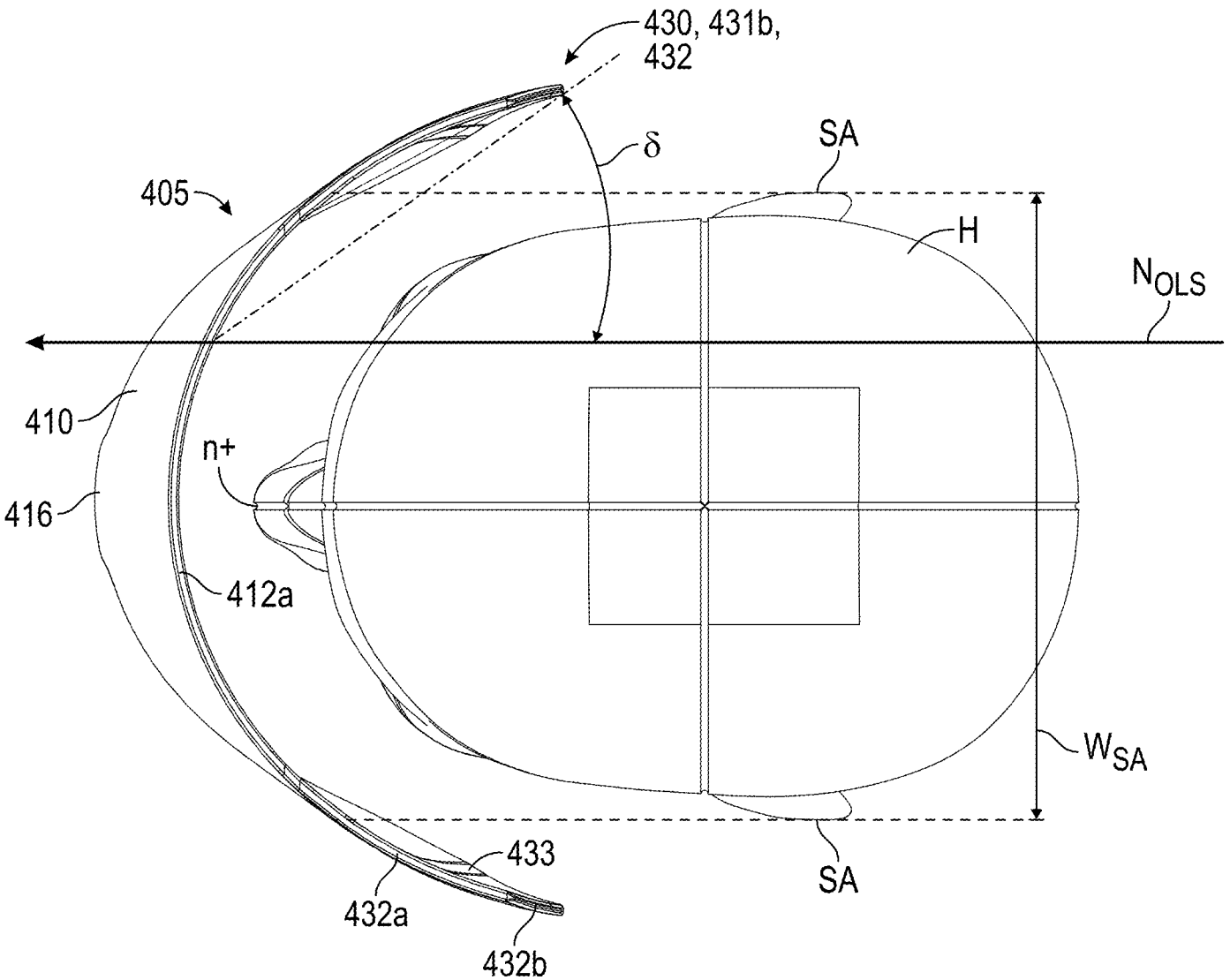
Figure 137:
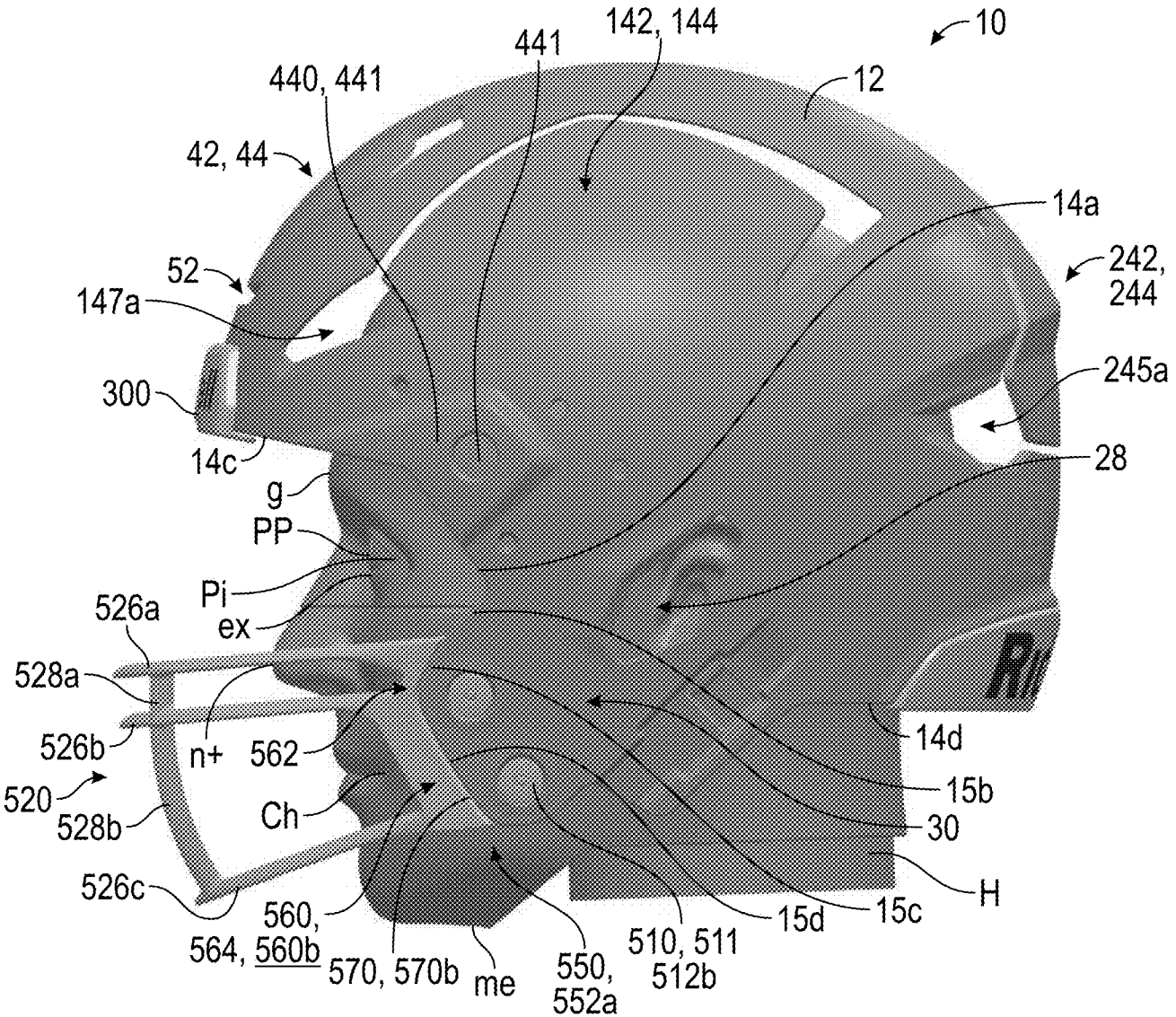
Figure 138:
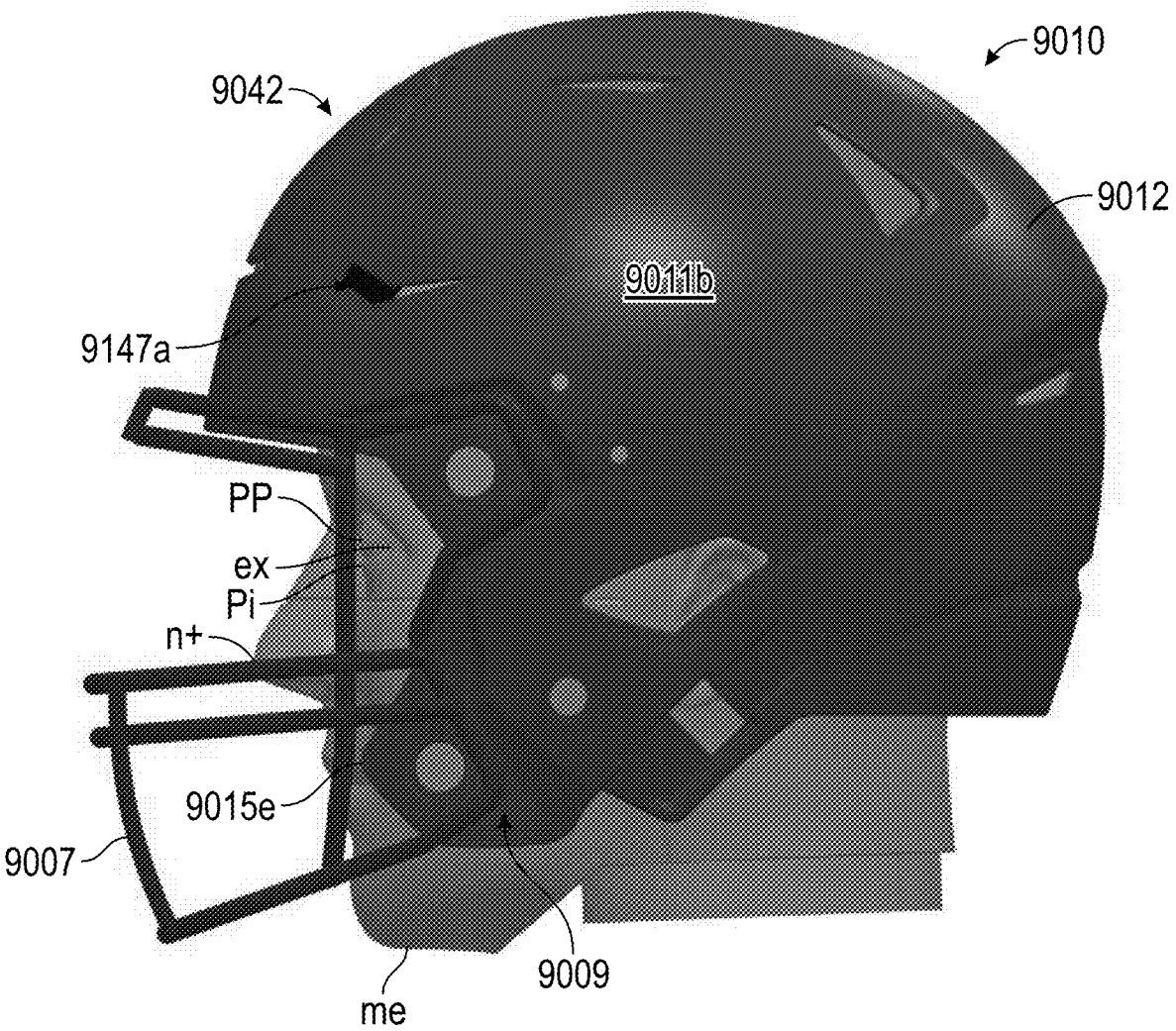
Figure 139:
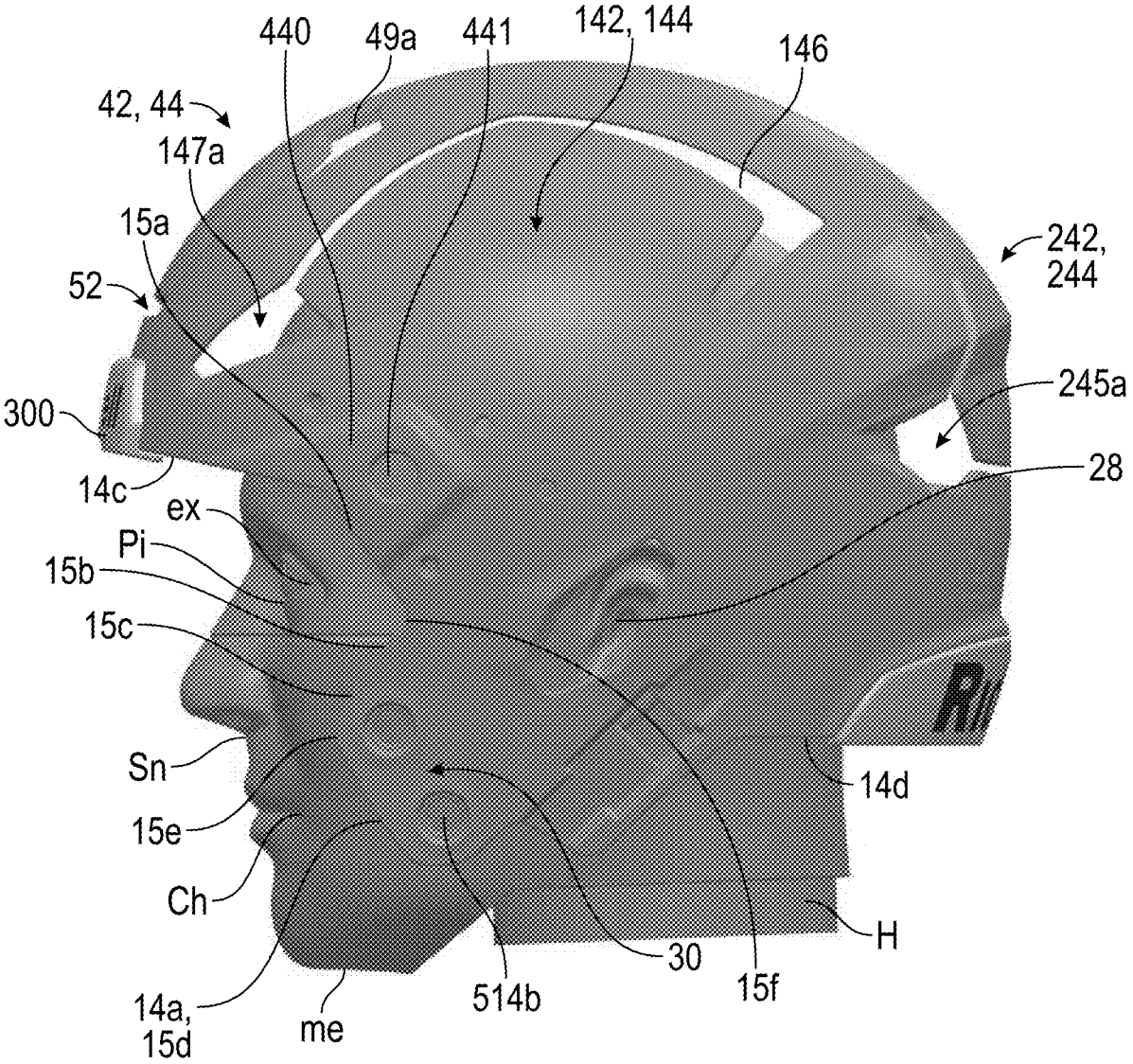
Figure 140:
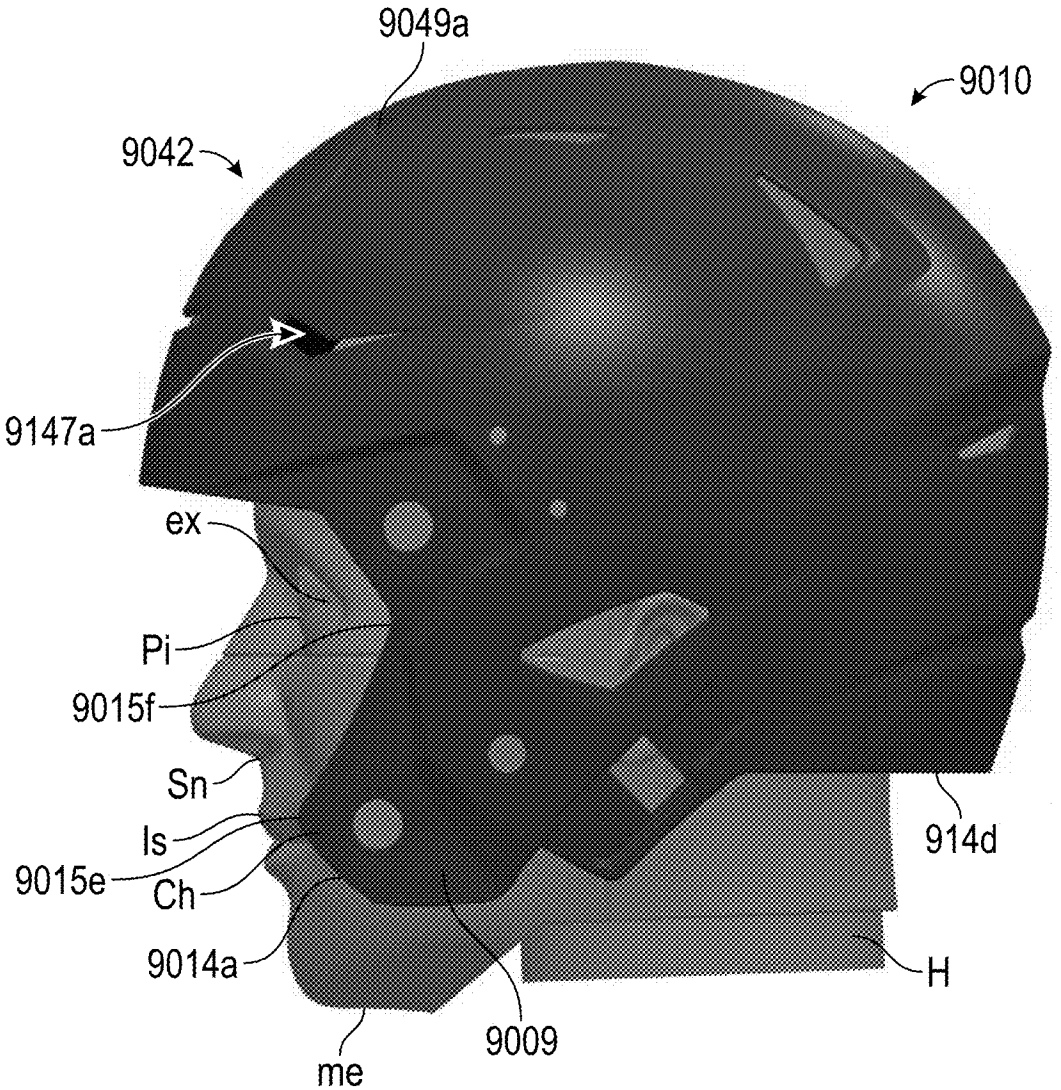
Figure 141:
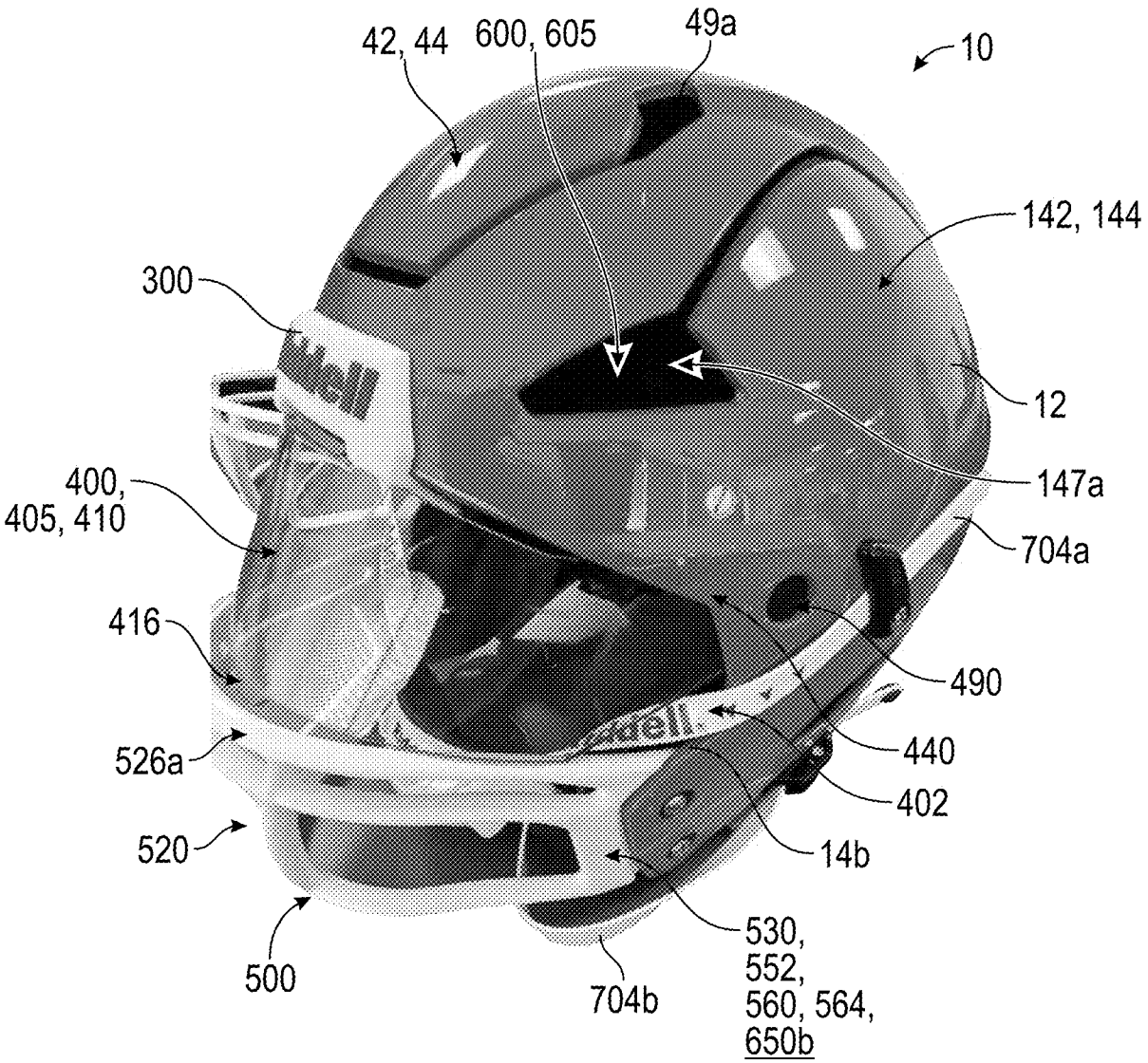
Figure 142:
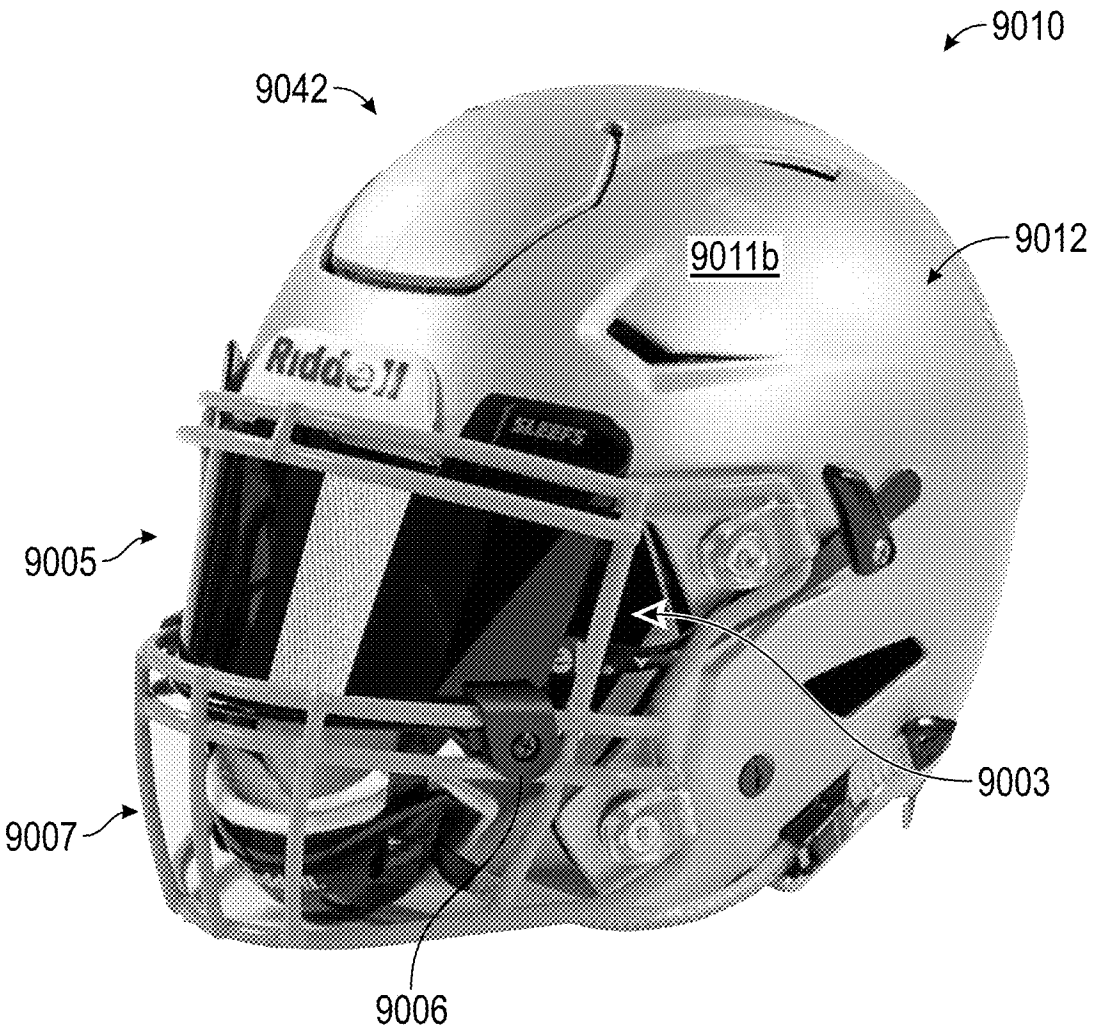
Figure 143:
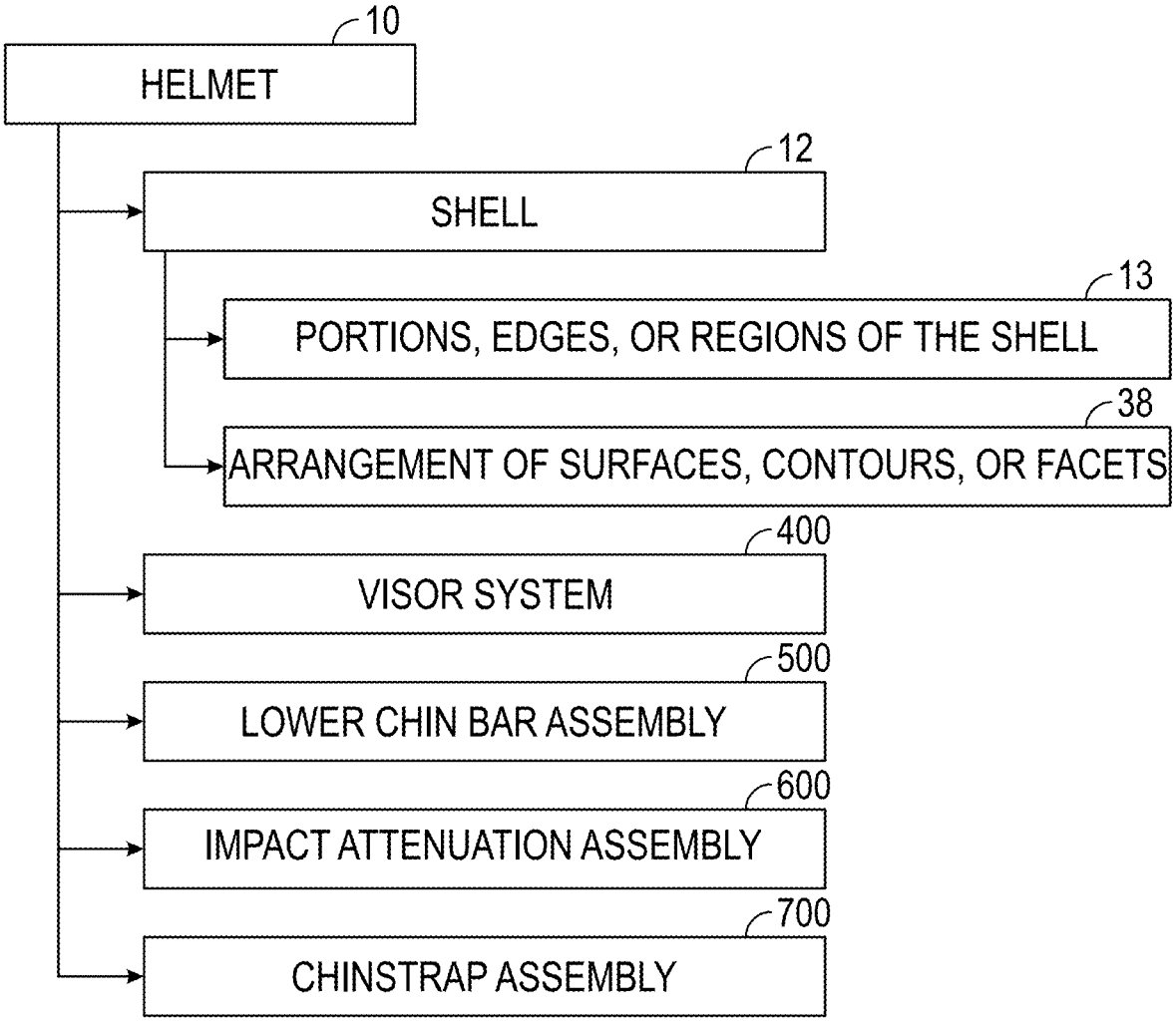
Figure 144:
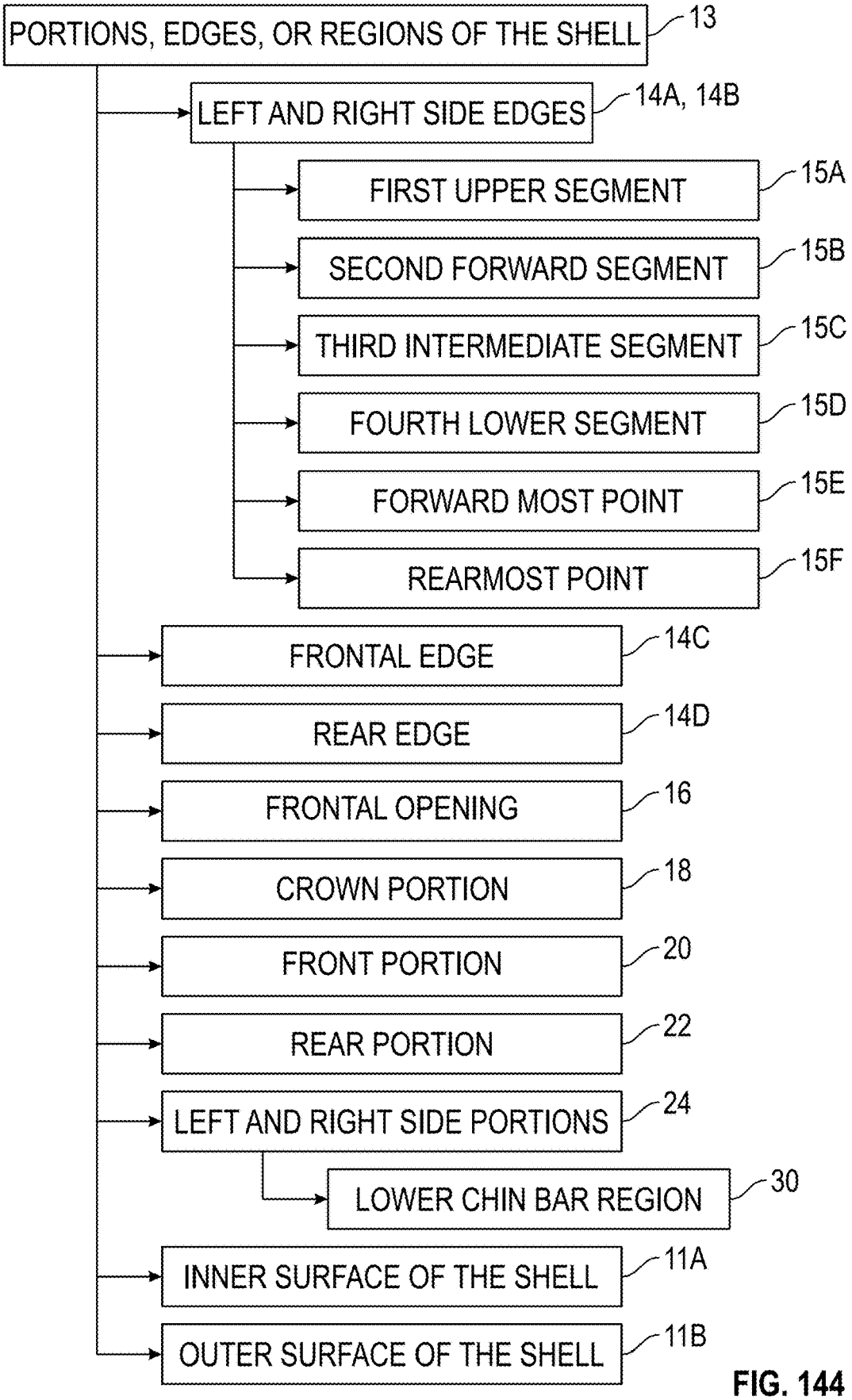
Figure 145:
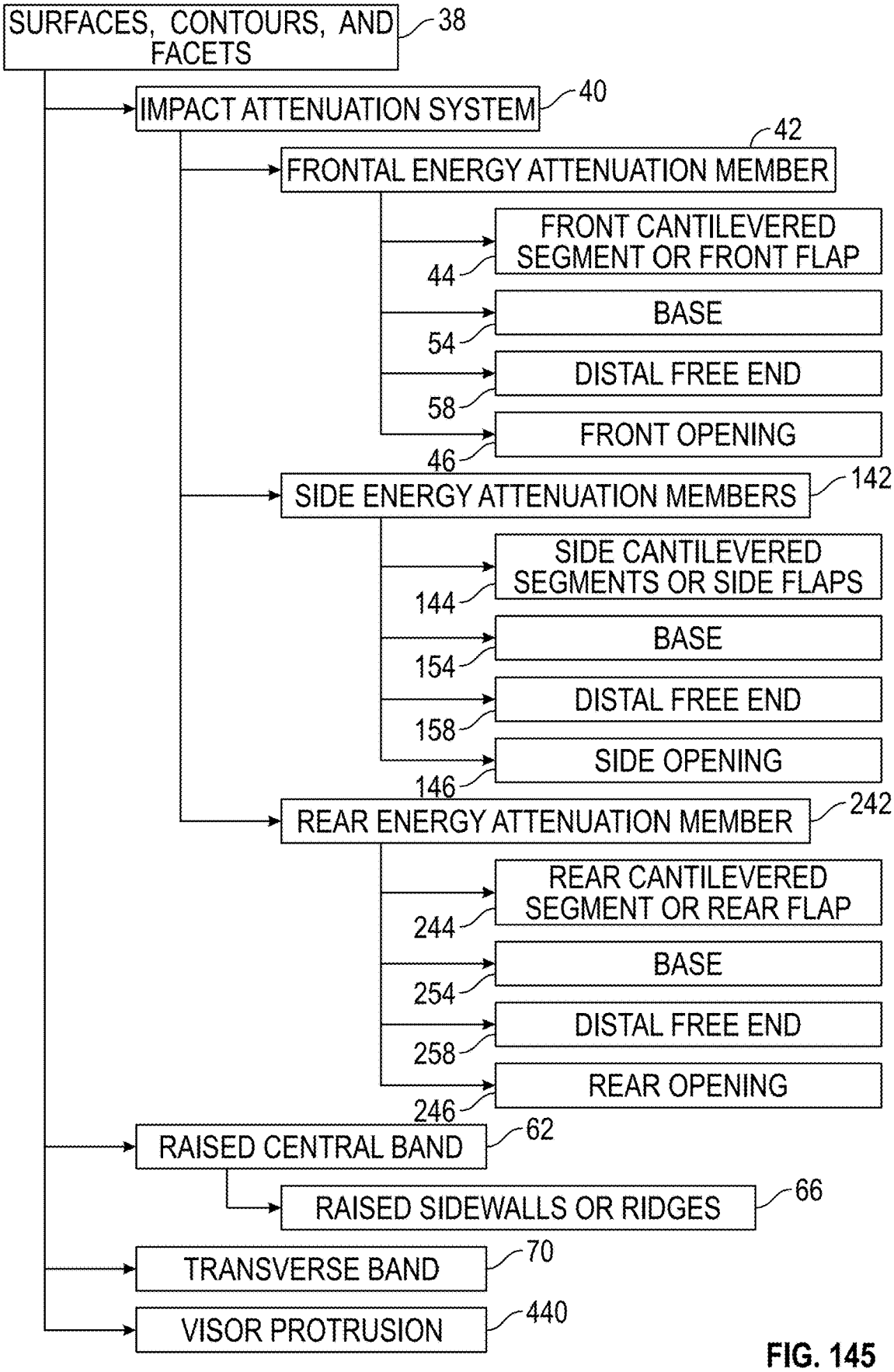
Figure 146:
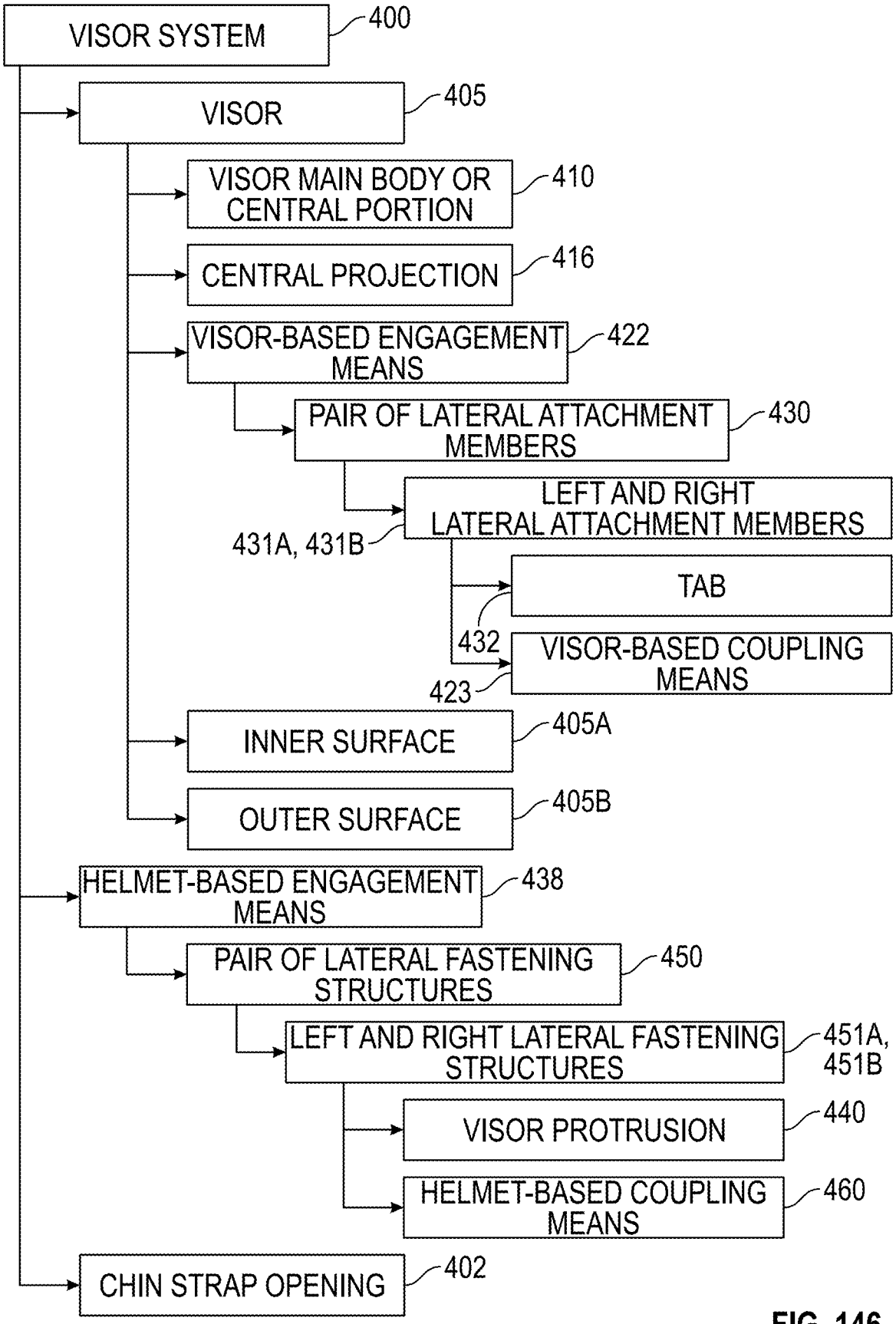
Figure 147:
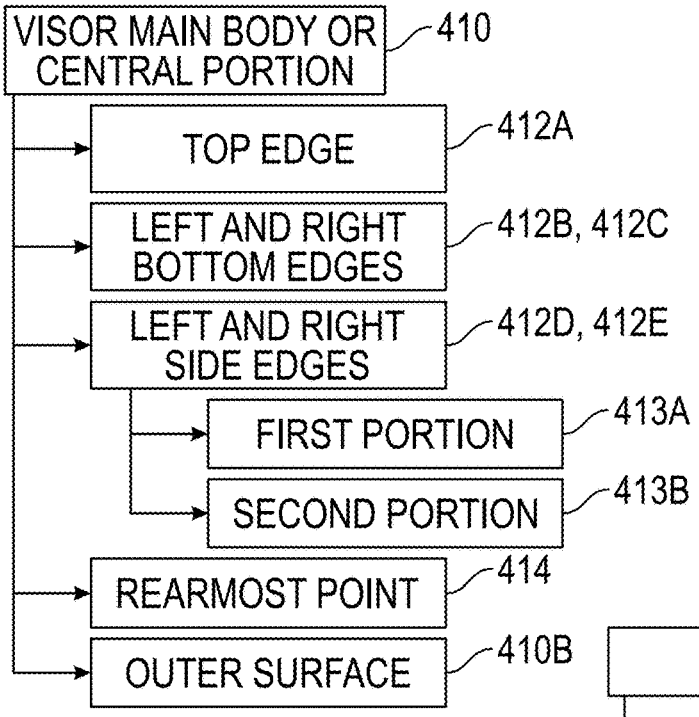
Figure 148:
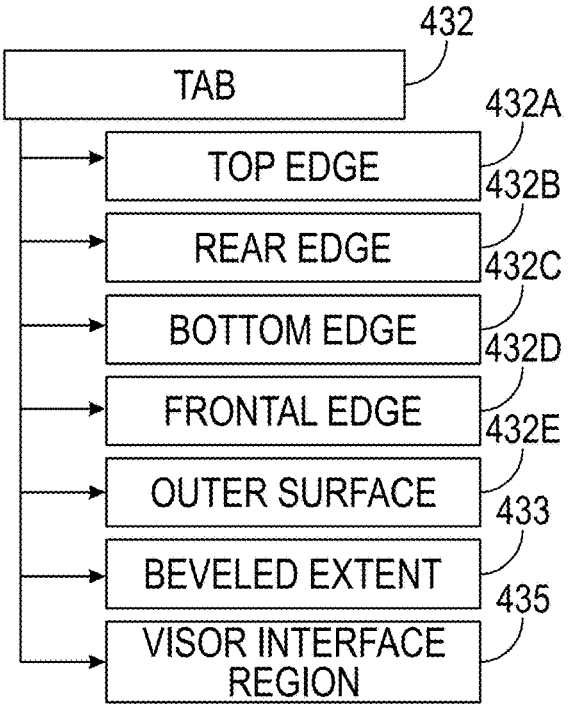
Figure 149:
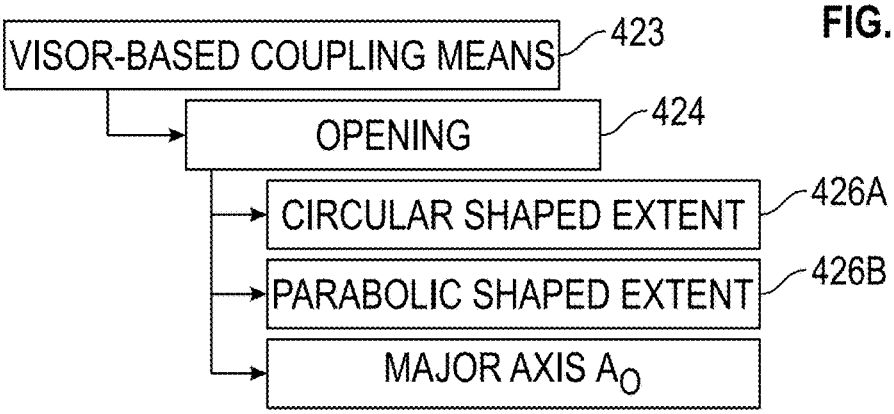
Figure 150:
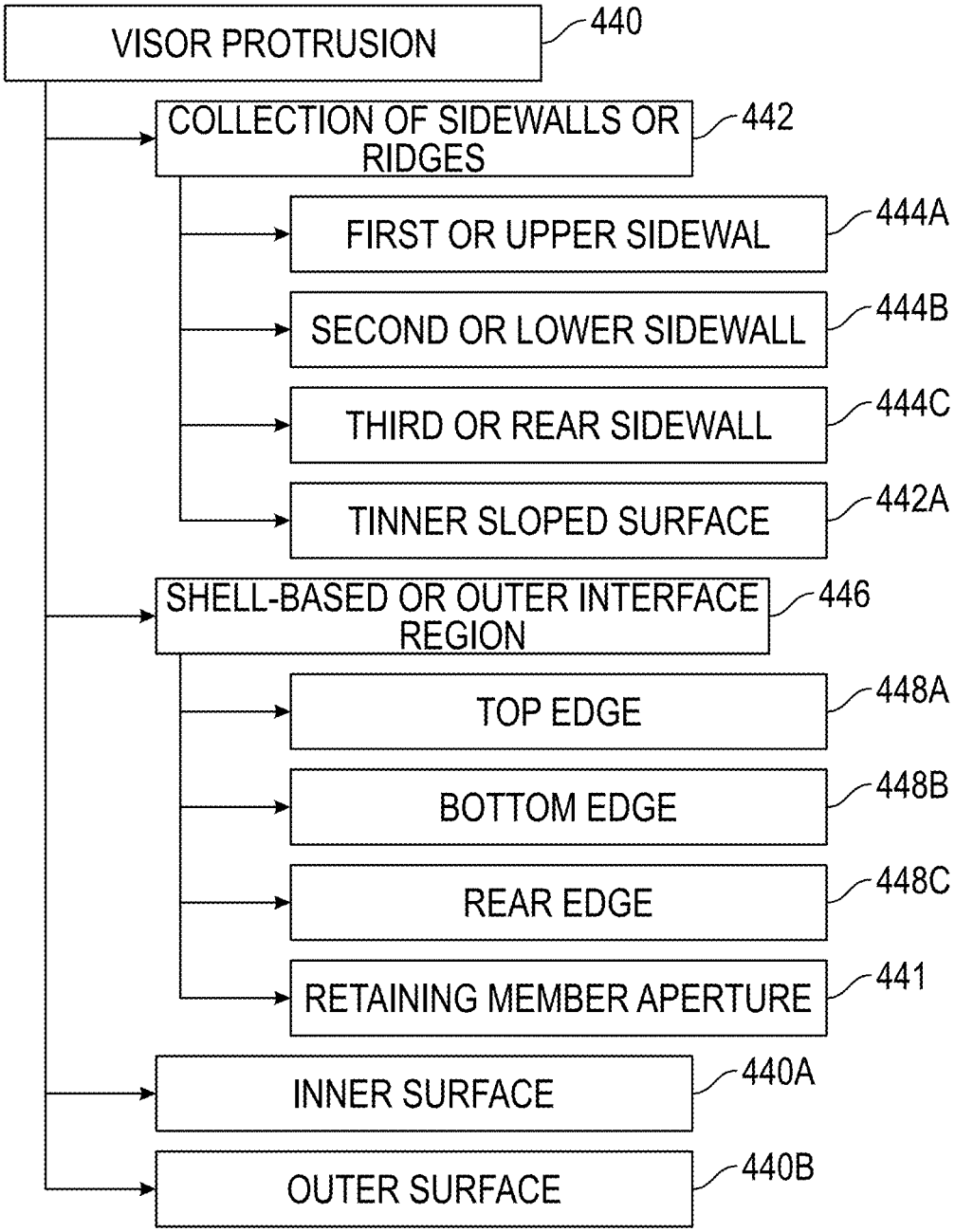
Figure 151:
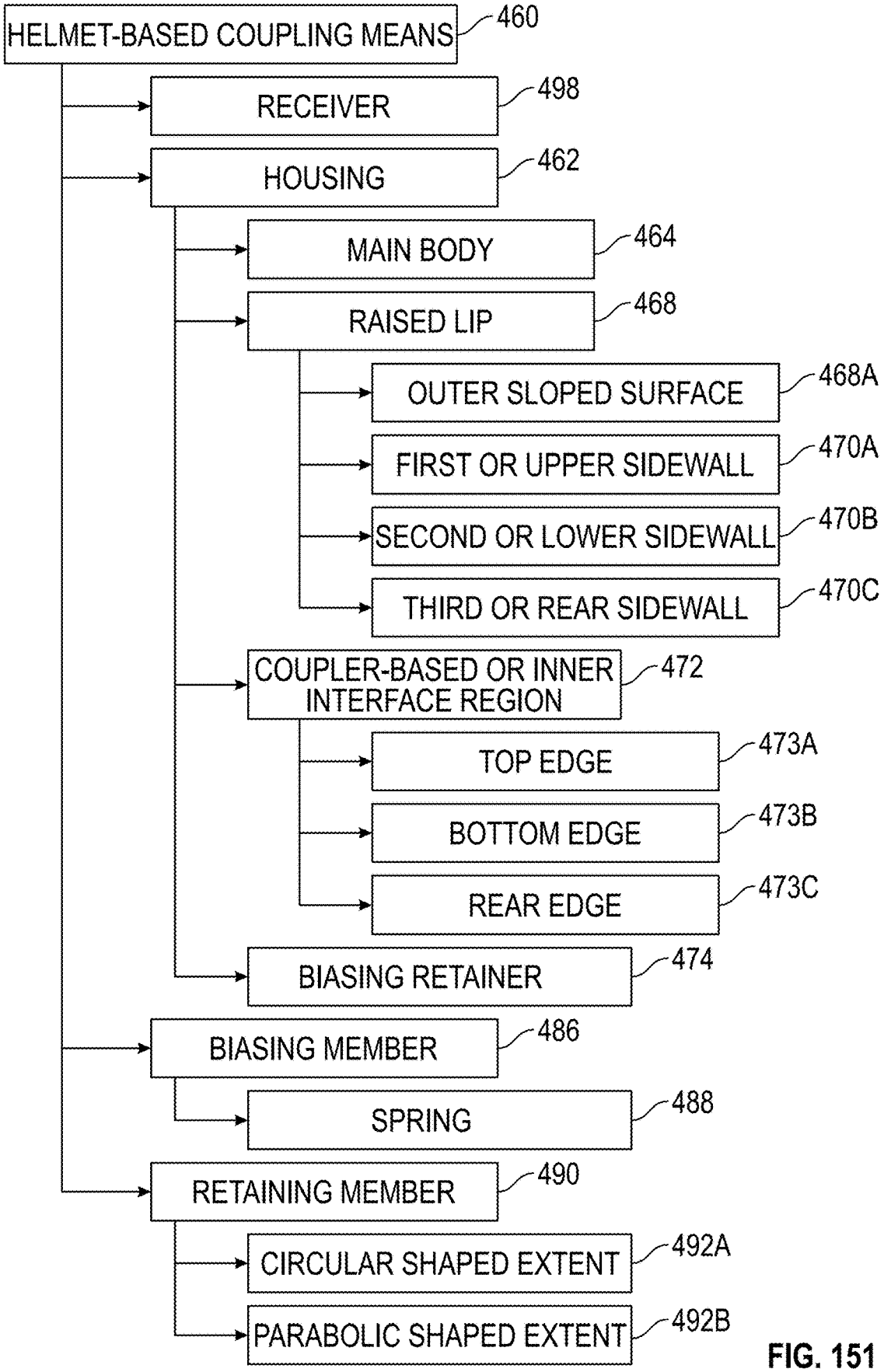
Figure 152:
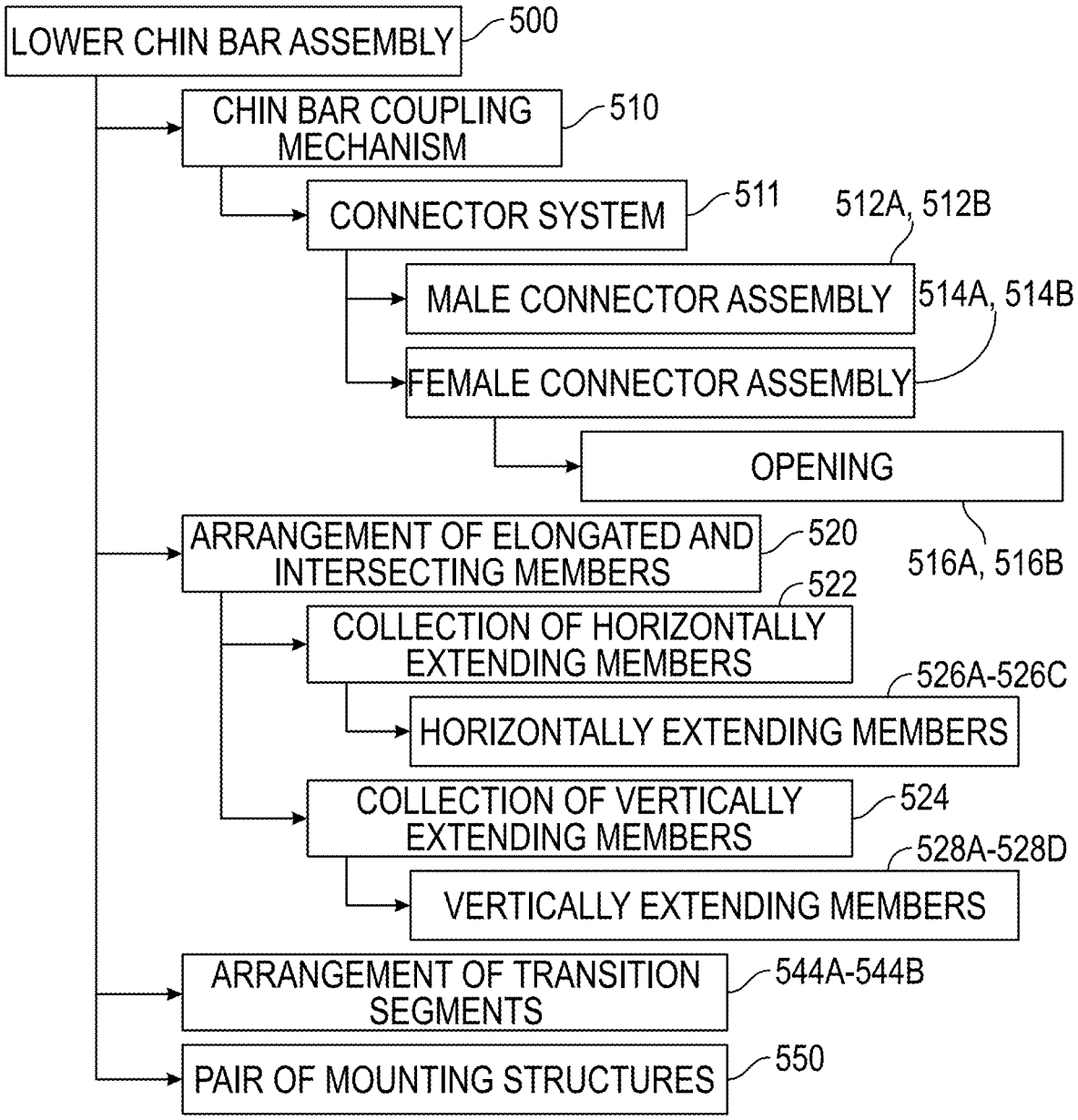
Figure 153:
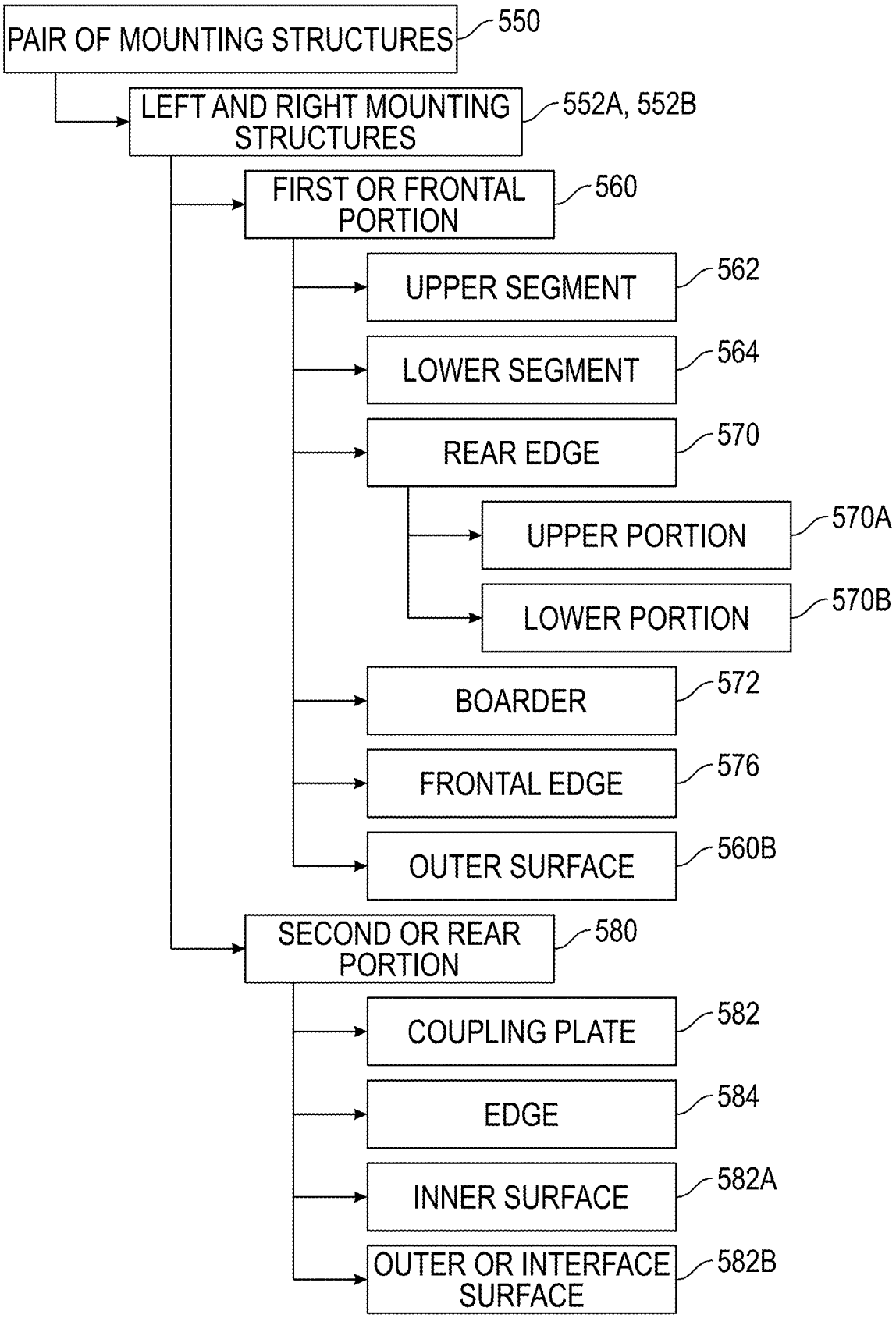

FIG. 136 is a top view of the headform and the visor of FIG. 130;

FIG. 137 is a left side view of the helmet of FIG. 1, showing the headform positioned within the helmet shell and the lower chin bar assembly, while the visor have been omitted from view;

FIG. 138 is a conventional protective sports helmet with a conventional full faceguard assembly, showing the headform positioned within the helmet shell;

FIG. 139 is a left side view of FIG. 1 showing the headform positioned within the helmet shell, while the lower chin bar assembly and the visor have been omitted from view;

FIG. 140 is a right side view of the conventional protective sports helmet of FIG. 138, showing the headform positioned within the helmet shell, while the wherein faceguard assembly has been omitted;

FIG. 141 is a perspective view of a picture of the inventive protective sports helmet of FIG. 1, which includes a helmet shell, a visor system, a chinstrap assembly, a lower chin bar assembly, and an internal energy attenuation assembly; and FIG. 142 is a perspective view of a picture of the conventional protective sports helmet with a conventional visor and a conventional full faceguard assembly;

FIG. 143 is a block diagram showing components of the protective sports helmet;

FIG. 144 is a block diagram showing portions, edges or regions of the shell of the protective sports helmet;

FIG. 145 is a block diagram showing surfaces, contours, and facets of the shell of the protective sports helmet;

FIG. 146 is a block diagram showing components of the visor system of the protective sports helmet;

FIG. 147 is a block diagram showing components of the visor main body of the visor system;

FIG. 148 is a block diagram showing components of the tab of the visor system;

FIG. 149 is a block diagram showing components of the visor-based coupling means of the visor system;

FIG. 150 is a block diagram showing components of the visor protrusion of the visor system;

FIG. 151 is a block diagram showing components of the helmet-based coupling means of the visor system;

FIG. 152 is a block diagram showing components of the lower chin bar assembly of the protective sports helmet; and FIG. 153 is a block diagram showing components of the pair of mounting structures of the lower chin bar assembly.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well-known methods, procedures, components, and/or circuitry have been described at a relatively high-level, without detail, in order to avoid unnecessarily obscuring aspects of the present disclosure.

While this disclosure includes several embodiments of protective sports helmets in different forms, there is shown in the drawings and will herein be described in detail particular embodiments with the understanding that the present disclosure is to be considered as an exemplification of the principles of the disclosed methods and systems, and is not intended to limit the broad aspects of the disclosed concepts to the embodiments illustrated. As will be realized, the disclosed methods and systems are capable of other and different configurations, and several details are capable of being modified all without departing from the scope of the disclosed methods and systems. For example, one or more of the following embodiments, in part or whole, may be combined consistent with the disclosed methods and systems. As such, one or more steps from the flow charts or components in the Figures may be selectively omitted and/or combined consistent with the disclosed methods and systems. Accordingly, the drawings, flow charts, and detailed description are to be regarded as illustrative in nature, not restrictive or limiting.

As discussed in the Background section (above), existing football helmets may include a conventional visor, which is located between the facemask and the helmet shell such that the conventional visor underlies facemask and overlies the helmet shell. During installation, the conventional visor is inserted between the helmet shell and the facemask. Once the visor is inserted at the proper location, the operator (typically a coach or equipment manager for the team) applies an outwardly directed force on the visor to deform it a distance to substantially match the curvature of the facemask. Next, the visor is secured to the facemask by a plurality of bulky clips that include an elongated fastener that extends through the facemask (see FIG. 142). This process and configuration results in several limitations and shortcomings for both the conventional football helmet and the conventional visor.

A. Introduction/Benefits

FIGS. 1-137, 139, and 141 show an innovative protective sports helmet, namely a protective football helmet 10 with a durable shell 12 having an impact attenuation system 40, a visor system 400, a lower chin bar assembly 500, and internal impact attenuation assembly 600. The visor system 400 provides numerous benefits over conventional shields, and it allows the helmet shell 12 and the lower chin bar assembly 500 to be modified in beneficial ways. First, the connection of the visor 405 of the visor system 400 to the shell 12 is "tool-less," meaning that no unique tool is required for coupling the visor system 400 to the shell 12 or removing it from the shell 12. This tool-less connectivity attribute allows a player P or an operator (such as a coach or equipment manager) to quickly change the visor 405 during a game or practice situation. Second, the visor system 400 is not coupled to the lower chin bar assembly 500. By not coupling the visor system 400 to a faceguard or the chin bar assembly 500, the visor 405 is not influenced or constrained by the connection between the faceguard and the visor 405. This positional arrangement allows the visor 405 to independently flex and independently elastically deform relative to the the chin bar assembly 500 when on-center or off-center impacts are received by the visor 405, the shell 12 and/or the chin bar assembly 500, which improves the impact response and durability of the visor 405. Third, the visor 405 is configured to match a substantial extent of the curvature of the shell 12, namely a portion of the frontal region 20 of the shell 12. Thus, the visor 405 does not need to be substantially deformed during the installation process, which eliminates the introduction of additional stresses on the visor 405 during the installation process. For example, when the shell 12 is a size 44 (extra large), the ends of the visor 405 are slightly expanded, and when the shell 12 is a size 22 (medium), the ends of the visor 405 are slightly contracted. The lack of deformation ensures that the visor 405 is an optically correct lens, which provides a clearer, crisper, more accurate view of the playing environment for the player wearing the helmet 10 and looking through the visor 405.

Fourth, since the visor 405 is optically correct, a coating or treatment can be applied to the visor 405 to improve the system's performance 400. For example, the visor 405 can be tinted a darker color which is beneficial in warm climates with significant sun exposure. Fifth, the visor 405 not only acts as a protective shield for a player's facial region, including the eye region, but the visor 405 also replaces a significant upper extent of the conventional facemask 9007 that is both heavy and costly to manufacture. The lower chin bar assembly 500 does not include an upper collection of protective bars or an upper attachment point. In other words, the lower chin bar assembly 500 does not include either an elongated side bar or an elongated upper or top bar that extends across the middle of the shell 12 at a point that is above the central frontal edge 14*c* of the frontal opening 16. Sixth, the omission of the side bars and the upper bar (that are found in the conventional facemask 9007) allows for improved performance because additional energy attenuation through elastic deformation of the shell 12 is permitted when the shell 12 receives on-center and off-center impacts. Seventh, the connection between the shell 12 and the lower chin bar assembly 500 permits a significant increase in the player P's field of view through the helmet 10, namely the visor 405. This significant increase in the field of view provides greater situational awareness for the player P and allows the player to reduce the amount of head rotation necessary to see objects or other players when the player P is engaged in playing the sport. Other benefits will be obvious to one of skill in the art of designing protective sports helmets based on the following disclosure and the figures that accompany this disclosure.

As explained in greater detail below, the impact attenuation system 40 is specifically designed and engineered to adjust how the helmet 10 responds to impact forces occurring while playing football and manages the energy resulting from those impacts. It is understood by those of skill in the art of designing protective football helmets that different regions of the football helmet experience impacts of different types, magnitudes, and durations during the course of playing football. It is also understood that the types, magnitudes, and durations of impact forces are different in contact sports, such as football, hockey, and lacrosse because these sports differ in many significant ways, e.g., the underlying nature of the play, the number and type of players, the equipment worn or carried by the players (e.g., hockey sticks and lacrosse sticks), and the playing surface. It is further understood that while playing football, a player may experience multiple impacts on the same or different regions of the helmet during a single play or a series of plays that are separated by a brief period of time. The impact attenuation system 40 is purposely designed to adjust how select portions of the helmet 10 respond, including elastic deformation, to impact forces by adjusting the dynamic performance of the portion having the system 40 compared to adjacent portions lacking the system 40. In one embodiment, a first portion of the helmet 10 that includes the system 40 has increased flexibility and, as a result, behaves differently than a helmet that lacked the system 40, when an impact force(s) is applied normal to the first and/or second portions of the helmet. Conventional football helmets lack these structural and functional aspects. In addition, these impacts differ, in terms of at least magnitude, location, direction and duration, between the sports of American football, hockey and lacrosse. Thus, the structures and/or features of a helmet designed for one of these three sports cannot be simply adopted or implemented into a helmet designed for another of these three sports without careful analysis and verification of the complex realities of designing, testing, manufacturing, and certifying a protective sports helmet.

B. Definitions

Referring to FIGS. 124 and 125, the following anatomical features are defined as: (i) player's exocanthion (ex) is located at the player's outer commissure of the eye fissure or where the upper eyelid meets with the lower eyelid, (ii) the player's cheilion (ch) is located at the lateral oral commissure or where the upper lip meets with the lower lip, (iii) the player's menton (me) is located at the most inferior midline point of the soft tissue chin, (iv) the player's subnasale (sn) is located at the deepest midline point where the base of the nasal columella meets the upper lip, (vii) the player's labrale superius (Is) is located at the midline point of the upper lip, and (viii) the player's palpebrale inferius (pi) is located at the lowest point of each lower eyelid, (ix) supra-aural (sa) is located at the outermost points of the player's cars, (x) the nasal tip (nt) is located at the forward most point of the player's nose, (xi) the trichion (t) is located at t the intersection of the normal hairline and the middle line of the forehead, (xii) the *glabella* (g) is located at the most prominent midline point of the forehead between the brow ridges, (xiii) coronal suture is a fibrous connective tissue joint that separates the two parietal bones from the frontal bone of the skull.

The following terms will be used in connection with FIGS. 127*a*-140 to describe the line of sight of the player, P. The normal line of sight ("NLOS") is a fixed-line that projects forward from each eye when the eyes are fixed on a distant point. The NLOS of the two eyes extends in a generally horizontal plane through the eyes when the head is in an upright position with the eyes staring into the distance. The activity line of sight ("ALOS") and is a determinable direction of gaze for performing a particular activity.

C. Shell

As shown in FIGS. 1-48, the helmet 10 includes a shell 12 formed from a plastic or polymer material, such as polycarbonate, acrylonitrile butadiene styrene (ABS), or nylon. The shell 12 may be formed using any known method of manufacturing, including injection molding, subtractive manufacturing (e.g., CNC), or additive manufacturing (e.g., 3D printing). The shell 12 includes regions that have different stiffness and rigidities, wherein one region may be rigid or stiff, another region may be semi-rigid, and another region may be flexible. In particular, the stiffness of each region may be defined by the thickness of shell, material of the shell in that region, and/or structures (e.g., openings, corrugations, etc.) contained within or adjacent to the region. The shell 12 is symmetric along a vertical plane dividing shell 12 into left and right halves. When helmet 10 is worn by the player P, this vertical plane Pv is aligned with the midsagittal plane that divides the player P (including his head) into substantially symmetric left and right halves, wherein the midsagittal plane is shown in the NOCSAE standard ND002 for newly manufactured football helmets. Therefore, features appearing in one half of shell 12 are also present in the other half of shell 12.

1. Portions, Edges, or Regions

The shell 12 includes several portions, edges, or regions 13, which include: (i) a crown portion 18 defining a top region of the helmet 10, (ii) a front portion 20 generally extending forwardly and downwardly from the crown portion 18, (iii) a rear portion 22 generally extending rearwardly and downwardly from the crown portion 18, and (iv) left and right side portions 24 generally extending downwardly and laterally from the crown portion 18. The left and right side portions 24 each include: (i) an car flap 26 generally positioned to overlie and protect the player P's car region when the helmet 10 is worn and (ii) a lower chin bar region 30.

As best shown in FIGS. 1-2, 6, 9, 13, 16, 17, 21, 23, 24, 28, and 29, the shell 12 also includes a frontal opening 16 that is formed by a combination of: (i) the frontal left and right side edges 14*a*, 14*b*, which are the forward most extents of the side portions 24 of the shell 12, and (ii) a lower frontal edge 14*c* that is the lowermost edge of the front portion 20 of the shell 12 and that extends between the frontal left and right side edges 14*a*, 14*b*. The frontal left and right side edges 14*a*, 14*b* include a collection of segments, which include: (i) a first or upper segment 15*a* that extends downward and rearward from the frontal edge 14*c*, (ii) a second or forward segment 15*b* extends forward from the lowermost point of the first upper segment 15*a*, (iii) a third or intermediate segment 15*c* that extends downward and forward from the lowermost point of the second segment 15*b*, and (iv) a fourth or lower segment 15*d* that extends downward and rearward from the lowermost point of the third intermediate segment 15*c*. It should be understood that in other embodiments, the number of segments may be increased or decreased, the extents may be curvilinear, or may have differential positional relationship/configurations.

A lower chin bar region 30 of the shell 12 generally extends forward from each of the respective car flaps 26 to the combination of the third intermediate segment 15*c* and the fourth lower segment 15*d* of the frontal left and right side edges 14*a*, 14*b*. The lower chin bar region 30 of the shell 12 is generally configured to protect the player's P zygomatic Ry and buccal RB regions and overlie an extent of the player's mandible or lower jaw bone when the helmet 10 is worn by the player. As best shown in at least FIG. 116, the lower chin bar region 30 includes an outer surface 30*b* that is substantially flush with the adjacent outer surface 11*b* of the shell 12. In other words, the outer surface 30*b* of the lower chin bar region 30 of the shell 12: (i) is not inwardly offset or recessed in comparison to an adjacent region of the shell's outer surface 11*b*, (ii) is not outwardly offset or protrudes in comparison to an adjacent region of the shell's outer surface 11*b*, and (iii) does not include an exterior transition surface, ridge or sidewall that is positioned between the outer surface 30*b* and the outer surface 11*b* of the adjacent region of the shell 12. Omitting a recess 9009 found in a conventional helmet 9010 is beneficial to the inventive shell 12 because it: (i) allows for additional energy management material to be placed between the player's P head and the shell 12, which can increase the energy attenuation performance of the helmet 10, (ii) it provides the external surface 11*b* of the shell 12 smoother and devoid of prominent ridges or edges which may cause the lower chin bar assembly 500 can get snagged on another player's P equipment or clothing, and (iii) reduces the air resistances or drag of the helmet 10. Additional details about the lower chin bar assembly 500 and how it is coupled to the shell 12 are described below.

Still referring to at least FIG. 116, the lower chin bar region 30 has an inner surface 30*a* that is not substantially flush with the adjacent inner surface 11*a* of the shell 12. Instead of these surfaces 30*a*, 11*a* being substantially flush with one another, the inner surface 30*a* is inwardly offset, moved inward, or moved towards the center of the helmet 10. By moving the inner surface 30*a* inward and keeping the outer surface 30*b* substantially flush with the adjacent outer shell surface 11*a*, the thickness of the lower chin bar region $T_{LCBR}$ is increased in comparison to a thickness in an adjacent region of the shell 12. In fact, the difference between the thickness $T_{LCBR}$ of the lower chin bar region 30 and the thicknesses of both of the car flap 26, $T_{EF}$ and rear portion 22, $T_R$ of the shell 12 are substantial. In this embodiment, the thickness of the lower chin bar region $T_{LCBR}$ varies from 0.18 to 0.22 inches, while the ear flap 26 thickness $T_{EF}$ and the rear portion 22 thickness $T_R$ are approximately 0.13 inches. Thus, the thickness of the lower chin bar region $T_{LCBR}$ is approximately 60% larger than compared to the thickness contained within other portions (e.g., car flap 26 and rear portion 22) of the shell 12. This increased thickness in the lower chin bar region $T_{LCBR}$ region is beneficial because it provides additional support for lower chin bar assembly 500. It should be understood that in other embodiments of the helmet 10, the thicknesses $T_{LCBR}$, $T_{EF}$, $T_R$ may be larger, smaller, or equal to each while not departing from the inventive concepts and attributes of the helmet 10.

The lower chin bar region 30 has a substantial size, as it is configured to accommodate the lower chin bar coupler mechanism 510. As shown in the Figures, the lower chin bar coupler mechanism 510 includes two connector systems 511*a*, 511*b*. Said connectors 511*a*, 511*b* are positioned below (in a vertical orientation) the player's P exocanthion (ex) in the player's eye region and rearward of the player's P exocanthion (ex) when the helmet 10 is worn, as shown in FIG. 127*a*, 127*b*. The use of two connector systems 511*a*, 511*b* is beneficial because it helps ensure that the lower chin bar assembly 500 does not rotate or pivot when the helmet 10 receives an off-center impact or an upwardly or downwardly directed impact. To further aid in preventing this rotational movement, an extent of the lower chin bar assembly 500 is positioned adjacent and above a forward most point 15*e* of the frontal left and right side edges 14*a*, 14*b* and an extent of the lower chin bar assembly 500 is positioned adjacent and below the forward most point 15*e*, as shown in FIGS. 111-112. In other words, the V-shaped configuration of the third intermediate segment 15*c* and the fourth lower segment 15*d* and mating V-shaped configuration of an extent of the lower chin bar assembly 500 aids in preventing this rotational movement. It should be understood that in other embodiments that: (i) the inner surface 30*a* may not be substantially flush (e.g., inwardly offset or outwardly offset) with the adjacent inner surface 11*a* of the shell 12, (ii) the outer surface 30*b* may not be substantially flush (e.g., inwardly offset or outwardly offset) with the adjacent outer surface 11*b* of the shell 12, (iii) the lower chin bar assembly 500 may extend along and be coupled to the shell 12 on the outer surface 11*b* of the shell 12, (iv) may not have multiple lower chin bar couplers, (v) may not have a V-shaped configuration and instead could have a curvilinear configuration that is convex or concave, or (vi) any combination thereof.

The frontal left and right side edges 14*a*, 14*b* of the side portions 24 are generally moved rearward on the player's head H in comparison with a conventional helmet 9010. In particular, FIG. 139 shows that the forward most point 15*e* of the frontal left and right side edges 14*a*, 14*b* are positioned rearward of a frontal opening 147*a* in the shell 12 and is vertically aligned with an extent of a first edge 49*a*, while FIG. 140 shows that the forward most point 9015*e* of the frontal left and right side edges 9014*a*, 9014*b* on the conventional helmet 9010 is forward the first edge 9049*a* and is aligned with an extent of a frontal opening 9147*a* in the shell. Additionally, FIG. 139 shows that the forward most point 15*e* is positioned rearward of the player's P exocanthion (ex), cheilion (ch), and menton (me), while FIG. 140 shows that the forward most point 9015*e* on the conventional helmet 9010 is forward of the player's P exocanthion (ex), cheilion (ch), and menton (me). Further, FIG. 139 shows that the forward most point 15*e* is positioned above the lowermost extent of a rear edge 14*d* of the shell 12, while FIG. 140 shows that the forward most point 9015*e* is positioned below a rear edge 9014*d* of the shell. Moreover, FIG. 139 shows that the forward most point 15*e* is substantially aligned with the player's P subnasale (sn), while FIG. 140 shows that the forward most point 9015*e* is positioned below the player's P subnasale (sn) and substantially aligned with the player's P labrale superius (Is).

As shown in FIG. 139 a rearmost point 15*f* of the frontal left and right side edges 14*a*, 14*b* is positioned rearward of both a frontal energy attenuation member 42 and the frontal opening 147*a* in the shell 12, while FIG. 140 shows that the rearmost point 15*f* of the frontal left and right side edges 9014*a*, 9014*b* on the conventional helmet 9010 is forward of an extent of both of the frontal energy attenuation member 9042 and the frontal opening 9147*a* in the shell. Additionally, FIG. 139 shows that the rearmost point 15*f* is positioned below the player's P palpebrale inferius (pi), while FIG. 140 shows that the rearmost point 9015*f* on the conventional helmet 9010 is substantially aligned with forward of the player's P palpebrale inferius (pi). By moving the frontal left and right side edges 14*a*, 14*b* rearward, the weight of the helmet shell 12 has been reduced and the player P's field of view through the helmet 10 has been increased.

2. Surfaces, Contours, and Facets

The helmet 10 includes an arrangement of surfaces, contours, and facets 38 of the shell 12 that are integrally formed with one another. The arrangement 38 includes: (i) impact attenuation system 40, (ii) a raised central band 62, (iii) a transverse band 70, and (iv) a visor protrusion segment 440.

i. Impact Attenuation System

The helmet's engineered impact attenuation system 40 includes (i) frontal energy attenuation member 42, (ii) side energy attenuation members 142, and (iii) rear energy attenuation member 242. These energy attenuation members 42, 142, 242 adjust how the helmet 10 responds to an impact force compared to helmets 10 that lack these members 42, 142, 242. The energy attenuation members 42, 142, 242 are formed by altering at least one portion of the shell 12. These alterations to the shell 12 change the configuration of the shell 12 and its local response to impact forces. For example, the impact attenuation system 40 includes: (i) a front cantilevered segment or front flap 44 formed in the front shell portion 20, (ii) side cantilevered segments or side flaps 144 formed in the side shell portions 24, and (iii) a rear cantilevered segment or rear flap 244 formed in the rear shell portion 22. Compared to other helmet shells that lack the cantilevered segment(s) 44, 144, 244, the shell 12 has a lower structural modulus ($E_s$) within the front 20, rear 22, and side 24 of the shell 12. This improves the attenuation of energy associated with impacts to at least these portions 20, 22, 24. Thus, the localized structural modulus values within each of these portions 20, 22, 24 of the helmet 10 differ from one another, which in turn improves the performance of the helmet 10.

As shown in the Figures, most particularly FIGS. 1-29, the illustrated cantilevered segments 44, 144, 244 are formed by removing material from the shell 12 to define multi-segment gaps or openings 46, 146, 246, which partially define boundaries of the cantilevered segments 44, 144, 244. Unlike conventional impact force management techniques that involve adding material to a helmet, the impact attenuation system 40 involves the strategic removal of material from the helmet 10 to integrally form the cantilevered segments 44, 144, 244 in the shell 12. Although the illustrated embodiment of the helmet 10 includes a frontal energy attenuation member 42, side energy attenuation members 142, and a rear energy attenuation member 242, the helmet 10 could also include an energy attenuation member 42 in the crown portion 18. It should be understood that the helmet 10 may not include all of the energy attenuation members 42, 142, 242 disclosed herein. For example, the helmet 10 may only include the front energy attenuation member 42. It should also be understood that the size, shape, amount of material that is removed, position, structural modulus of the energy attenuation members 42, 142, 242 may be changed or altered. In fact, helmets that are specifically designed for a subset of the population of players P may have different configurations. For example, the configuration of a helmet deigned for a NFL level player may have a different configuration than a helmet design for a high school level player. Additionally, the helmet 10 that is designed for a lineman may have a different configuration than a helmet design for a wide receiver.

Figure 18:
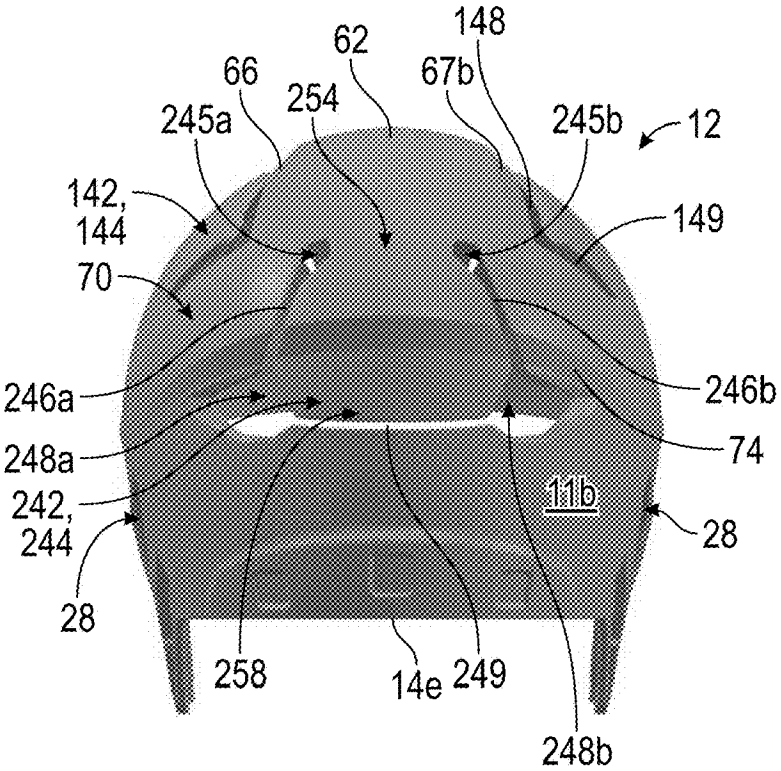
FIG. 18 is a rear view of the helmet shell of FIG. 16.
Figure 17:
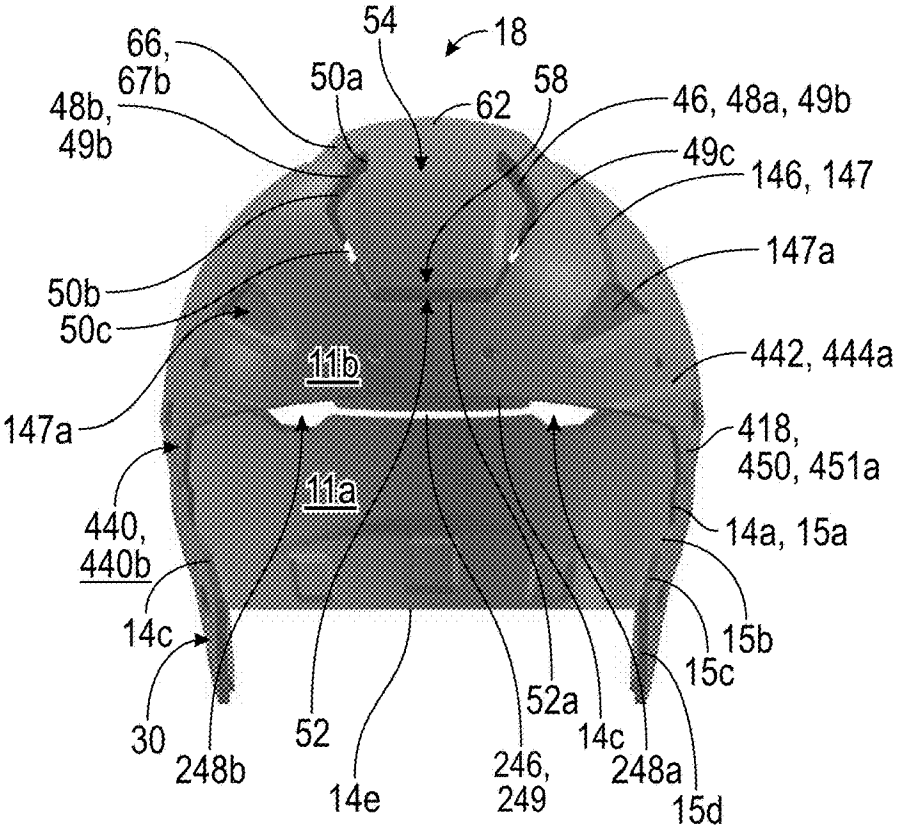
FIG. 17 is a front view of the helmet shell of FIG. 16.
Figure 19:
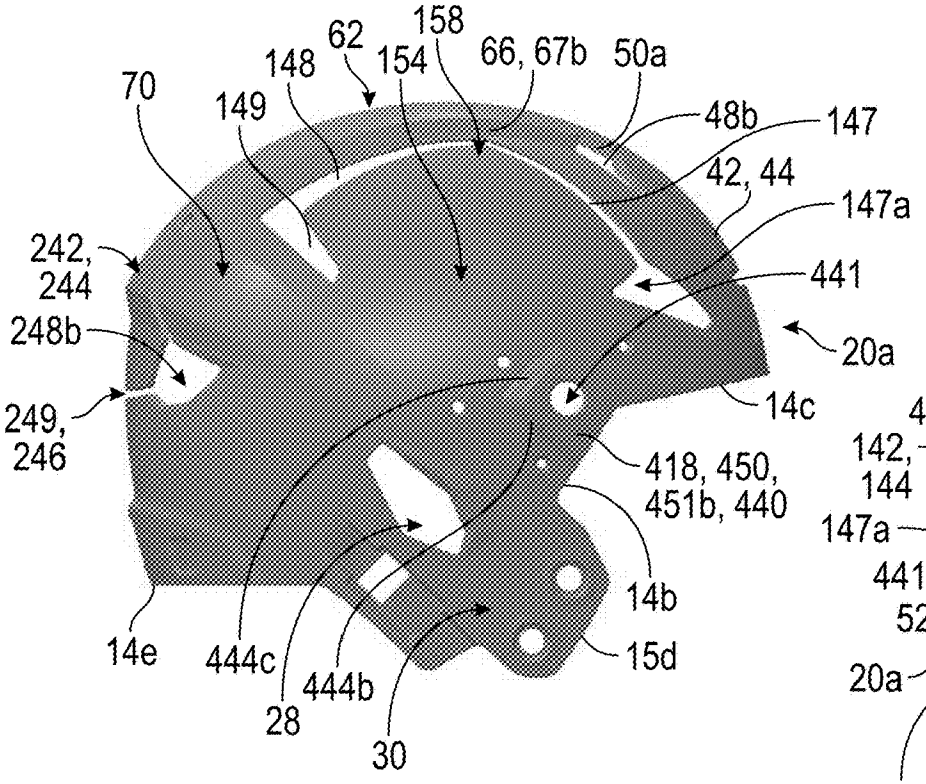
FIG. 19 is a right side view of the helmet shell of FIG. 16.
Figure 20:
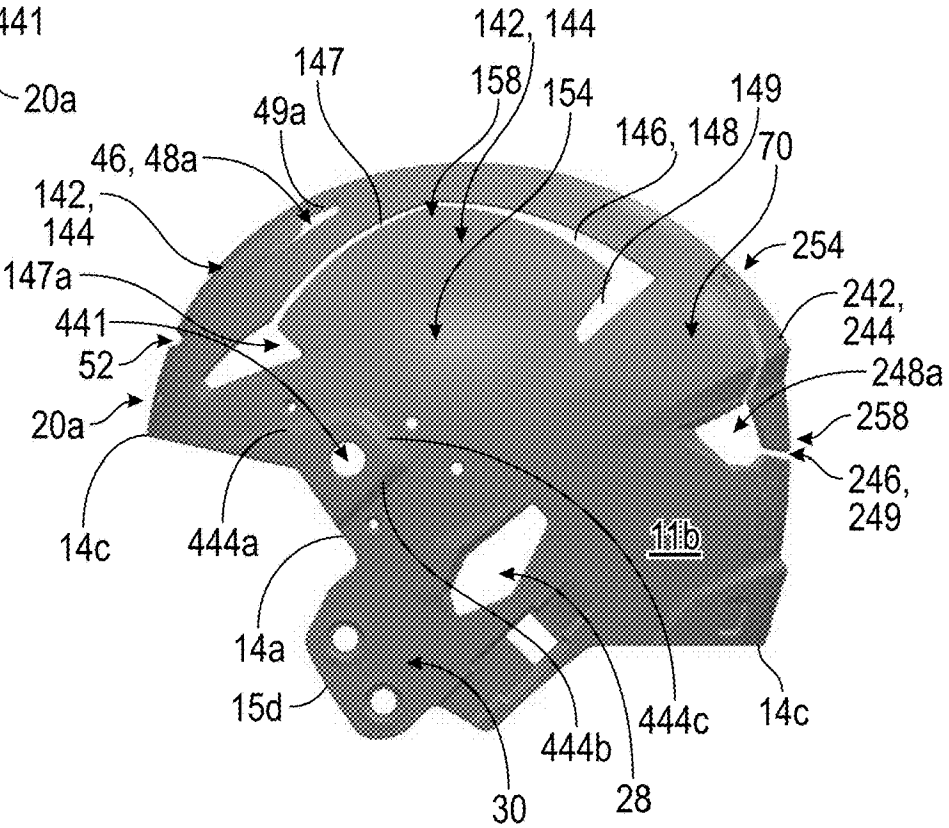
FIG. 20 is a left side view of the helmet shell of FIG. 16.
Figure 22:
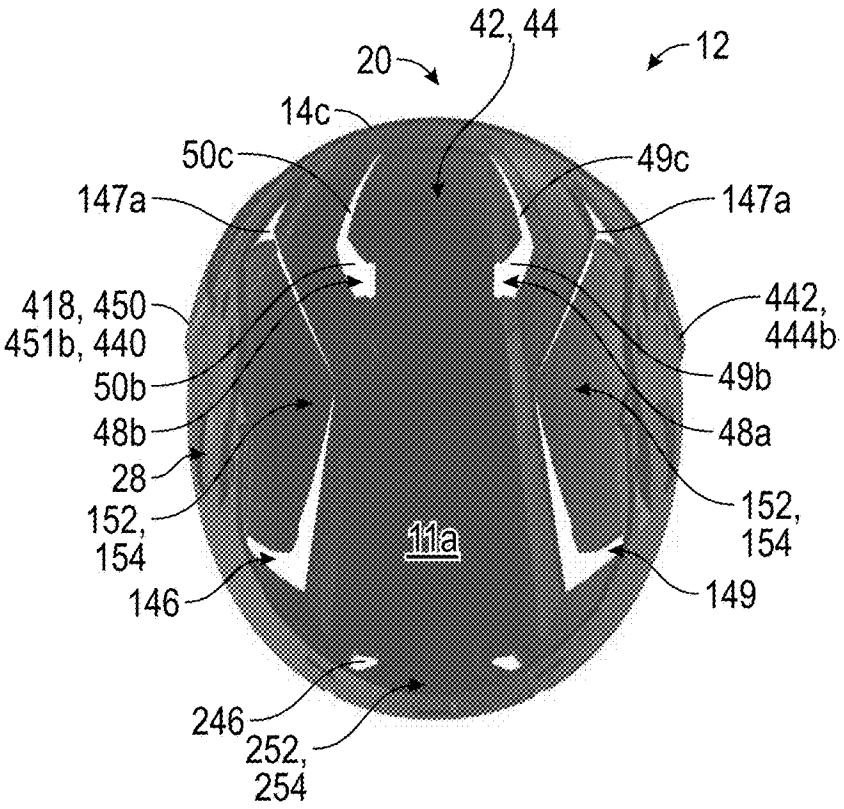
FIG. 22 is a bottom view of the helmet shell of FIG. 16.
Figure 21:
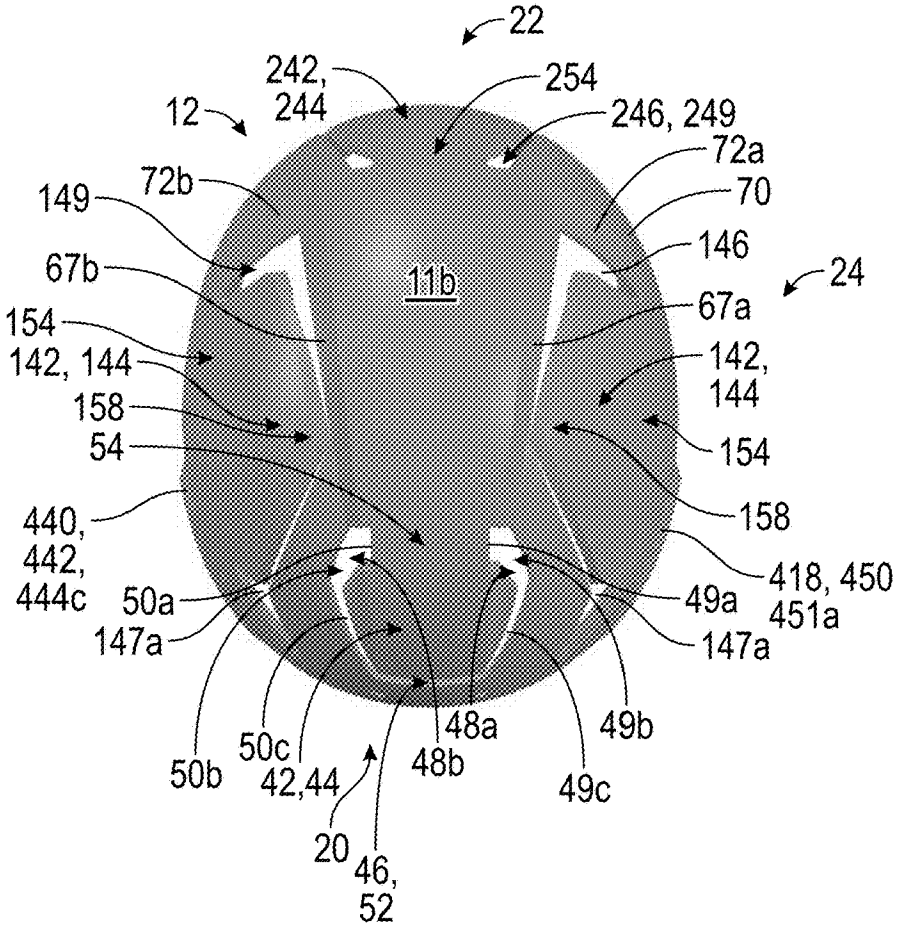
FIG. 21 is a top view of the helmet shell of FIG. 16.
Figure 23:
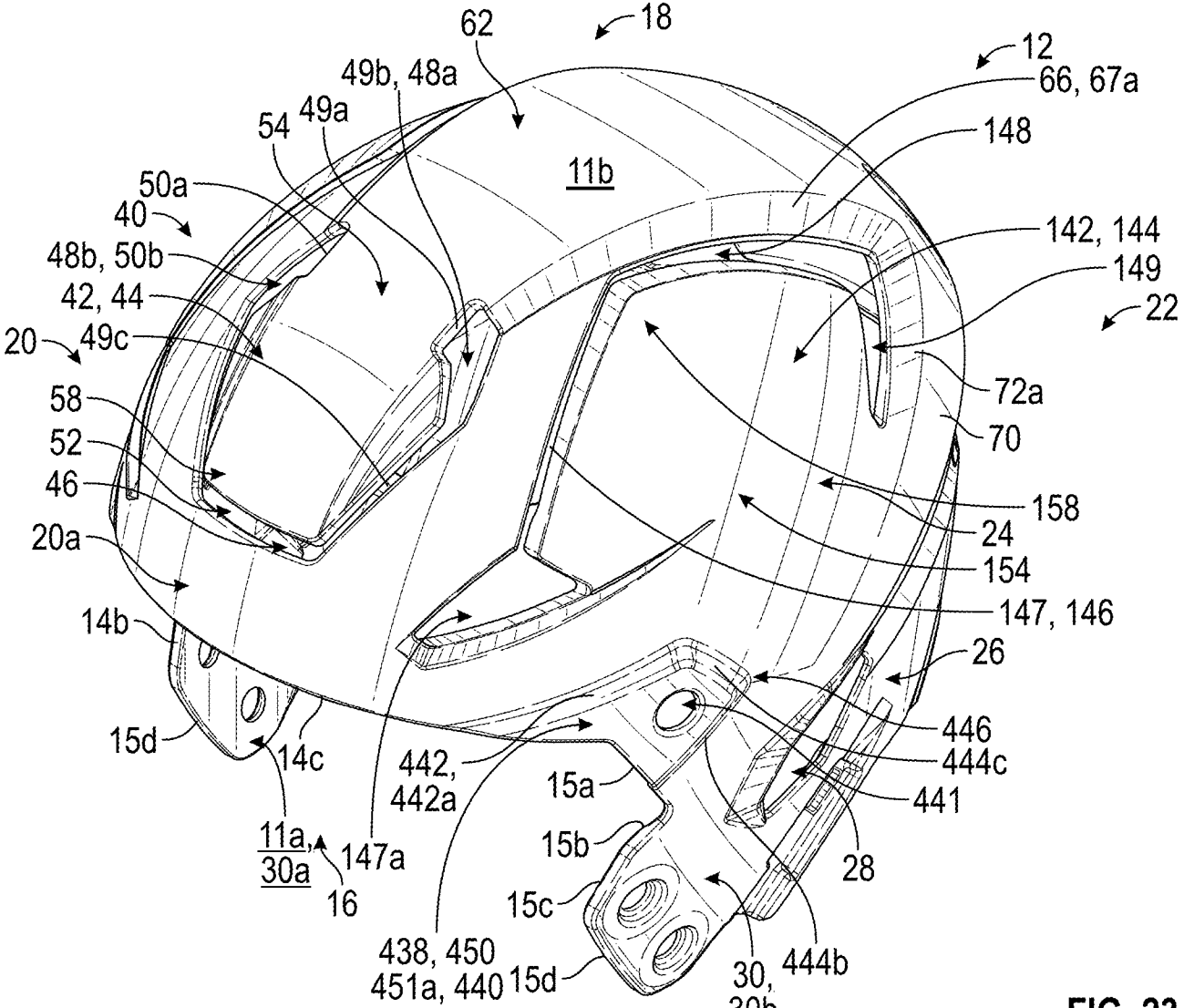
FIG. 23 is a perspective view of the helmet shell of the protective sports helmet of FIG. 1, wherein the helmet shell is shown in a line drawing format.
Figure 24:
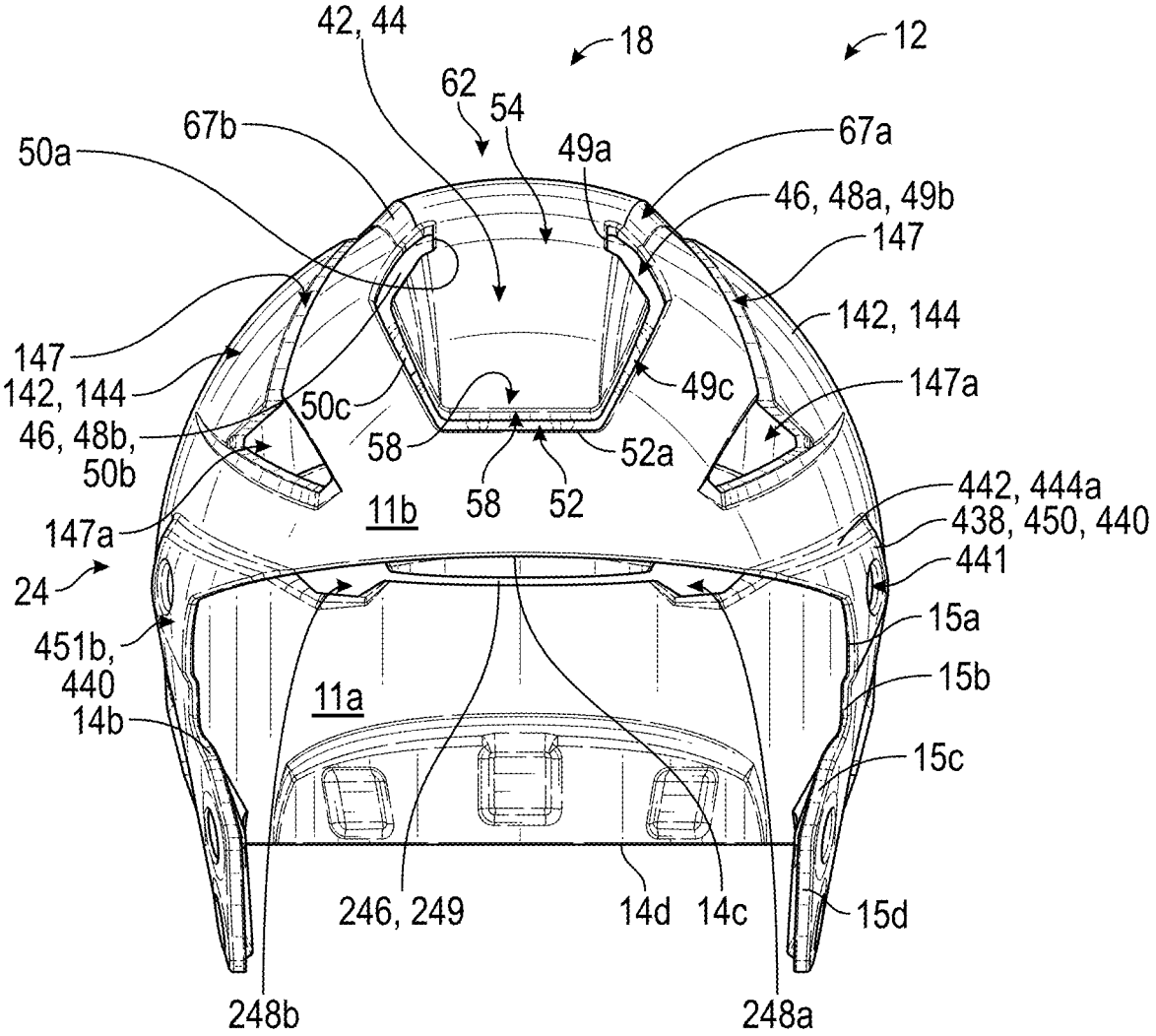
FIG. 24 is a front view of the helmet shell of FIG. 23.
Figure 25:
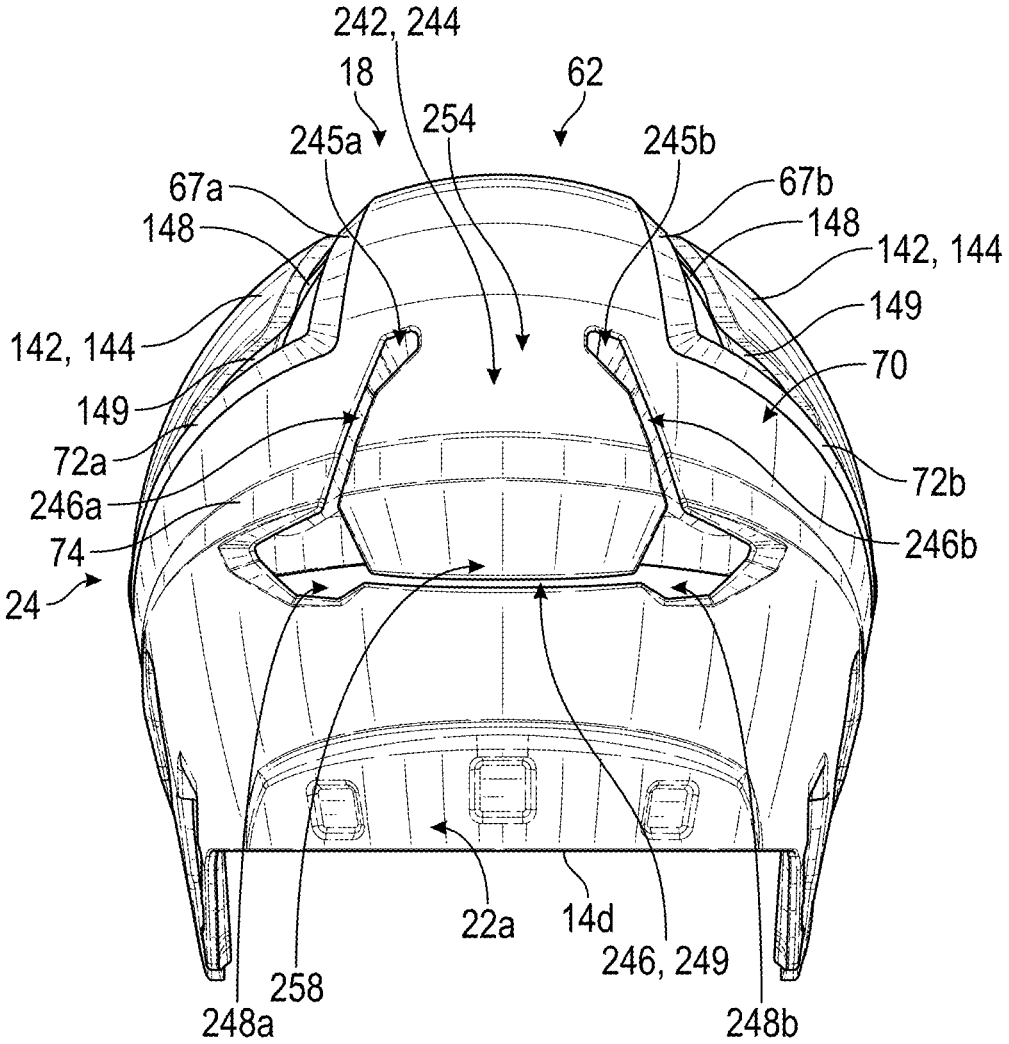
FIG. 25 is a rear view of the helmet shell of FIG. 23.
Figure 26:
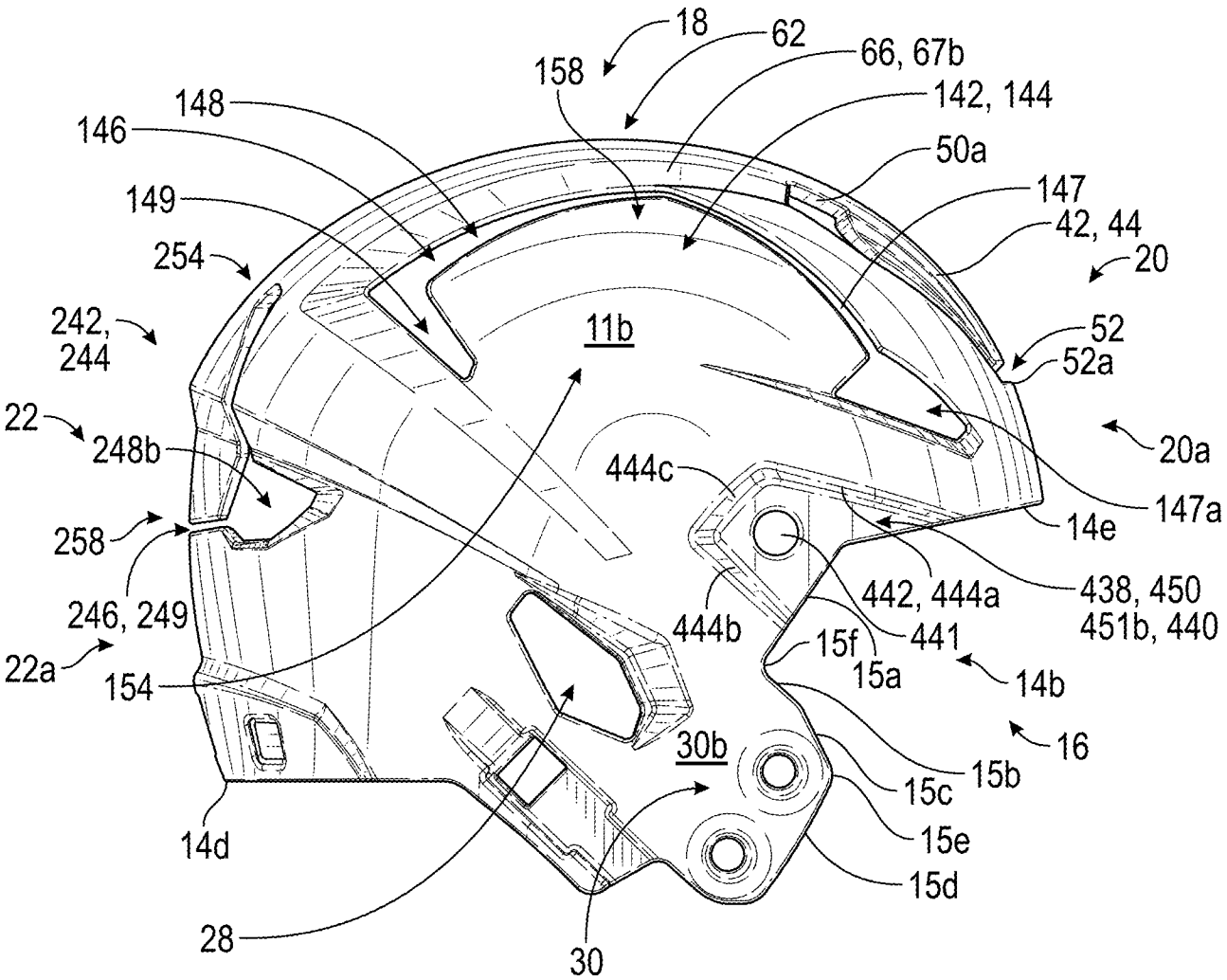
FIG. 26 is a right side view of the helmet shell of FIG. 23.
Figure 27:
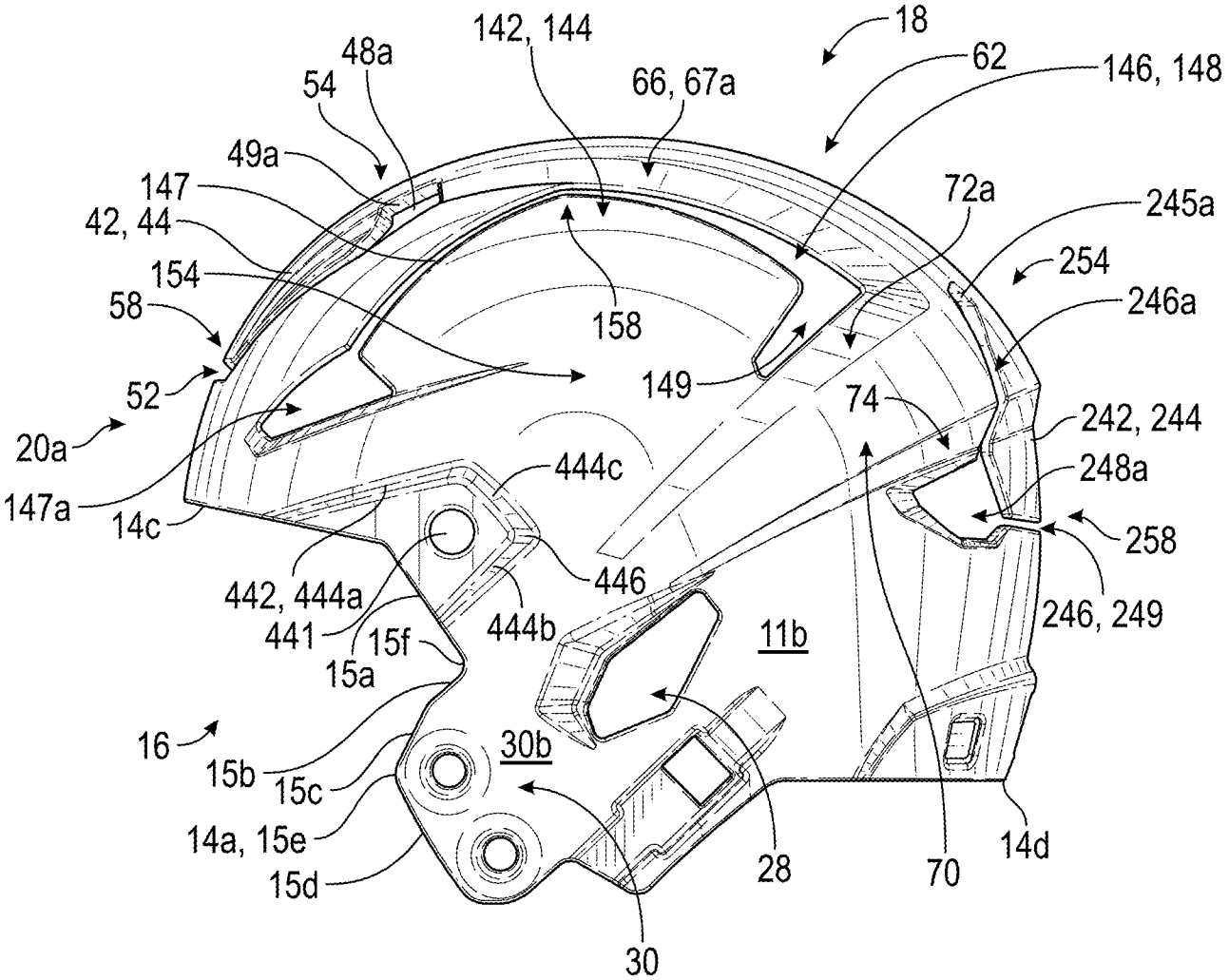
FIG. 27 is a left side view of the helmet shell of FIG. 23.
Figure 28:
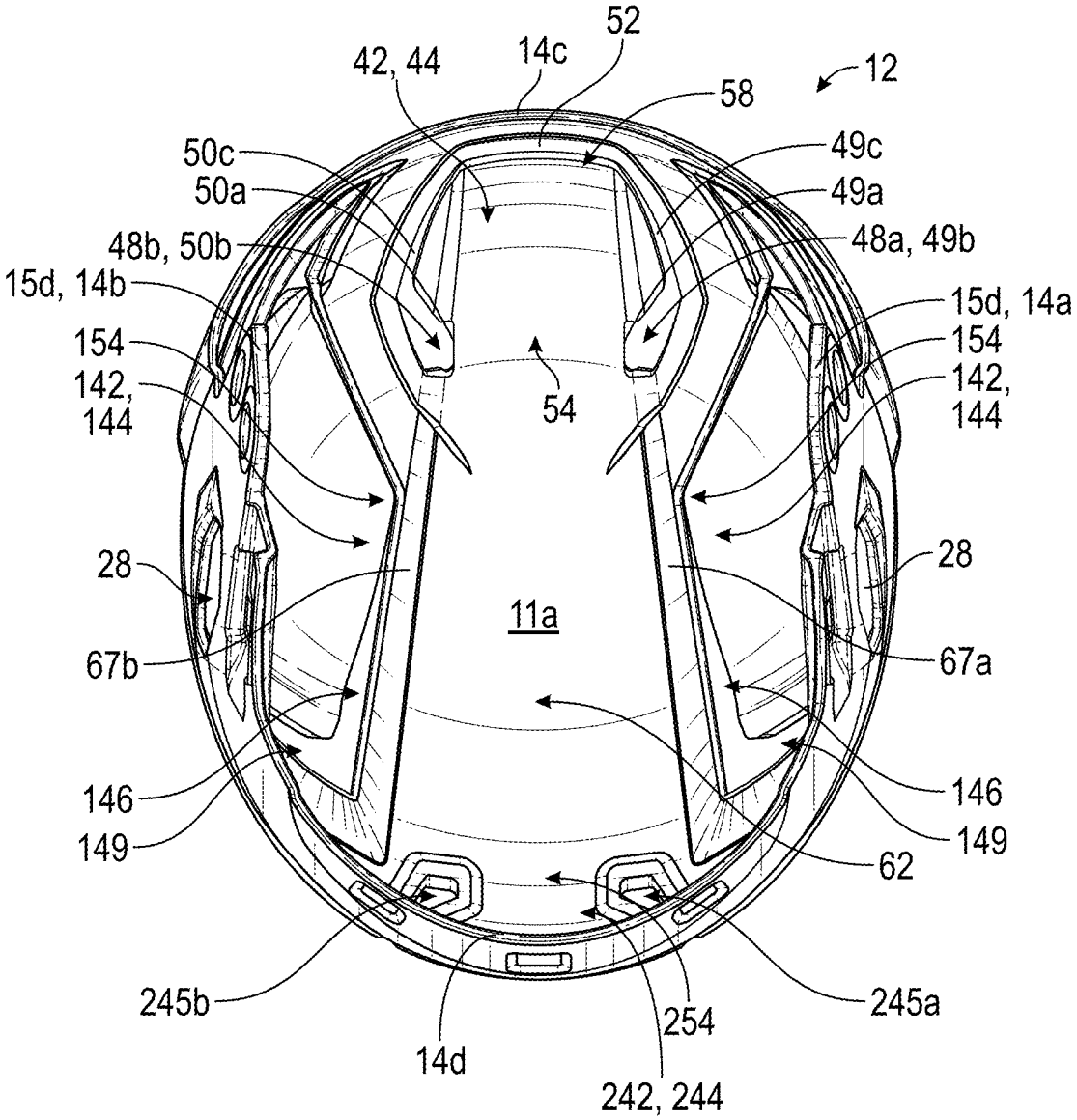
FIG. 28 is a bottom view of the helmet shell of FIG. 23.
Figure 29:
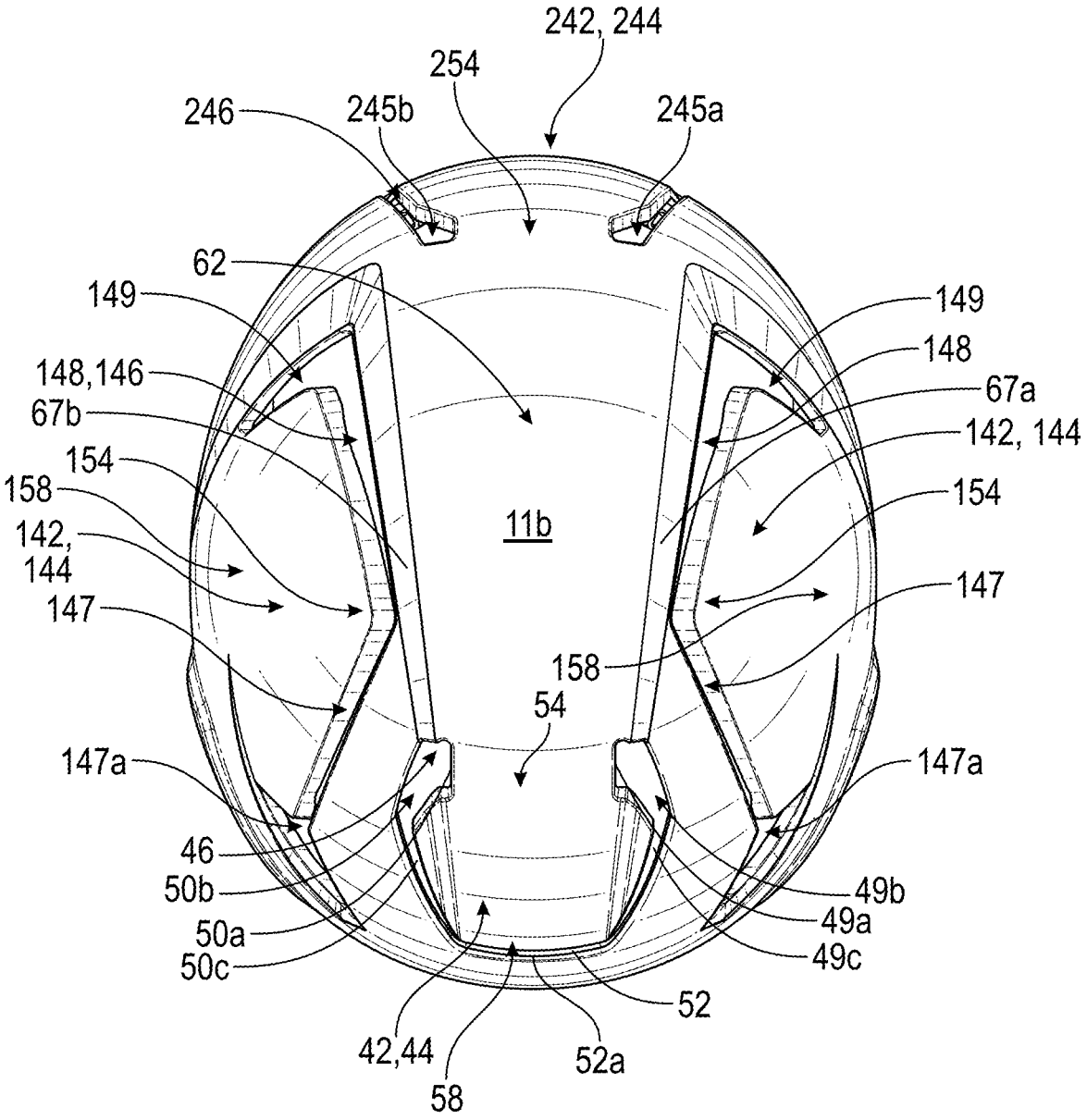
FIG. 29 is a top view of the helmet shell of FIG. 23.
Figure 30:
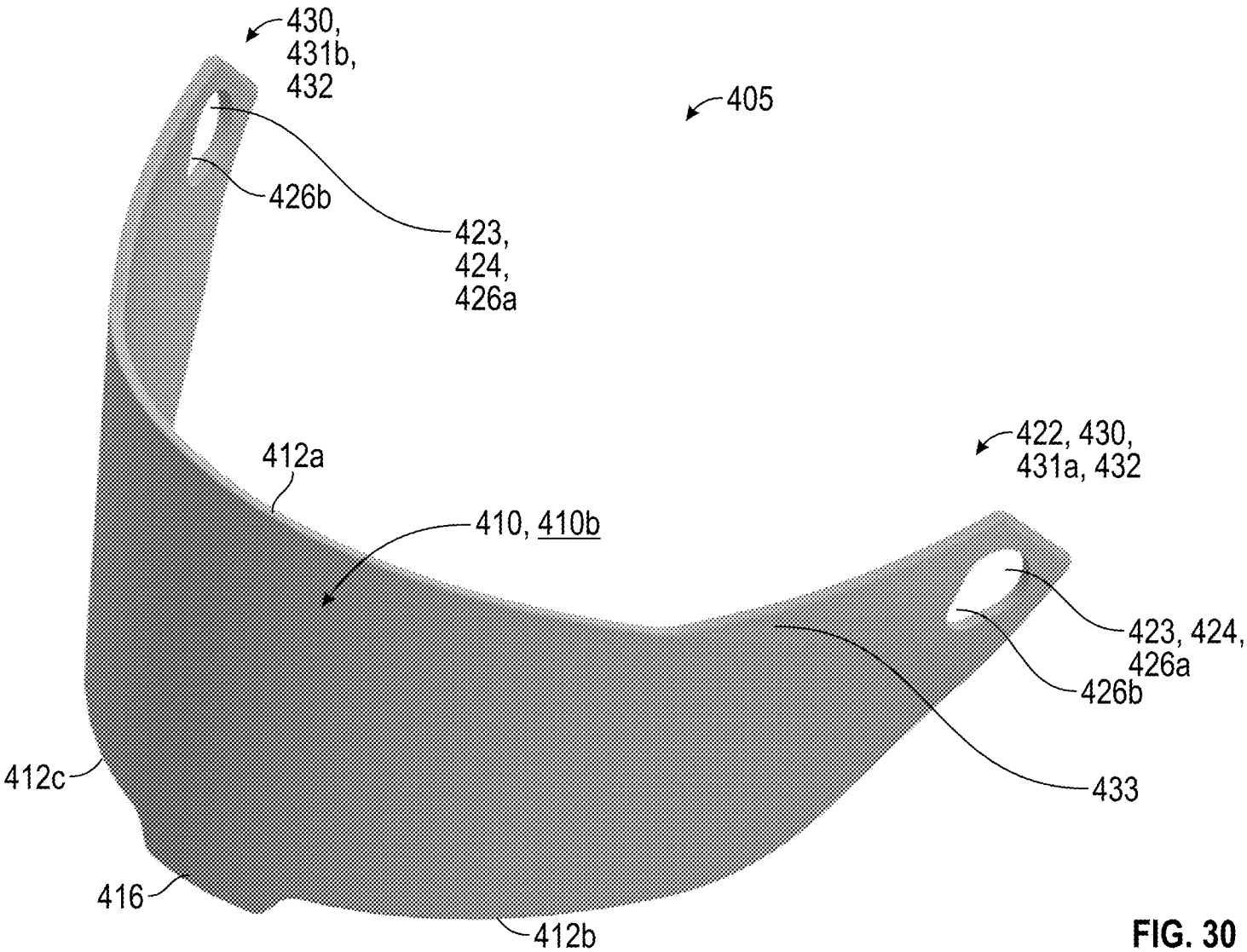
FIG. 30 is a perspective view of the first embodiment of the visor of the protective sports helmet of FIG. 1.
Figure 31:
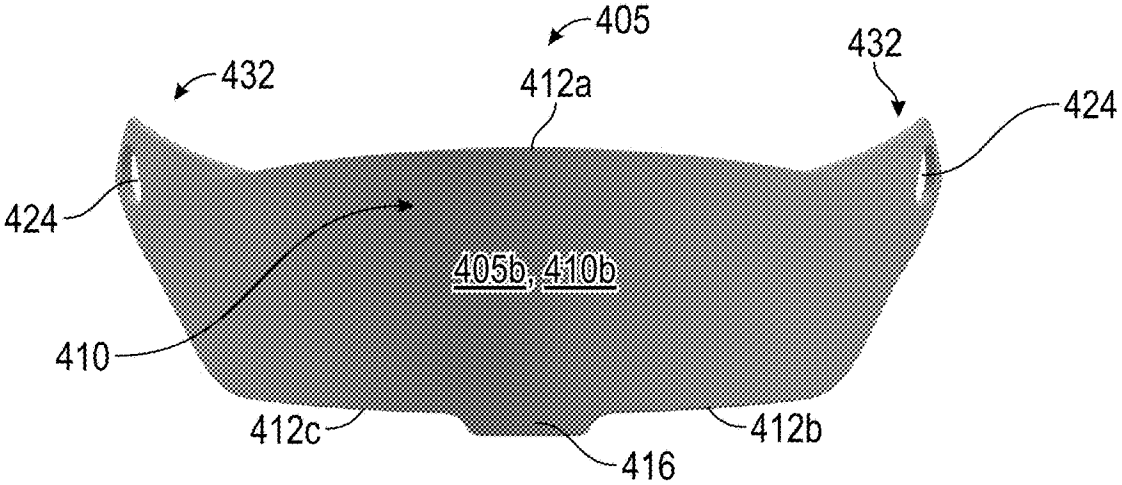
FIG. 31 is a front view of the visor of FIG. 30.
Figure 32:
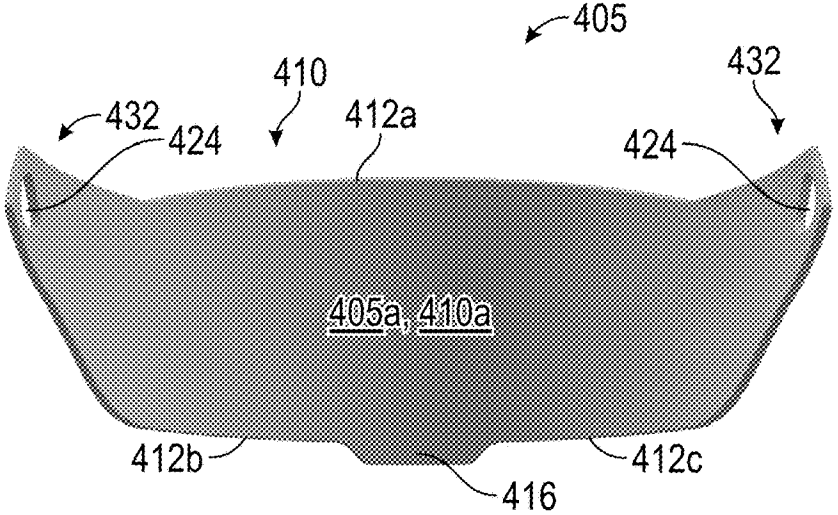
FIG. 32 is a rear view of the visor of FIG. 30.
Figure 33:
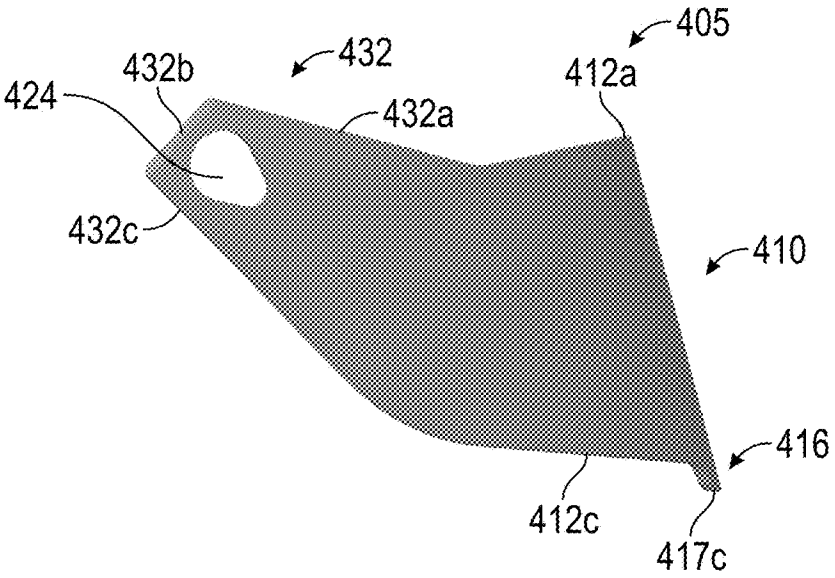
FIG. 33 is a right side view of the visor of FIG. 30.
Figure 34:
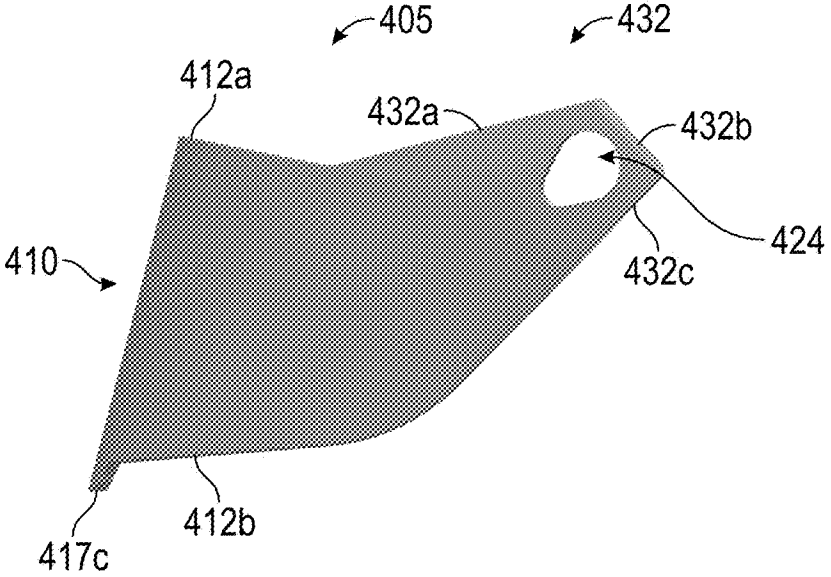
FIG. 34 is a left side view of the visor of FIG. 30.
Figure 35:
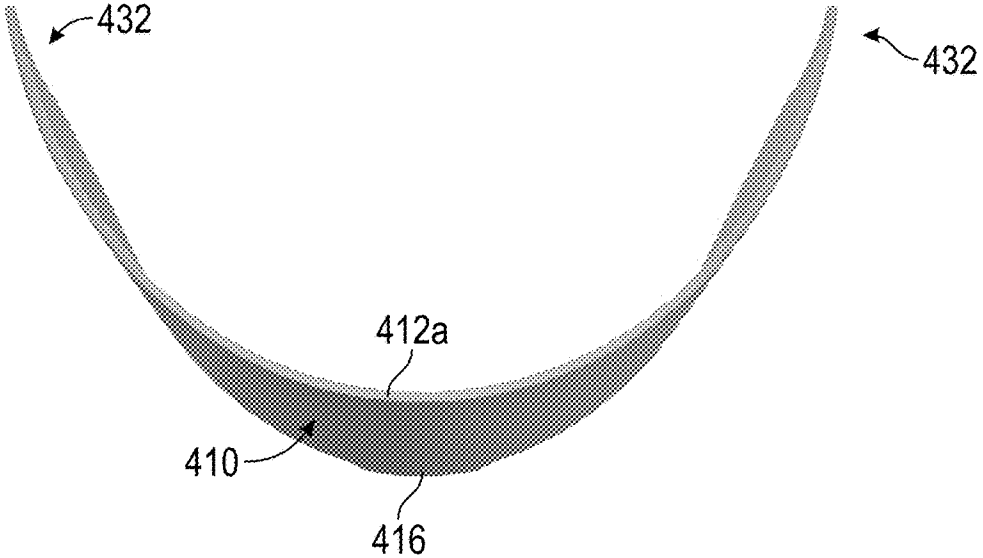
FIG. 35 is a top view of the visor of FIG. 30.
Figure 36:
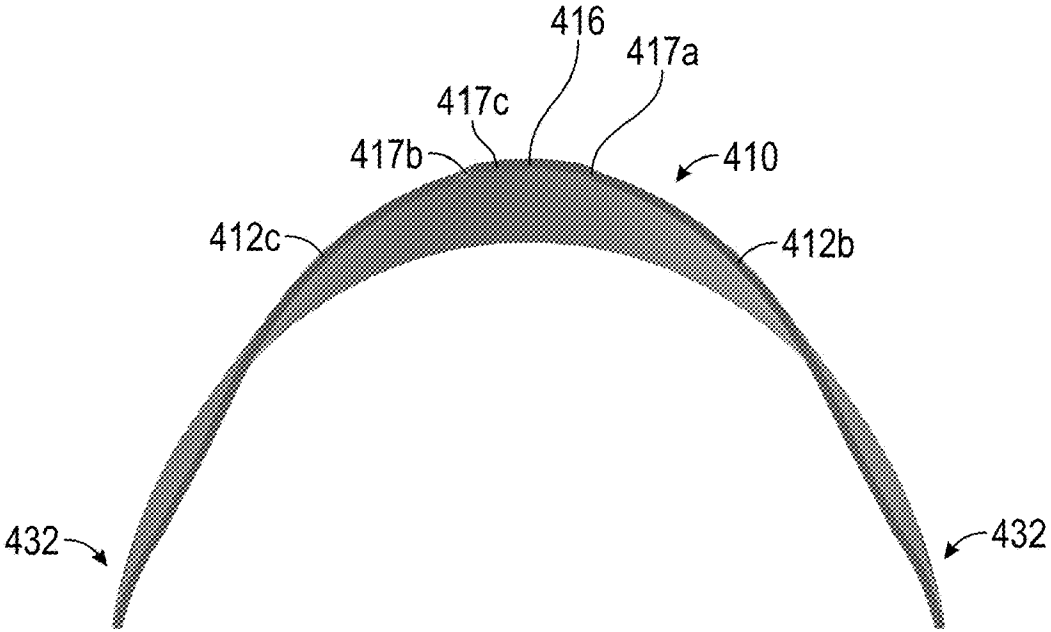
FIG. 36 is a bottom view of the visor of FIG. 30.
Figure 37:
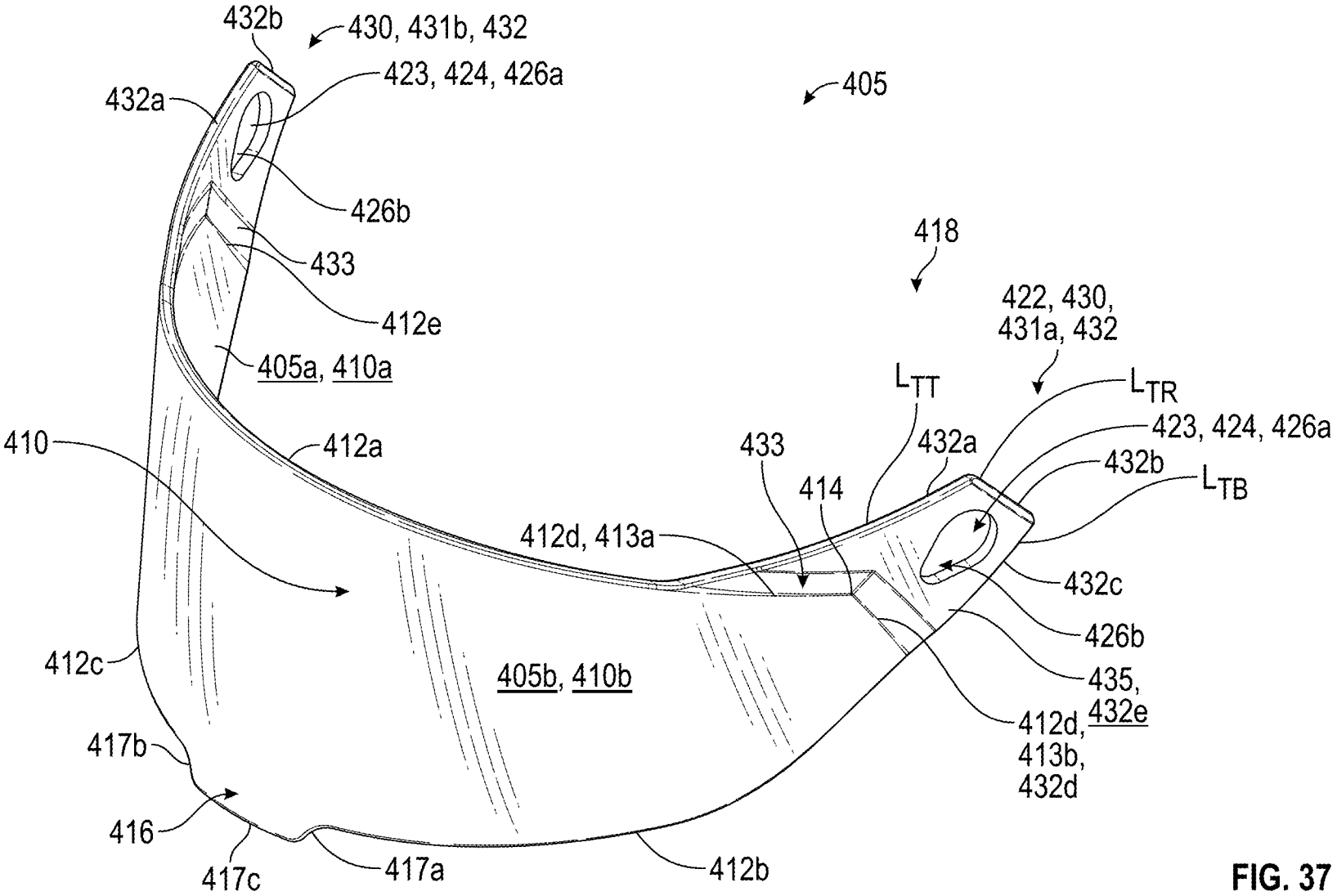
FIG. 37 is a perspective view of the first embodiment of the visor of the protective sports helmet of FIG. 1, wherein the visor is shown in a line drawing format.
Figure 38:
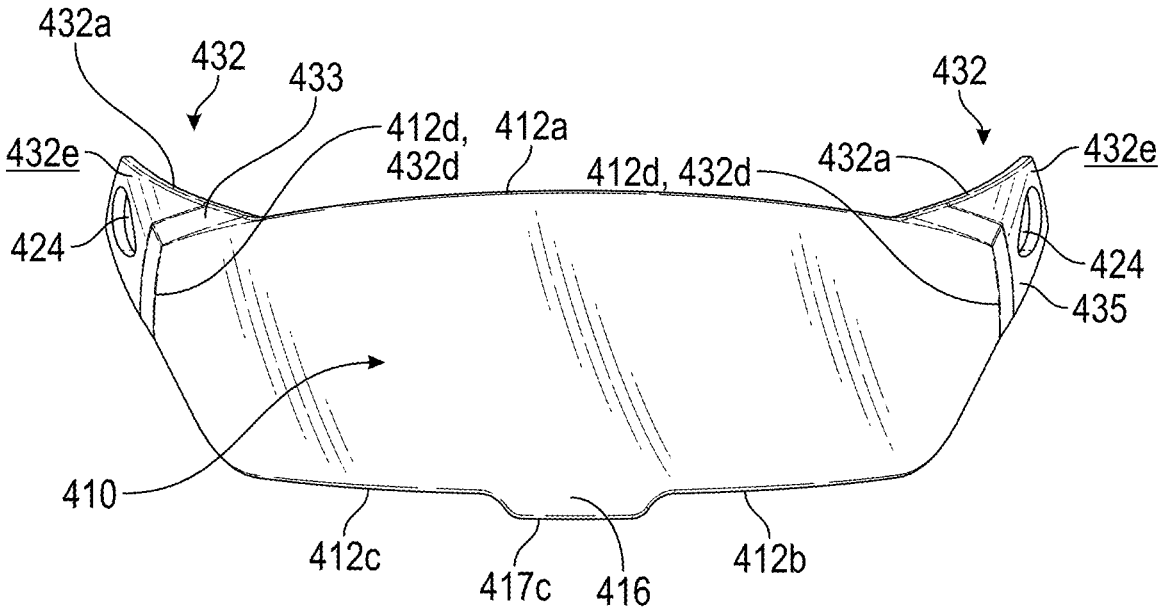
FIG. 38 is a front view of the visor of FIG. 37.

Unlike the conventional helmet 9010 that is shown in FIGS. 138, 140 and 142, the shell 12 does not include vent openings that are not formed as part of the impact attenuation system 40. In other words, the shell 12 does not include vent openings that are isolated openings in the shell 12. Instead, each opening in the shell 12 is connected by a gap to at least one other opening. For example and referring to FIGS. 16, 17 and 20, the left and right openings 48*a*, 48*b* in the front region 20 of the shell 12 are connected to the lateral segment 52. In this manner, the left and right openings 48*a*, 48*b* provide the end points for the frontal gap 46. The frontal opening 147*a* is connected to a forward extent of the frontal gap 147 of the side opening 146, and the rear side opening 149 is connected to a rear extent of the rear gap 148 of the side opening 146. Referring to FIG. 18, the lower left and right rear openings 245*a*, 245*b* are connected to the rear lateral segment 249. In other embodiments, the shell 12 may have one or more vent openings that are completely isolated.

1. Front Cantilevered Segment

The front cantilevered segment 44 depends downward from an upper extent of the front shell portion 20 near the interface between the front portion 20 and the crown portion 18. Referring to FIGS. 1-29, the cantilevered segment 44 includes a base 54 and a distal free end 58, and approximates the behavior of a living hinge when a substantially frontal impact is received by the front shell portion 20. The lowermost edge of the free end 58 is positioned approximately 1.5-2.5 inches, preferably 2.0 inches from the central frontal edge 14*c*, wherein the lower frontal region 20*a* of the front shell portion 20 is there between. As shown in the Figures, the lower frontal region 20*a* is an extent of the front portion 20 of the shell 12 that resides below the cantilevered segment 44 and above the central frontal edge 14*c* of the shell 12. The front opening 46 is generally U-shaped with an upward orientation. The opening 46 has a complex geometry with several distinct segments. A right frontal opening 49*b* extends downward and outward from a right frontal opening edge 49*a* towards the right side of the front shell portion 20. A right frontal segment 49*c* extends downward and inward from the right frontal segment 49*b* to a generally lateral segment 52. Similarly, a left frontal opening 50*b* extends downward and outward from a left frontal opening edge 50*a* towards the left side of the front shell portion 20. A left frontal segment 50*c* extends downward and inward from the left frontal opening 50*b* to the lateral segment 52. The lateral segment 52 extends between the left and right frontal segments 49*c*, 50*c*. The lowermost point of the lateral segment 52 is positioned approximately 1.5-2.5 inches, preferably 2.0 inches from the central frontal edge 14*c*.

In the illustrated embodiment, the lateral segment 52 forms an obtuse inner angle with the respective left and right frontal segments 49*c*, 50*c*. Although the illustrated frontal segments 49*c*, 50*c* and the lateral segment 52 are substantially linear, these segments can be configured as curvilinear, a combination of curvilinear and straight segments has a curvilinear inner edge and a straight outer edge, or have a curvilinear outer edge and a straight inner edge. Additionally, the edges of the frontal segments 49*c*, 50*c* and lateral segment 52 may be parallel, a portion of the edges may be parallel, or none of the edges may be parallel. Furthermore, the opening 46 may be formed by fewer or greater than the three segments 49*c*, 50*c*, and 52. Moreover, the size of the left and right frontal openings 49*b*, 50*b*, left and right frontal segments 49*c*, 50*c*, and lateral segment 52 may be enlarged or reduced.

Although the illustrated opening 46 does not contain a material disposed between the edges of the opening 46, it should be understood that a material may be disposed of within this opening 46. For example, the material may be only coupled to the shell 12 or may be formed as a part of the internal energy attenuation assembly 600. This material may have a Young's modulus that is lower than the Young's modulus of the material that shell 12 is made from, such that the material will not interfere with the function of the front cantilevered segment 44. In a further alternative embodiment, the material may not be disposed within the opening 46, and instead, a layer may be coupled to the shell 12 or the internal energy attenuation assembly 600. This layer may be: (i) air permeable and water impermeable, (ii) air and water impermeable, (iii) have a Young's modulus that is lower than the Young's modulus of the shell 12.

2. Side Cantilevered Segment

The side cantilevered segments 144 extend upward from a lower extent of the side shell portion 24 towards the crown portion 18. These cantilevered segments 144 includes a base 154 and a distal free end 158. At least an extent of the periphery of the cantilevered segments 144 is defined by a side gap or opening 146 formed in the shell 12. The side gap or opening 146 has a generally C-shaped configuration and is comprised of a front segment 147 and a rear segment 148. The frontal gap or segment 147 extends rearward from a frontal opening 147*a* and towards the raised central band 62. The edges that border/define the first gap segment 147 have a curvilinear aspect. The frontal opening 147*a* is not circular and instead has a periphery comprised of multiple substantially linear edge segments. As shown in the Figures, this frontal opening 147*a* has a substantial size and is nearly the size of the car opening 30. The second gap or segment 148 extends rearward from the frontal gap or segment 147 and towards the rear raised band 70. The edges that border/define the second gap segment 148 are not parallel with one another and have a curvilinear aspect. In particular, the width of the second gap segment 148 or distance between the edges that border/define the gap 148 increase from the front to the rear of the shell 12. The rear side opening 149 extends downward and forward from the second gap segment 148. The edges that border/define the rear side opening 149 are not parallel with one another and have a substantially linear configuration. The width of the second gap segment 148 or distance between the edges that border/define the gap 148 decrease from the rear to the front of the shell 12 and intersect with one another just rearward of the car opening 30. The upper edge of the second gap segment 148 is positioned adjacent to an extent of the sidewall 66*a* of the raised central band 62, while the rearward edge of the rear side opening 149 is positioned adjacent to an extent of the transverse band 70. The first and second gap segments 147, 148 meet at a point that is positioned over the car opening 30 and form an obtuse angle with one another.

Although the illustrated first and second segments 147, 148 have a curvilinear aspect, these segments 147, 148 can be configured as substantially linear, a combination of curvilinear and straight segments, has a curvilinear inner edge and a straight outer edge, or have a curvilinear outer edge and a straight inner edge. Additionally, the edges of the segments 147, 148 may be parallel, a portion of the edges may be parallel, or none of the edges may be parallel. While the rear side opening 149 has substantially linear aspects, this segment may have a curvilinear aspect, a combination of curvilinear and straight segments, has a curvilinear inner edge and a straight outer edge, or have a curvilinear outer edge and a straight inner edge. Additionally, the edges of the segments 147, 148 may be parallel, a portion of the edges may be parallel, or none of the edges may be parallel. Furthermore, the opening 146 may be formed by fewer or greater than the two segments 147, 148. Moreover, the front opening 147*a* may be enlarged or reduced. In addition, the multiple substantially linear edge segments of the front opening 147*a* may be replaced by curvilinear edge segments or a combination of curvilinear and linear edge segments. Although the illustrated opening 146 does not contain a material that is disposed between the edges of the opening 146, it should be understood that a material may be disposed within this opening 146. For example, the material may be only coupled to the shell 12 or may be formed as a part of the energy attenuation assembly 600. This material may have a Young's modulus that is lower than the Young's modulus of the material that the shell 12 is formed from, such that this material will not interfere with the movement of the side cantilevered segment 144. In a further alternative, material may not be disposed within the opening 146, and instead, a layer may be coupled to the shell 12 or the energy attenuation assembly 600. This layer may be: (i) air permeable and water impermeable, (ii) air and water impermeable, (iii) have a Young's modulus that is lower than the Young's modulus of the shell 12.

3. Rear Cantilevered Segment

The rear cantilevered segment 244 depends downward from an upper extent of the rear shell portion 22 and more specifically it depends downward from an upper point of the rear raised band 70. Referring to FIGS. 3, 10, 18, and 25, the cantilevered segment 244 includes a base 254 and a distal free end 258, and approximates the behavior of a living hinge when a substantially rear impact is received by the rear shell portion 22. The lowermost edge of the free end 258 is positioned above the lower rear edge of the shell 14*d*. As such, a lower rear region 22*a* is an extent between the lowermost edge of the free end 258 and the lower rear edge 14*d* of the shell 12. The rear opening 246 is generally U-shaped. The rear opening 246 has a complex geometry with several distinct segments. A right rear segment 246*a* extends between an upper right rear opening 245*a* and terminate at a lower right rear opening 248*a*. The path the right rear segment 246*a* follows is downward and outward towards the right side of the shell portion 24. The lower right rear opening 248*a* is substantial, as it is nearly the size of the car opening 30, and it does not have a circular periphery. Instead, the periphery of the lower right rear opening 248*a* is comprised of multiple (e.g., 5) substantially linear edge segments. A left rear segment 246*b* extends between an upper left rear opening 245*b* and terminate at a lower left rear opening 248*b*. The path the left rear segment 246*b* follows is downward and outward towards the left side of the shell portion 24. The lower left rear opening 248*b* is substantial, as it is nearly the size of the car opening 30, and it does not have a circular periphery. Instead, the periphery of the lower left rear opening 248*b* is comprised of multiple (e.g., 5) substantially linear edge segments.

The lower right rear opening 248*a* and lower left rear opening 248*b* are connected to one another by a rear lateral segment 249. The rear lateral segment 249 forms an obtuse angle with the second left and right segments 246*a*, 246*b*. Although the illustrated rear segments 246*a*, 246*b*, 249 are substantially linear, these segments can be configured as curvilinear or a combination of curvilinear and straight segments. Furthermore, the opening 246 may be formed by more or less than the three segments 246*a*, 246*b*, and 249. Moreover, the size of the upper rear left and right openings 245*a*, 245*b* and lower rear left and right openings 248*a*, 248*b* may be enlarged or reduced, and the multiple substantially linear edge segments may be replaced by curvilinear edge segments or a combination of curvilinear and linear edge segments. Although the illustrated opening 246 does not contain a material that is disposed between the edges of the opening 246, it should be understood that a material may be disposed within this opening 246. For example, the material is only coupled to the shell 12 or may be formed as a part of the energy attenuation assembly 600. This material may have a Young's modulus that is lower than the Young's modulus of the shell 12, such that the material will not interfere with the function of the rear cantilevered segment 244. In a further alternative, material may not be disposed within the opening 246. Instead, a layer may be coupled to the shell 12 or the energy attenuation assembly 600 to prevent the elements from entering into the interior of the helmet 10. This layer may be: (i) air permeable and water impermeable, (ii) air and water impermeable, (iii) have a Young's modulus that is lower than the Young's modulus of the shell 12.

ii. Raised Central Band, Transverse Band, Lower Channel

The shell 12 also includes an integrally formed raised central band 62 that extends from the front shell portion 20 across the crown portion 18 to the rear shell portion 22. The band 62 is defined by a pair of substantially symmetric raised sidewalls or ridges 66 that extend upwardly at an angle from an outer shell surface 11*b*. When viewed from the side, the sidewalls 66 define a curvilinear path as they extend across the crown portion 18 to the rear shell portion 22. The front portion of the band 62 is coincident with the energy attenuation member 42 and is positioned a distance above the central frontal edge 14*c*. Referring to FIGS. 1, 6, 8, 13, 15, 16, 23-25, and 28-29, the band 62 has a width that increases as the band 62 extends from the front shell portion 20 across the crown portion 18 to the rear shell portion 22. As shown in Figures, a rear portion of the band 62 is coincident with and merges with a rear raised band 70 that extends transversely between the left and right side portions 24 of the shell 12. The left sidewall 67*a* intersects with an upper left sidewall 72*a* of the transverse band 70, and the right sidewall 67*b* intersects with an upper right sidewall 72*b* of the transverse band 70, wherein each of these intersections defines a substantially right angle. A lower transverse sidewall 74 extends from the outer shell surface 11*b* along the length of the transverse rear band 70. As shown in FIGS. 4-5, 11-12, 19-20, 23, and 26-27, the lower transverse sidewall 74 includes a lateral segment 74 aligned with the lateral band segment and a tapered segment leading to and aligned with the terminal end of the rear raised band 70. Similar to the sidewalls 66, the rear band sidewalls 72, 74 also extend outwardly and upwardly at an angle from the outer shell surface 11*b*.

D. Visor System

The visor system 400 includes multiple components to provide an optical lens that the player P looks through when the helmet 10 is worn by the player P. The visor system 400 is comprised of a visor main body or central portion 410 and a visor attachment assembly 418 that couples the visor 405 to the shell 12. The visor attachment assembly 418 is described in greater detail below, but at a high level this assembly 418 provides a "tool-less" connection between the visor main body 410 and the shell 12. This "tool-less" connection means that no unique tool is required for coupling the visor system 400 to the shell 12 or removing it from the shell 12. In fact, the visor 405 can be disconnected from the shell 12 by applying forces on the visor system 400 using the player/operators/installer hands. By allowing for the removal of the visor 405 by the player/operators/installer hands and without a tool, the visor 405 can be quickly changed (e.g., between plays) during a game or practice. This provides a substantial benefit over conventional shields 9005, like the shield shown in FIG. 142. Also, unlike conventional shields 9005, the visor system 400 is not coupled to the lower chin bar assembly 500 with conventional faceguard fasteners 9006. This provides multiple benefits, which include: (i) eliminating components that are coupled to the frontal and exterior extents of the helmet 10 that are subject to high impact rates, (ii) the movement and/or deformation of the visor 405 is not inhibited or constrained by the faceguard, and (iii) other benefits that are obvious to one of skill in the art.

As best shown in FIGS. 2, 4-5, 62, 64, 66, 68, and 70, the visor 405 spans the entire horizontal distance of the frontal edge 14*c*. In contrast, the conventional shield 9005 (e.g., shield shown in FIG. 142) does not span this entire distance. Spanning the entire distance of the frontal edge 14*c* is beneficial because: (i) the visor 405 covers the entire field of view of the player P, which helps ensure that the player P does not experience optical shifts or changes when looking through the conventional shield 9005 and then looking through the opening 9003 that is positioned between the conventional shield 9005 and the edge of the shell 9012, (ii) provides additional protection for the player's eyes, (iii) eliminates the possibility that other player's may insert their fingers within the opening 9003, (iv) increases the durability/reduces failures of the visor 405, and (v) other benefits that are obvious to one of skill in the art.

Also, as best shown in FIGS. 2, 4-5, 62, 64, 66, 68, 70, 127*a*, 127*b*, and 129 the visor 405 spans a majority of the face guard height $H_{FG}$ that extends between the frontal edge 14*c* and an upper extent of the lower chin bar assembly 500. Spanning a majority of the face guard height $H_{FG}$ provides similar benefits to the benefits associated with spanning the entire distance between the left and right side edges 14*a*, 14*b* of the shell 12. Additionally, unlike conventional shields 9005, the visor 405 does not include projections that are sandwiched between an extent of the front region of the shell and the faceguard. In the embodiment shown in the Figures, no portion of the visor 405 is positioned: (i) above the frontal edge 14*c* of the shell 12 and (ii) forward of either of the frontal opening 147*a* and the left/right frontal openings 49*a*, 49*b* of the frontal energy attenuation member 42. Instead, the top edge 412*a* of the main body 405 is substantially parallel with and complements the frontal edge 14*c* of the shell 12. In an alternate embodiment (not shown), the visor 405 is modified to include an upwardly extending tab that overlies a minor extent of the lower frontal shell portion 22*a*. Referring to at least FIG. 8, this tab would likely be located between the visor protrusion section 44 and a frontal bumper 300 of the shell 12. Like the bumper 300, this tab can be dimensioned large enough to accommodate logos, symbols or indicia-such as the visor manufacturer name, visor model name or number, player name, team name of the player and/or symbols.

As described above, the visor 405 spans a majority of the frontal opening 16 that is positioned above the lower chin bar assembly 500. However, as best shown in FIG. 141, the visor 405 does not span the entirety of this opening 16 that is positioned above the lower chin bar assembly 500 because there is a small chin strap opening 402 that is formed between the bottom edge 14*b*, 14*c* of the visor 405, the lower chin bar assembly 500, and the side edges 14*a*, 14*b* of the shell 12. This chin strap opening 402 is designed and configured to receive an extent of the chinstrap assembly 700 and namely an extent of an elongated member 704*a*. Thus, when the chin strap and visor 405 are coupled to the shell 12, an extent of the chin strap is positioned below an extent of the visor 405 and specifically the bottom edge 412*b*, 412*c*. By placing the chin strap within this chin strap opening 402, the chin strap does not obstruct the player's P field of vision and helps ensure that undue stresses are not placed on the strap, shell 12, or chin bar assembly 500. In contrast, the chin strap and shield 9005 associated with a conventional helmet 9010 does not place an extent of the chin strap below an extent of the shield 9007. It should be understood that in other embodiments: (i) the size of this opening may be enlarged or reduced, (ii) the opening 402 may be omitted, (iii) the opening 402 may be formed in only an extent of the shell 12, and/or (iv) the opening 402 may have a different shape (e.g., slot, circular, square, triangular, or any other similar polygonal shape).

In the embodiment described above and shown in FIG. 127*b*, the visor 405 does not span the entirety of the frontal opening 16. In fact, the central height $H_{CV}$ of the visor 405 spans less than 75% of the height $H_{FO}$ of the frontal opening 16 and preferably about 60% of frontal opening height $H_{FO}$. Specifically, the height that spans from the top edge 412*a* of the visor 405 to the bottom edge 147*c* of the central projection is between 2.25 inches and 4.5 inches and preferable 3.25 inches, while the frontal opening height $H_{FO}$, which extends between the frontal edge 14*c* and the lowermost point of the side edge 14*a*, 14*b* is between 4.5 inches and 6.5 inches and preferable 5.5 inches. In contrast, conventional hockey shield typically span the entirety of the frontal opening of a conventional hockey helmet. In fact, some conventional shields have lower edges that are positioned below the lowermost extent of the hockey helmet shell. These conventional hockey helmet shields have this configuration because conventional hockey helmets typically do not include substantial ear flaps or shell regions that extend over and protect the player's mandible or lower jaw bone.

A majority of the visor system 400 (e.g., the visor main body 410) may be comprised of polycarbonate, a combination of polycarbonate and Lexan, Plutonite, or any other known material that may be used in connection with optical shields for helmets or safety glasses. The visor system 400 may be manufactured using any known process, including injection molding, subtractive manufacturing (e.g., CNC), or additive manufacturing (e.g., 3D printing). It should be understood that various alterations or modifications to the visor system 400 are contemplated by this disclosure, some of which are described below and others will be obvious to one of skill in the art based on this disclosure.

1. Main Body of the Visor

The visor 405 includes: (i) the main body or central portion 410 and (ii) visor-based engagement means 422. The main body 410 is designed to be an optical shield and has a configuration that matches or conforms with the curvature of the frontal region 20 of the helmet shell 12. In particular, this conformance is generally accomplished by the main body 410: (i) substantially matching the curvature of the frontal shell region 20, (ii) having an outer surface 405*b* that is substantially flush with an extent of the outer surface 11*b* of the shell 12, namely in the frontal shell region 20, while in the connected position $P_C$, and (iii) having an inner surface 405*a* that is substantially flush with an extent of the inner surface 11*a* of the shell 12, namely in the frontal shell region 20, while in the connected position $P_C$. By conforming with the curvature of the helmet shell 12, the visor 405 provides an aesthetically pleasing appearance without requiring that the visor 405 be bent or deformed a substantial extent to complement the curvature of the frontal shell region 20 which is typically required when connecting a conventional shield 9005 to a helmet 9010. By eliminating or greatly reducing the stresses that are placed on the visor 405 in the connected position $P_C$, the durability of the visor 405 is increased and the visor 405 provides a lens that is optically correct. Additionally, this configuration of a visor 405 is vastly different than conventional shields 9005 that are typically used on football or hockey helmet because the inner surfaces of these shields are typically placed in front of the outer surface of the shell such that the conventional shield overlies the outer shell surface—this positional relationship does not permit either: (i) the outer surfaces of the shell and shield to be flush with one another or (ii) the inner surface of the shell and shield to be flush with one another.

It should be understood that the main body 410 may still substantially conform to the curvature of the helmet shell 12 without having each and every one of the above attributes. For example, the main body 410 may still conform to the curvature of the helmet shell 12 if: (i) a substantial percentage of the outer surface 405*b* is not flush with an extent of the outer surface 11*b* of the shell 12 in the connected position $P_C$, or (ii) a substantial percentage of the inner surface 405*a* is not flush with an extent of the inner surface 11*a* of the shell 12 in the connected position $P_C$. These substantial percentages may not be flush or match in order to: (i) create an optically correct visor, (ii) aid in the venting of the visor, and/or (iii) reduce failures (e.g., cracking of the visor 405) upon an impact.

Referring to FIGS. 127-134, the main body 410 or optical extent of the visor 405 may be placed at an angle in comparison to the player's NOLS. In particular, this angle is shown in FIGS. 132*b* and 134 as ¿, epsilon that extends between the NLOS and the outer surface 410*b* of the visor main body 410 is between 95 degrees and 140 degrees and preferably 105 degrees. In contrast, this outer angle in a conventional football helmet 9010 is typically nearly 90 degrees. Increasing this angle is beneficial over conventional helmets because it aids in providing an optically correct lens and the venting of the helmet 10. Also, as shown in at least FIGS. 33-36, 40-43, 54, 62-70, and 127*a*-136, the main body 410 or optical extent of the visor 410 has a conical shape with a substantially linear inner and outer surfaces 405*a*, 405*b*. Said surfaces 405*a*, 405*b* are substantially parallel to one another along a cross-section of the visor 405. As such, the main body 410 or optical extent of the visor 405 may have a substantially uniform thickness, which may be equal to or greater than 1 mm and preferably greater than 2 mm. In other embodiments, the main body 410 or optical extent of the visor 405 may have a parabolic, spherical, cylindrical, toroidal, aspheric, or free-form configuration. In these embodiments, the inner and outer surfaces 405*a*, 405*b* may not be linear and instead may have a curvilinear shape. In fact, the curvature of the main body 405 in this alternative embodiments may vary or change horizontally and/or vertically across the main body 405. Additionally, the main body 410 or optical extent of the visor 405 may not have a substantially uniform thickness and the inner and outer surfaces 405*a*, 405*b* may not be parallel with one another. For example, the inner surface 405*a* may have a greater curvatures than the curvature of the outer surface 405*b*.

Figures 11, 12:
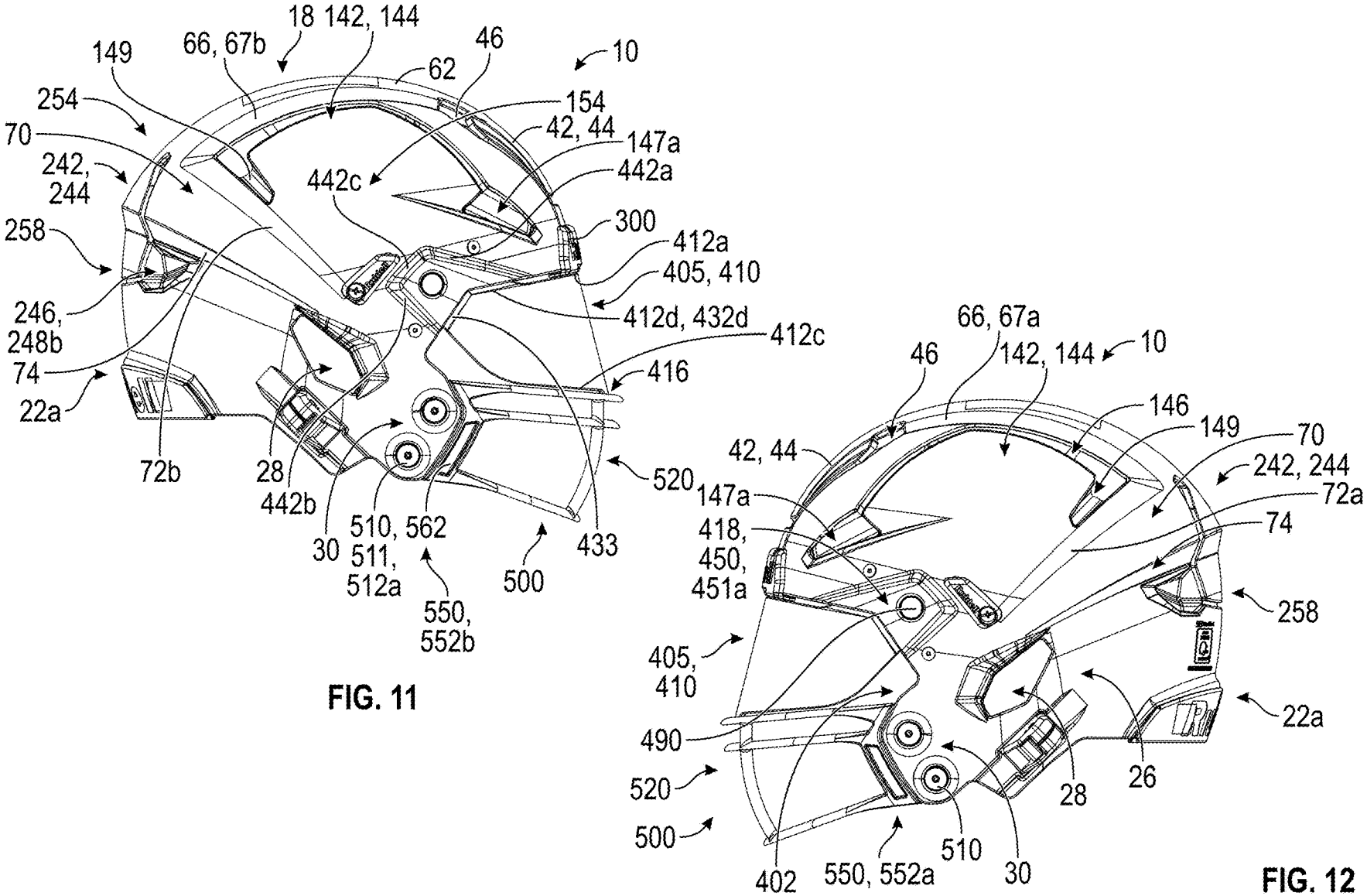
FIG. 11 is a right side view of the protective sports helmet of FIG. 8.
FIG. 12 is a left side view of the protective sports helmet of FIG. 8.
Figure 14:
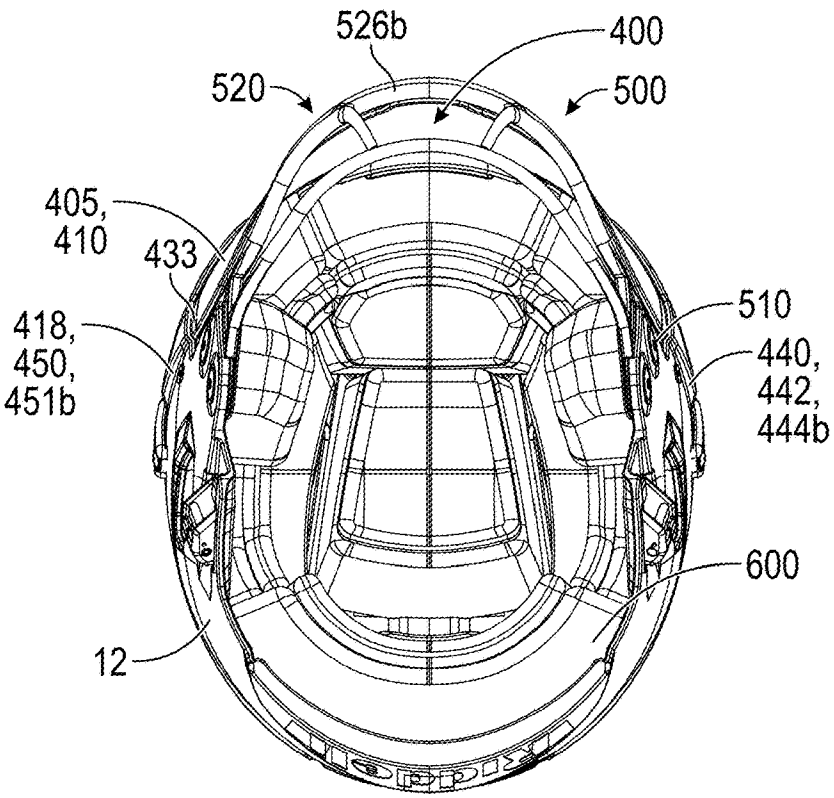
FIG. 14 is a bottom view of the protective sports helmet of FIG. 8.
Figure 13:
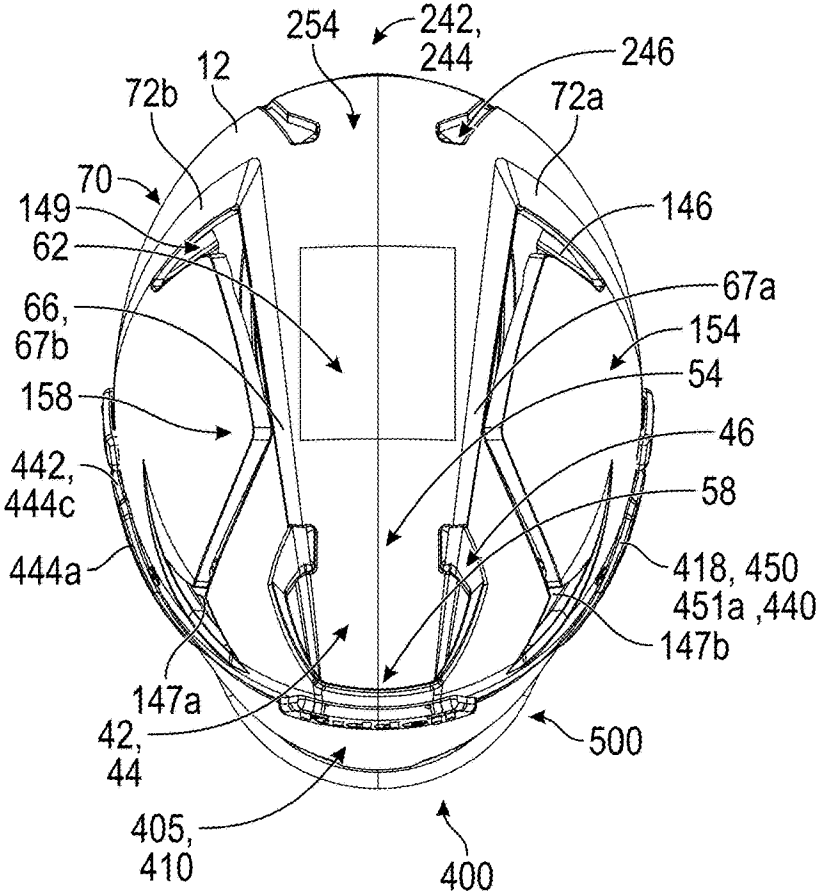
FIG. 13 is a top view of the protective sports helmet of FIG. 8.
Figure 15:
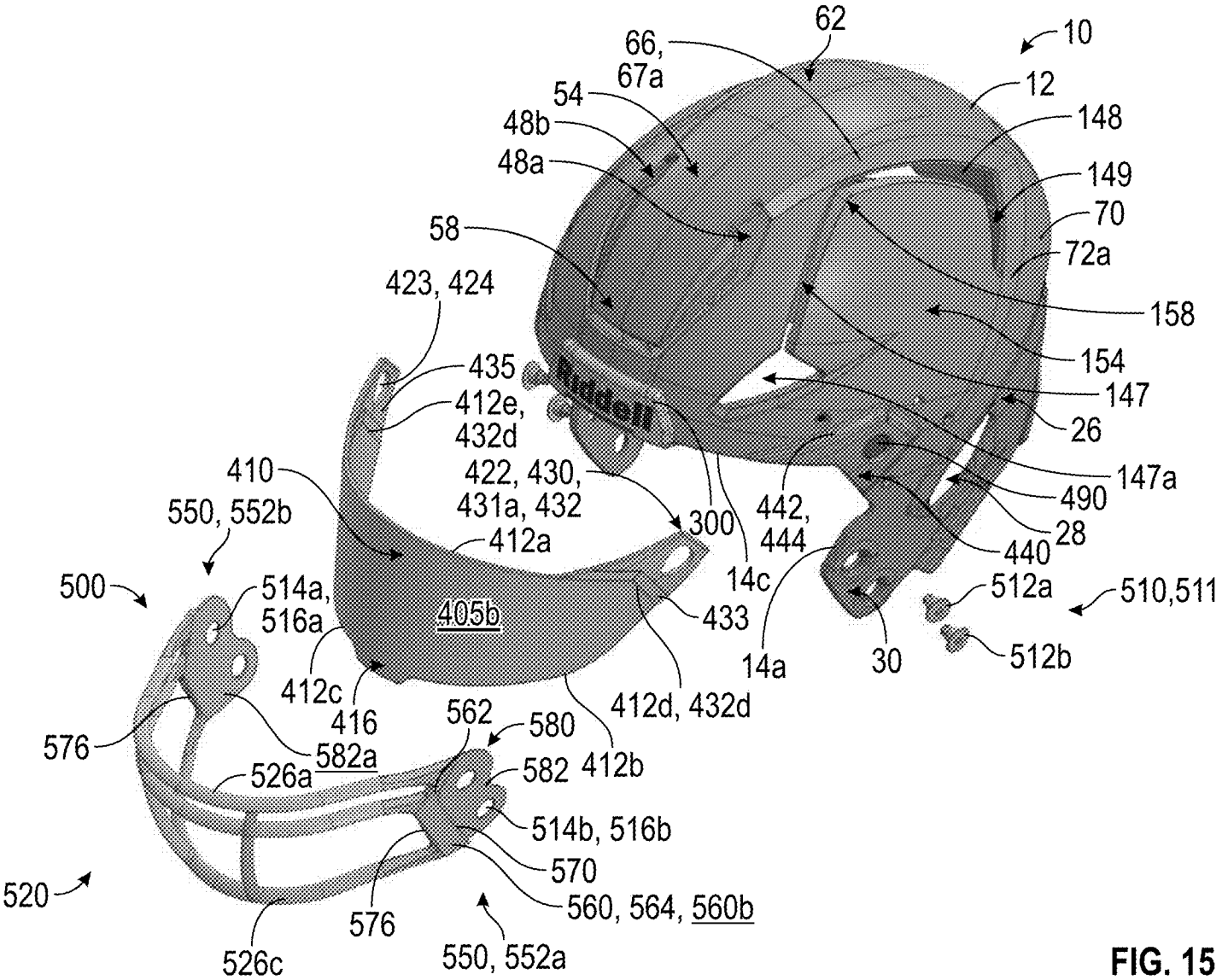
FIG. 15 is an exploded view of the protective sports helmet of FIG. 1, wherein the visor system is in a disconnected position $P_D$.
Figure 16:
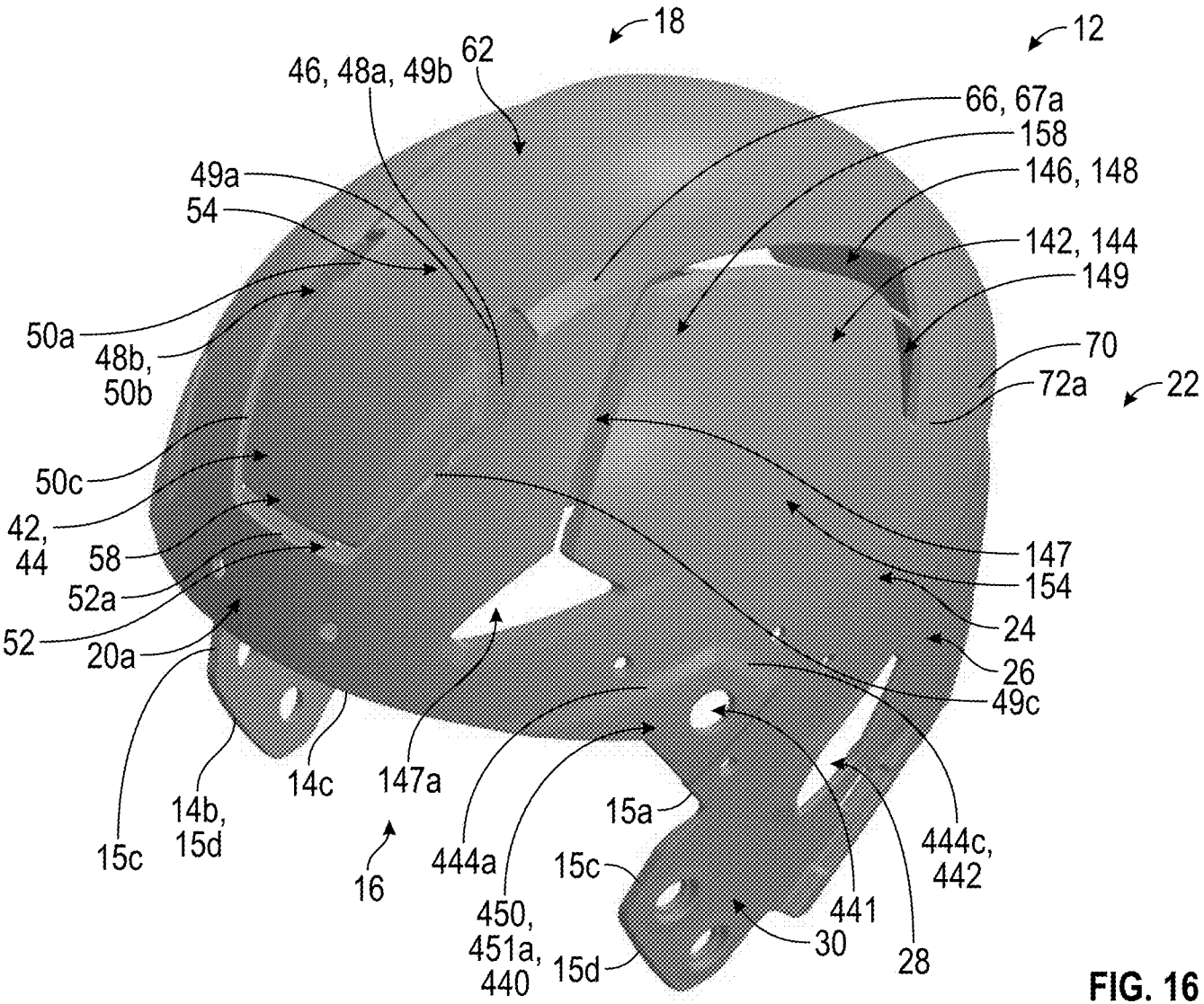
FIG. 16 is a perspective view of the helmet shell of the protective sports helmet of FIG. 1.

The main body 410 is typically not a corrective lens and has a dioptric power of less than 0.25 diopters, preferably less than 0.12 diopters, and most preferably less than 0.06 diopters. The main body 410 may have a reverse/negative pantosope tilt, a forward/positive pantosope tilt, or no pantoscope tilt. The main body 410 of the visor 405 provides a substantial extent, if not the entirety, of the optical lens that the player P will look through when the helmet 10 is placed on the player's head. The main body 410 has: (i) has a top edge 412*a* that extends between the visor-based engagement means 422, (ii) left and right bottom edges 412*b*, 412*c* that extend between the visor-based engagement means 422 and the central projection 416, and (iii) left and right side edges 412*d*, 412*e* that abut a portion of the visor-based engagement means 422 and extent between the top edge 412*a* and a respective bottom edge 412*b*, 412*c*. In this embodiment, the left and right side edges 412*d*, 412*e* include two portions, wherein: (i) a first portion 413*a* extends rearward from the top edge 412*a* and is substantially aligned therewith and (ii) a second portion 413*b* that extends between rearmost point 414 of the first portion 413*a* and the rearmost point of the bottom edge 412*b*, 412*c*. As best shown in FIG. 11, the first and second portions 413*a*. 413*b* are: (i) positioned near the side edges 14*a*, 14*b* and frontal edge 14*c* of the shell 12 and (ii) complement the shape or configuration of side edges 14*a*-14*c*. It should be understood that in other embodiments, the left and right side edges 412*d*, 412*e* may not be or the edges 412*d*. 412*e* may not be clearly defined. In such a situation, the edges 412*d*, 412*e* may be considered aligned with the edges 14*a*-14*c* of the shell 12 when the visor 405 is coupled thereto. Additionally, the left and right side edges 412*d*, 412*e* may not be substantially linear (e.g., may have a curvilinear configuration) and may be formed from more or less portions (e.g., between one and ten).

As best seen in FIGS. 1, 8, 30-36, and 39-43, the visor 405 includes a central projection 416 that extends from a bottom extent of the main body 410 and includes: (i) a first or left edge 417*a* that slopes downward and towards the center of the main body 410 from the left bottom edge 412*b*, (ii) a second or right edge 417*b* that slopes downward and towards the center of the main body 410 from the right bottom edge 412*c*, and (iii) an intermediate lower edge 417*c* that extends between the first or left edge 417*a* and the second or right edge 417*b*. The central projection 416 has a height that is between 0.1 inches and 0.75 inches. The central projection 416 is configured to be positioned below an extent of the lower chin bar assembly 500. This central projection 416 is designed to help ensure that upon an impact the visor 410 is not displaced over an extent of the lower chin bar assembly 500, which may break or crack the visor 405. In contrast to the visor 405 that is disclosed herein, a conventional shield 9005 does not typically have a central projection 416 because the shield is directly coupled to the conventional faceguard 9007 and as such there is no concern that the shield could be displaced over an extent of the faceguard 9007. It should be understood that the length and width of the lower projection 416 may be increased or decreased; thus, increasing or decreasing the size of the central projection 416. In other embodiments, the central projection 416 may be omitted, the bottom edge 412*b*, 412*c* may be thickened or a secondary material (e.g., metal) may be used to strengthen the main body 412, the central projection 416 may be configured to be received by a receiver attached to the lower chin bar assembly 500, or other combinations that are obvious to one of skill in the art based on this disclosure.

The optically correct extent of the visor 405 will be primarily contained within the main body 410 and as such other portions of the visor 405 may not be optically correct or even transparent. For example, the visor-based engagement means 422 may be coated or etched with substance that improves the mating or coupling of the shell 12 and the visor 405 easier, more durable, or aids in reducing rotational movement between the shell 12 and visor 405. Additionally, optical coatings that may be applied to the visor 405 may only be applied to the main body 410 or may be focused on the main body 410 while extending into other regions of the visor 405. Said optical coatings may: (i) aid in filtering out certain wavelengths of light in order to make the playing field, ball or other objects easier to see under certain conditions, (ii) reduce the fogging potential of the visor 405, (iii) increase the visor's durability (e.g., reduces cracking or scratches), (iv) make the visor easier to clean or protects it from certain cleaning products. Examples of such optical coatings include anti-reflection coatings, hard coatings, anti-static coatings, anti-fog coatings, some of which are described within U.S. patent application Ser. Nos. 16/896,016, 16/698,775, 16/417,311, 16/126,983, 15/359,317, 15/515,966, each of which are incorporated herein by reference. Further, the material composition, shape, number of layers, composition of said layers of the main body 410 may be different from the material composition, shape, number of layers, composition of said layers utilized within other parts of the visor 405. Some of the material compositions, shapes, number of layers, composition of said layers are described within the above U.S. patent applications Ser. No. that are incorporated herein by reference. However, it should be understood that this disclosure is not limited to just the information that is disclosed within those applications; but instead should include any compositions, shapes, layer numbers, compositions of layers that are known in the art or are obvious in light of what is known in the art.

As best shown in FIGS. 2, 4-5, 62, 64, 66, 68, and 70, the visor main body 410 nearly spans nearly the entire distance between the left and right side edges 14*a*, 14*b* of the shell 12. Along with spanning this distance, the top edge 412*a* of the visor main body 410 complements the shape of the frontal edge 14*c* of the shell 12. This may be accomplished by configuring: (i) the top edge 412*a* and the frontal edge 14*c* to have a substantially linear design, (ii) the top edge 412*a* is positioned adjacent to the frontal edge 14*c* of the shell 12, and/or (ii) the top edge 412*a* to be substantially parallel the frontal edge 14*c*. In contrast to the configuration of the visor main body 410 and the positional relationship of the main body 410 and the frontal shell edge 14*c*, a conventional shield 9005 typically does not have: (i) a top edge that is substantially linear design, (ii) a top edge that is positioned adjacent to the frontal edge of the shell, or (iii) a top edge that is substantially parallel with the frontal edge. In addition, conventional shields that are affixed to hockey helmets have a top edge that is not positioned adjacent to the frontal edge of the shell. Instead, the top edge of a typical conventional hockey helmet is positioned at a substantial distance away from the frontal edge of the shell to aid in the venting of the helmet, wherein said venting of a conventional hockey helmet presents different challenges than the venting of a football helmet. In an alternative embodiment, the top edge 412*a* of the main body 410 may have a curvilinear configuration. Said curvilinear configuration may be configured such that it is comprised of: (i) one curvilinear extent that has a substantially consistent arc path, or (ii) multiple or a plurality of curvilinear extents with similar or differing arc paths. It should be understood that if the top edge 412*a* has an alternative configuration then the frontal edge 14*c* of the shell 12 may have a different shape in order to complement the shape of the visor 405.

To aid in the venting of the helmet 10 in order to reduce the fogging of the visor 405, the top edge 412*a* of the main body 410 may have multiple recesses formed therein. For example, between 1 and 30 recesses may be formed therein with heights that vary between 0.03 inches and 0.75 inches (preferably between 0.1 inches and 0.05 inches). As such, the top edge 412*a* may not be substantially linear and may not match the frontal edge 14*c* of the shell 12. An example of these recesses formed in the top edge 412*a* of the main body 410 is included within U.S. Provisional Application Ser. No. 63/157,337, which is incorporated herein by reference. Alternatively or in addition to the recesses, the main body 410 may be moved such that there is a larger gap that is formed between the frontal edge 14*c* of the shell 12 and the top edge 412*a* of the main body 410. Formation of this larger gap may be created by moving: (i) the main body 410 forward of the outer surface 11*b* of the shell 12, (ii) inward of the inner surface 11*a* of the shell 12, (iii) downward and away from the frontal edge 14*c* of the shell 12. Still other methods of venting the helmet are contemplated by this disclosure to help ensure that the visor 410 does not fog during use. For example, the visor 405 may not span the entire distance between the left and right side edge 14*a*, 14*b* of the shell 12, the overall height of the main body 410 may be reduced, or other well-known methods may be utilized to improve the venting of the helmet 10.

As best shown in FIGS. 2, 4-5, 62, 64, 66, 68, and 70, the visor main body 410 spans a majority of the distance between the frontal edge 14*c* of the shell 12 and an upper extent of the chin bar assembly 500. By spanning a majority of this distance, the visor 405 protects the player's face and helps prevent other players from being able to grab an upper portion of the chin bar assembly 500. In addition to spanning this distance, the left and right bottom edges 412*b*, 412*c* complement the shape of an upper extent of the chin bar assembly 500. This may be accomplished by configuring: (i) the upper extent of the chin bar assembly 500 and the left and right bottom edges 412*b*, 412*c* to have a substantially linear design and positing said structures adjacent to one another, and/or (ii) the left and right bottom edges 412*b*, 412*c* to be substantially parallel an upper extent of the chin bar assembly 500. In an alternative embodiment, the lower edge (comprised of 412*b*, 412*c*, 417*a*, 417*b*, 417*c*) of the visor 405 may have a curvilinear configuration. Said curvilinear configuration may be configured such that it is comprised of: (i) one curvilinear extent that has a substantially consistent arc path, or (ii) multiple or a plurality of curvilinear extents with similar or differing arc paths. It should be understood that if the lower edge of the visor 405 has an alternative configuration then the upper extent of the chin bar assembly 500 may have a different shape in order to complement the shape of the visor 405. For example, if the center of the visor's lower edge is moved upward then the center of the upper extent of the chin bar assembly 500 may be moved upward.

2. Visor Attachment System

The visor attachment system 418 is designed to directly couple the visors main body 410 to the shell 12. Directly coupling of the visors main body 410 to the shell 12 is vastly different then indirectly coupling a conventional shield 9005 to the shell 9012 via the faceguard 9007. The direct coupling of the visor 405 to the shell 12 essentially allows the visor 405 to be structurally and functionally paired with the shell 12. This is beneficial because when the helmet 10 receives an impact, the visor 405 can flex, bend, and temporarily deform in a manner that is similar to, but not necessarily the same as, the shell 12, depending upon the physics of the impact(s) received by the shell 12. These substantially matching movements increases the durability of the visor 405 and improves the helmet's ability to absorb both linear and rotational impacts. In contrast, when conventional shield 9005 is directly coupled to the faceguard and indirectly to the shell and the helmet receives an impact, the shield will likely move in a different path and to a different extent then the shell. This decreases the durability of the shield and does not improve the helmet's ability to absorb impacts.

To facilitate the direct coupling, the visor attachment system 418 is comprised of two primary components: (i) the visor-based engagement means 422, and (ii) the helmet-based engagement means 438. As shown in the Figures, the entirety of the visor-based engagement means 422 is integrally formed with an extent of the main body 410 of the visor 405. However, in other embodiments that are not shown in the Figures: (i) part of the visor-based engagement means 422 may be integrally formed with the main body 410 and part of the visor-based engagement means 422 may not be integrally formed with the main body 410, or (ii) the entirety of the visor-based engagement means 422 may not be integrally formed with the main body 410. For example, the engagement means 422 may be a separate component coupled to the main body 410 after the fabrication of the main body 410. Unlike the visor-based engagement means 422, the entirety of the helmet-based engagement means 438 is typically not integrally formed with its associated structure-namely, an extent of the helmet shell 12. Instead and as shown in the Figures, a portion of the helmet-based engagement means 438 is integrally formed with the shell 12 and a portion of the helmet-based engagement means 438 is not integrally formed with the shell 12. However, in other embodiments that are not shown in the Figures: (i) the entirety of the helmet-based engagement means 438 may not be integrally formed with the shell 12, or (ii) the entirety of the helmet-based engagement means 438 may be integrally formed with the shell 12. For example, the entirety of the helmet-based engagement means 438 may not be integrally formed with the shell 12 because the visor protrusion segment 440 may be omitted.

i. Visor-Based Engagement Means

The visor-based engagement means 422 is shown in FIGS. 30-66 and is designed to interact with the helmet-based engagement means 438 in order to couple the visor 405 to the shell 12. The visor-based engagement means 422 includes a pair of lateral attachment members 430. The following disclosure will be simplified by only referring to and describing the left lateral attachment members 431*a*. However, it should be understood that the visor 405 and likewise the helmet 12 are formed from two symmetric hales. Thus, the following disclosure that focuses on the left lateral attachment member 431*a* applies in equal force to the right lateral attachment member 431*b*. The left lateral attachment member 431*a* is configured as a tab 432 that extends upward and outward from a side edges 412*d* of the visor 405. As best shown in FIGS. 30, 38, 42-45, an outer surface 432*e* of the tab 432 is not flush with the outer surface 405*b* of the visor 405. Instead, the tab's outer surface 432*e* is offset from the outer surface 405*b* via a beveled extent 433 to enable the outer surface 405*b* of the visor 410 to be substantially flush with the outer surface 11*b* of the shell 12. In other words, the outer surface 432*e* of the tab 432 is not flush with an outer surface 410*b* of the main body 410 due in part to the beveled extent 433.

Figure 39:
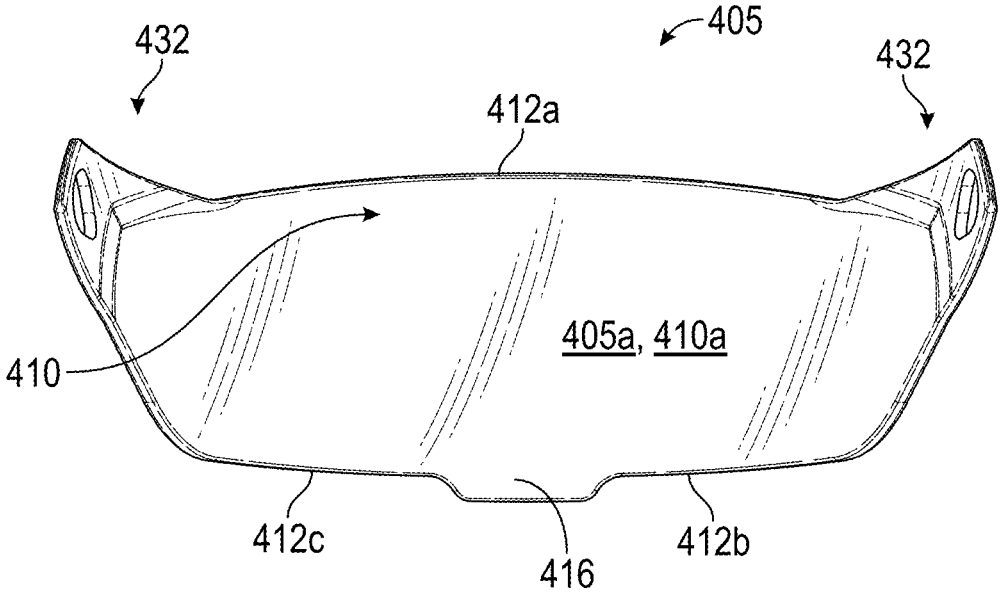
FIG. 39 is a rear view of the visor of FIG. 37.
Figure 40:
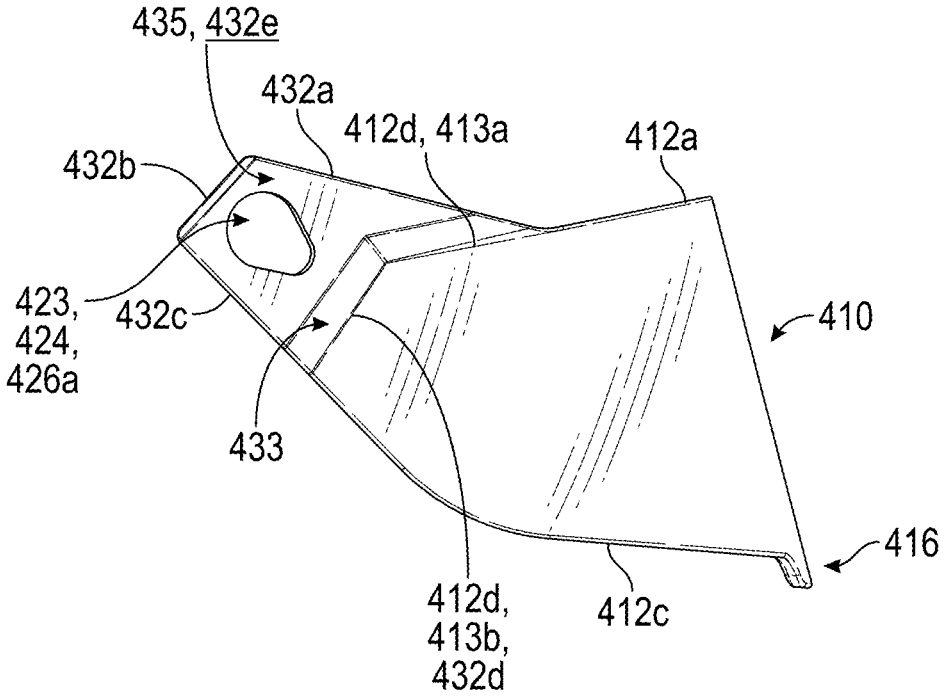
FIG. 40 is a right side view of the visor of FIG. 37.
Figure 41:
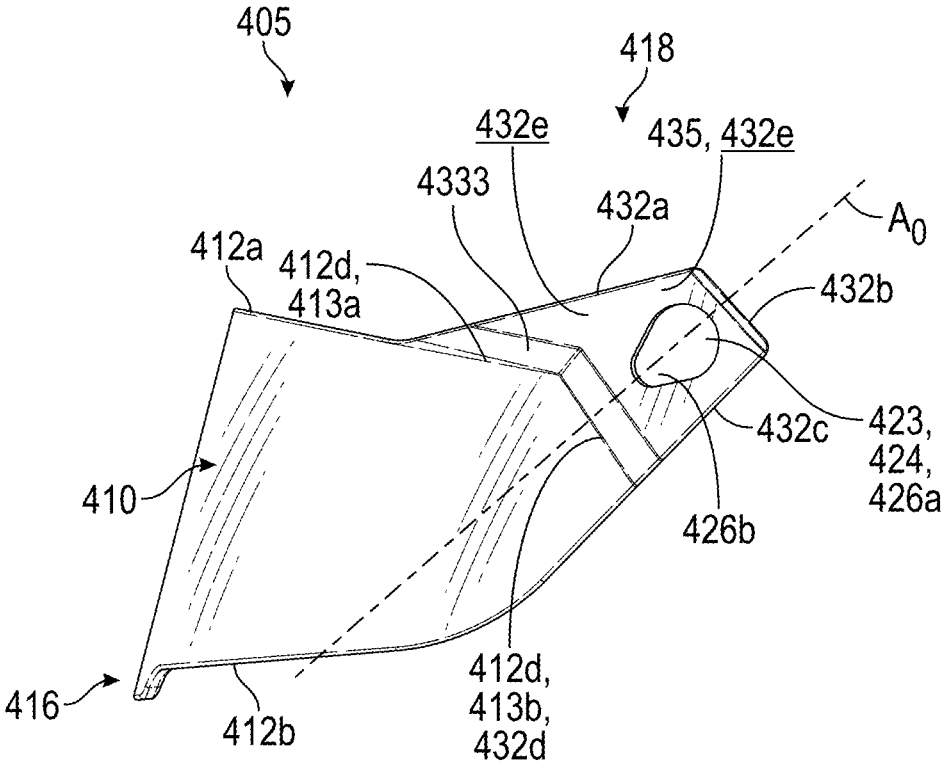
FIG. 41 is a left side view of the visor of FIG. 37.
Figure 42:
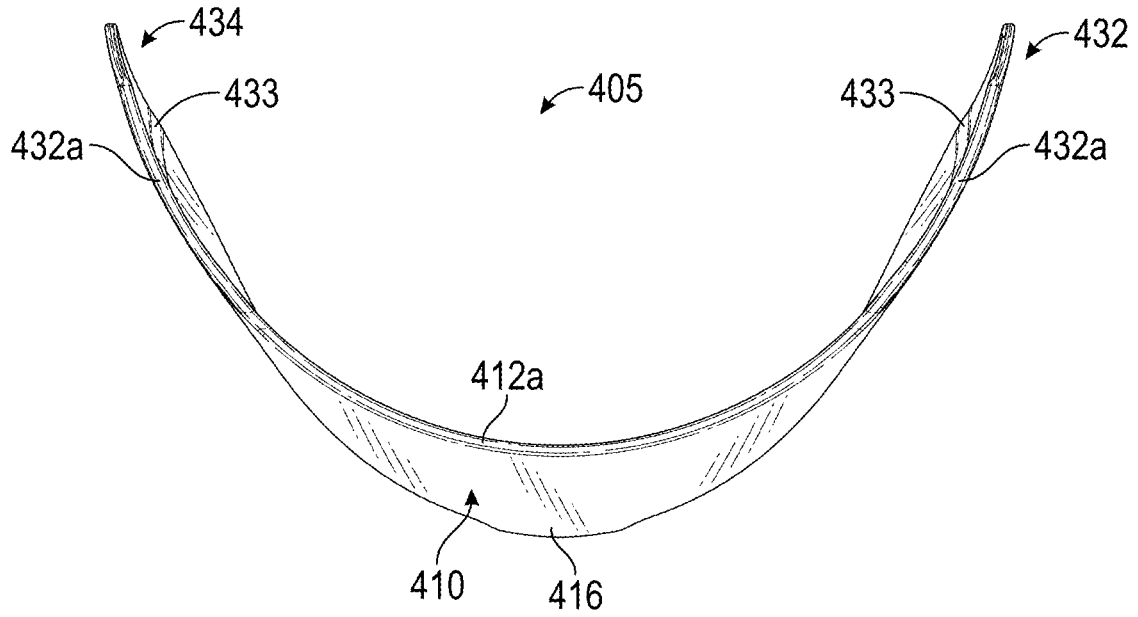
FIG. 42 is a top view of the visor of FIG. 37.
Figure 43:
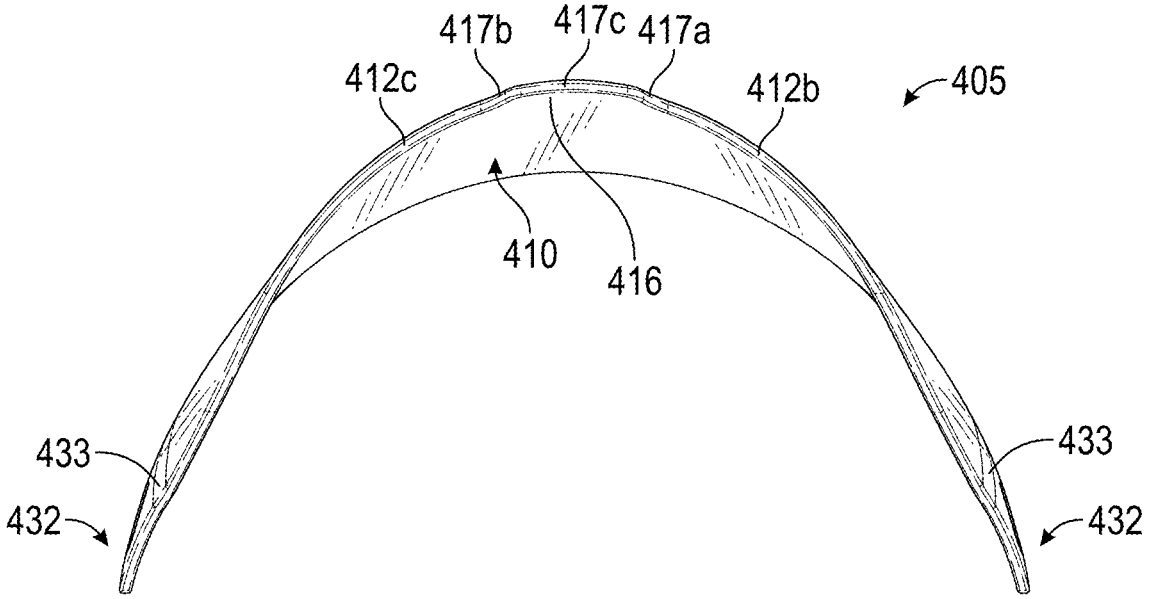
FIG. 43 is a bottom view of the visor of FIG. 37.
Figure 45B:
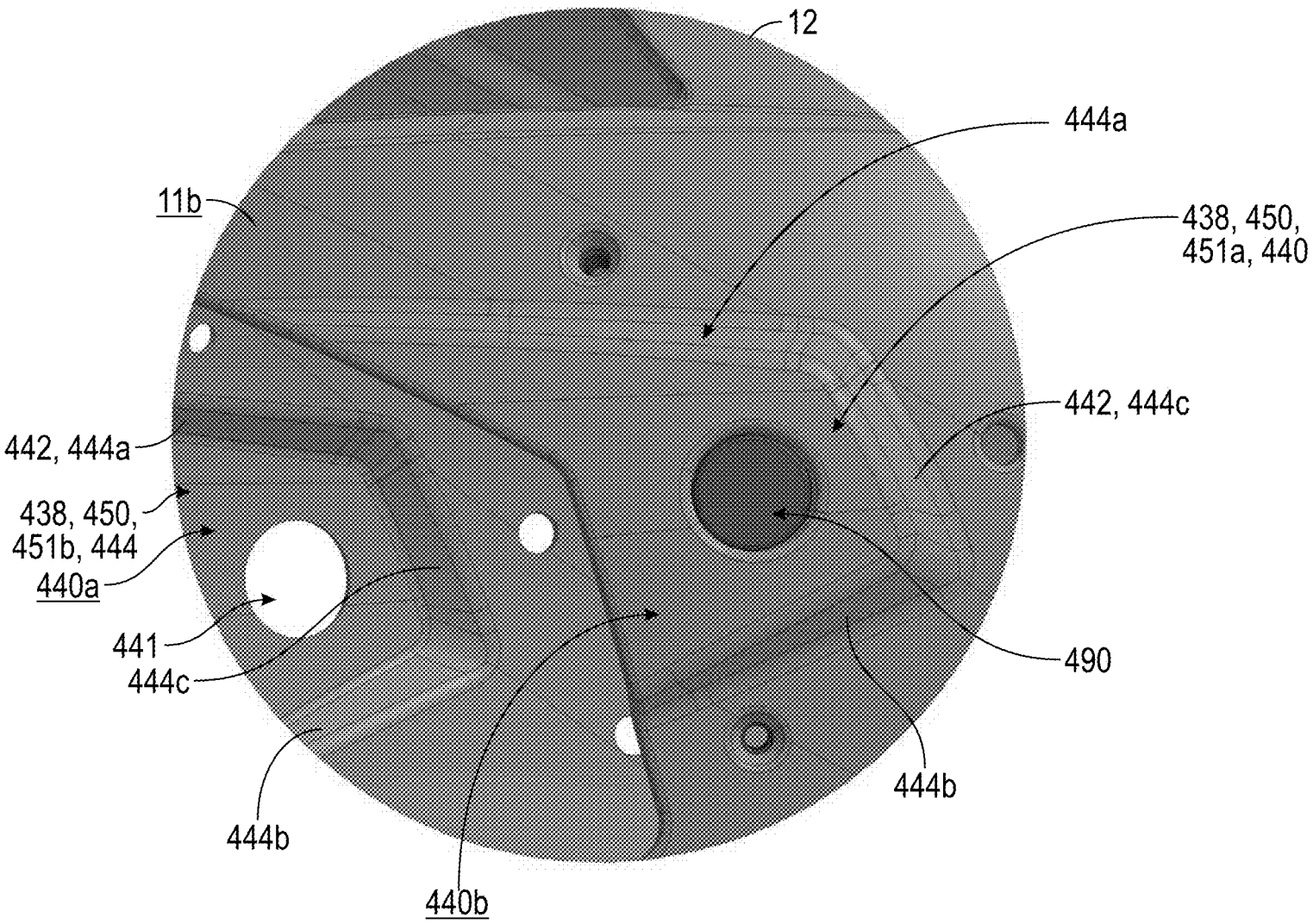
FIG. 45*b* is a zoomed-in view of area B of FIG. 44.
Figure 46:
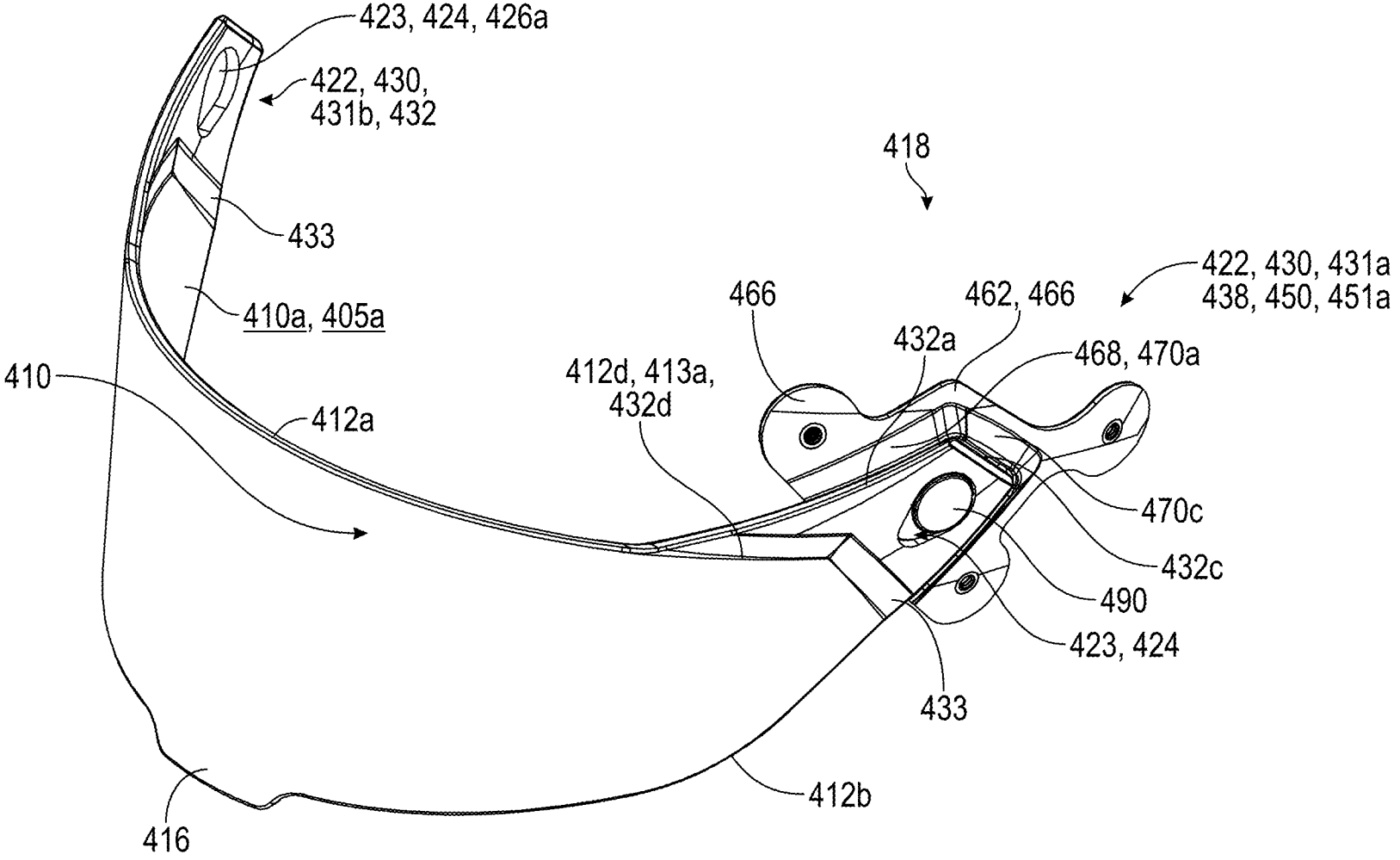
FIG. 46 is a perspective view of an extent of the visor system of the protective sports helmet of FIG. 1, showing a first embodiment of a visor of the visor system and an extent of the helmet-based engagement means of the shell of the protective sports helmet.
Figure 47:
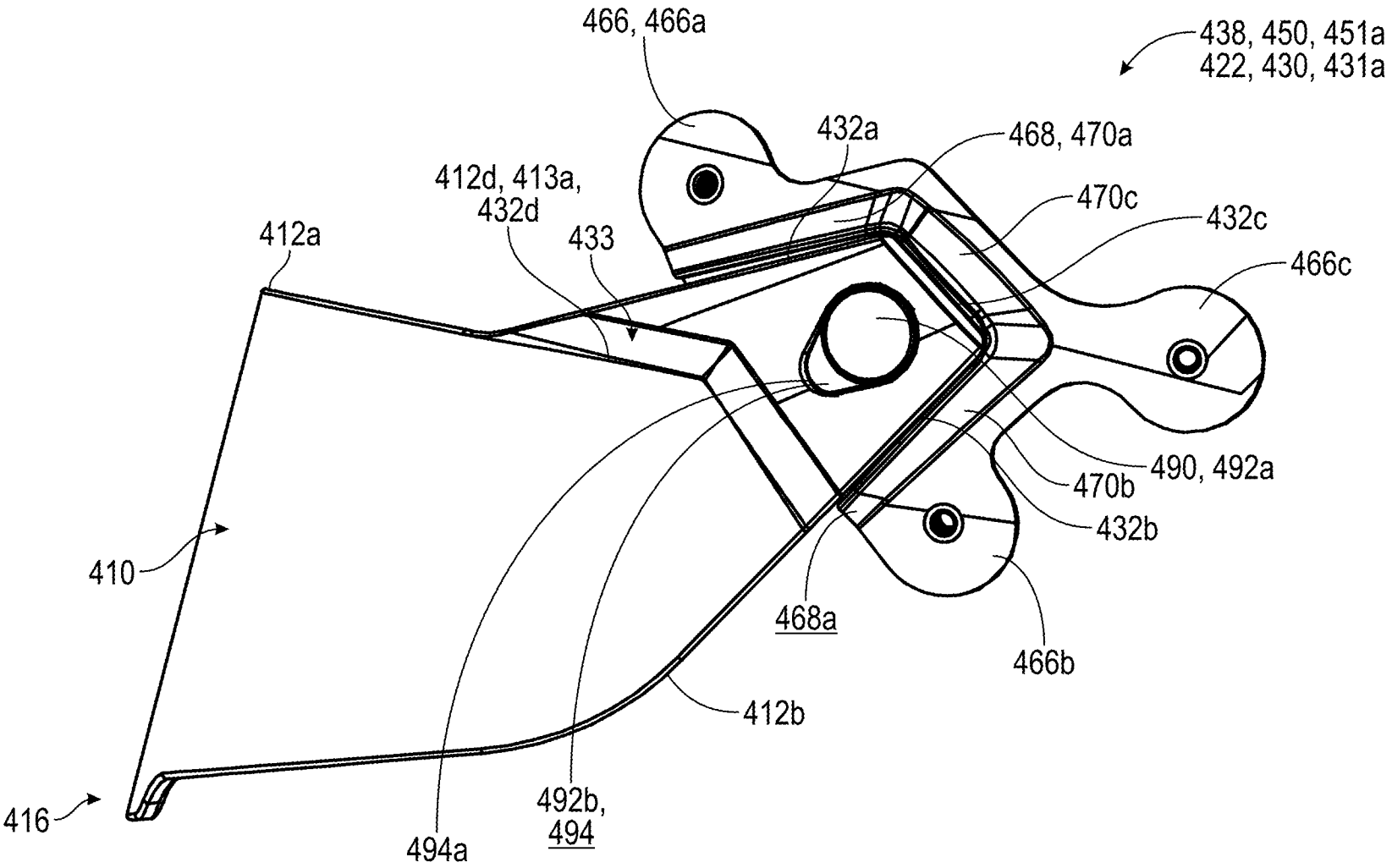
FIG. 47 is a left side view of the visor system of FIG. 30.

As best shown in FIGS. 39, 42, and 43, the beveled extent 433 starts at the side edge 412*d* and extends rearward a substantially equal predefined distance (e.g., 0.3 inches). This beveled extent 433 separates the main body 410 from a visor interface region 435 of the visor-based engagement means 422, wherein said interface region 435 is designed to interact with/be positioned adjacent to the shell 12. As shown in the Figures, the offset that the beveled extent 433 provides is minimal and is primarily designed ensure that the visor properly mates with the shell 12. In other embodiment, this offset may be more substantial such that it creates a "notched" or "staggered" configuration. This may be necessary if the visor protrusion segments 440 are removed from the shell 12. In further embodiments, the tab 432 may not be offset from the outer surface 405*b* of the visor 405 or the tab 432 may be inset from the outer surface 405*b* of the visor 405.

The tab 432 has a substantially trapezoidal shape with: (i) a substantially linear top edge 432*a*, (ii) a substantially linear rear edge 432*b*, (iii) a substantially linear bottom edge 432*c*, and (iv) a multi-part frontal edge 432*d* that extends between the top edge 432*a* and the bottom edge 432*c*. The frontal edge 432*d* is positioned adjacent to the side edge 412*d* of the visor main body 410. The top edge 432*a* has a length $L_{TT}$ that is between 1.5 and 3 inches, preferably 2.2, a rear edge 432*b* that has a length $L_{TR}$ that is between 0.1 and 1 inch and preferably 1.4 inches, and a bottom edge 432*c* that has a length $L_{TB}$ that is between 0.75 and 2.5 inches, preferably 1.4 inches. The lengths $L_{TR}$, $L_{TR}$, and $L_{TB}$ may be increased or decreased, which may increase or decrease the overall size of the tab 432. Additionally, the linear configuration of the edges 432*a*-432*d* may be replaced with a curvilinear configuration or a combination of linear and curvilinear configuration.

As shown in FIGS. 132*b* and 136, the tab 432 extends upward, rearward, and outward from the main body 410. The upwardly extending configuration of the tab 432 is defined by angles α, alpha, β, beta, γ, gamma, which extend between the top edge 432*a* and bottom edge 432*b* of the tab 432 to various reference lines or structures (e.g., top edge 412*a* of the main body 410 and NOLS). In particular, the angle α, alpha that extends between the top edge 412*a* of the main body 410 and the top edge 432*a* of the tab is between 135 degrees and 185 degrees and preferably 155 degrees. Additionally, the angle β, beta that extends between the top edge 432*a* of the tab 432 and the NLOS is between 145 degrees and 195 degrees and preferably 165 degrees. Further, the angle γ, gamma that extends between the bottom edge 432*b* of the tab 432 and the NLOS is between 25 degrees and 65 degrees and preferably 45 degrees. This upward extending configuration is beneficial because it provides additional support to the top edge 412*a* of the visor 405. In fact, this additional support is provided: (i) forward of the both the side edge 14*a*, 14*b* of the shell 12 and rearmost extent of the frontal edge 14*c*, (ii) forward of the player's coronal suture axis (csa), trichion (t), *glabella* (g), and pupil (pp), when the helmet 10 is worn by the player P, (iii) rearward of both of the lateral opening 52 in the shell 12 and front bumper 300, and (iv) rearward of the player's nasal tip (nt). This additional support helps increase the durability of the visor 405 in light of the impacts that are typically experienced while playing football. In contrast, this additional support along the top edge of the shield is not provided in a conventional hockey helmet because the helmet impacts that are experienced while playing hockey are significantly different than the helmet impacts received while playing football. For example, the literature has reported that football player's helmets experience more frontal impacts then side impacts, while hockey player's helmets experience more side impacts than frontal impacts. See Crisco, Joseph J. et al.; *Head impact exposure in collegiate football players*, Journal of Biomechanics, Volume 44, Issue 15, 2673-2678 and Mihalik, J. P., Guskiewicz, K. M., Marshall, S. W. et al. *Head Impact Biomechanics in Youth Hockey: Comparisons Across Playing Position, Event Types, and Impact Locations*. Ann Biomed Eng 40, 141-149 (2012), both of which are fully incorporated herein by reference.

The outward extending configuration of the tab 432 can be seen in at least FIGS. 38, 42, 43, 131, 138 and is partially defined by angles δ, delta. In particular, angle δ, delta that extends between an outermost point of the tab 432 and the NLOS is between 0 degrees and 40 degrees and preferably 25 degrees. This outward extending configuration is beneficial because it helps ensure that a sufficient amount of energy attenuation material can be positioned between the player's head and the visor system 400. It should be understood that the above described angles may be changed, modified or altered without departing from the scope of this disclosure. It should also be understood that in other embodiments the lateral attachment members 430 may have other configurations, shapes, or features. Examples of some of these configurations are shown and described within U.S. Provisional Application Ser. No. 63/188,836. Alternatively, the lateral attachment members 430 may have any one of the following shapes: (i) circular, (ii) ellipsoidal, (iii) oval, (iv) square, (v) rectangular, (vi) triangular, or (vii) any other similar shape.

The pair of lateral attachment members 430 include a visor-based coupling means 423. In FIGS. 30-45, 50, 57, 60, this visor-based coupling means 423 is shown as an opening 424. In other words, the tab 432 includes an opening 424. The opening 424 is configured to receive an extent of the helmet-based engaging assembly 438 in the connected position $P_C$, which will be discussed in greater detail below. The opening 424 is completely positioned within the tab 432 and does not extend into the visors main body 410. The opening 424 has a raindrop shape that is comprised of two primary components, which include: (i) a circular shaped extent 426*a* and (ii) a parabolic shaped extent 426*b* that is positioned forward of the circular extent 426*a*. The opening 424 has a major axis $A_O$ that is substantially perpendicular with the rear edge 432*b* of the tab 432 and substantially parallel with the bottom edge 432*c*. This positional relationship places the parabolic shaped extent of the opening in a positon that generally points forward and downward, when the visor 405 is viewed from the side. The opening 424 is positioned in the center of the interface region 435 of the tab 432, as: (i) a forward most point of the parabolic shaped extent 426*b* of the opening is positioned approximately: (a) 0.5 inches rearward of the side edge 412*d* and (b) 0.25 inches rearward of the beveled extent 433, and (ii) rearmost point of the circular extent 426*a* is positioned approximately 0.25 inches forward of the rear edge 432*b*.

This raindrop shaped opening 424 is beneficial because it provides a unique or keyed coupling configuration, which reduces the visors 405 ability to rotate in relation to the shell 12 when the helmet receives an impact. In other embodiments, the opening 424 may have any one of the following shapes: (i) circular, (ii) ellipsoidal, (iii) oval, (iv) square, (v) rectangular, (vi) triangular, or (vii) any other similar shape. However, it should be understood that if the shape of the opening 424 is altered than the designer should consider whether an alteration to the extent of the helmet-based engagement means 438 is necessary. For example, if the opening 424 has a parabolic shape then the extent of the helmet-based engagement means 438 must have a shape that is designed to fit within the parabolic shaped opening 424.

1. Alternative Embodiment of the Visor-Based Engagement Means

Multiple other embodiments of the visor-based engagement means 422 are described and shown in U.S. Provisional Application Ser. Nos. 63/079,476, 63/157,337, and 63/188,836, all of which are incorporated herein by reference. For sake of brevity these disclosures will not be repeated herein. However, it should be understood that the visor-based engagement means 422 may include or be replaced with: (i) upper attachment member(s), (ii) intermediate attachment member(s), (iii) lower lateral attachment member(s), or (iv) a combination of these attachment member(s). These additional or replacement member(s) may be: (i) positioned adjacent to an extent of the shell 12 and overlap an extent of said shell 12, (ii) positioned between an extent of the energy attenuation assembly 600 and an extent of the shell 12 and underlie an extent of the shell 12, (iii) positioned within an opening that is formed within the energy attenuation assembly 600 and not positioned adjacent to an extent of the shell 12, or (iv) another position that is obvious to one of skill in the art based on this disclosure. It should be understood that any additional or replacement member(s) may or may not have corresponding member(s) that form part of the helmet-based engagement means 438.

ii. Helmet-Based Engagement Means

The helmet-based engagement means 438 is shown in FIGS. 1, 8, 15-16, 23-24, 26-27, 30-31, and 46-66 and is designed to interact with the visor-based engagement means 422 in order to couple the visor 405 to the shell 12. The helmet-based engagement means 438 includes a pair of lateral fastening structures 450. The left and right lateral fastening structures 451*a*, 451*b* include: (i) the visor protrusion segment 440 and (ii) a helmet-based coupling means 460.

1. Visor Protrusion Segment

The visor protrusion segment 440 is a protruberance that is integrally formed with the shell 12 and includes a retaining member aperture 441. The visor protrusion segment 440 extends rearward from an extent of frontal edge 14*c* and the first upper segment 15*a* of the side edge 14*a*, 14*b* towards the rear portion 22 of the shell 12. The visor protrusion 440 has an outer surface 440*b* that is offset or positioned further away from the center of the helmet 10 than the outer surface 11*b* of the shell 12 that is positioned adjacent to the protrusion 440. This outer surface 440*b*, and likewise the visor protrusion 440, is defined by a collection of sidewalls or ridges 442 that extend upward at an angle from an outer shell surface 11*b*. Specifically, this collection of sidewalls 442 includes: (i) a first or upper sidewall 444*a* that is substantially linear and extends rearward and upward from frontal edge 14*c*. (ii) a second or lower sidewall 444*b* that is substantially linear and extends rearward and upward from first upper segment 15*a* of the side edge 14*a*, 14*b*, and (iii) a third or rear sidewall 444*c* that extends between the rearmost points of the upper and lower sidewalls 444*a*, 444*b*. When viewed from the side of the shell 12, the visor protrusion 440 has a trapezoidal shape and as such the width of the visor protrusion 440 decreases as the visor protrusion 440 extends from the frontal opening 16 of the shell 12 to towards the rear portion 22 of the shell 12.

Additionally and as best shown in FIG. 48, the height of the sidewall 444*a* substantially increases as it extends from the frontal opening 16 towards the rear portion 22. In particular, the forward most extent of the sidewall 444*a* is nearly flush with the adjacent extent of the shell 12, while the rearmost extent of the sidewall 444*a* has a height that is approximately 0.16 inches. Likewise, the forward most extent of the sidewall 444*b* has a height that is approximately 0.07 inches, while the rearmost extent of the sidewall 444*b* has a height that is approximately 0.22 inches. This expanding configuration is beneficial because it: (i) provides additional room on the inside of the shell 12 for the helmet-based coupling means 460, and (ii) reduces the requirement that the pair of lateral attachment members 430 be inset in order to fit within the shell 12, which increases the amount of the main body 410 that can substantially match the curvature of the shell 12 and simplifies the manufacture of the visor 405.

In reference to other surfaces contours and facets of the shell 12, the rearmost extent 446 of the visor protrusion 440 is positioned rearward of the openings formed in the check flap 30 and forward of the car hole 28. No portion of the visor protrusion 440 is positioned forward of the forward most extent of either the: (i) frontal openings 147*a*, or (ii) the frontal energy attenuation member 42. However, a portion of the visor protrusion 440 is positioned forward of the forward most point 15*e* of the side edge 14*a*, 14*b* and a portion of the visor protrusion 440 is positioned rearward of the rearward most point 15*f* of the side edge 14*a*, 14*b*. Additionally, a portion of the visor protrusion 440 is positioned below both: (i) the rear energy attenuation member 242 and (ii) an extent of the car hole 28. References to other positional relationships are obvious to one of skill in the art based on the Figures contained herein.

While the above paragraphs focused on the how the outer surface 440*b* is offset from the adjacent outer surface 11*b* of the shell 12, it should be understood that this offset creates an offset inner surface 440*a* when said inner surface 440*a* is compared to the inner surface 11*a* of the shell 12 that is positioned adjacent to the visor protrusion 440. This offset inner surface 440*a* is designed to be positioned adjacent to the pair of lateral attachment members 430, when the visor 405 is coupled to the shell 12; thus, this surface 440*a* forms a shell-based or outer interface region 446. In other words, this interface region 446 is defined by and extends between an inner perimeter of the collection of sidewalls 442. An extent of the interface region 446 is designed to be slightly larger than the tab 432 to ensure that the tab 432 can fit or can substantially fit within this region 446. For example, the interface region 446 may have: (i) a top edge 448*a* with a length $L_{TOI}$ that is between 1.5 and 3 inches, preferably 2.3, (ii) a bottom edge 448*b* that has a length $L_{BOI}$ that is between 0.75 and 2.5 inches, preferably 1.5 inches, and (iii) a rear edge 448*c* that has a length $L_{ROI}$ that is between 0.1 and 1 inch and preferably 0.5 inches. It should be understood that these lengths, widths, and heights are only exemplary and may be changed, modified, and/or altered.

The retaining member aperture 441 is an opening formed in the shell 12, which is designed to provide access to the retaining member 490 from outside the shell 12. In other words, the retaining member aperture 441 allows the player/user/operator/installer to depress the retaining member 490 from an environment that is external to the helmet 10. This is beneficial because over conventional connector designs because it does not require the player P to take off their helmet 10 or remove any additional structures from within the helmet 10 in order to remove the visor 405 from the shell 12. The retaining member aperture 441 has a substantially circular configuration and only permits access to the circular extent of the retaining member 490. In other words, the parabolic shaped extent 492*a* of member 490 is not directly viewable from the exterior of the shell 12 and through the aperture 441. The aperture 441 is positioned: (i) rearward of the frontal opening 147*a*, (ii) rearward of a majority of the front opening 46 of the front impact attenuation member 42, (iii) forward of the car hole 28, and (iv) forward of the second segment 148 of the side opening 146 of the side energy attenuation member 142. It should be understood that in other embodiments, the aperture 441 may be omitted and replaced with a deformable extent of the shell 12, its size may altered or changed (e.g., increased or decreased), its shape may be altered or changed, and its positional relationship to other features contained within the shell 12 may be modified.

In other embodiments that: (i) the visor protrusion 440 may be omitted, (ii) the visor protrusion 440 may be inset, wherein the outer surface 440*b* moved towards the center of the helmet 10 in relation to the outer surface 11*b* of the shell 12 that is adjacent to the protrusion 440, (iii) the size the visor protrusion 440 may be increased or decreased, (iv) the shape may be any known shape, including circular, ellipsoidal, oval, square, rectangular, or any combination thereof, (v) the shape may or may not substantially match the shape of the lateral attachment members 431*a*, 431*b*, (vi) the heights of the sidewall 444*a*, 444*b* may decrease as they extend from the frontal opening 16 towards the rear portion 22, (vii) the sidewalls 444*a*-444*c* may all have curvilinear configurations or a portion of the sidewalls 444*a*-444*c* may have curvilinear configurations, (viii) may not be integrally formed with the shell 12, (ix) any combination of the above disclosed concepts, and/or (x) any obvious configuration based on the above disclosure.

2. Helmet-Based Coupling Means

Figure 50:
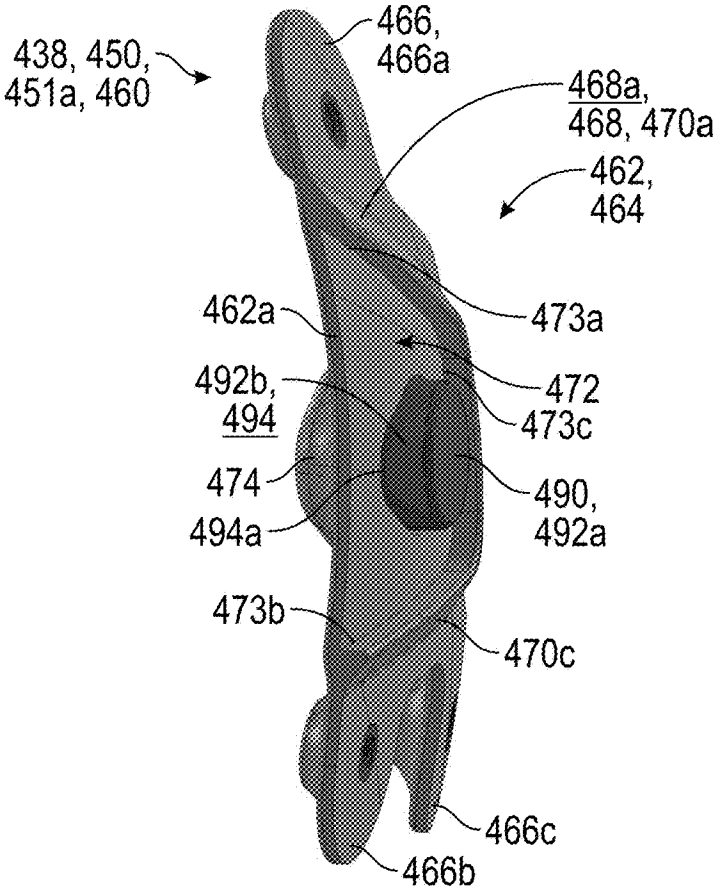
FIG. 50 is a frontal perspective view of the helmet-based engagement means of FIG. 46.
Figure 49:
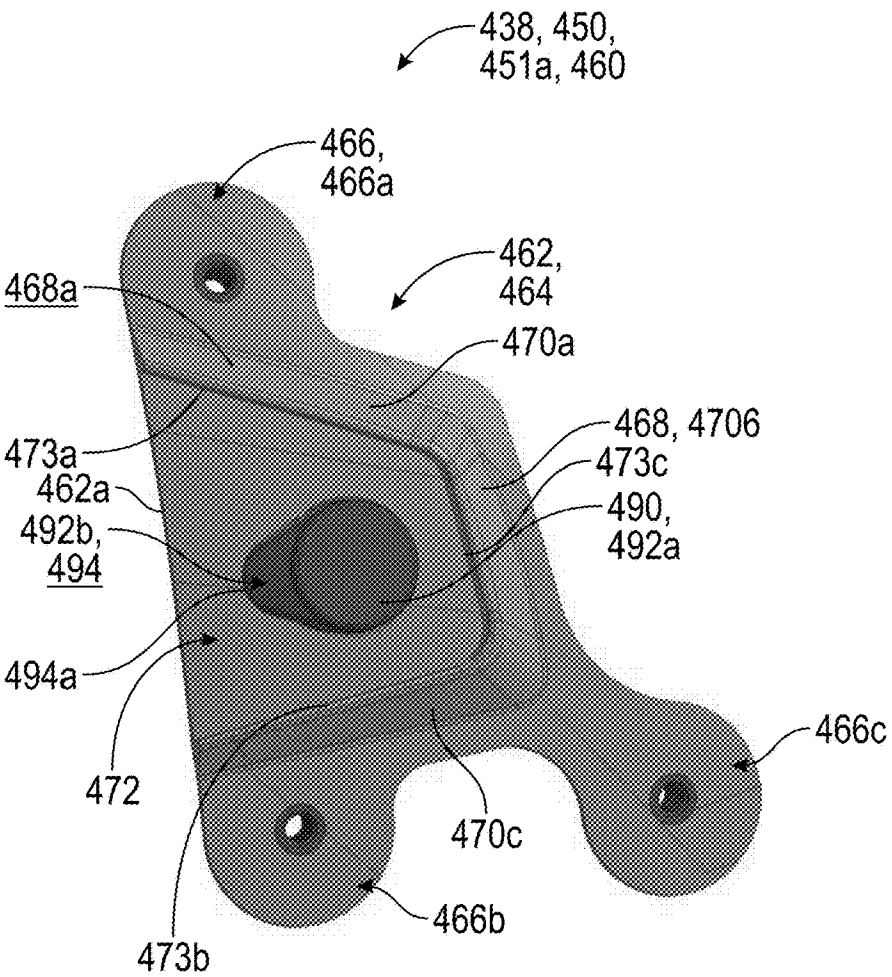
FIG. 49 is a side view of an extent of the helmet-based engagement means of FIG. 46.
Figure 51:
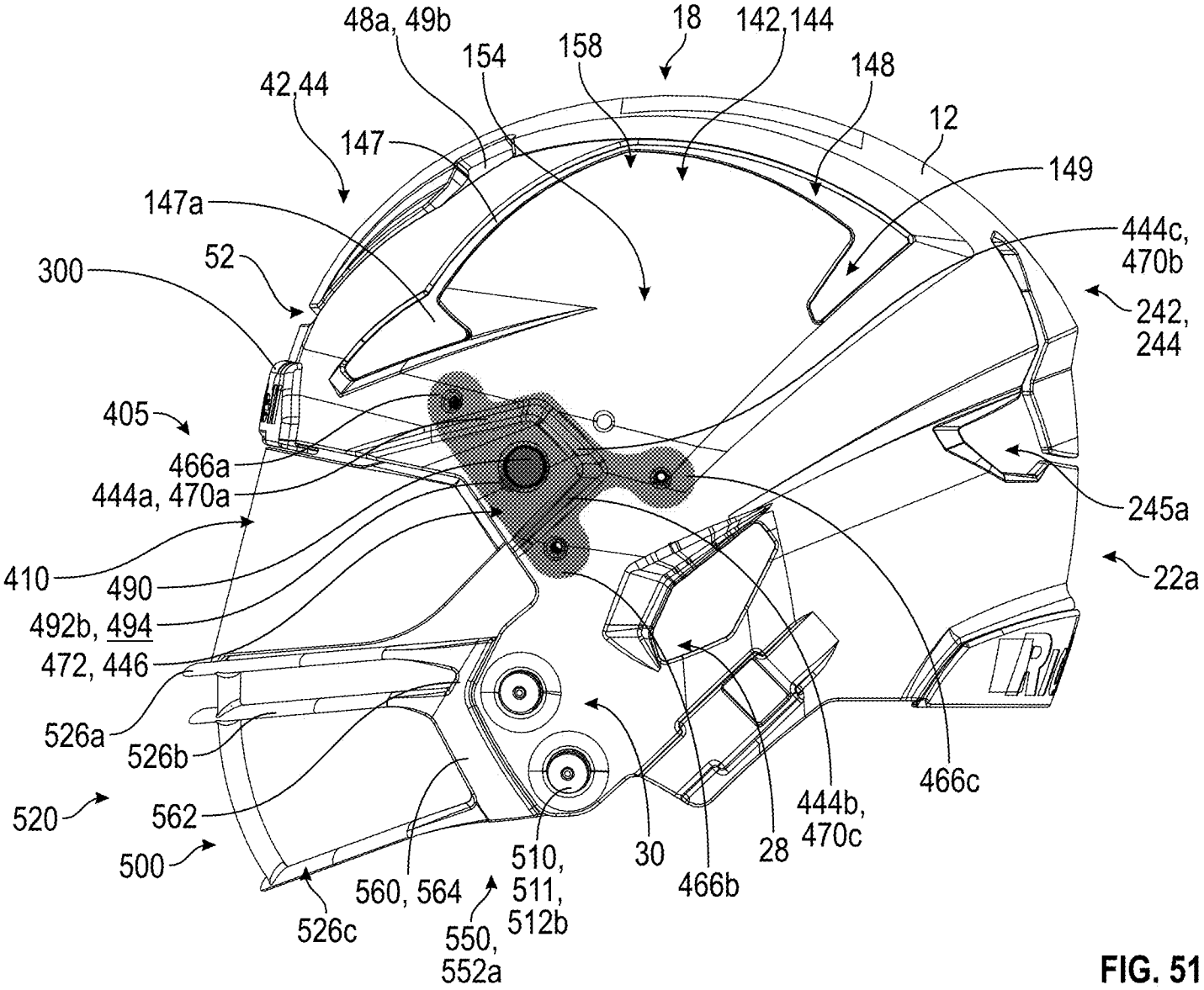
FIG. 51 is a left side view of the protective sports helmet of FIG. 1, with the helmet-based engagement means being highlighted to shows its positional relationship within the helmet.
Figure 52:
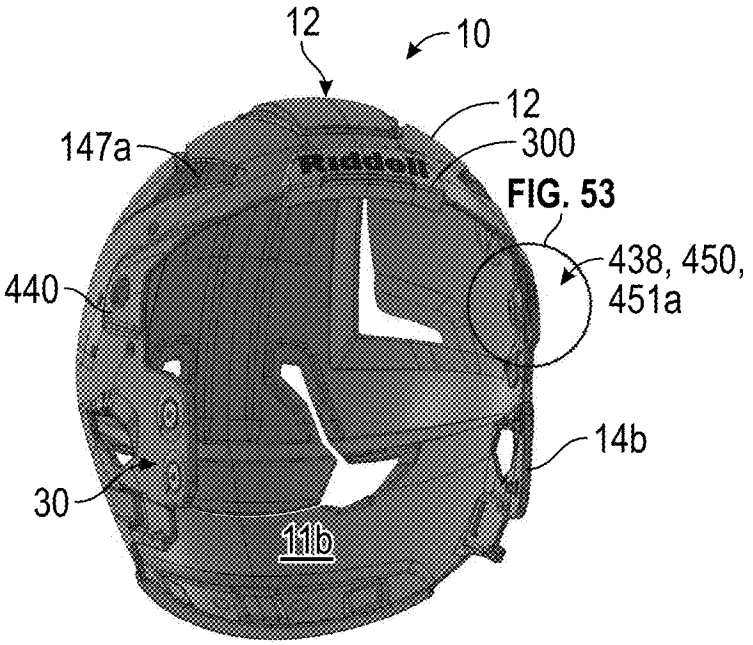
FIG. 52 is a front perspective view of the protective sports helmet of FIG. 1 showing the helmet shell and the helmet-based engagement means.
Figure 53:
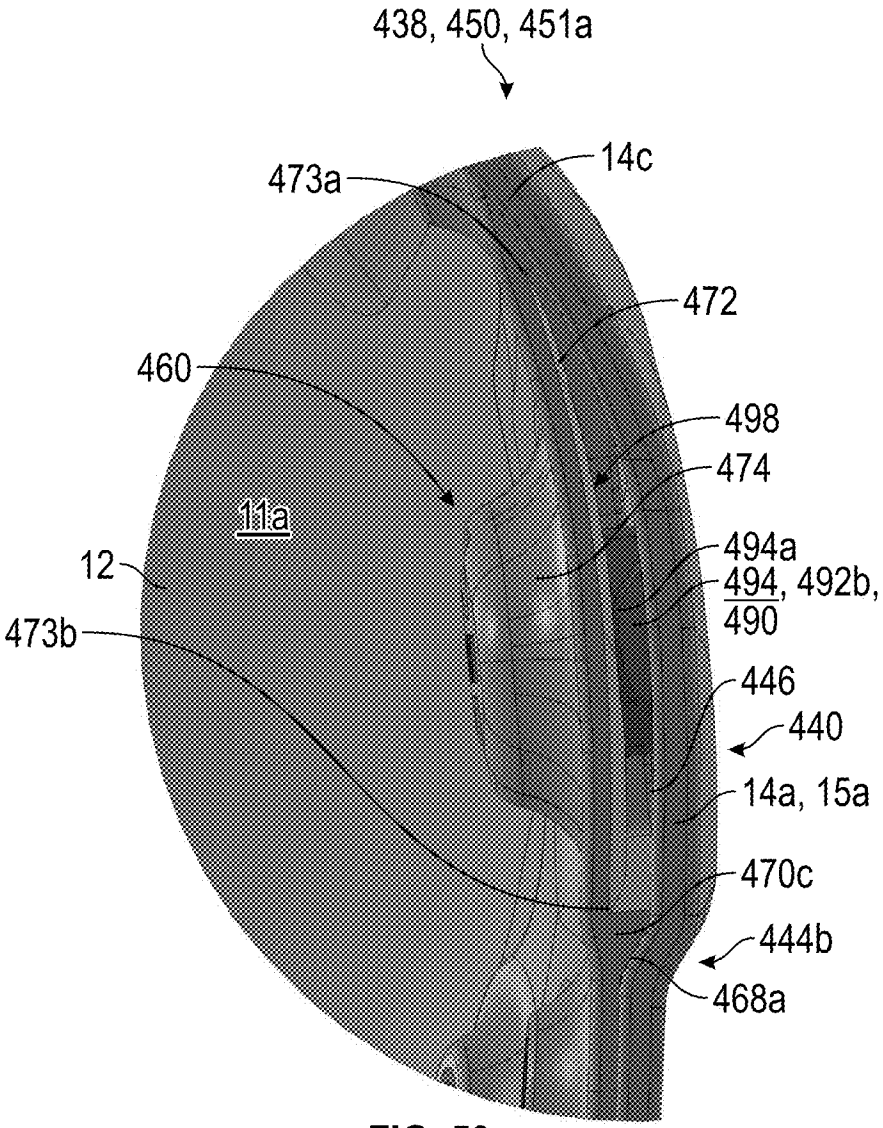
FIG. 53 is a zoomed-in view of area D of FIG. 52, showing the helmet shell and the helmet-based engagement means.

As best shown in FIGS. 30-31 and 48-60, the helmet-based coupling means 460 includes: (i) a housing 462, (ii) a biasing member 486, and (iii) a retaining member 490. Said housing 462 is directly coupled to an inner surface 11*a* of the shell 12 using elongated fasteners. Positioning housing 462 on the inside of the shell 12 is beneficial over conventional helmets 9010 that place the connectors on the exterior of the faceguard 9007 or shell because it minimizes components that are coupled to the exterior of the shell, which in turn reduces failures/increases durability and reduces the number of points that can snag or get caught on another player's uniform. The housing 462 is best shown in FIGS. 50, 51, and 52. The housing 462 includes: (i) a main body 464, (ii) a raised lip 468, (iii) a coupler-based or inner interface region 472 that is defined by the raised lip 468 and a frontal edge 462*a* of the housing 462, (iv) a biasing retainer 474, and (v) a receiver 498. The main body 464 has a general curvilinear shape that substantially matches the shell's curvature of the inner surface 11*a* in areas adjacent to the visor protrusion 440.

To couple the main body 464 to the shell 12 in these areas that are adjacent to the visor protrusion 440, the main body 464 includes a plurality of mounting regions 466 that are configured to receive an extent of an elongated fastener that extends through the shell 12. In particular, these mounting regions 466 include: (i) a first or upper mounting region 466*a*, (ii) a second or lower mounting region 466*b*, and (iii) a third or rear mounting region 466*c*. When the housing 462 is coupled to the shell 12: (i) the upper mounting region 466*a* is positioned above the upper sidewall 444*a* and is positioned forward of the rear sidewall 444*b*, (ii) the lower mounting region 466*b* is positioned below the lower sidewall 444*b* and is positioned forward of the rear sidewall 444*c*, and (iii) the rear mounting region 466*c* is positioned rearward of the rear sidewall 444*c* and is positioned below the upper sidewall 444*a*. When the housing 462 is secured to the shell 12, the frontal edge 462*a* is not aligned with the either: (i) frontal edge 14*c* or the side edges 14*a*, 14*b*. Instead, the frontal edge 462*a* of the housing 462 is: (i) positioned rearward of both of the frontal edge 14*c* or the side edges 14*a*, 14*b* and (ii) is substantially parallel with upper segment 15*a* of the side edges 14*a*, 14*b*. It should be understood that in other embodiments, the frontal edge 462*a* may be: (i) alight with one or both of the frontal edge 14*c* or the side edges 14*a*, 14*b*, (ii) not be parallel with any extent of the side edges 14*a*, 14*b*, and/or (iii) may have a curvilinear component.

Figure 54:
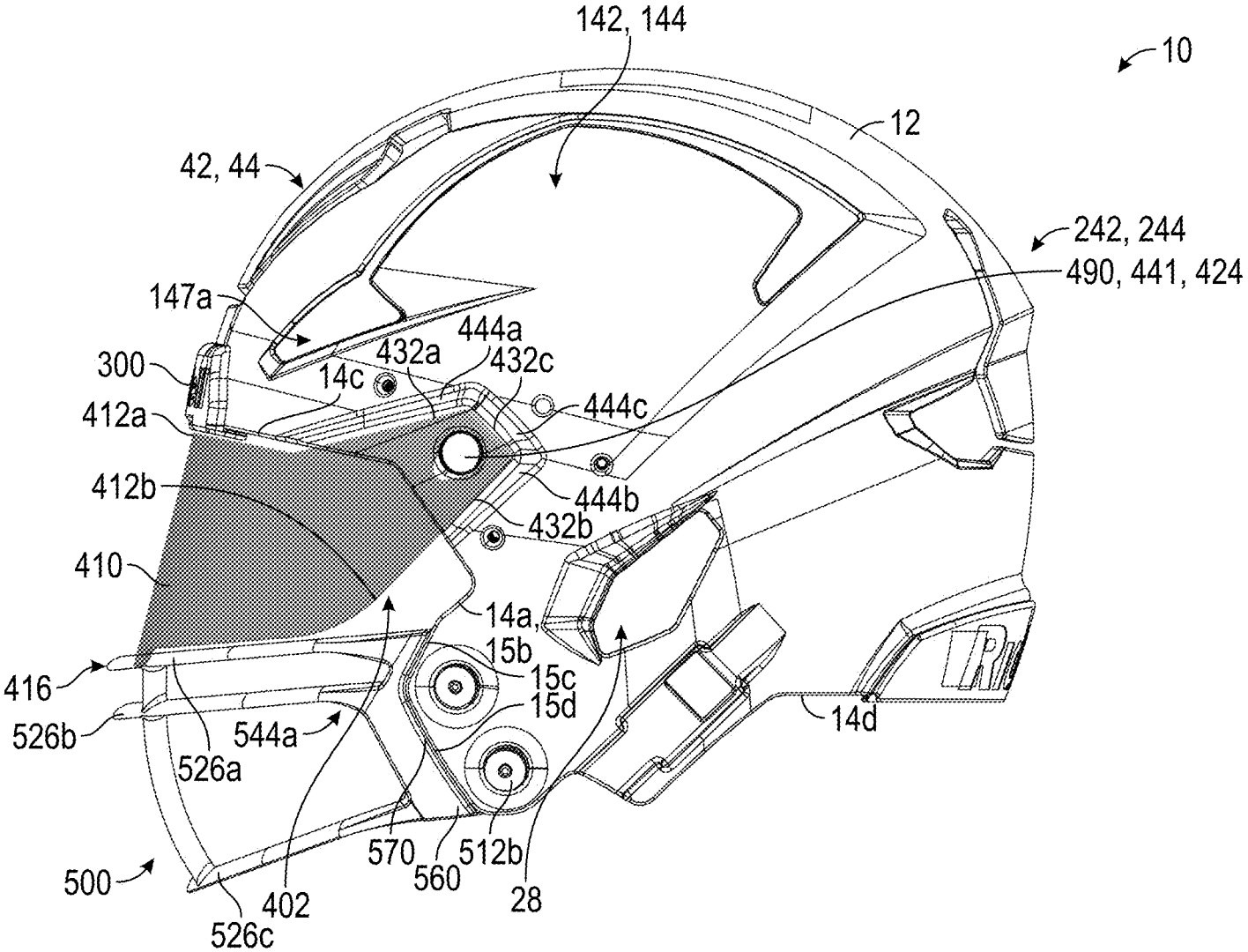
FIG. 54 is a left side view of the protective sports helmet of FIG. 1, the visor being highlighted to shows its positional relationship within the helmet.
Figure 57:
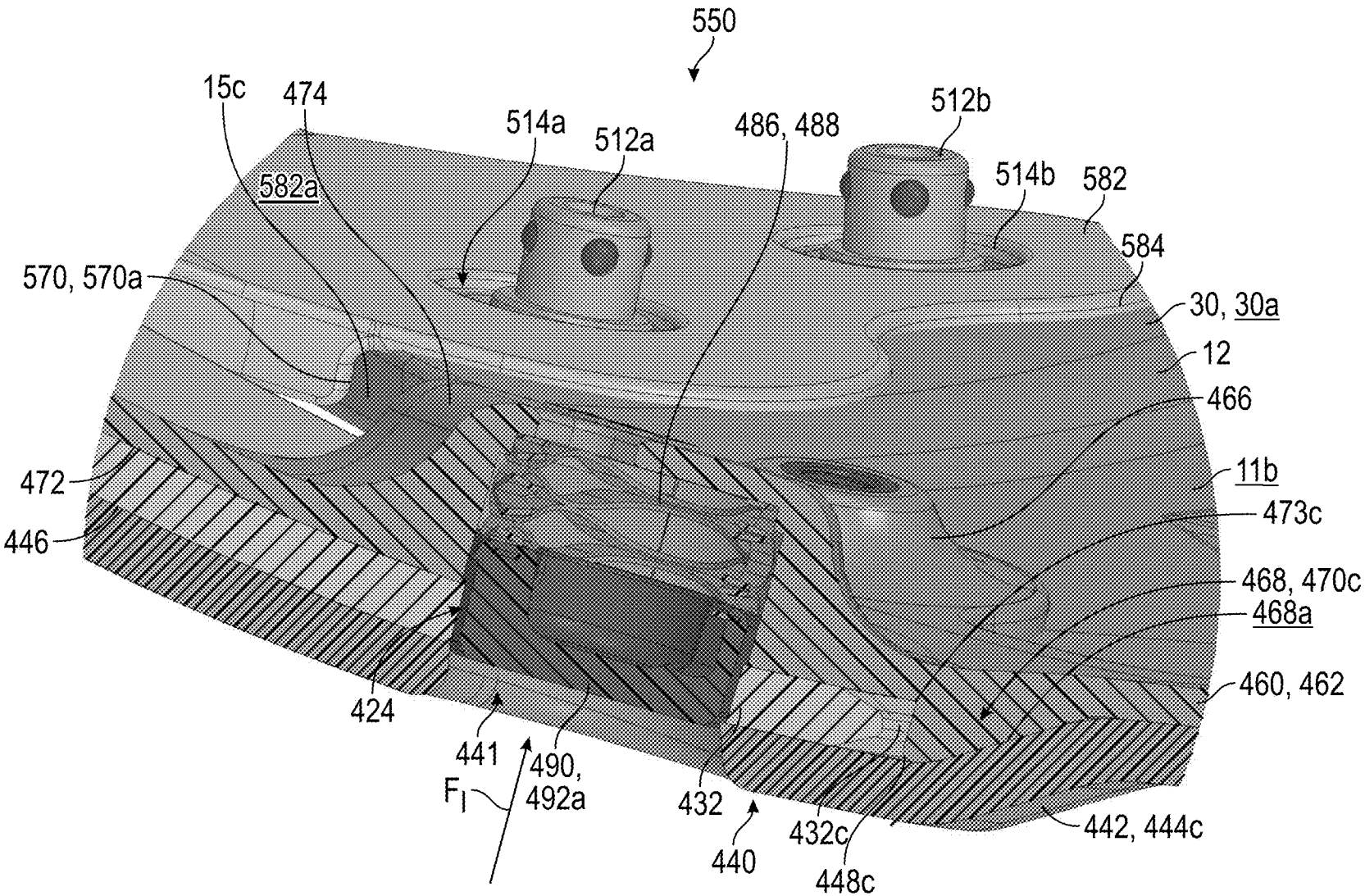
FIG. 57 is a zoomed-in view of area E of the helmet of FIG. 56.
Figure 59:
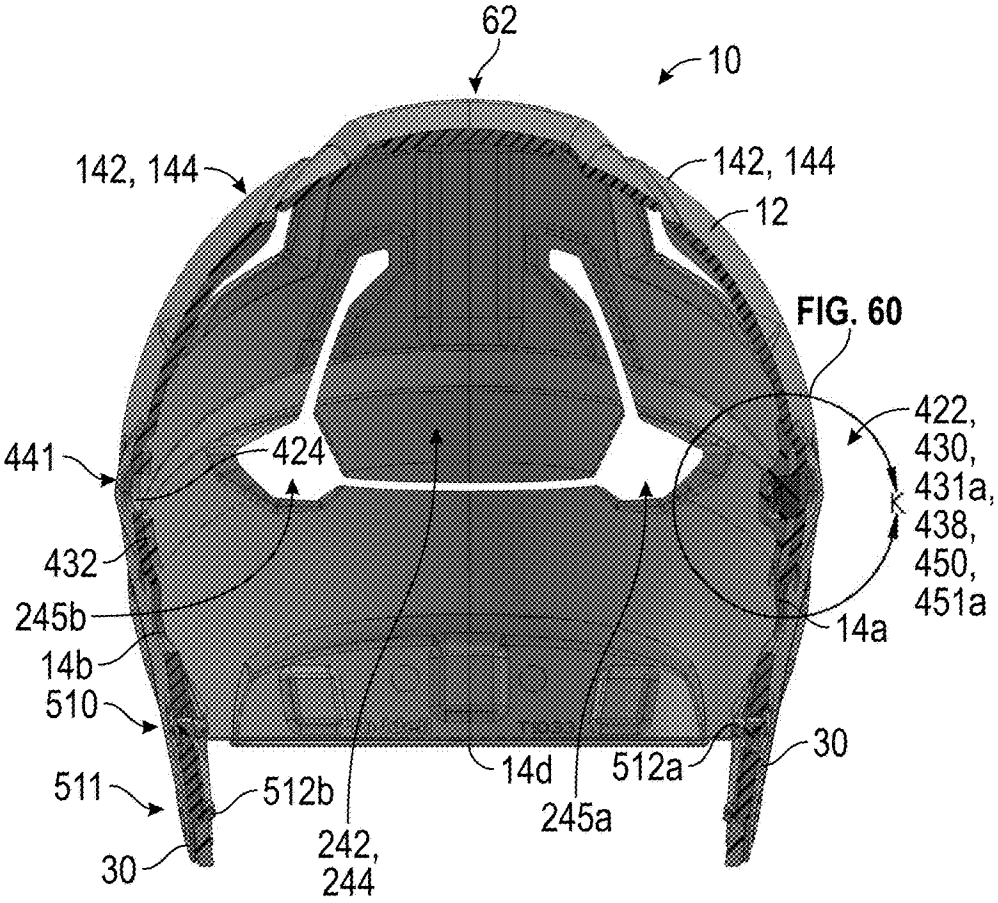
Figure 58:
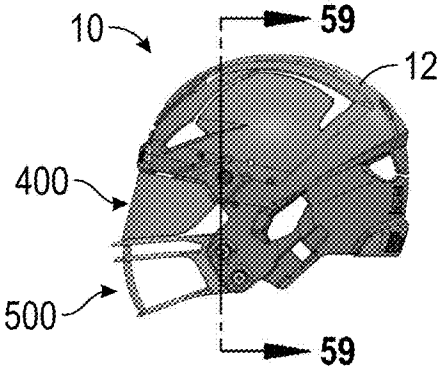
FIG. 58 is a left side view of the protective sports helmet of FIG. 1.
Figure 60:
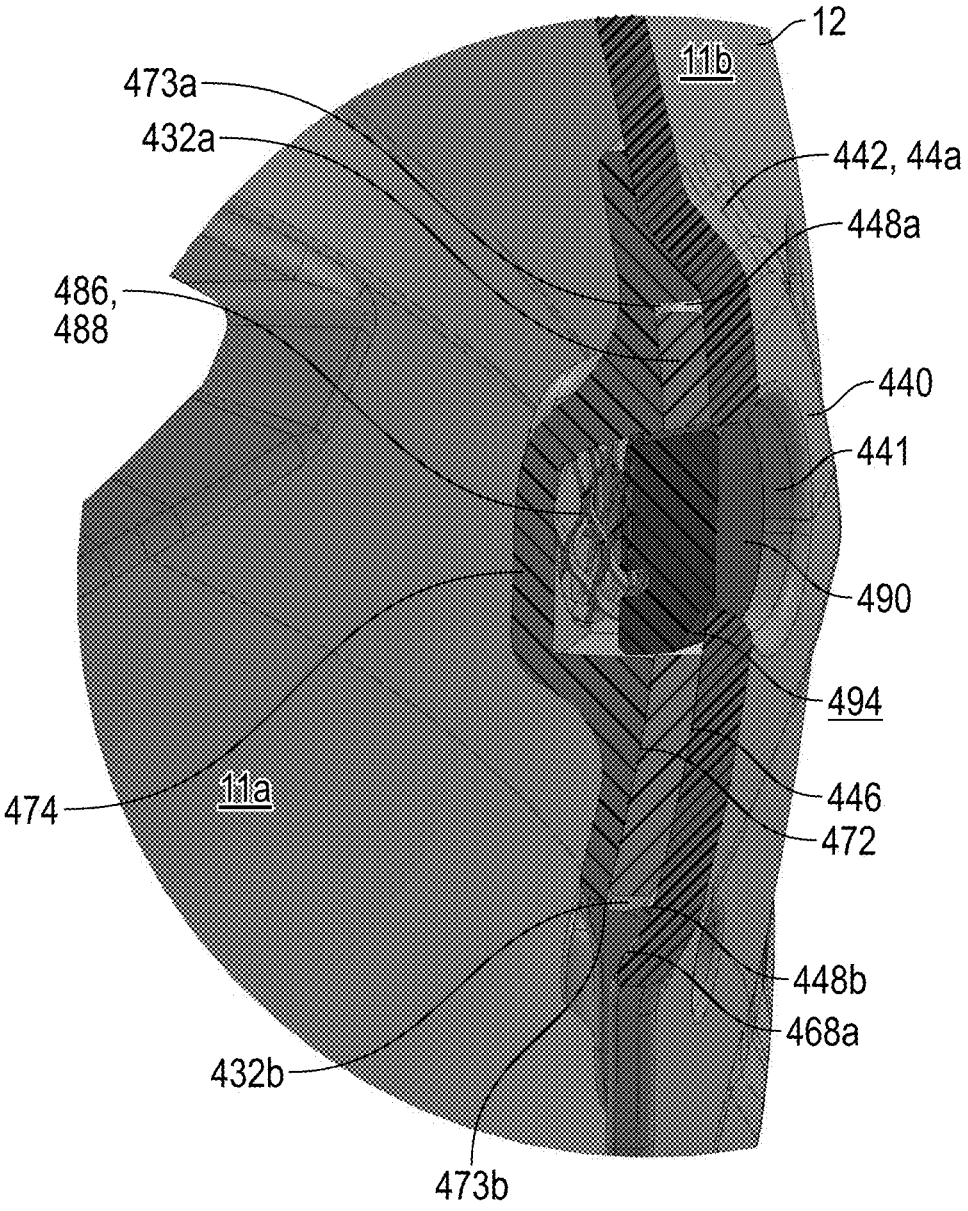
FIG. 60 is a zoomed-in view of area F of the helmet of FIG. 59.
Figure 62:
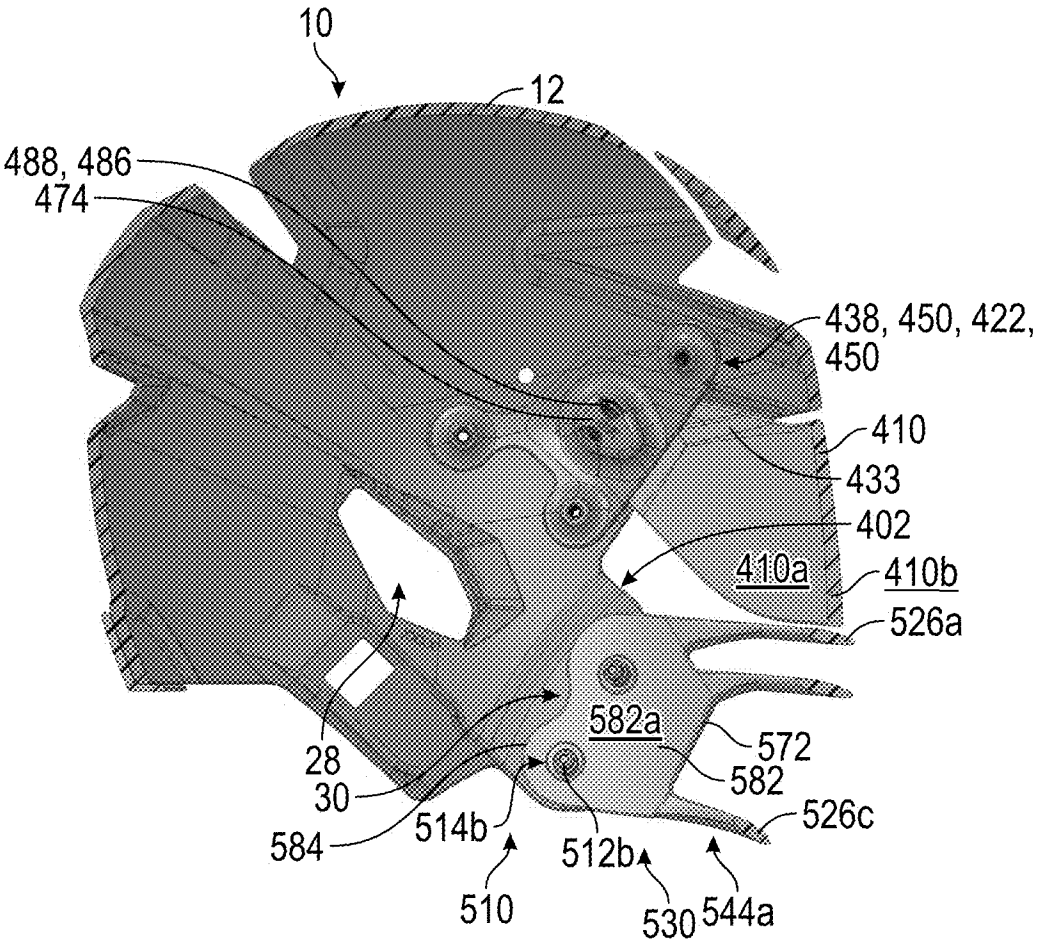
FIG. 62 is a cross-sectional view of the protective sports helmet taken along line 62-62 of FIG. 61, showing the helmet engaging means, the visor, the lower chin bar assembly and the interior of the shell.
Figure 61:
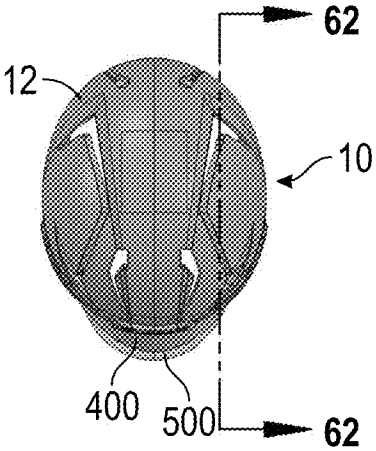
FIG. 61 is a top view of the protective sports helmet of FIG. 1.
Figure 64:
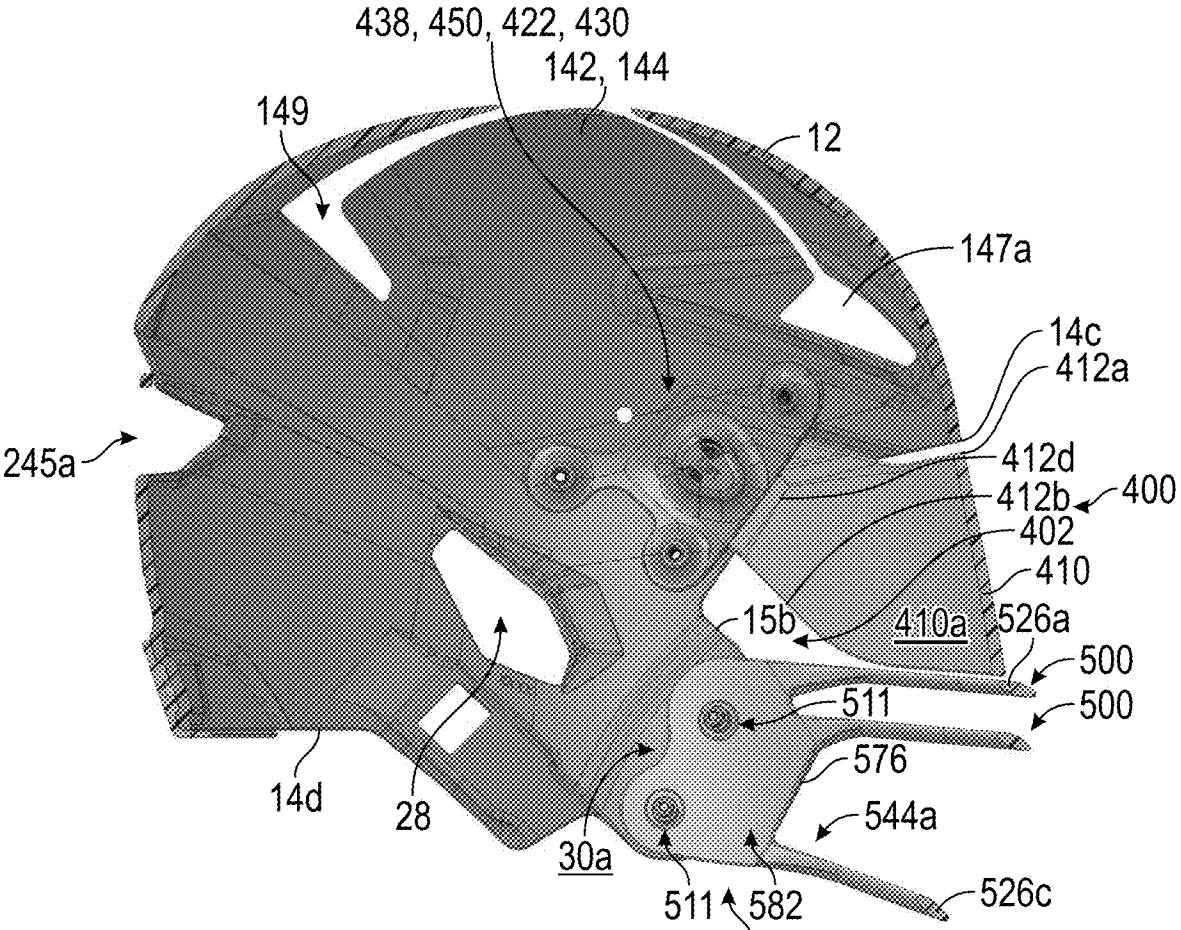
FIG. 64 is a cross-sectional view of the protective sports helmet taken along line 64-64 of FIG. 63, showing the helmet engaging means, the visor, the lower chin bar assembly and the interior of the shell.
Figure 63:
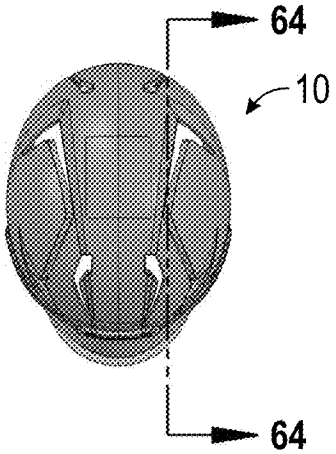
FIG. 63 is a top view of the protective sports helmet of FIG. 1.
Figure 66:
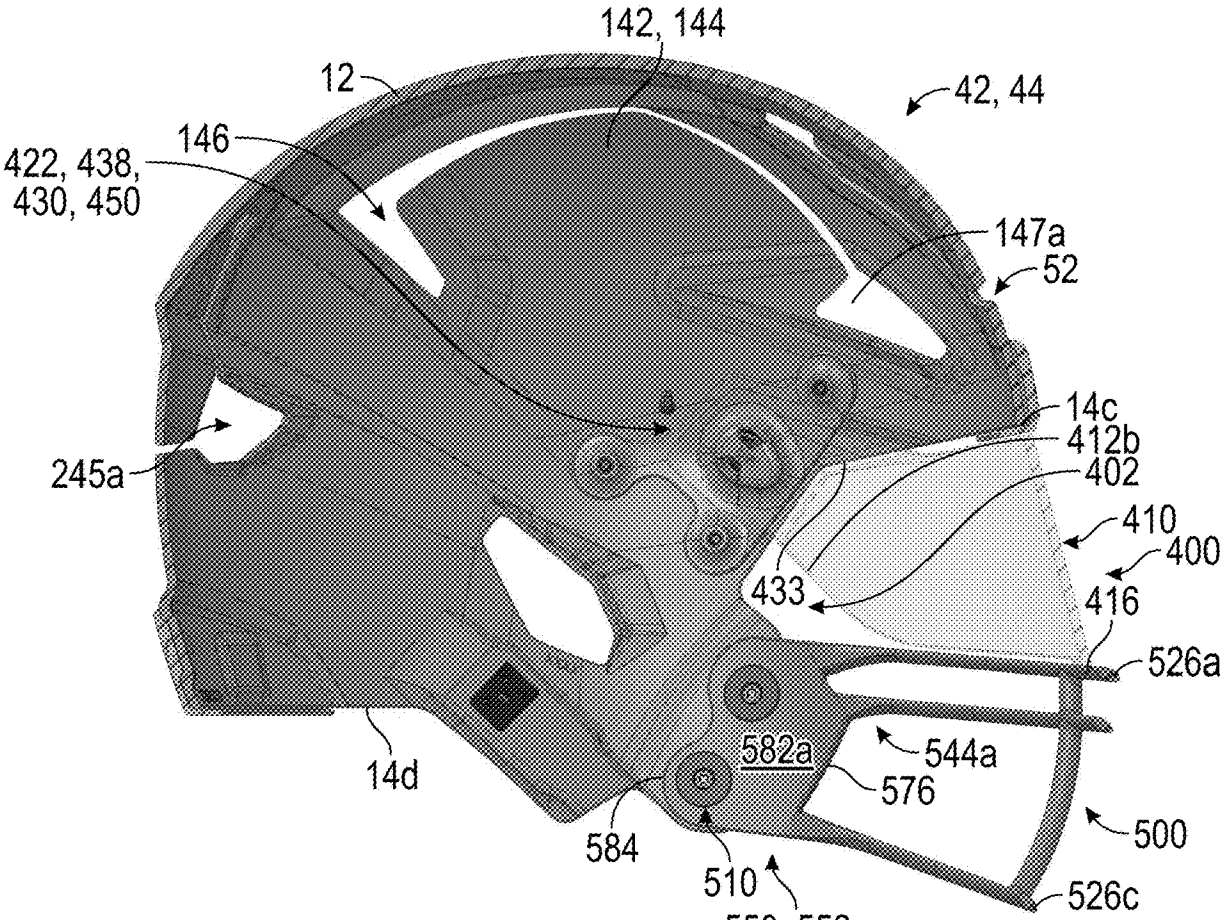
FIG. 66 is a cross-sectional view of the protective sports helmet taken along line 66-66 of FIG. 65, showing the helmet engaging means, the visor, the lower chin bar assembly and the interior of the shell.
Figure 65:
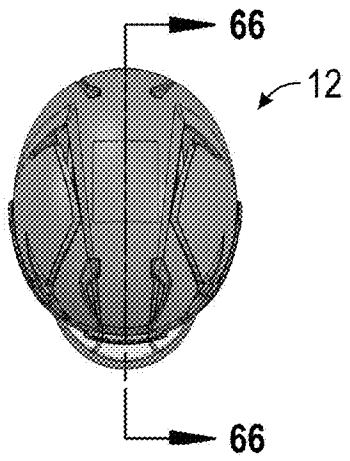
FIG. 65 is a top view of the protective sports helmet of FIG. 1.
Figure 67:
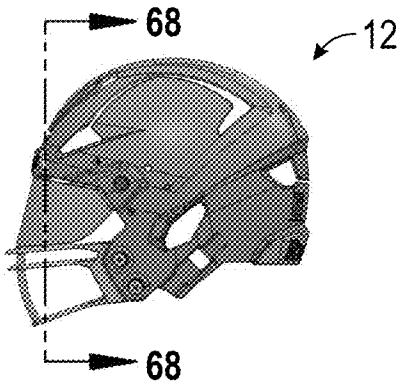
FIG. 67 is a left side view of the protective sports helmet of FIG. 1.
Figure 68:
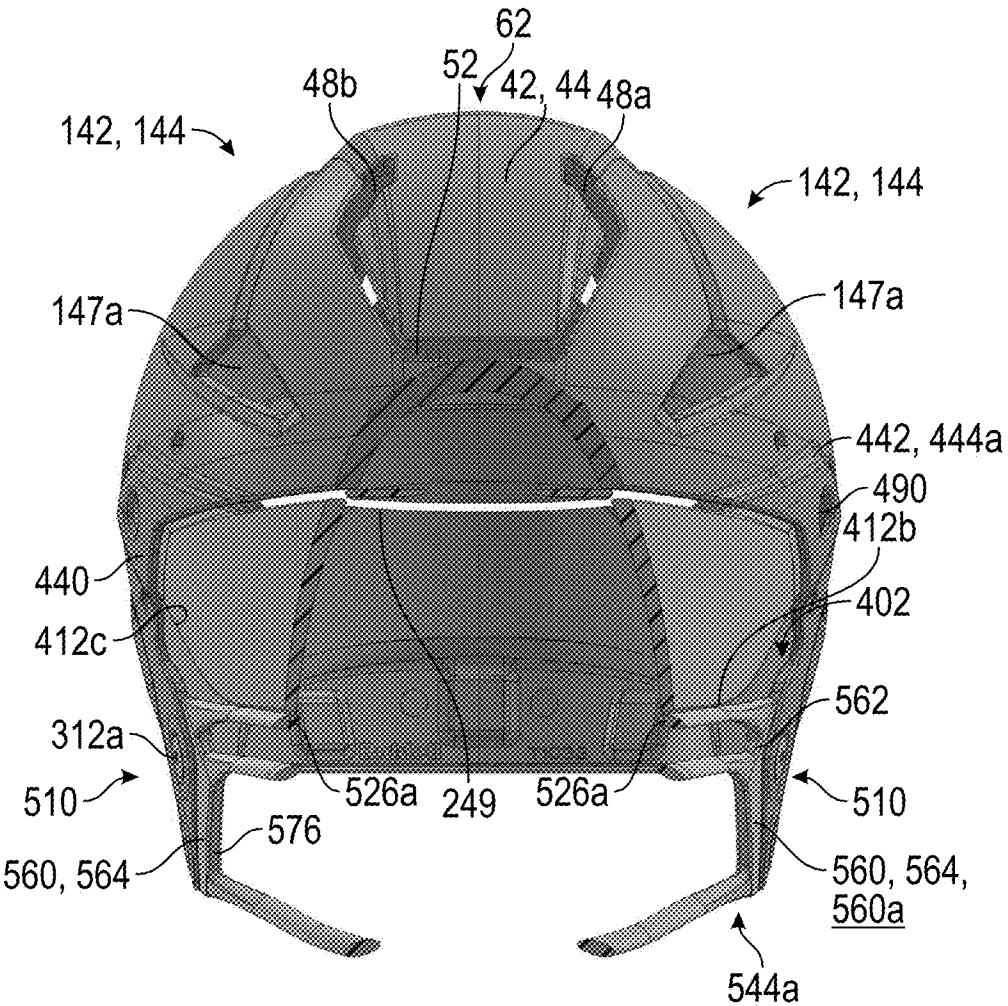
FIG. 68 is a cross-sectional view of the protective sports helmet taken along line 68-68 of FIG. 67.
Figure 70:
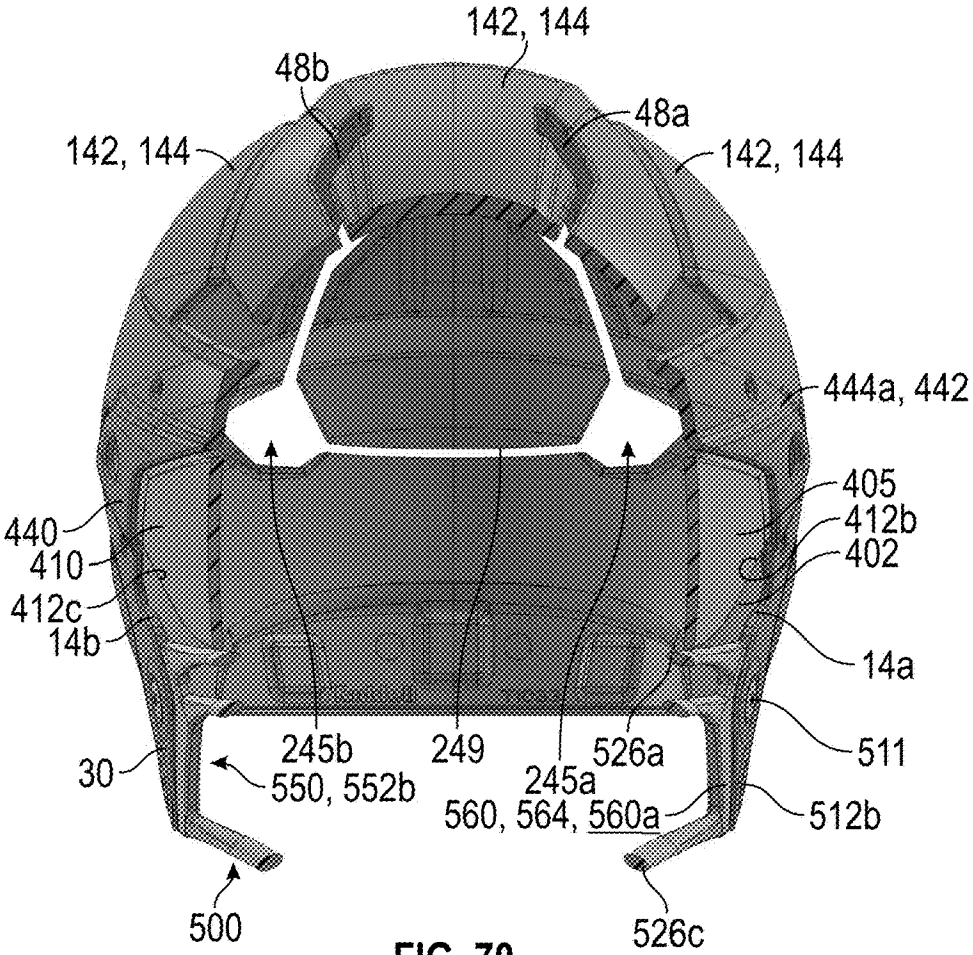
FIG. 70 is a cross-sectional view of the protective sports helmet taken along line 70-70 of FIG. 69.
Figure 69:
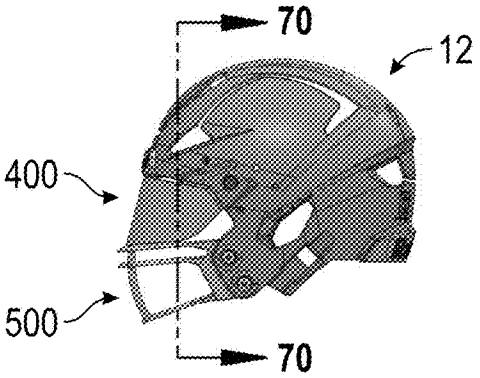
FIG. 69 is a left side view of the protective sports helmet of FIG. 1.
Figure 71:
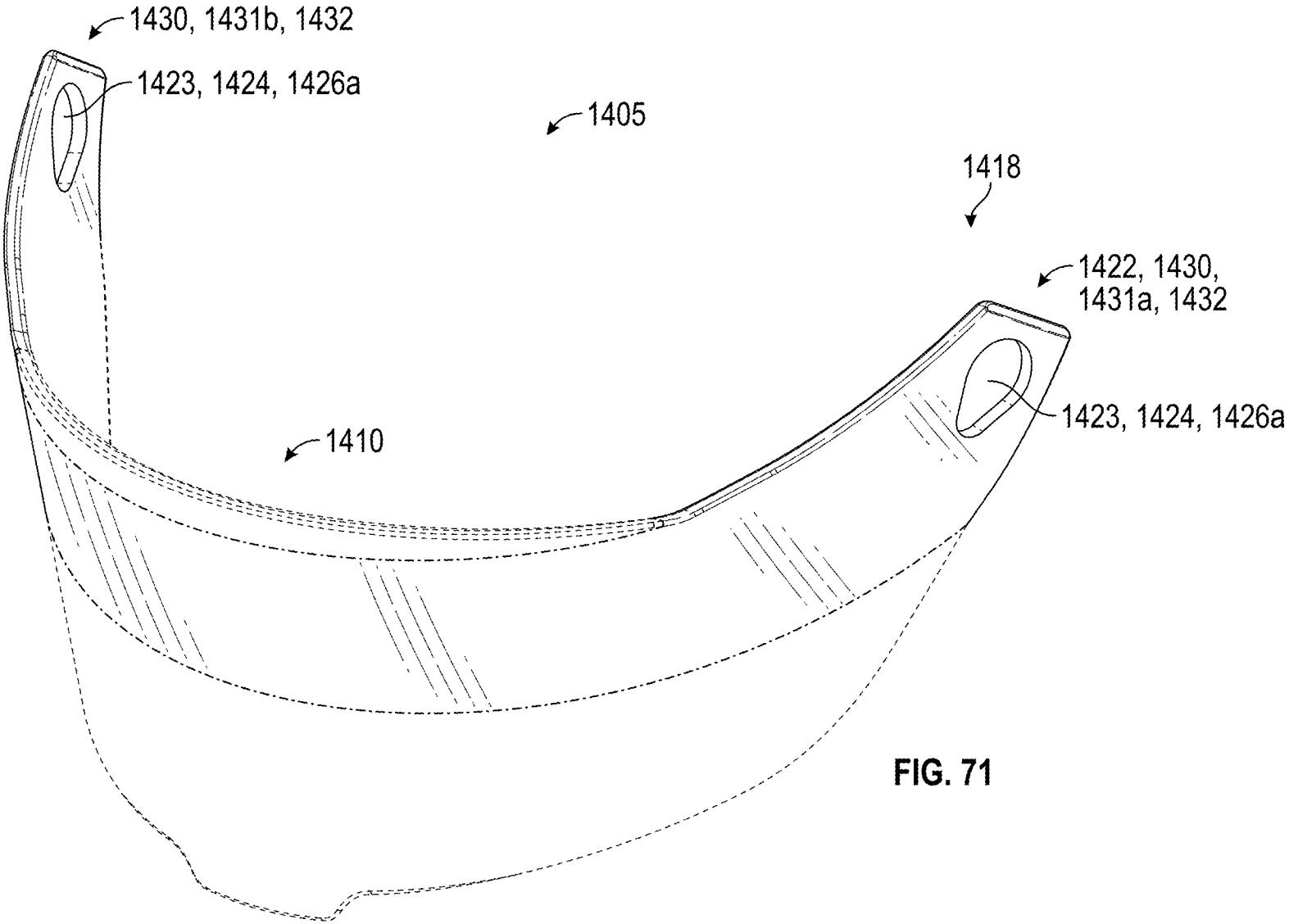
FIG. 71 is a perspective view of a second embodiment of a visor of the protective sports helmet.
Figure 72:
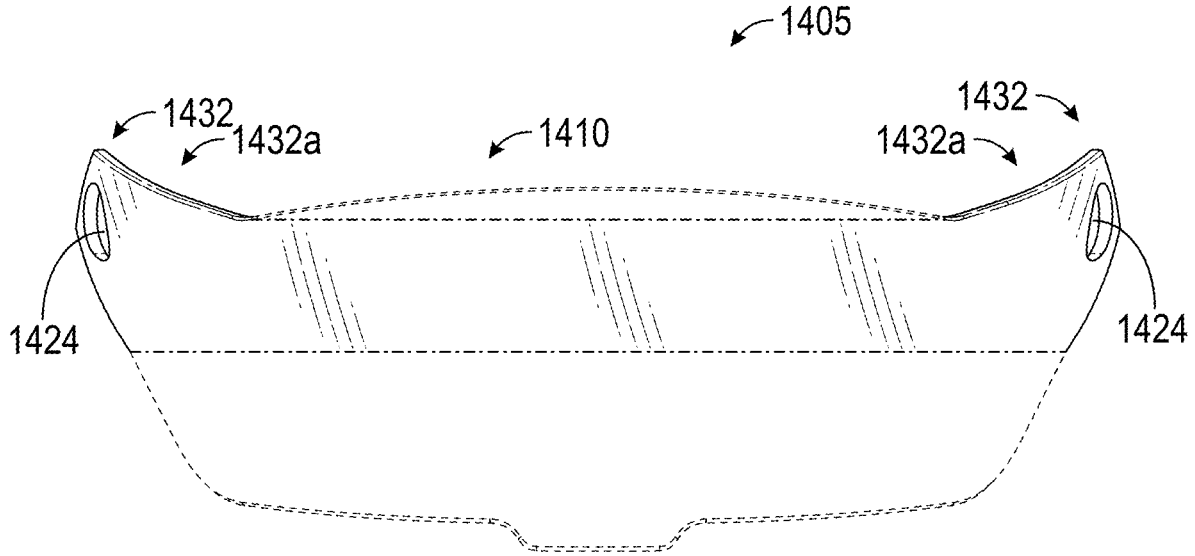
FIG. 72 is a front view of the visor of FIG. 71.
Figure 73:
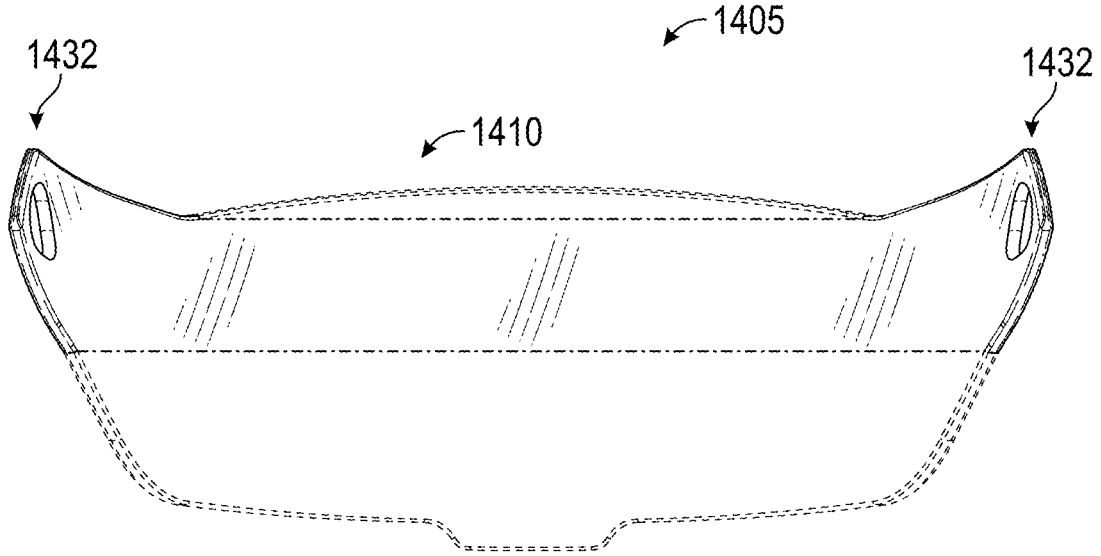
FIG. 73 is a rear view of the visor of FIG. 71.
Figure 74:
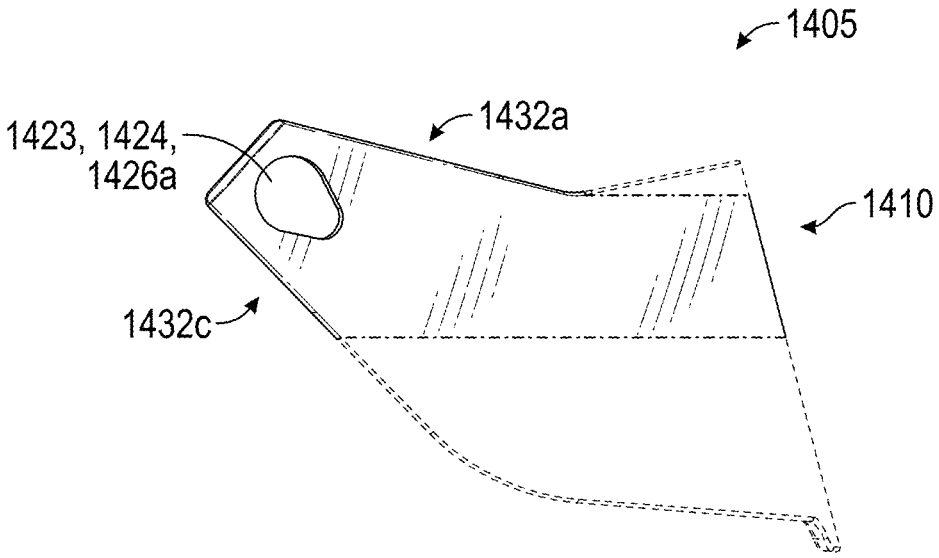
FIG. 74 is a right side view of the visor of FIG. 71.
Figure 75:
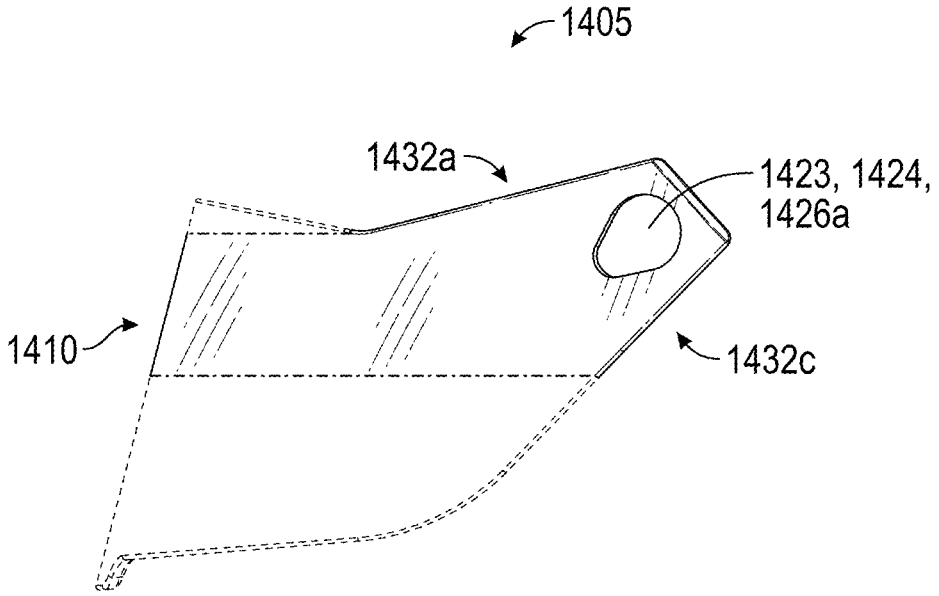
FIG. 75 is a left side view of the visor of FIG. 71.
Figure 76:
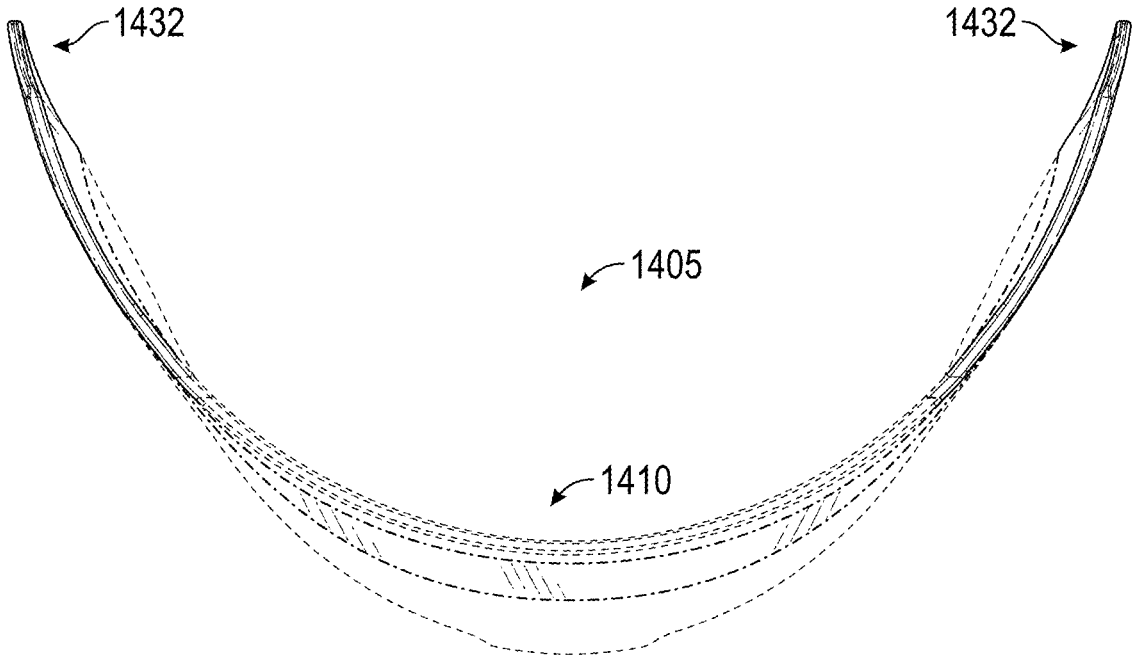
FIG. 76 is a top view of the visor of FIG. 71.
Figure 77:
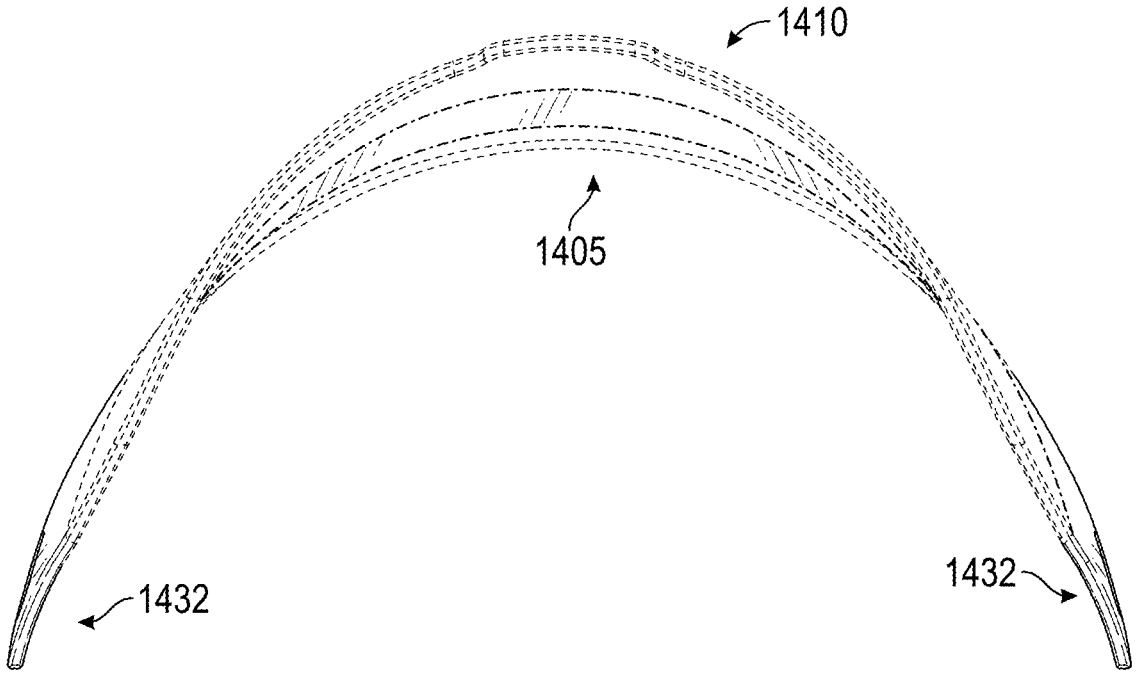
FIG. 77 is a bottom view of the visor of FIG. 71.
Figure 78:
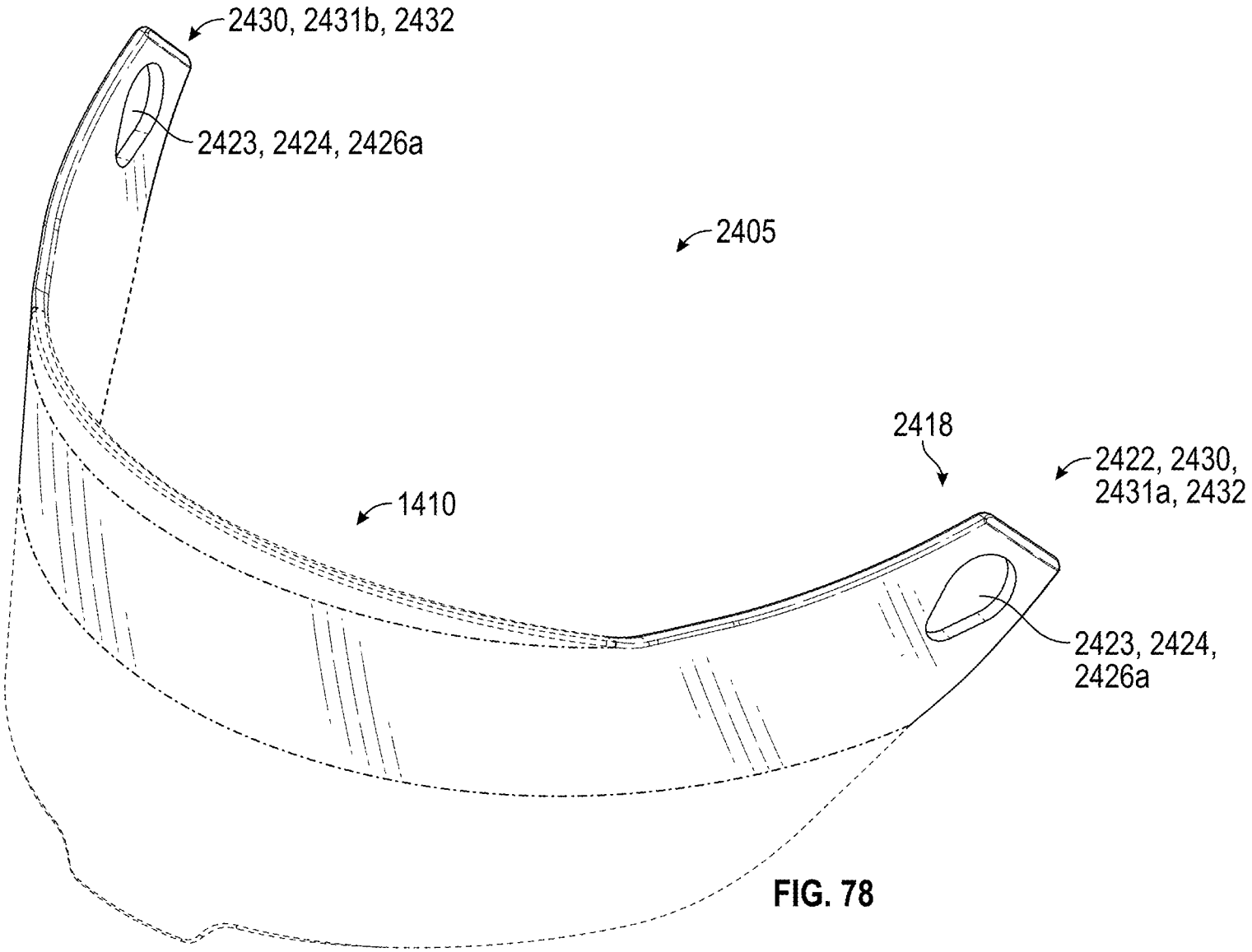
FIG. 78 is a perspective view of a third embodiment of a visor of the protective sports helmet.
Figure 79:
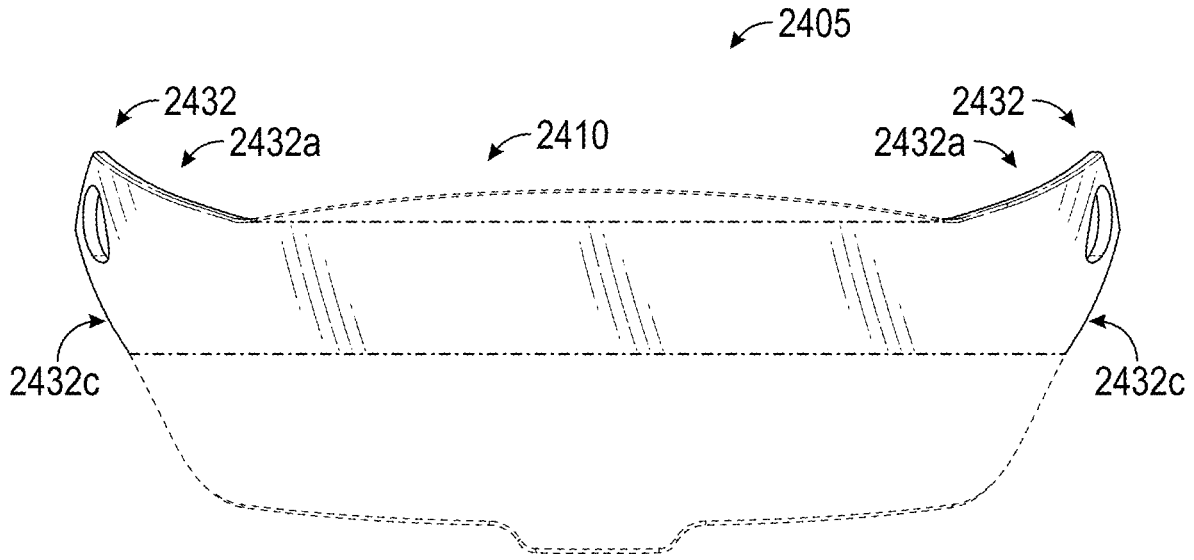
FIG. 79 is a front view of the visor of FIG. 78.
Figure 80:
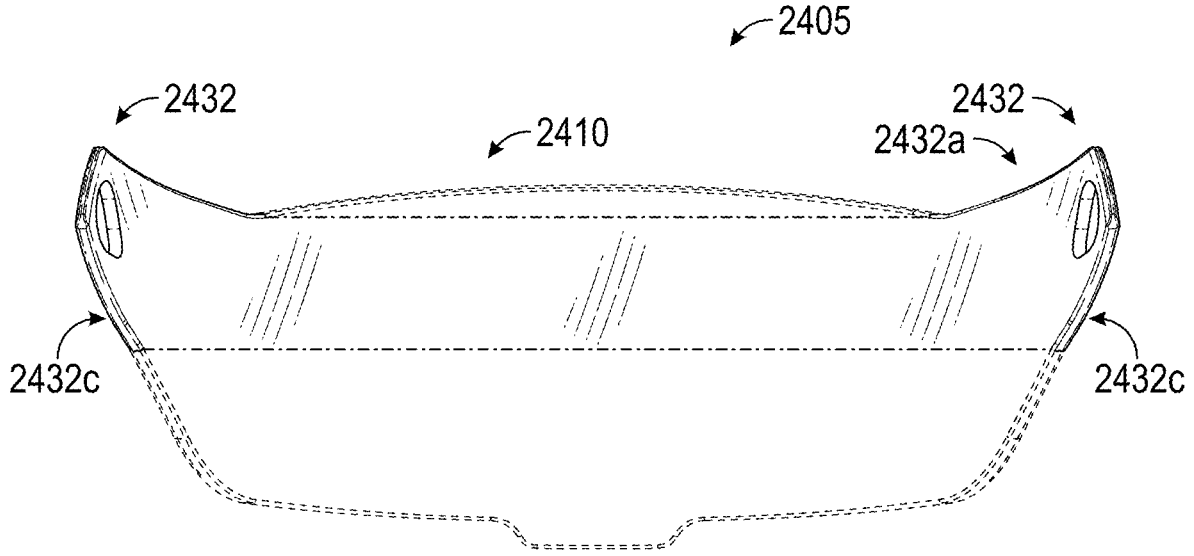
FIG. 80 is a rear view of the visor of FIG. 78.
Figure 81:
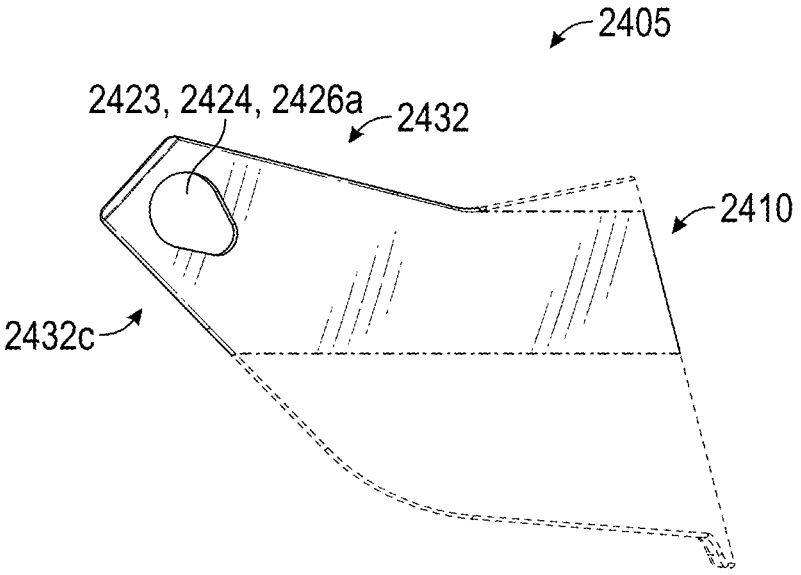
FIG. 81 is a right side view of the visor of FIG. 78.
Figure 82:
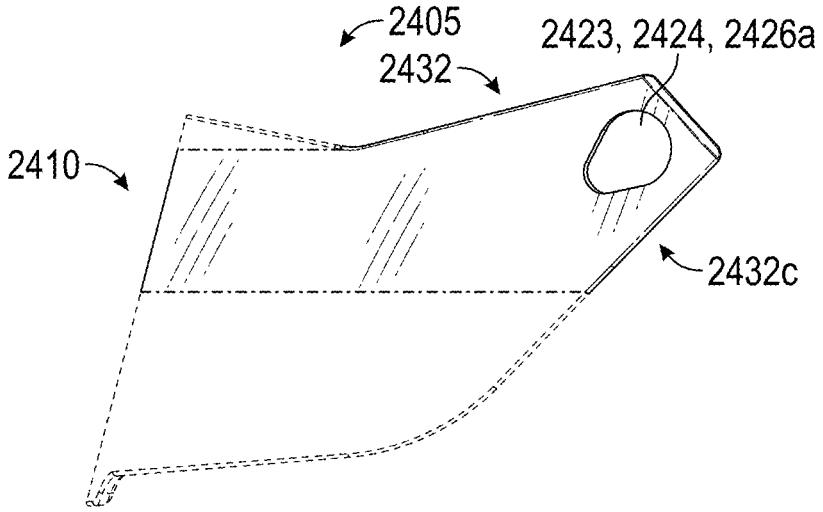
FIG. 82 is a left side view of the visor of FIG. 78.
Figure 83:
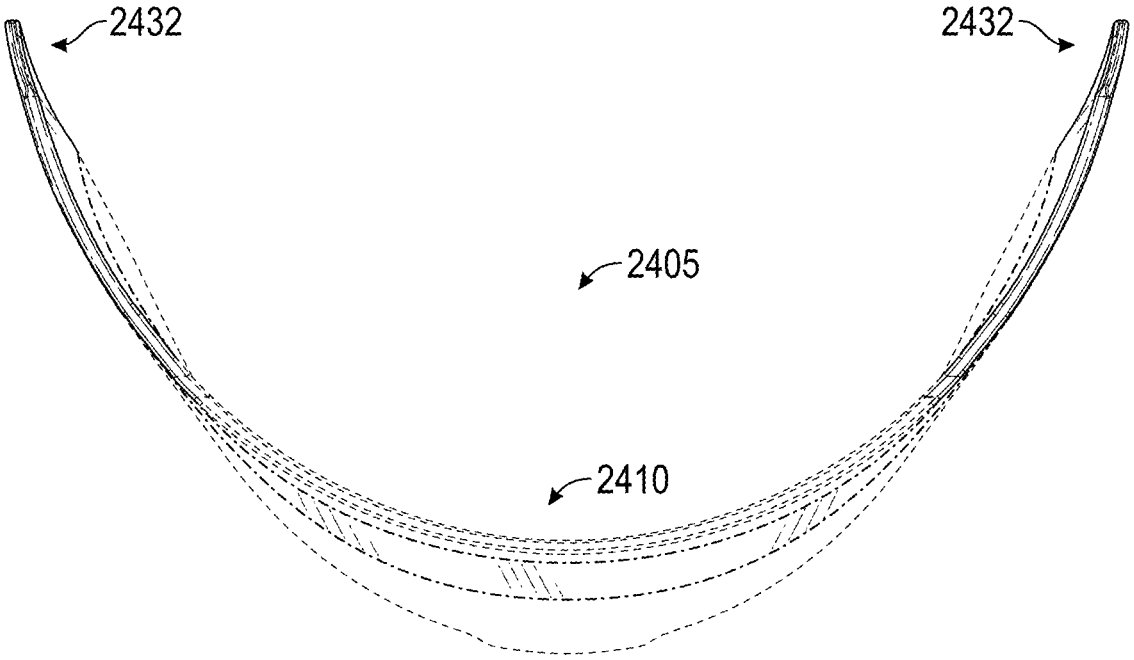
FIG. 83 is a top view of the visor of FIG. 78.
Figure 84:
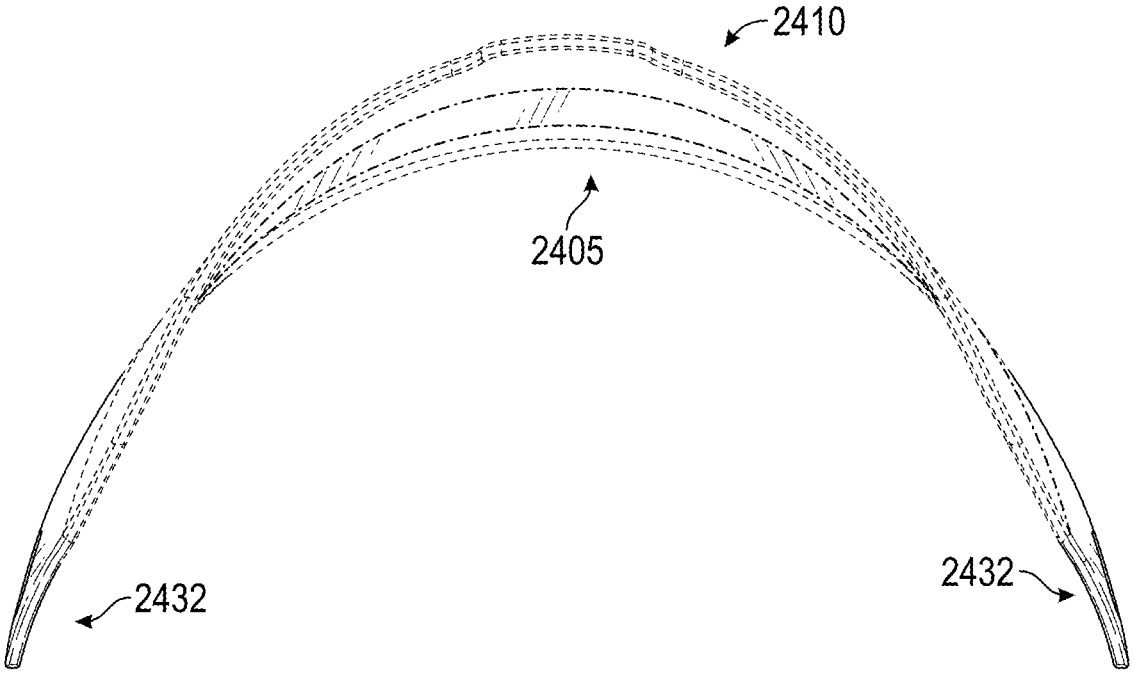
FIG. 84 is a bottom view of the visor of FIG. 78.
Figure 85:
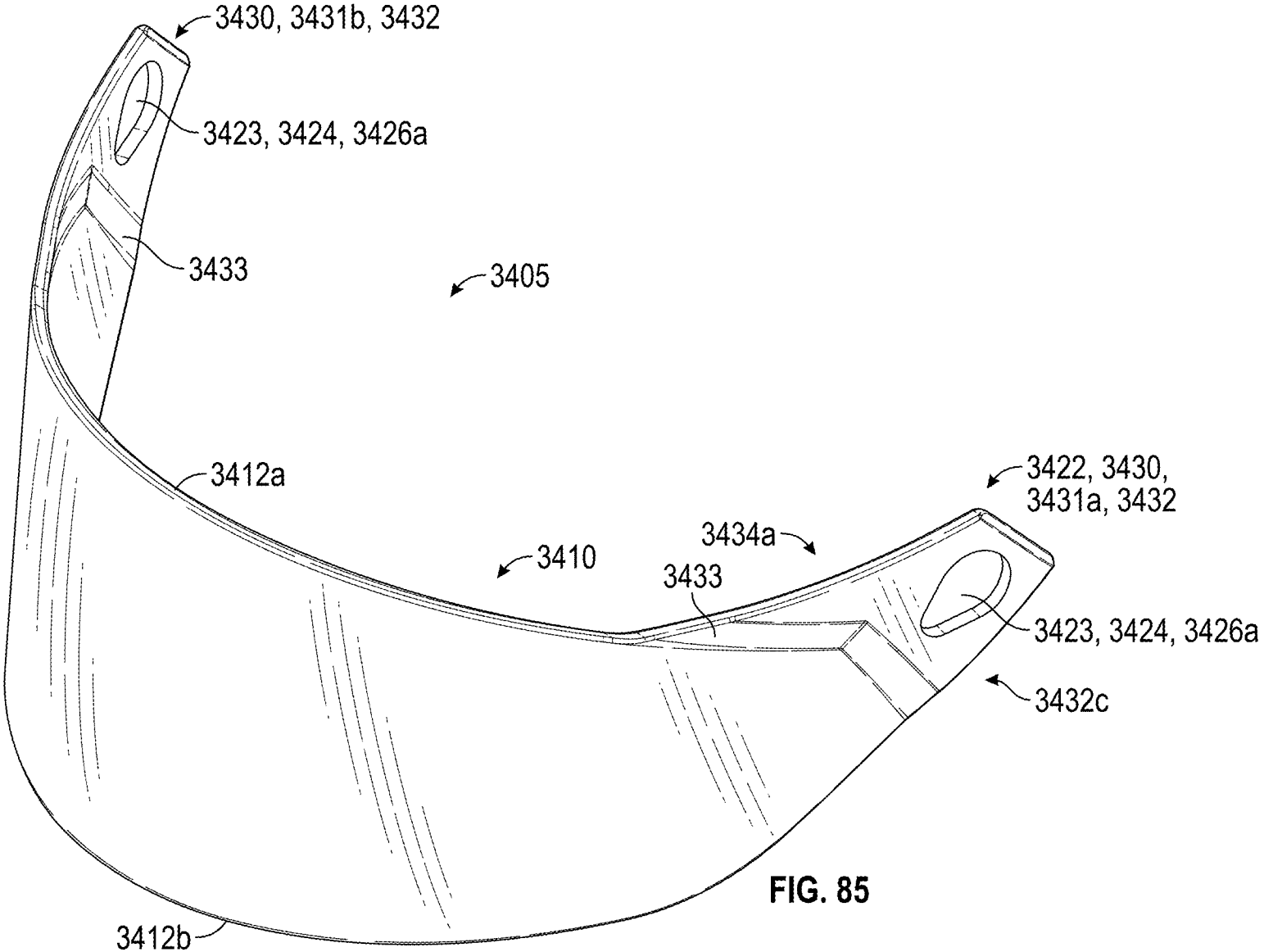
FIG. 85 is a perspective view of a fourth embodiment of a visor of the protective sports helmet.
Figure 86:
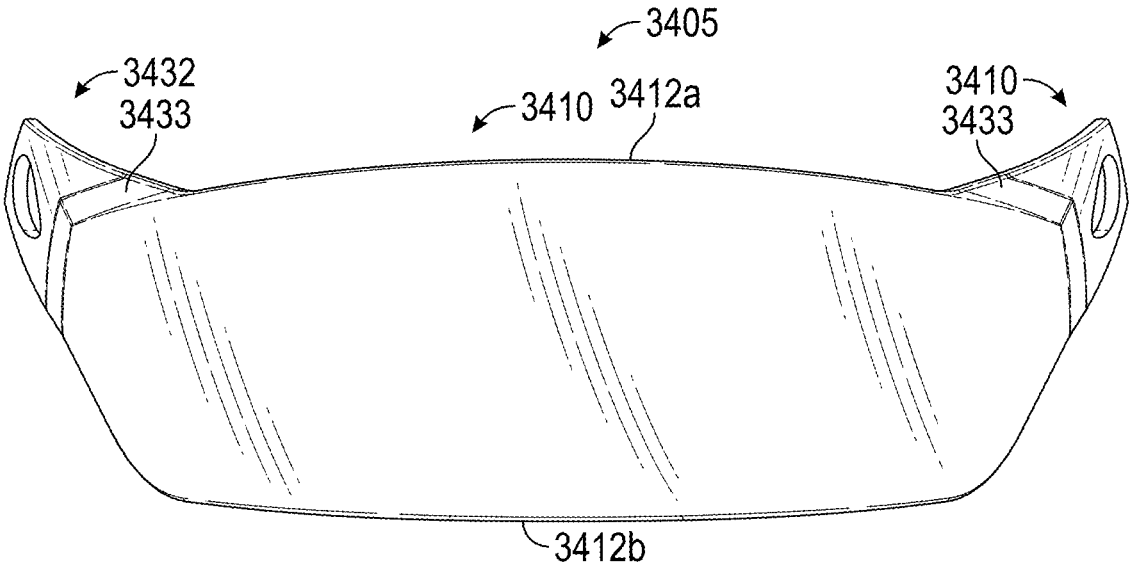
FIG. 86 is a front view of the visor of FIG. 85.
Figure 87:
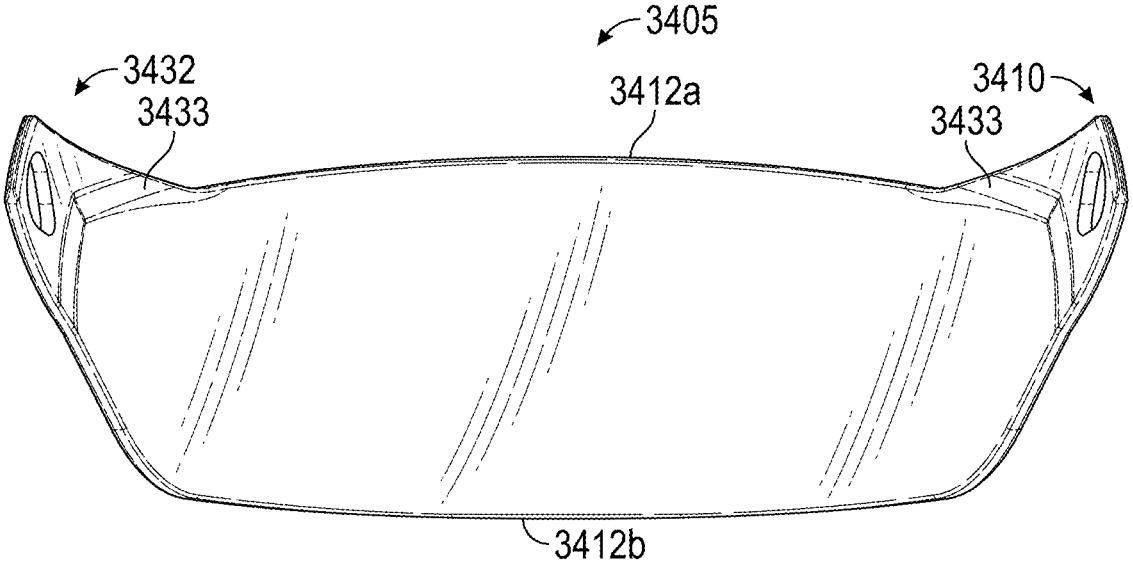
FIG. 87 is a rear view of the visor of FIG. 85.
Figure 88:
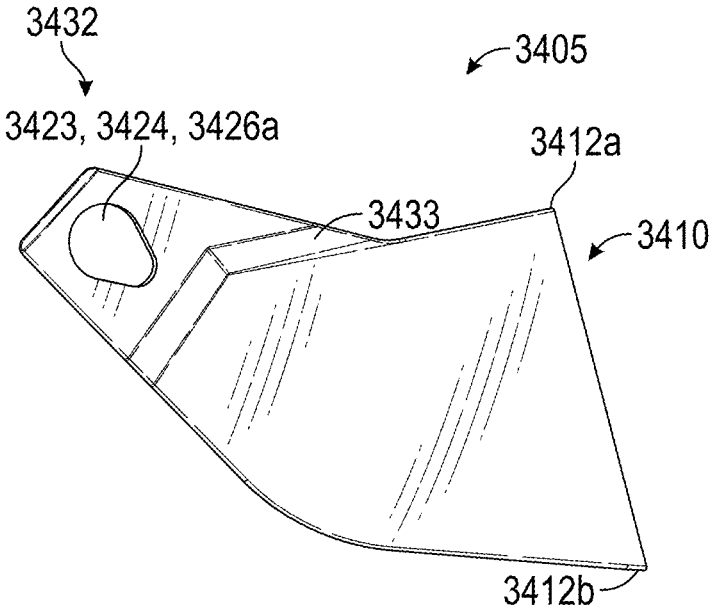
FIG. 88 is a right side view of the visor of FIG. 85.
Figure 89:
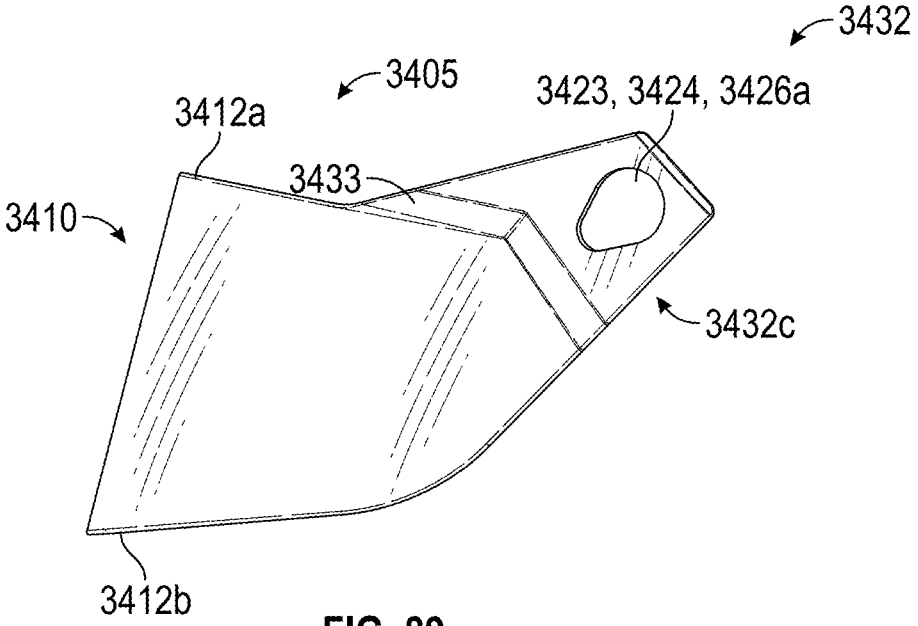
FIG. 89 is a left side view of the visor of FIG. 85.
Figure 90:
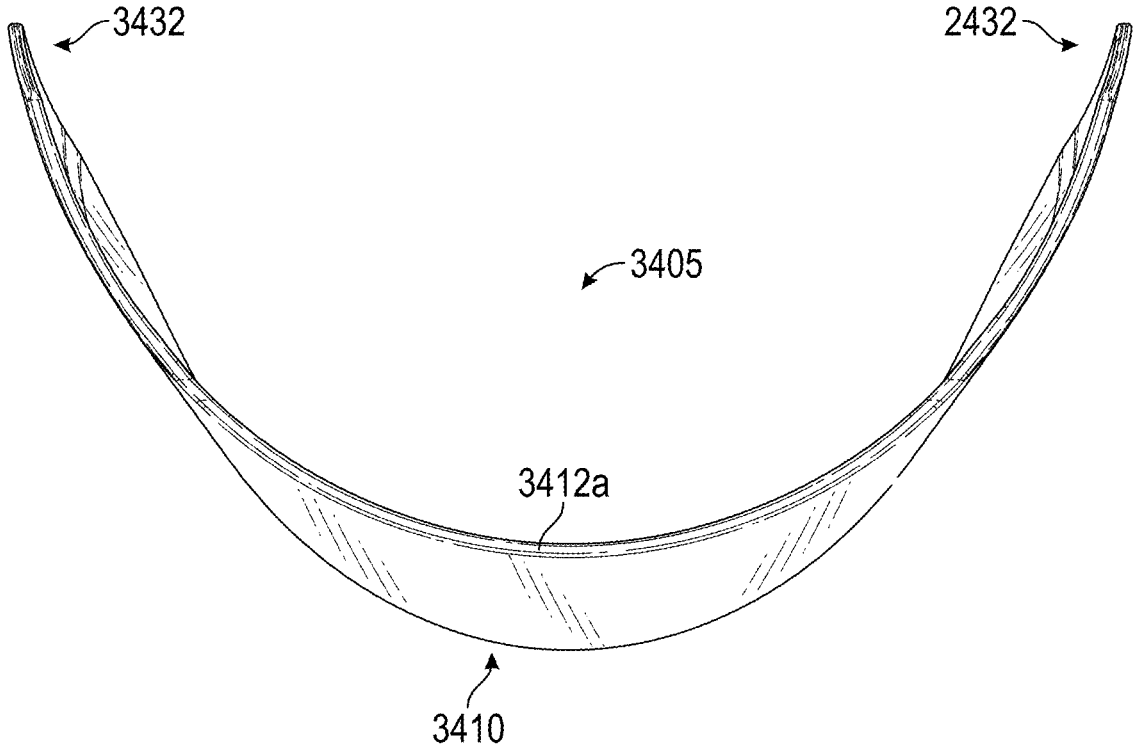
FIG. 90 is a top view of the visor of FIG. 85.
Figure 91:
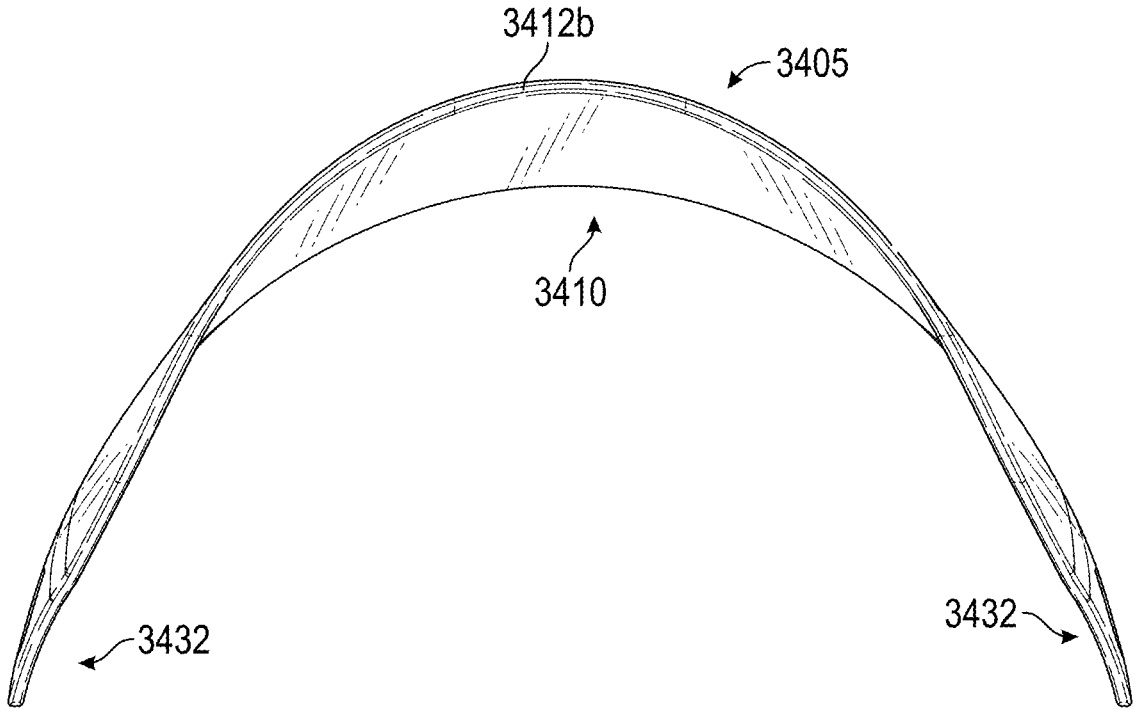
FIG. 91 is a bottom view of the visor of FIG. 85.

The raised lip 468 is formed from a collection of sidewalls or ridges that extend upward at an angle from an outer surface of the housing 462. As shown in FIGS. 54, 57, 60, the raised lip 468 is designed to be positioned adjacent to the collection of sidewalls 442 of the visor protrusion 440, when the helmet-based coupling means 460 is coupled to the shell 12. Specifically, the outer sloped surface 468*a* of the raised lip 468 is designed to abut an inner sloped surface 442*a* of the collection of sidewalls 442. Accordingly, the configuration of the raised lip 468 substantially matches the configuration of the collection of sidewalls 442. Thus, this raised lip 468 includes: (i) a first or upper sidewall 470*a* that is substantially linear and extends rearward from frontal edge of the frontal edge 462*a* of the housing 462, (ii) a second or lower sidewall 470*b* that is substantially linear and extends rearward from the frontal edge 462*a* of the housing 462, and (iii) a third or rear sidewall 470*c* that extends between the rearmost points of the upper and lower sidewalls 470*a*, 470*b*. Due to the positional relationship between the raised lip 468 and the collection of sidewalls 442, the height of the outer sloped surface 468*a* of the raised lip 468 increases as it extends from the frontal edge 462*a* towards a rear portion of the housing 462. As shown in FIGS. 54, 57, 60, the heights of this outer sloped surface of sidewalls 470*a*, 470*b*, 470*c* substantially match the heights of the sidewalls 444*a*, 444*b*, 444*c*. This configuration allows for the inner surface of housing 462 to substantially match the curvature on the inner surface of the shell 11*a*.

The coupler-based or inner interface region 472 that is defined by and extends between: (i) the inner perimeter of the raised lip 468 and (ii) the frontal edge 462*a* of the housing 462 is designed to be positioned adjacent to the pair of lateral attachment members 430. Like the shell-based or outer interface region 446, an extent of the coupler-based or inner interface region 472 is designed to be slightly larger than the tab 432 to ensure that the tab 432 can fit or can substantially fit within this region 472. For example, the interface region 472 may have: (i) a top edge 473*a* with a length $L_{TII}$ that is between 0.5 and 3 inches, preferably 1.2, (ii) a bottom edge 473*b* that has a length $L_{BII}$ that is between 0.75 and 3 inches, preferably 1.4 inches, and (iii) a rear edge 473*c* that has a length $L_{RII}$ that is between 0.1 and 1.5 inch and preferably 0.7 inches. It should be understood that these lengths, widths, and heights are only exemplary and may be changed, modified, and/or altered.

The biasing retainer 474 is a recess that extends inward from an outer extent of the main body 464 and is designed to receive the biasing member. Additionally, the biasing retainer 474 is designed to receive a majority, if not the entirety, of the retaining member 490, when the retaining member 490 is depressed to allow for the visor 205 to move from the connected position $P_C$ to the disconnected position $P_D$. Openings in the biasing retainer 474 are formed therein to allow for movement of the air out of the helmet-based coupling means 460, when the retaining member 490 is depressed towards the center of the helmet 10. The housing 462 may be formed using any known method of manufacturing, including injection molding, subtractive manufacturing (e.g., CNC), or additive manufacturing (e.g., 3D printing). Additionally, the housing 462 may have other configurations, additional features or structures, have a different positional relationship in connection with the shell 12, may be integrally formed with the shell 12, may be permanently able attached to the shell 12, may have more or less mounting regions 466, or any other combination or omission of features that are obvious to one of skill in the art.

As best shown in FIG. 51, when the housing 462 is removably coupled to the shell 12, the coupler-based interface region 472 is substantially aligned with the shell-based interface region 446. This substantial alignment between these components along with the inner surface of the raised lip 468 creates the receiver 498 (see FIG. 53) that is designed to receive a lateral attachment members 431*a*, 431*b*, which is shown as a tab 432. This receiver 498 is positioned on the inside of the shell 12 and has a curvilinear shape. Like the interface regions 446, 472, the receiver 498 has a size that is slightly larger than the tab 432. In particular, the surface area of the receiver 498 substantially matches the mating surface area of the tab 432. Substantial matching of these components is desired because it help support and prevent the rotation of the visor 405, when the helmet 10 receives an impact. Additionally, the width of the receiver 498 is between 0.10 inches and 0.13 inches, which is slightly greater than the thickness of tab 432 that is between 0.09 inches and 0.12 inches.

The biasing member 486 and the retaining member 490 are shown as a depressible member assembly or depressible button assembly. The biasing member 486 is best shown in FIGS. 57 and 60 and is shown as a spring 488. The spring 488 is positioned between the biasing retainer 474 and retaining member 490 and is designed to apply a biasing or retaining force on the retaining member 490 once a user/installer applies an inwardly directed force on the retaining member 490. This retaining force helps ensure that the retaining member 490 remains seated within the visor-based coupling means 423 when the user/installer is not applying an inwardly directed force on the retaining member 490. The biasing member 486 may be made from spring steel or any other similar material. In other embodiments, the biasing member 486 may be: (i) a magnet, (ii) a deformable member (e.g. deformable projection), or (iii) any other structure that can apply an outwardly directed force on the retaining member 490 and deformed inward upon the application of a force by the user.

The retaining member 490 is best shown in FIGS. 30, 31, 47-53, 57, and 60. The retaining member 490 is designed to fit within or is cooperatively dimensioned with the visor-based coupling means 423—namely, opening 424. As such, the retaining member 490 has a raindrop shape that is comprised of two primary components, which include: (i) a circular shaped extent 492*a* and (ii) a parabolic shaped extent 492*b* that is positioned forward of the circular extent 492*a*. The parabolic shaped extent has a sloped outer surface 494 with a rounded edge 494*a*. As best shown in FIG. 50, the forward most point of this rounded edge 494*a* is substantially aligned with an extent of the outer surface housing 462 and more specifically an extent of the coupler-based interface region 472. This alignment facilitates the coupling of the visor 405 to the shell 12 by enabling the user or installer of the visor 405 to simply apply a rearward directed force on the visor 405 in order to couple the visor 405 to the shell 12. Without this sloped outer surface 494, the user or installer would have to apply an inwardly directed force on the retaining member 490 in order to allow the rear edge 432*b* to overcome the frontal edge of the retaining member 490 in order to couple the visor 405 to the shell 12. In other embodiments, the sloped outer surface 494 and/or the rounded edge 494*a* may be replaced with an extent that does not have a sloped outer surface or has an edge that is beveled, bullnose, flat, or rounded. Also and in light of the above discussion and in connection with other embodiments, the retaining member 490 may have any one of the following shapes: (i) circular, (ii) ellipsoidal, (iii) oval, (iv) square, (v) rectangular, (vi) triangular, or (vii) any other similar shape. However, it should be understood that if the shape of the retaining member 490 is altered than the designer should consider whether an alteration to the opening 424 is necessary.

3. Alternative Embodiment of the Helmet-Based Engagement Means

Multiple other embodiments of the helmet-based engagement means 438 are described and shown in U.S. Provisional Application Ser. Nos. 63/079,476, 63/157,337, and 63/188,836, all of which are incorporated herein by reference. For sake of brevity these disclosures will not be repeated herein. However, it should be understood that the helmet-based engagement means 438 may include or be replaced with: (i) upper attachment member(s), (ii) intermediate attachment member(s), (iii) lower lateral attachment member(s), or (iv) a combination of these attachment member(s). These additional or replacement member(s) may be: (i) positioned adjacent to an extent of the shell 12 and overlap an extent of said shell 12, (ii) positioned between an extent of the energy attenuation assembly 600 and an extent of the shell 12 and underlie an extent of the shell 12, (iii) positioned within an opening that is formed within the energy attenuation assembly 600 and not positioned adjacent to an extent of the shell 12, or (iv) another position that is obvious to one of skill in the art based on this disclosure. It should be understood that any additional or replacement member(s) may or may not have corresponding member(s) that form part of the visor-based engagement means 422.

iii. Coupling the Visor to the Shell

To move the visor 405 from a disconnected position $P_D$ to partially connected position $P_{PC}$ and then to a connected position $P_C$ requires the user/installer to place the pair of lateral attachment members 430 within an extent of the pair of lateral fastening structures 450 and apply a rearwardly directed force on the visor 405. For example, the visor tabs 432 are slightly expanded approximately 0.1 inches to allow the lateral attachment members 430 to be inserted within the pair of lateral fastening structures 450 when the shell 12 is a size 44 (extra large, which is designed to fit players (who have been tested and/or measured) up to the 95th percentile). As yet another example, the visor tabs 432 are slightly compressed approximately 0.1 inches to allow the lateral attachment members 430 to be inserted within the pair of lateral fastening structures 450 when the shell 12 is a size 22 (medium, which is designed to fit players (who have been tested and/or measured) up to the $49^{th}$ percentile). In a further example, the visor tabs 432 may not be compressed or expanded to allow the lateral attachment members 430 to be inserted within the pair of lateral fastening structures 450 when the shell 12 is a size 33 (large, which is designed to fit players (who have been tested and/or measured) up to the $75^{th}$ percentile). Due to the careful design of the visor 405, the optics of the visor 405 are not compromised by this expansion or compression of the visor tabs 432.

Once the pair of lateral fastening structures 450 are positioned within the lateral attachment members 430, the visor 405 is in a partially connected position $P_{PC}$. For this partially connected position $P_{PC}$, the user/installer applies a rearwadly directed force that is: (i) has a upwardly directed angle in relation to a force that is only substantially perpendicular to the outer surface 410*b* of the main body 410, (ii) sufficiently large to overcoming the retaining force provided by the biasing member 486, and (iii) sufficiently long in order to move the rear edge 432*b* of the visor 405 passed the circular extent 492*a* or rearmost point of the retaining member 490. This rearwadly directed force causes the lateral attachment members 430—namely, the visor interface region 435 of the tab 432, to sideling engage with an extent of the lateral fastening structures 450—namely, at least one of the shell-based interface region 446 and/or the coupler-based interface region. Once the rear edge 432*b* of the visor 405 is positioned adjacent to the rear sidewall 470*c* of the raised lip 468 or is aligned with a rear extent of the interface region 472, the retaining force provided by the biasing member 486 will force the retaining member 490 within the opening 424; thus, securing the visor 405 to the shell 12 and forming the connected position $P_C$.

To move the visor 405 from the connected position $P_C$ position to the disconnected position $P_D$. In the connected position $P_C$, the biasing member 486 helps ensure that the retaining member 490 remains seated within the visor-based coupling means 423. Thus, the visor 405 cannot be moved from the connected position $P_C$ position to the disconnected position $P_D$ by the application of only a forwardly directed force. This is beneficial because it helps prevent the visor 405 from being disconnected while the player is playing the game. Accordingly, the application of two forces is necessary to move the visor 405 from the connected position $P_C$ position to the disconnected position $P_D$. The first force that must be utilized is an inwardly directed force, which is applied to the retaining member 490. This inwardly directed force must be: (i) sufficiently large to overcome the retaining force provided by the biasing member 486, and (ii) sufficiently long in order to move an outer surface of the retaining member 490 to a position that is substantially flush with an extent of the outer surface housing 462 and more specifically an extent of the coupler-based interface region 472. While the user/installer continues to apply this inwardly directed force, the user/installer must also apply an forwardly force on the visor 405 in order to move the circular shaped extent 426*a* of the visor 405 forward of rearmost point of the retaining member 490. At this point, the user/installer can forgo the application of the inwardly directed force, while continuing to apply the forwardly directed force on the visor 405. This forwardly directed force shall be applied on the visor 405 until it is removed from the shell 12.

3. Alternative Embodiment of the Visor Attachment System

Additionally, the visor attachment system 480 or the combination of the visor-based engagement means 422 and the helmet-based engagement means 438 may be replaced with other structures or features that facilitate the coupling of the visors main body 410 to the shell 12. For example, the following components may be added to components 422, 438 or may replace components 422, 438: (i) a projection that includes teeth that are received by ratcheting mechanism, (ii) a projection that is locked into place by the pressure that is exerted by a lever, (iii) a projection that is received by a deformable clip, (vi) a deformable structure that is received by another structure, (v) traditional elongated fasteners (e.g., threaded screw) and receptacles (e.g., threaded receiver), (vi) quick release connections (e.g., described within U.S. Pat. No. 8,813,269, which is incorporated herein by reference), (vii) ¼ turn connectors, (viii) bayonet connectors, (ix) press-fit connection assembly, (x) any combination of the above components, or (xi) or other similar methods of attaching an optical shield to a helmet 10.

4. Configuration/Positional Relationship of the Visor

FIGS. 127*a*-129 show approximately where the visor 405 will be positioned in relationship to the player's head H when the helmet is worn by the player P. Some of these views have been simplified by hiding extents and/or components of the helmet 10 to highlight various positional relationships. The height frontal opening 16 $H_{FO}$, which extends between the frontal edge 14*c* and the lowermost point of the side edge 14*a*. 14*b*, is less than the height of the frontal guard assembly $H_{FG}$, which extends between the uppermost point on the visor main body 405 and the lowermost point on the lower chin bar assembly 500. The height frontal opening 16 $H_{FO}$ is less than frontal guard assembly $H_{FG}$ primarily because the lower chin bar assembly 500 extends downward from the lowermost part of the side edge 14*a*, 14*b*. However, in other embodiments, the height frontal opening 16 $H_{FO}$ may be equal to or greater than frontal guard assembly $H_{FG}$. The height of the visor main body $H_{MB}$, which extends between the lowermost point of the visor main body 410 to the uppermost point of the visor main body 410, is less than the height of the lower chin bar assembly $H_{LCB}$, which extends between the lowermost point of the lower chin bar assembly 500 to the uppermost point of the lower chin bar assembly 500. In fact, the height of the visor main body $H_{MB}$ is approximately 80% of the height of the lower chin bar assembly $H_{LCB}$. It should be understood that there may be alternative heights because different size helmet shells may have different size visors 405 and chin bar assemblies 500. In addition, other percentages of the visor main body $H_{MB}$ in comparison with the height of the lower chin bar assembly $H_{LCB}$ are contemplated by this disclosure. In particular, the visor main body $H_{MB}$ may be between 0% (all chin bar assembly 500) and 100% (all visor) of height of the lower chin bar assembly $H_{LCB}$, preferably between 25% and 95%, more preferably between 35% and 90%, and most preferably between 55% and 85%. The height of the visor main body $H_{MB}$ is between: (i) 40% and 70% of the height frontal opening 16 $H_{FO}$ and preferably 55% of the height frontal opening 16 $H_{FO}$ and (ii) 30% and 65% of the frontal guard assembly $H_{FG}$ and preferably 47.5% of the frontal guard assembly $H_{FG}$. In other words, the lower chin bar assembly 500 may be completely omitted and the bottom edges 412*b*, 412*c* may be moved towards the lower edge of the shell 12. Additionally, the height of the lower chin bar assembly $H_{LCB}$ is approximately: (i) 50% and 85% of the height frontal opening 16 $H_{FO}$ and preferably 67.5% of the height frontal opening 16 $H_{FO}$ and (ii) 40% and 75% of the frontal guard assembly $H_{FG}$ and preferably 57.5% of the frontal guard assembly $H_{FG}$. Still other percentages of these components are contemplated by this disclosure in connection with other embodiments thereof.

Focusing on FIG. 131-133, the visor 405 has: (i) a visor width $W_V$ that is between 8 and 10.5 inches and is preferably 9.25 inches, (i) a visor height $H_V$ that is between 0.5 and 6 inches and is preferably 3.75 inches, and (iii) a visor distance $D_V$ that is between 4.5 inches and 6.5 inches and is preferably 5.5 inches. The visor main body 410 has: (i) a visor main body width $W_{MB}$ that is between 7.5 and 9.5 inches and is preferably 8.5 inches, (ii) a visor main body height $H_{MB}$ that is between 0.5 and 6 inches and is preferably 3 inches, and (iii) a visor main body distance $D_{MB}$ that is between 3 inches and 5.5 inches and is preferably 4.25 inches. As such, the width $W_{MB}$ of the main body 405 is approximately 90% of the width $W_V$ of the visor 405. Additionally, the height $H_{MB}$ of the main body 405 is approximately 80% of the height $H_V$ of the visor 405. Finally, the distance $D_{MB}$ of the main body 405 is approximately 80% of the distance $D_V$ of the visor 405. As shown in FIG. 131, the widths $W_V$, $W_{MB}$ are both greater than the width of the supra-aural width $W_{SA}$, which extends between the outermost points of the player's cars. In fact, the main body width $W_{MB}$ is nearly 20% larger than supra-aural width $W_{SA}$. In contrast, the shields that may be used in connection with conventional helmets may not have a width that is greater than the player's supra-aural width $W_{SA}$ due to the mounting configuration that is used in these conventional helmets. Enlarging the main body 405 with a width $W_{MB}$ over the width of the supra-aural width $W_{SA}$ helps ensure that the player's peripheral vision is not obstructed and the player's eyes are adequately covered. It should be understood that in other embodiments the heights and widths may be different. For example, the main body height $H_{MB}$ may be equal to visor height $H_V$ and/or the main body width $W_{MB}$ may be equal to visor width $W_V$.

As shown in FIG. 131-133, the center of the main body 410 (which is shown as an axis $A_{CMB}$ in FIG. 132*b*) is not aligned with the player's pupil or the player normal line of sight. The main body height $H_{MB}$ of the main body 410 can be split into two components, wherein a first component is an upper main body height $H_{ANLOS}$ above the player's pupil or normal line of sight, which extends between the player's pupil or normal line of sight and the uppermost point of the main body 410 and a second component is a lower main body height $H_{BNLOS}$ that is below the player's pupil or normal line of sight, which extends between the player's pupil or normal line of sight and the lowest point of the main body 410. The upper main body height $H_{ANLOS}$ is between 0.7 inches and 2.7 inches and preferably 1.7 inches, while the lower main body height $H_{BNLOS}$ is between 0.4 and 2.4 and preferably 1.4. Thus, the upper main body height $H_{ANLOS}$ is approximately 20% larger than lower main body height $H_{BNLOS}$. Increasing the upper main body height of $H_{ANLOS}$ by 20% over the lower main body height $H_{BNLOS}$ is beneficial because the ALOS, while playing football, is typically equal to the NLOS or has an upwardly directed angle (as shown in FIG. 134). This is different from a hockey visor where lower main body height $H_{BNLOS}$ is typically larger than the upper main body height $H_{ANLOS}$ because the player's ALOS, while playing hockey, typically has a downward angle. It should be understood that in alternative embodiments the upper main body height $H_{ANLOS}$ may be more than 20% larger than the lower main body height $H_{BNLOS}$. For example, it may be desirable to have a larger upper main body height $H_{ANLOS}$ for a lineman or a receiver (e.g., increase may between 10% and 40%), while having a smaller lower main body height $H_{BNLOS}$ for a quarterback or running back (e.g., an increase may between-5% and 20%). In other words, the optical center of the main body 410 may be positioned above, equal to, or below the NLOS for the player.

Still referring to FIG. 131-133, the uppermost extent of the visor 405 is positioned below the player's trichion (t) and above the *glabella* (g). The visor-trichion height $H_{BT}$ that extends between the uppermost point of the visor 405 and the trichion (t) is between 0.75 inches and 2.75 inches and preferably 1.75 inches. The upper visor-*glabella* height HAG that extends between the uppermost point of the visor 405 and the *glabella* (g) is between 0.5 inches and 2 inches and preferably 1 inch. The visor engagement means height $H_{VMB}$ that extends between the uppermost point of the visor 405 and the uppermost point of the main body 410 is between 0.1 inches and 1 inches and preferably 0.35 inches. The upper main body-*glabella* height $H_{MBG}$ that extends between the uppermost point of the main body 410 and the *glabella* (g) is between 0.3 inches and 1.75 inches and preferably 0.6 inches. The lowermost extent of the visor 405 is positioned above the subnasale (sn) and is substantially aligned with the nasal tip (nt). The main body 410 of the visor 405 has an uppermost extent positioned above *glabella* (g) and has a lowermost extent positioned above nasal tip (nt). The visor-subnasale height $H_{ASN}$ that extends between the lowermost point of the visor 405 and the subnasale (sn) is between 0.2 inches and 1.75 inches and preferably 0.4 inches. The lower visor-*glabella* height $H_{BG}$ that extends between the *glabella* (g) and the lowermost point of the visor 405 is between 2 inches and 4 inches and preferably 3 inches. The lower main body-*glabella* height $H_{GMB}$ that extends between the *glabella* (g) and the lowermost point of the main body is between 1.5 inches and 3.5 inches and preferably 2.5 inches. The above configuration is desirable because: (i) it provides sufficient coverage over the player's facial region, and (ii) helps ensure that the lower chin bar assembly 500 is positioned low enough to maximize the player's field of view. In further embodiments, the main body 410 may extend below the *nasale* tip (nt) or the subnasale (sn), and the lowermost extent of the visor 405 may be positioned below the subnasale (sn). It should be understood that this disclosure contemplates other configurations.

The central projection 416 has: (i) a central projection width $W_{CP}$ that is between 0 and 6 inches and is preferably 2 inches and (ii) central projection height $H_{CP}$ of the central projection is between 0 inches and 1 inch and preferably 0.25 inches. The inner pupillary width $W_{IP}$ of a player may be approximately 2.8 inches, while the player's nasal width $W_N$ may be approximately 1.5 inches. Thus, the central projection width $W_{CP}$ is greater than the nasal width $W_N$ and less than the inner pupillary width $W_{IP}$. In certain embodiments, it may be desirable to increase the central projection width $W_{CP}$ to a width that is larger than the inner pupillary width $W_{IP}$ in order to help ensure that the visor 405 is not displaced over an extent of the lower chin bar assembly 500. Also, it should be understood that the central projection width $W_{CP}$ may be equal to or less than the nasal width $W_N$. In even further embodiment, the lowermost point of the central projection 416 may be positioned below the player's subnasale (sn) or may be positioned above the player's *nasale* tip (nt). Finally and as discussed above, the central projection 416 may be completely omitted in certain embodiments.

Referring to FIG. 132, the rearmost extent of the visor 405 is positioned rearward of a vertical axis that intersects an extent of the player's coronal suture (csa), forward of the car, and above the player's *glabella* (g). In fact, the visor-coronal suture distance DRCS that the extends between a rearmost extent of the visor 405 and the coronal suture axis (csa) is between 0 inches and 1 inches and preferably 0.3 inches. The coronal suture-visor surface distance $D_{RCS}$ that extends between the coronal suture axis (csa) and a point on the inner surface of the central projection 416 is between 2 inches and 8 inches and preferably 5 inches. Additionally, the nasal tip-inner surface distance DENT that extends between the player's nasal tip (nt) and a point on the inner surface of the central projection 416 is between 0.5 inches and 3 inches and preferably 1.5 inches. These distances are beneficial because they provide sufficient coverage for the player's eyes, as the visor 405 extends a significant extent rearward from the player's *nasale* tip (nt). In fact, over 70% of the visor's rearward extending configuration is positioned behind or rearward from the player's *nasale* tip (nt). It should be understood that other configurations and measurements are within the scope of this disclosure.

Referring to FIGS. 134 and 136, the forward pupil-main body distance $D_{MBP1}$ that the extends between the player's pupil (pp) and a point on the main body 410 that is forwardly aligned with the player's pupil is between 1.7 inches and 3.7 inches and is preferably 2.4 inches. This forward pupil-main body distance $D_{MBP1}$ provides a number of benefits, which include: (i) helps ensure that the visor 405 does not make contact with the player's eyes upon receiving an impact, (ii) helps ensure a that the visor can support a significant angle between the player's NLOS and their ALOS, (iii) helps reduce fogging of the visor 405, and (iv) other benefits that are obvious to one of skill in the art. In contrast, a distance between the player's pupil (pp) and a point on the main body 410 that is forwardly aligned with the player's pupil for a hockey helmet is typically much greater due to the fogging challenges that are associated with hockey helmets. Additionally, the lateral pupil-main body distance $D_{MBP2}$ that the extends between the player's pupil (pp) and a point on the main body 410 that is vertically and laterally aligned with the player's pupil is between 1.3 inches and 2.3 inches and is preferably 2.3 inches. Further, the NOLS-main body distance $D_{MBP3}$ that the extends between the player's NLOS and the furthest point on the main body 410 is between 1.7 inches and 3.7 inches and is preferably 2.7 inches. The cross-sectional NOLS distance $D_{CP}$ that the extends between the furthest point of the visor 405 when the visor 405 is cross-sectioned at the player's NOLS or pupil (pp) is between 7.25 inches and 9.25 inches and is preferably 8.25 inches. The nasal tip-central projection distance $D_{CPNR}$ that the extends between the player's nasal tip (nt) and a point on the central projection 216 that is aligned with the player's nasal tip (nt) is between 0.7 inches and 2.7 inches and is preferably 1.7 inches. The *glabella*-central projection distance $D_{MBG}$ that the extends between the player's *glabella* (g) and a point on the central projection 216 that is aligned with the player's *glabella* (g) is between 1 inch and 3 inches and is preferably 1.8 inches. The *glabella*-central projection distance $D_{MBG}$ is configured to reduce the chance that the visor 305 can deform to an extent that is makes contact with the player's nasal.

As described above, different visors 405 may be created for different players, different playing levels, or different playing positions. For example, a completely custom visor 405 may be created for a player using a monitoring system or a video analysis system to determine their ALOS during play. This data can then be fed into a computer to be analyzed to create a custom visor 405 optimized for that player's playing style. In particular, the computer may adjust the location of the optical center, the radius of curvature of the rear surface of the main body 410, the radius of curvature of the front surface of the main body 410, may alter the $H_{ANLOS}/H_{BNOLS}$ ratio, overall height of the visor 41, the pantoscopic tilt, or any other variables of the visor 405. For example, a receiver that typically catches the ball over his right shoulder may have an upward and right ALOS. The visor 405 can be optimized for this player by shifting the optical center above and to the right of the NOLS, increasing the $H_{ANLOS}/H_{BNOLS}$ ratio, and altering the radius of curvature of the front and rear surface. In other embodiment, a position specific visor 405 may be created based upon collecting and analyzing data from players that typically play that position at a certain playing level. For example, this visor 405 may be designed to fit varsity and above lineman or college level quarterbacks. An example of a visor 405 optimized for college-level quarterback may have an optical center directly in line with their NOLS (both vertically and horizontally), as their ALOS is typically aligned with their NOLS. Or it may be desirable to shift the optical center for a lineman above the NOLS because their ALOS is typically equal to or above the NOLS. It should be understood that the above shifts in the optical centers may be slight (e.g., less than 5 mm), larger (e.g., between 10 mm and 25 mm), or significant (e.g., greater than 30 mm). It should be understood that other position specific, level specific, or player specific visors 405 are contemplated by this disclosure, and the above examples are non-limiting.

5. Configuration/Positional Relationship of the Visor

Alternative embodiments of the visor system 400 are disclosed below. For the sake of brevity, the above disclosure will not be repeated below, but it should be understood that across embodiments like numbers represent like structures. In particular, like structure have like number that is separated by 1000*s*. For example, the disclosure relating to first embodiment of the visor main body 410 applies in equal force to: (i) the second embodiment of the visor main body 1410, (ii) third embodiment of the visor main body 2410, and (iii) fourth embodiment of the visor main body 3410. Moreover, it is to be understood that any one or more features of the visor 405 can be used in conjunction with those disclosed regarding the visor 1405, 2405, 3405, and that anyone or more features of the visor 1405, 2405, 3405 can be used in conjunction with those disclosed regarding the visor 405.

The second embodiment of the visor 1405 is shown in FIGS. 71-77. This alternative embodiment 1405 is substantially similar to the first embodiment of the visor 405, but for the fact that the upper extent and lower extents of the visor 1405 may have any shape (e.g., straight, curvilinear, angled, slanted, or etc.), as indicated by the dotted lines. Additionally, the third embodiment is shown in FIGS. 78-84 and is substantially similar to the second embodiment of the visor 1405, but for the fact that the parabolic shaped front extent 426*b* of the opening 424 may be any shape (e.g., circular, triangular, blunted, squared off, or etc.), as indicated by the dotted lines. Finally, the fourth embodiment is shown in FIGS. 84-91 and is substantially similar to the first embodiment of the visor 405, but for the fact the central projection has been omitted. Other alternative embodiments of the visor 405, 1405, 2405, 3405 are contemplated by this disclosure, some of which are disclosed within U.S. Provisional Application Nos. 63/079,476, 63/157,337, and 63/188,836.

E. Chin Bar Assembly

The helmet 10 also includes a lower chin bar assembly 500 that is configured to protect the facial area and chin of the player P. The lower chin bar assembly 500 is removably attached to the shell 12 within a lower chin bar region 30 and is designed to span: (i) the entire distance between the left and right side edges 14*a*, 14*b* of the shell 12 and (ii) an extent of the frontal opening 16 in shell 12. The lower chin bar assembly 500 is unlike a conventional faceguard 9007, because the lower chin bar assembly 500 includes a pair of mounting structures 550 that couple the chin bar assembly 500 to the shell 12 that are positioned on the inner surface 11*a* of the shell 12. Additionally, the lower chin bar assembly 500 is unlike a conventional faceguard 9007, as the lower chin bar assembly 500 lacks an upper component positioned above: (i) the player's pupils (pp), *glabella* (g), or trichion (t), (ii) the rearmost point 15*f* of the side edges 14*a*. 14*b*, (iii) the frontal edge 14*c*. (iv) a majority of the car opening 28, (v) a location where the elongated member 704*a* of the chinstrap assembly 700 is coupled to the shell 12, (vi) ventilation openings in the shell 12, (vii) lowermost point of the connection between the visor-based engagement means 422 and helmet-based engagement means 438. Further, the lower chin bar assembly 500 is unlike a conventional faceguard 9007, as the lower chin bar assembly 500 includes: (i) a first or frontal portion 560 that is positioned forward and adjacent to the side edges 14*a*, 14*b* of the shell 12 and (b) a second or rear portion 580 that is positioned rearward of the side edges 14*a*, 14*b* of the shell 12 and adjacent an inner surface 30*a* of the lower chin bar region 30 of the shell 12. Moreover, the lower chin bar assembly 500 is unlike a conventional faceguard 9007, as the second or rear portion 580 of the lower chin bar assembly 500 has a rear mounting thickness $T_{RM}$ that is less than the thickness of both the frontal portion 560 and the shell 12. Finally, other differences between the lower chin bar assembly 500 may be obvious to one of skill in the art based on the below disclosure and figures.

The lower chin bar assembly 500 comprises: (i) a chin bar coupling mechanism 510, (ii) an arrangement of elongated and intersecting members 520, (iii) a pair of mounting structures 550, and (iv) an arrangement of transition segments 544*a*, 544*b* that extend between the arrangement of elongated members 520 and the pair of mounting structures 550. The arrangement of elongated and intersecting member 520 extend between the transition segments 544*a*, 544*b*. Specifically, the arrangement of elongated and intersecting members 520 includes: (i) a collection of horizontally extending members 522 and (ii) a collection of vertically extending members 524 that extend between the horizontally extending members 522. The lower chin bar assembly 500 that is shown in the Figures includes three 526*a*-526*c* horizontally extending members 522 and four 528*a*-528*d* vertically extending members 524. Each of the members' 526*a*-526*c* and 528*a*-528*d* have: (i) a substantially linear component (e.g., horizontal component), (ii) a substantially curvilinear component (e.g., vertical and depth components), and (iii) an ovular cross-sectional shape.

The uppermost horizontally extending member 426*a* is substantially aligned with and positioned adjacent to the bottom edges 14*b*, 14*c* of the visor 405. This configuration and positional relationship helps ensure that another player cannot grab an upper extent of this horizontally extending member 426*a*. The horizontally extending member 426*a* has a downwardly sloping configuration when the chin bar assembly 500 is coupled to the shell 12 and the helmet is worn by the player. In this position, a portion of the horizontally extending member 426*a* adjacent to the transition segments 544 is at a higher position than a portion of the horizontally extending member 426*a* that is located at the mid-point of the frontal edge 14*c*. In fact, an angle ζ, zeta that extents between an upper surface of the horizontally extending member 426*a* and NLOS is between 1 degree and 20 degrees and is preferably 5 degrees (see FIG. 129). This downwardly sloping configuration is beneficial because it increases the player's field of view while providing sufficient protection to player P.

It should be understood that in other embodiments, the arrangement of elongated and intersecting member 520 may include: (i) more or less horizontally extending members 522 and/or vertically extending members 524, (ii) the horizontally extending members 522 and/or vertically extending members 524 may have only curvilinear component, (iii) horizontally extending members 522 that are positioned above: (a) second segment 15*b* of the side edge 14*a*. 14*b*, (b) player's palpebrale inferius (pi), (c) player's pupils (pp), (d) above a lowermost extent of visor protrusion 440, and/or (iv) other obvious combinations, alterations, or modifications. It should be understood that if the positional relationship uppermost horizontally extending member 426*a* is altered, then the location of the bottom edge 412*b*, 412*c* of the visor 405 may altered (e.g., move towards the frontal edge 14*c*).

The pair of opposed mounting structures 550 are comprised of opposing left and right mounting structure 552*a*, 552*b*, wherein each mounting structure 552*a*, 552*b* includes: (i) a first or frontal portion 560, (ii) a second or rear portion 580, and (iii) interface region 590. When the chin bar assembly 500 is coupled to the shell 12 in the connected positon $P_C$, the frontal portion 560 is configured to be positioned forward of the side edge 14*b*, 14*c* and viewable from the exterior of the helmet 10, while the rear portion 580 is configured to be positioned rearward of the side edge 14*b*, 14*c*, adjacent to an extent of the inner surface of the shell 11*b*, and substantially un-viewable from the exterior of the helmet 10. The frontal portion 560 is coupled to and positioned between the transition segments 544 and the rear portion 580 of the mounting structure 552*a*, 552*b*. The frontal portion 560 includes: (i) two segments that are comprised of an upper segment 562 and a lower segment 564, (ii) a rear edge 570 having an upper portion 570*a* positioned within the upper segment 562 and a lower portion 570*b* positioned within the lower segment 564, (iii) a boarder 572 that is positioned between the rear edge 570 of the frontal portion 560 and the rear portion 580, and (iv) frontal edge 576.

Figure 92:
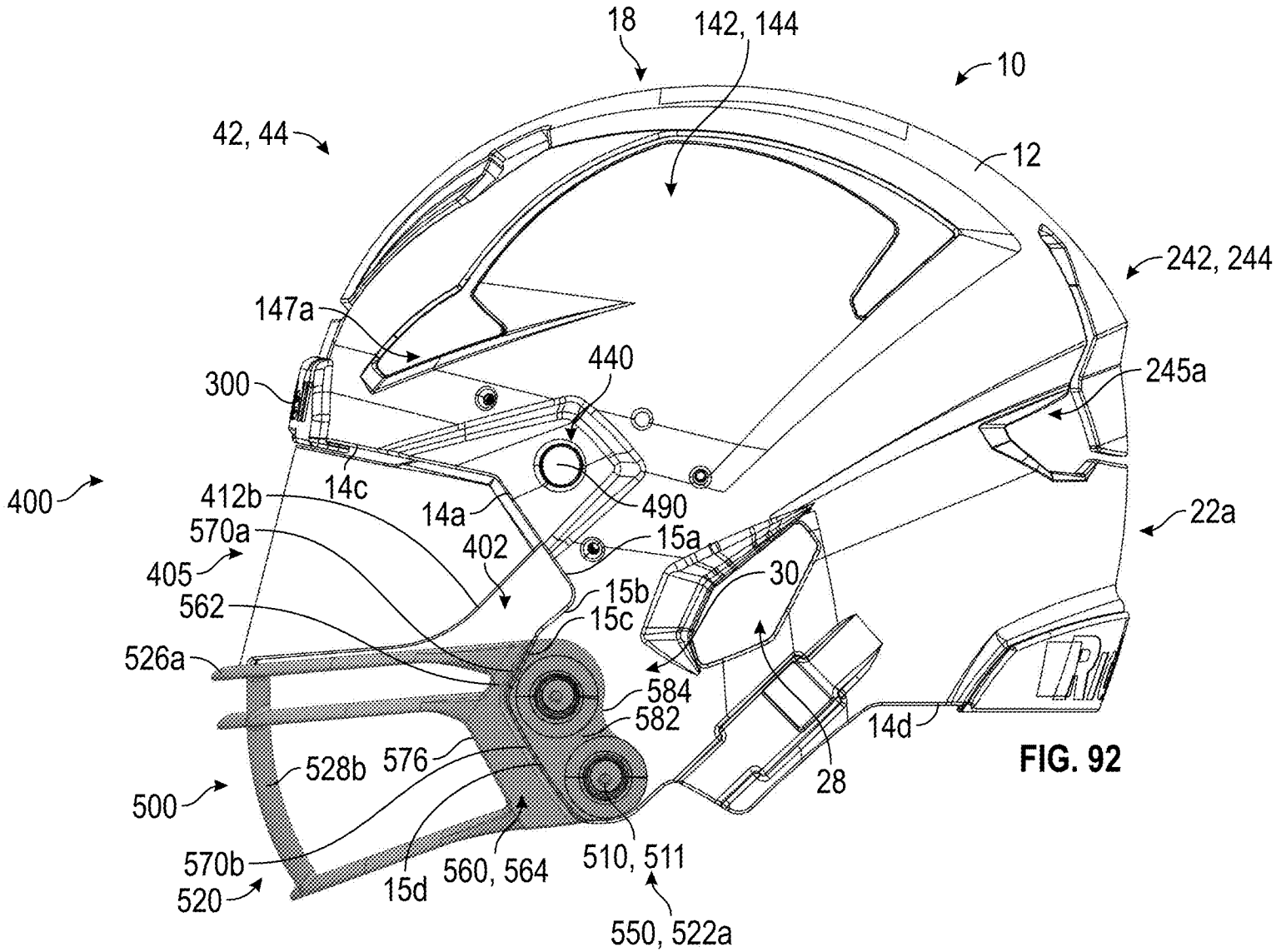
FIG. 92 is a left side view of the protective sports helmet of FIG. 1, with the lower chin bar assembly being highlighted to shows its positional relationship with the helmet.
Figure 93:
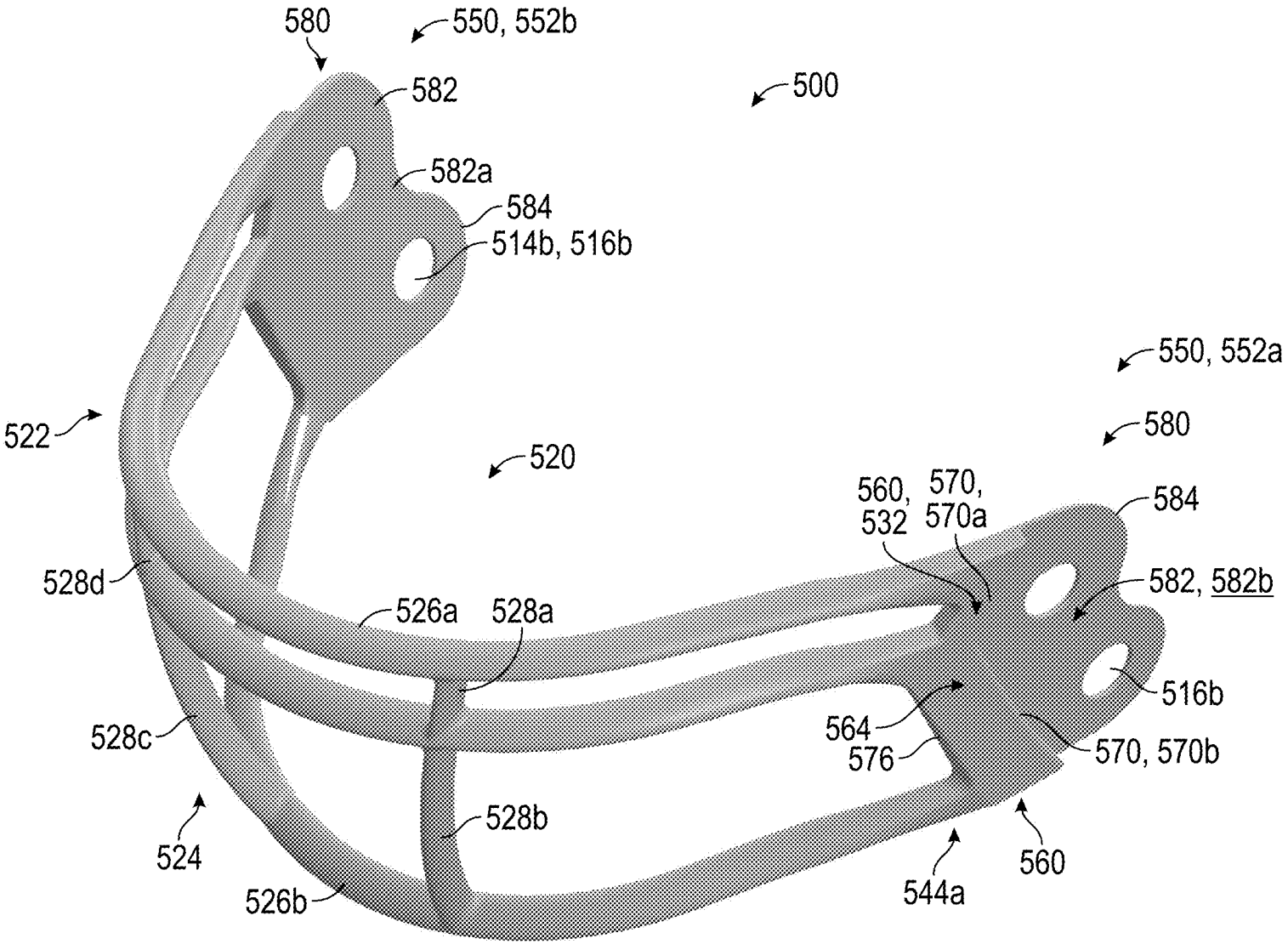
FIG. 93 is a perspective view of a first embodiment of the lower chin bar assembly of FIG. 1.
Figure 94:
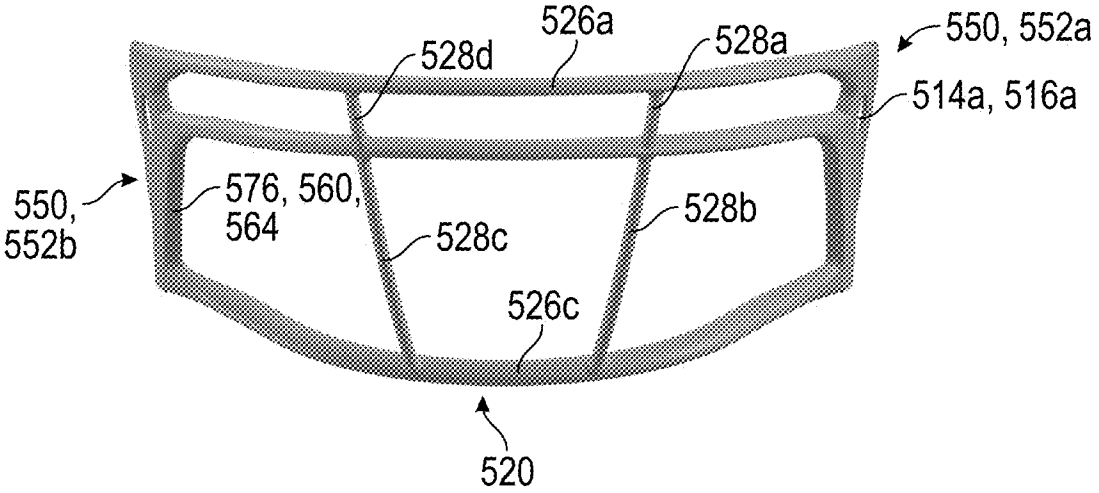
FIG. 94 is a front view of the lower chin bar assembly of FIG. 93.
Figure 95:
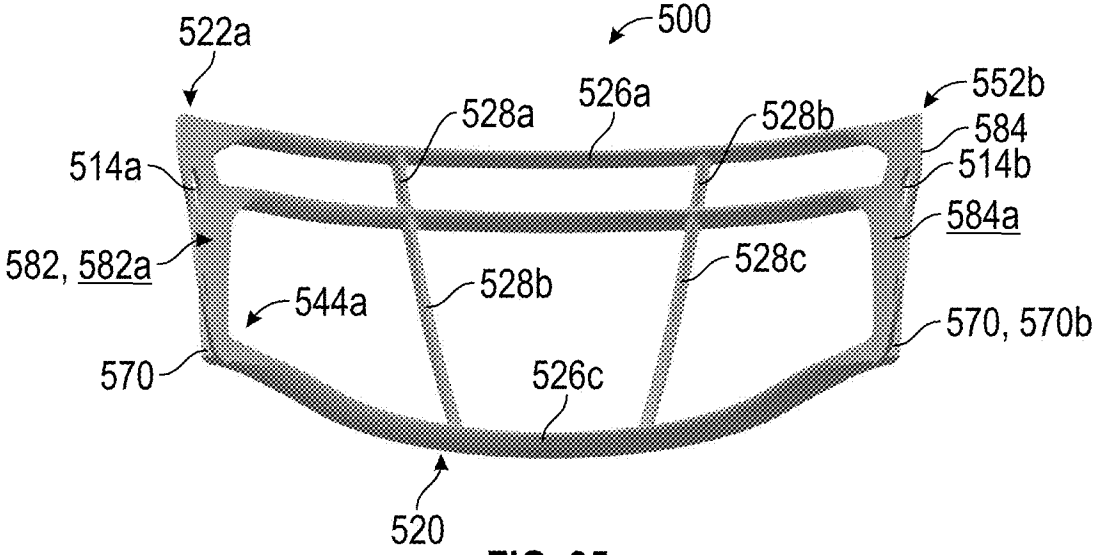
FIG. 95 is a rear view of the lower chin bar assembly of FIG. 93.
Figure 96:
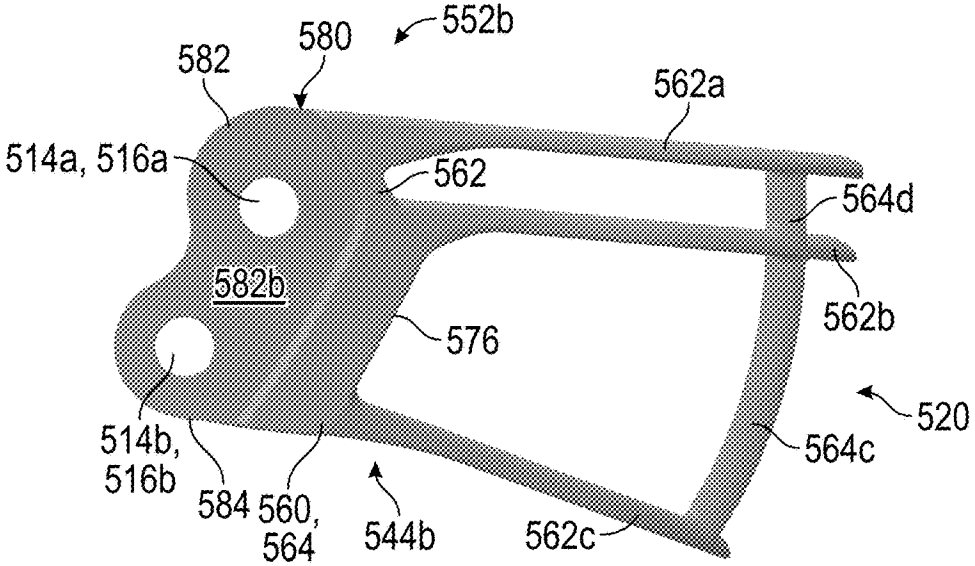
FIG. 96 is a right side view of the lower chin bar assembly of FIG. 93.
Figure 97:
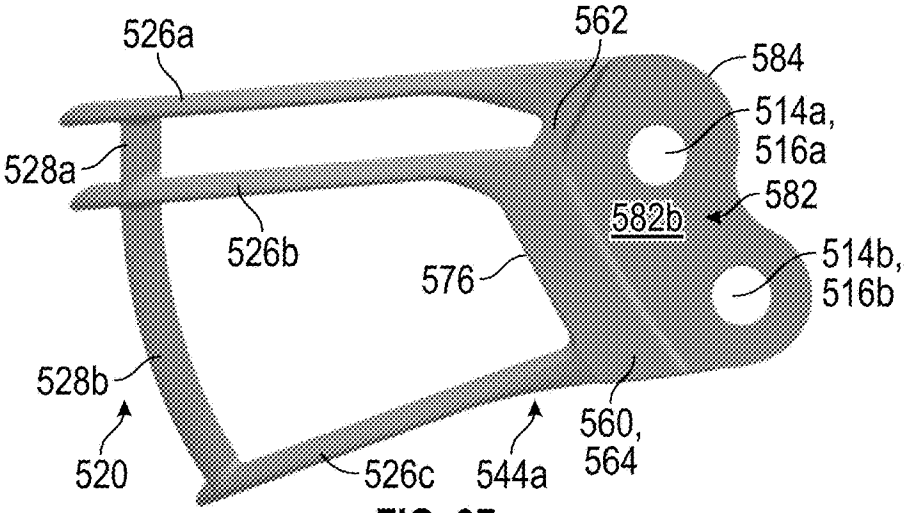
FIG. 97 is a left side view of the lower chin bar assembly of FIG. 93.
Figure 99:
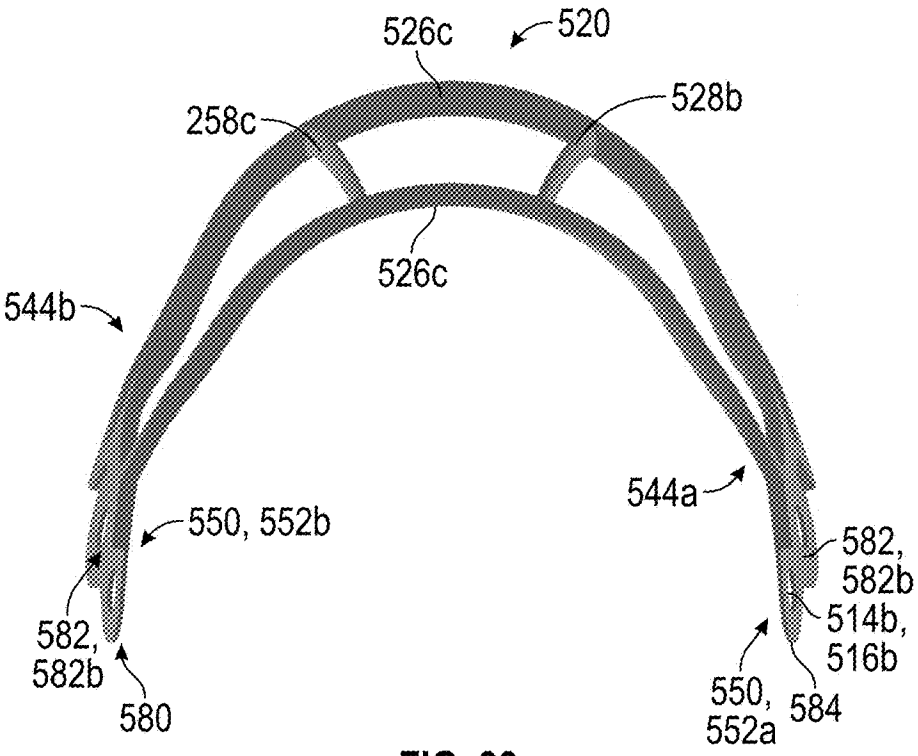
FIG. 99 is a bottom view of the lower chin bar assembly of FIG. 93.
Figure 98:
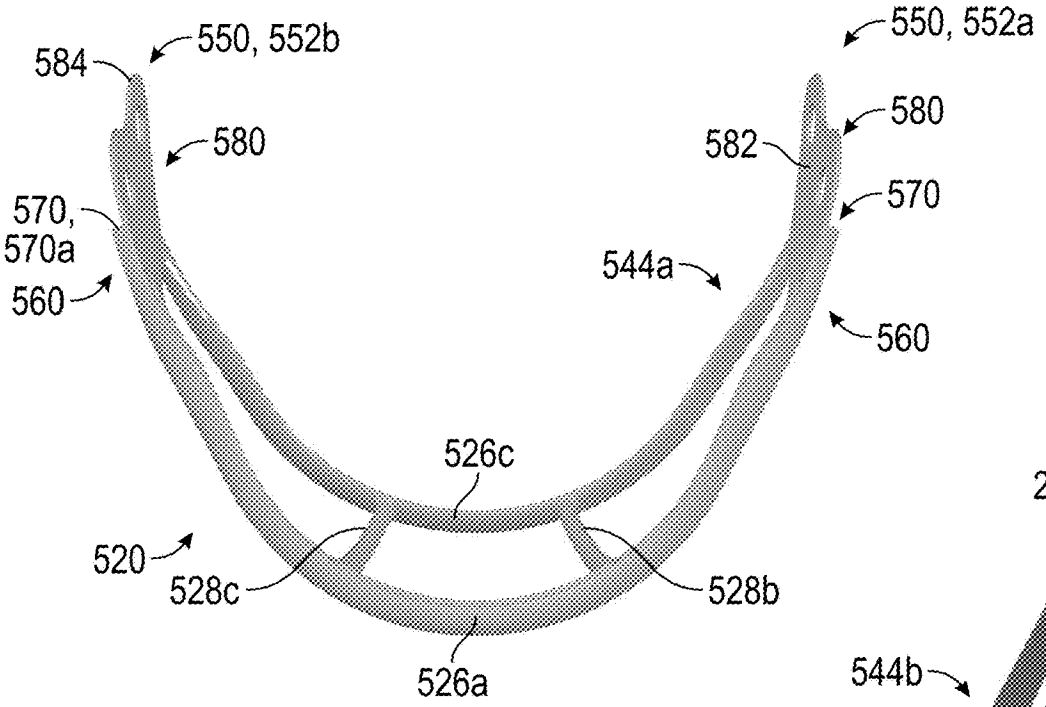
FIG. 98 is a top view of the lower chin bar assembly of FIG. 93.
Figure 100:
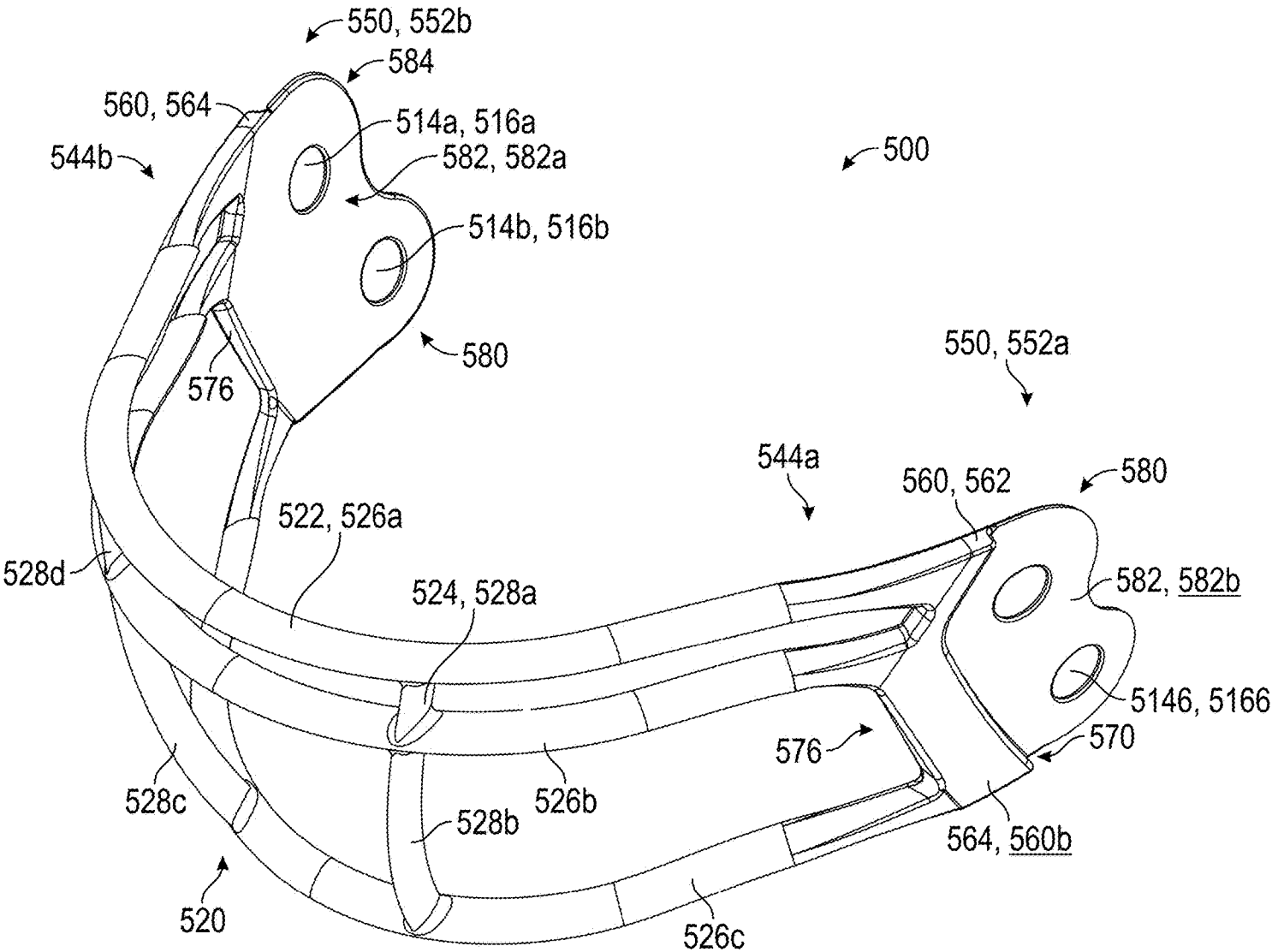
FIG. 100 is a perspective view of the first embodiment of the lower chin bar assembly of FIG. 93, wherein the lower chin bar assembly is shown in a line drawing format.
Figure 101:
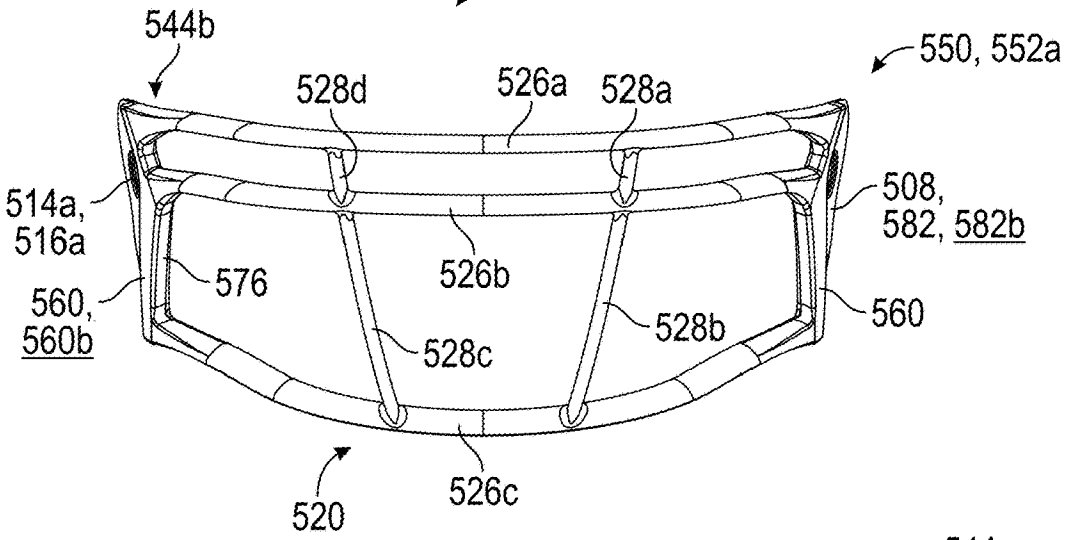
FIG. 101 is a front view of the lower chin bar assembly of FIG. 100.
Figure 102:
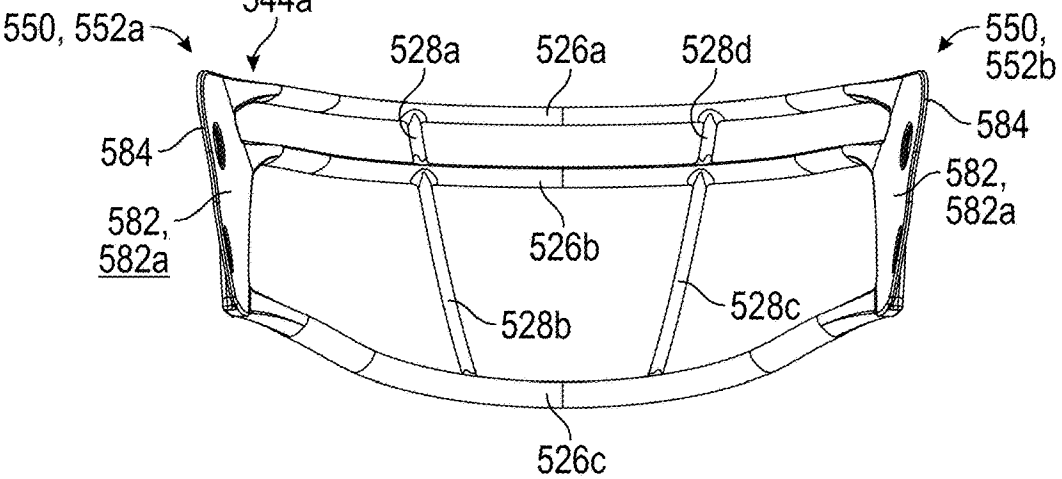
FIG. 102 is a rear view of the lower chin bar assembly of FIG. 100.

The combination of the upper portion 570*a* of the rear edge 570 and the lower portion 570*b* of the rear edge 570 forms the "V-shaped" configuration, wherein these rear edge portions 570*a*, 570*b* are positioned at an angle λ, *lama* that extends between the inner angle of these edges and is between 80 degrees and 150 degrees and is preferably 120 degrees. As best shown in FIGS. 92 and 112, this "V-shaped" configuration substantially matches the "V-shaped" configuration of the intermediate and lower segments 15*c*, 15*d* of the side edges 14*a*, 14*b* of the shell 12. In other words, when the chin bar assembly 500 is coupled to the shell 12, the upper portion 570*a* is positioned adjacent to the intermediate segment 15*c* of the side edges 14*a*, 14*b* and the lower portion 570*b* is positioned adjacent to the lower segment 15*d* of the side edges 14*a*, 14*b*. Utilizing this "V-shaped" configuration and placing portions 570*a*. 570*b* adjacent to segments 15*c*, 15*d* in the connected position $P_C$ helps prevent rotational movement of the chin bar assembly 500 when the helmet 10 receives an impact. It should be understood that in other embodiments, the chin bar assembly 500 may not have this configuration and instead may rely on other mechanisms in order to help prevent rotational movement of the chin bar assembly 500. For example, the chin bar assembly 500 may rely on keyed or unique connector system 511 that reduce or eliminate the need for this mating configuration of the chin bar assembly 500 and the side edges 14*b*, 14*c*.

The positional relationship of the rear edge portions 570*a*, 570*b* can be further defined in connection with: (i) one another, (ii) the upper surface of the horizontally extending member 426*a*, and (iii) NLOS. For example, the upper rear edge portion 570*a* has a positional relationship that includes: (i) an inner angle η, eta that extends between the upper surface of the horizontally extending member 426*a* and the upper rear edge portion 570*a* is between 100 degrees and 150 degrees and preferably 122.5 degrees, and (ii) an inner angle θ, theta that extends between a line L that is parallel with the NOLS and the upper rear edge portion 570*a* is between 90 degrees and 140 degrees and preferably 117.5 degrees. Meanwhile, the lower rear edge portion 570*b* has a positional relationship that includes: (i) an inner angle ι, lota that extends between the upper surface of the horizontally extending member 426*a* and the lower rear edge portion 570*b* is between 40 degrees and 80 degrees and preferably 62.5 degrees, and (ii) an inner angle θ, theta that extends between the line L that is parallel with the NOLS and the lower rear edge portion 570*b* is between 35 degrees and 75 degrees and preferably 57.5 degrees. It should be understood that these angles are shown in connection with this embodiment and may be changed in connection with other embodiments, wherein such changes are within the scope of this disclosure.

Figure 103:
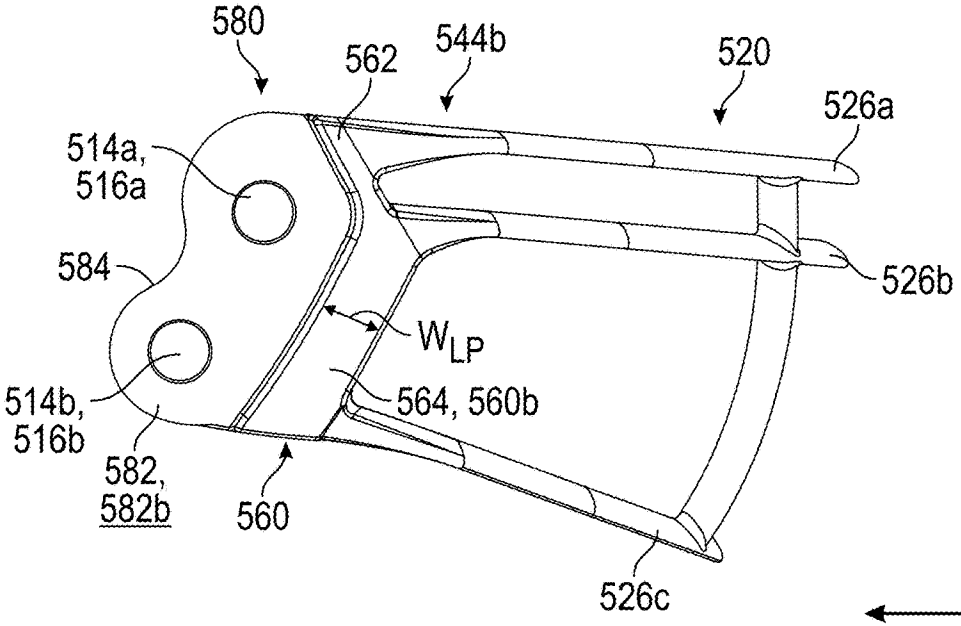
FIG. 103 is a right side view of the lower chin bar assembly of FIG. 100.
Figure 104:
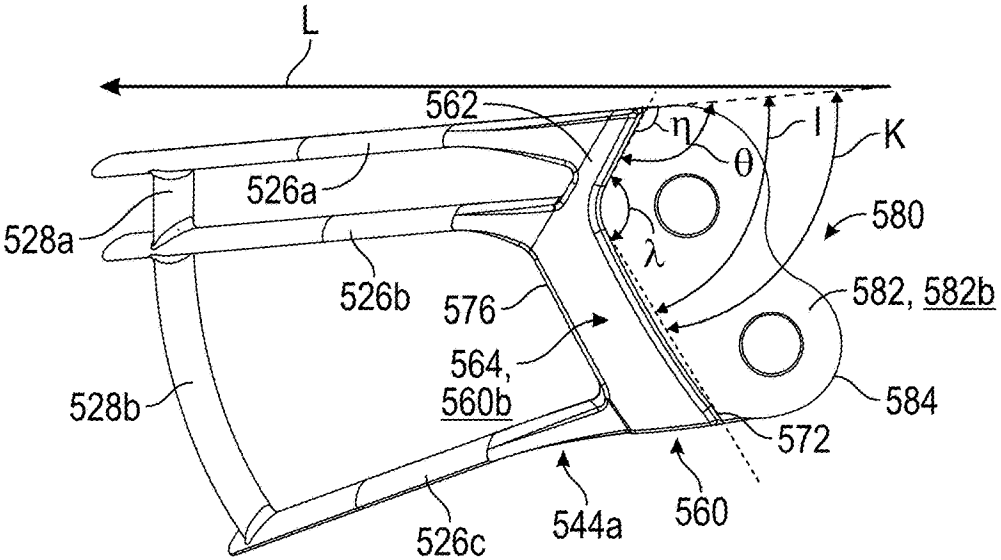
FIG. 104 is a left side view of the lower chin bar assembly of FIG. 100.
Figure 105:
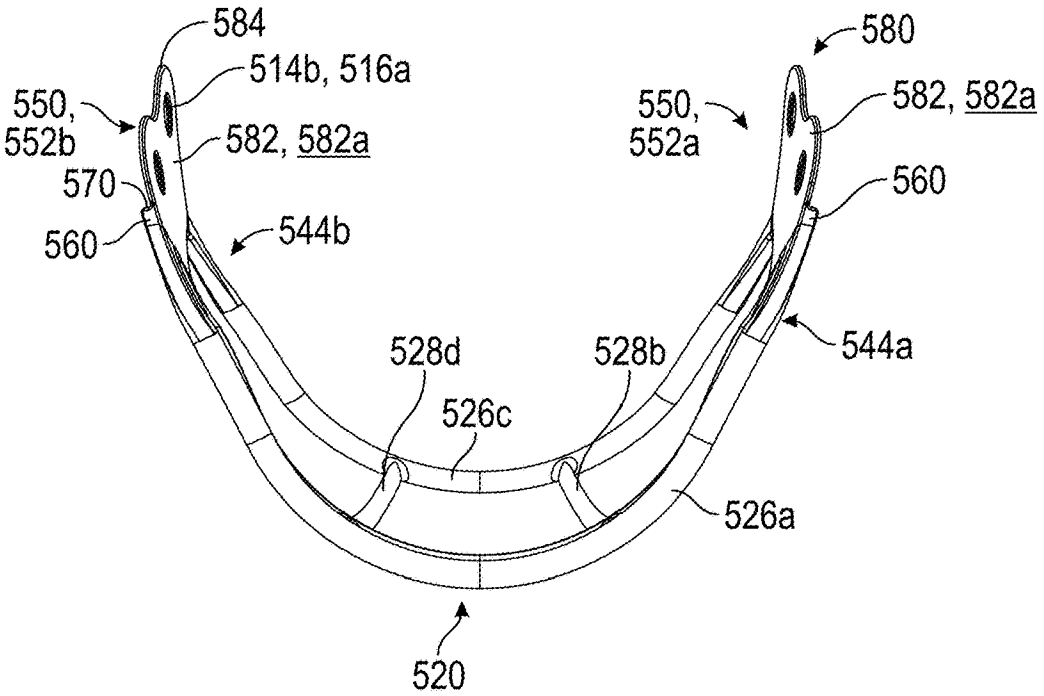
FIG. 105 is a top view of the lower chin bar assembly of FIG. 100.
Figure 106:
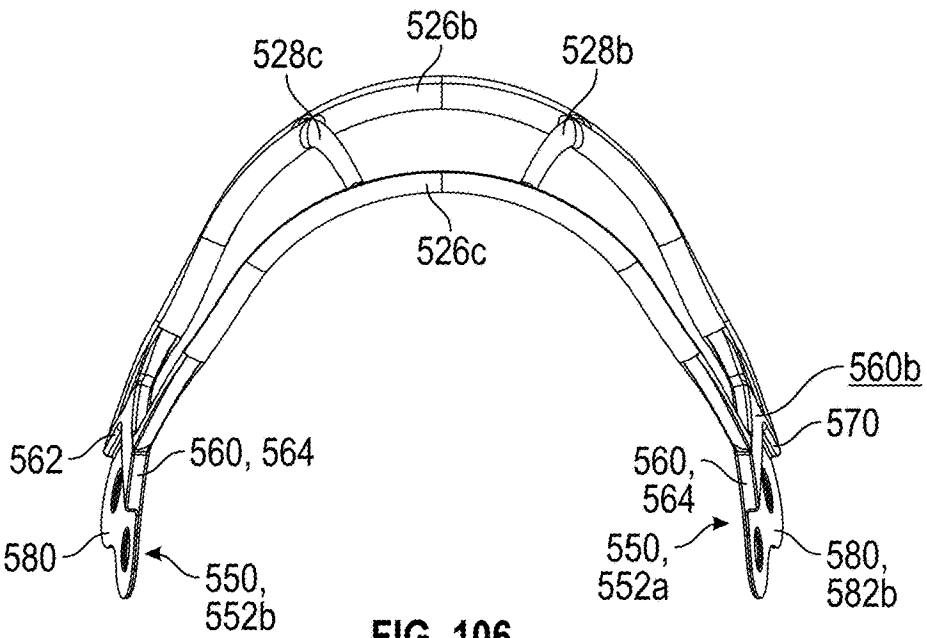
FIG. 106 is a bottom view of the lower chin bar assembly of FIG. 100.
Figure 108:
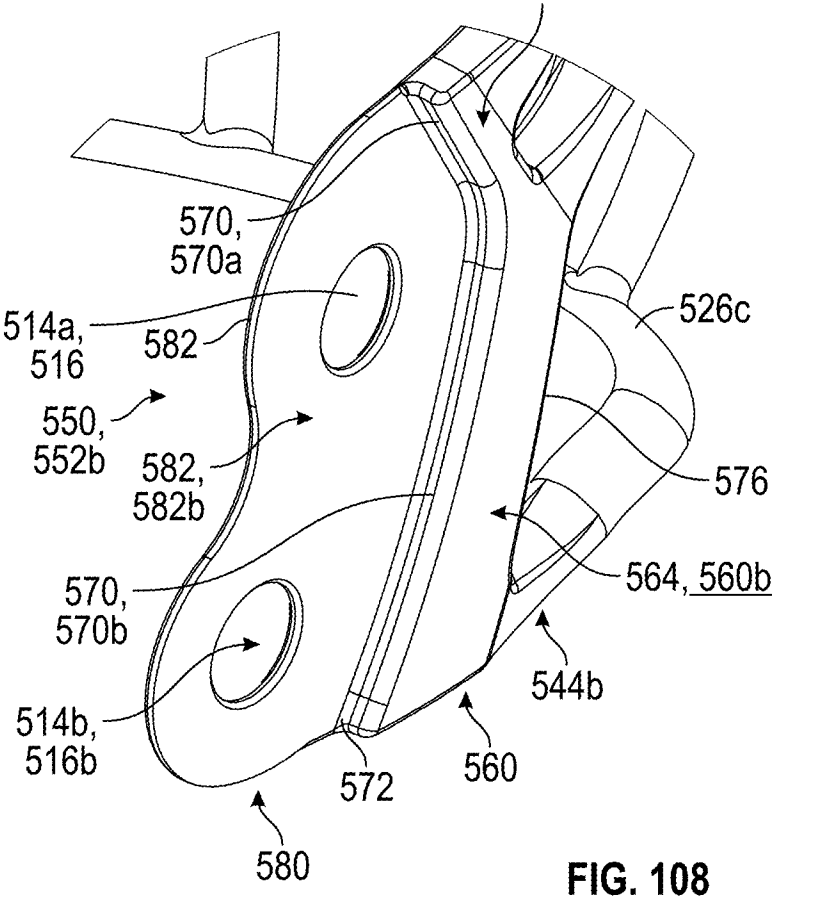
FIG. 108 is a zoomed-in view of area G the lower chin bar assembly of FIG. 107.
Figure 107:
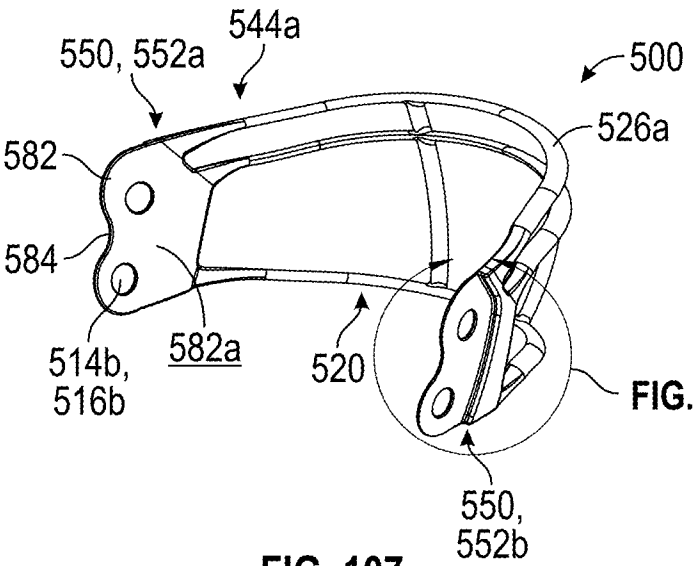
FIG. 107 is a rear perspective view of the lower chin bar assembly of FIG. 100.

As shown in FIG. 103, the upper segment 562 has an upper segment width $W_{US}$ that extends between the boarder 572 and the frontal edge 576 within said segment 562, which is between 0.1 inches and 0.5 inches and preferably 0.3 inches. Additionally, the lower segment 564 has a lower segment width $W_{LS}$ that extends between the boarder 572 and the frontal edge 576 within the lower segment 564, which is between 0.3 inches and 1.2 inches and preferably 0.7 inches. In other words, the lower segment width $W_{LS}$ that is almost 2.5 times larger than the upper segments width $W_{US}$. This substantial increase in lower segment width in comparison with the upper segments width $W_{US}$ is beneficial because of the impacts that are experienced by center to lower horizontally extending members 426*b*, 426*c*. It should be understood that in alternative embodiments these widths $W_{US}$, $W_{LS}$ may be increased, decreased or flipped (e.g., $W_{US}$ greater than $W_{LS}$).

When the lower chin bar assembly is coupled to the shell 12, the outer surface 11*b* of the shell 12 in the lower chin bar region 30 may be nearly flush with the outer surface 560*a* of the frontal portion 560 of the mounting structures 552*a*, 552*b*. However, these surfaces may not be entirely flush because the: (i) the rear edge width $W_{RE}$ that extends between the boarder 572 and the outer surface 560*a* of the frontal portion 560 of the mounting structure 552*a*, 552*b* is between 0.3 inches and 0.05 inches and preferably is 0.15 inches and (ii) the lower chin bar region thickness $T_{LCBR}$ of the shell 12 is between 0.4 and 0.1 inches and preferably is 0.19. Thus, the outer surface 11*b* of the shell 12 will protrude from the outer surface 560*a* of the frontal portion 560 by thickness $T_P$, which is less than 0.05 of inches (i.e., preferably less than 0.04 inches). In other embodiments, the outer surfaces 11*b*, 560*a* may be completely flush, the outer surface 11*b* may be inset from the outer surface 560*a*, or the outer surface 11*b* may be substantially offset from the outer surface 560*a*.

Unlike the frontal portion 560 of the mounting structures 552*a*, 522*b*, the rear portion 580 of the mounting structures 552*a*, 522*b* is configured to be positioned adjacent an extent of the inner surface 11*a* of the shell 12 and obscured from an exterior view of the helmet 10. The rear portion 580 includes a coupling plate 582 that extends rearward from the rear edge 570 of the frontal portion 560. The coupling plate 582 has: (i) an edge 584 that extends from the boarder 572 and around the perimeter of the rear portion 580, (ii) an extent of the connector system 511, and more specifically at least one female connector assembly 514, (iii) an inner surface 582*a* and (iv) an outer or interface surface 582*b*. When the lower chin bar assembly 500 is coupled to the shell 12: (i) the entirety of the rear portion 580, including the edge 584, is positioned forward of the car hole 28, (ii) the entirety of the rear portion 580, including the edge 584, is positioned rearward of: (a) the frontal edge 14*c*. (b) side edges 14*a*, 14*b*, and (c) opening 147*a*, and (iii) the bottom extent of the edge 584 substantially matches the shape of a bottom extent of the shell 12. In alternative embodiments, the edge 584 may be replaced with an edge that is linear or has a combination of linear and curvilinear segments or the positional relationships of the above structures may be altered.

The chin bar coupling means 510 includes at least connector system 511, and preferably two connector systems 511*a*, 511*b*. Each connector system 511*a*, 511*b* is comprised of a male connector assembly 512*a*, 512*b* and a female connector assembly 514*a*, 514*b*. The male connector assemblies 512*a*, 512*b* may be: (i) a quick-release connectors (e.g., connector disclosed within U.S. Pat. No. 8,813,269), (ii) traditional elongated fasteners (e.g., threaded screw), (iii) ¼ turn connectors, (iv) bayonet connectors, or similar types of male connectors. The female connector assemblies 514*a*, 514*b* are formed within the coupling plate 582 as openings 516*a*, 516*b*. Each opening 516*a*. 516*b* is cooperatively dimensioned to receive the male connector assembly 512*a*, 512*b* in order to couple the chin bar assembly 500 to the shell 12. When the inner surface 582*a* of the mounting structures 552*a*, 522*b* is positioned adjacent an extent of the inner surface 11*a* of the shell 12, the male connector assemblies 512*a*, 512*b* can be inserted through openings in the shell 12 and into the openings 516*a*. 516*b* in the coupling plate 582 in order to couple the chin bar assembly 500 to the shell 12. When the chin bar assembly 500 is connected to the shell 12, the first opening 516*a* is: (i) positioned above and forward of the second opening 516*b*, (ii) positioned below the ear hole 28. (iii) is substantially aligned with the retaining member 490 along a vertical axis, and (iv) dimensioned to receive an extent of a male connector assembly 512*a*, 512*b*. When the chin bar assembly 500 is connected to the shell 12, the second opening 516*b* is: (i) positioned below and rearward of the first opening 516*a*, (ii) positioned above the rear shell edge 14*d*, (iii) is substantially aligned with the retaining member 490 along a vertical axis, and (iv) dimensioned to receive an extent of a male connector assembly 512*a*, 512*b*. In other words, the first and second openings 516*a*. 516*b* are vertically and horizontally offset or not aligned with one another. This staggered configuration is beneficial because it helps reduce the ability for the chin bar assembly 500 to rotate.

In other embodiments, the connector system 511 may include more or less female connector assembly 514 within the coupling plate 582. For example, the connector system 511 may only include a single female connector assembly 514. In this alternative embodiment, the single female connector assembly 514 may have a keyed or unique configuration that helps prevent the chin bar assembly 500 from rotating when the helmet 10 receives an impact. In other embodiments, the connector system 511 may include three or more female connector assemblies 514. In further alternative embodiments, the first and second openings 516*a*. 516*b* may not be both vertically and horizontally offset or not aligned with one another. For example, the first and second openings 516*a*, 516*b* may be vertically aligned with one another. It should be understood in further alternative embodiments, the chin bar coupling means 510 may be: (i) a projection and retaining teeth, (ii) a projection and a pressure locking structure, (iii) a projection and a deformable retaining structure, (iv) traditional elongated fastener(s) (e.g., threaded screw) and receptacle(s) (e.g., threaded receiver), (v) press-fit connection assembly, (vi) any combination of the above components, or (vii) or other similar methods of attaching a chin bar to a helmet 10.

The connector plate 582 has a connector plate thickness $T_{CP}$ that is between 0.2 inches and 0.01 inches and is preferably 0.06 inches. As such, the connector plate thickness $T_{CP}$ is: (i) less than the thickness of the shell 12 (which varies primarily between 0.11 inches and 0.25 inches), and (ii) is less than a thickness $T_{HP}$ of the frontal portion 560 of the mounting structures 552*a*, 522*b*, which is between 0.4 inches and 0.1 inches and is preferably 0.2 inches. As such, the connector plate thickness $T_{CP}$ is approximately 30% of the frontal portion thickness $T_{HP}$ and between 20% and 60% of the shell's thickness, depending on the location where the shell's thickness is measured. It should be understood that in other embodiments, the thickness may be increased or decreased.

As described above, the shell 12 includes side edges 14*a*, 14*b* and an inner surface 11*b* and specifically an inner surface 30*b* that is located within the lower chin bar region 30. As described above, the intermediate segment 15*c* of the side edges 14*a*. 14*b* are not parallel with one another and instead have a "V-shaped" configuration. Additionally, the side edges 14*a*, 14*b* and the inner surface 30*b* are not parallel with one another and instead are substantially perpendicular with one another. Due to the fact that the mounting structures 552*a*, 552*b* interface with theses edges and surface, when the chin bar assembly 500 is coupled to the shell 12, the interface region 590 of the lower chin bar assembly 500 is comprised of three non-parallel surfaces 592*a*, 592*b*, 592*c*. Specifically, the first surface 592*a* that is formed by the upper portion 570*a* of the rear edge 570 is: (i) substantially perpendicular to 592*c* that is formed by the outer surface 580*b* of the connector plate 580, and (ii) angled to 592*b* that is formed by the lower portion 570*b* of the rear edge 570. Likewise, the second surface 592*b* that is formed by the lower portion 570*b* of the rear edge 570 is: (i) substantially perpendicular to 592*c* that is formed by the outer surface 580*b* of the connector plate 580, and (ii) angled to 592*b* that is formed by the upper portion 570*a* of the rear edge 570. Further, the three non-parallel surfaces 592*a*, 592*b*, 592*c* have non-linear and specifically curvilinear configurations to help ensure that the mounting structures 552*a*, 552*b* match the curvature of the shell 12 within this lower chin bar region 32 of the shell 12. Accordingly, the mounting structures 552*a*, 552*b* include this multi-faceted interface region 590 that aids in the coupling of the chin bar assembly 500 to the shell 12. In other words, angled and perpendicular surfaces of the shell 12 are positioned adjacent to angled and perpendicular surfaces of the lower chin bar assembly 500, when the chin bar assembly 500 is coupled to the shell 12. This positional relationship helps reduce rotation of the chin bar assembly 500 upon an impact to the helmet 10. This multi-faceted interface region 590 is vastly different than the interface regions of conventional football helmets 9010, wherein these conventional interface regions are simply extents of the faceguard 9007 that are received by a faceguard coupler.

F. Internal Energy Attenuation Assembly

As shown in FIG. 141, the helmet 10 includes the internal energy attenuation assembly 600, which comprises at least one energy attenuation member 605. In the embodiment of the helmet 10 shown in the Figures, the internal energy attenuation assembly 600 includes a plurality of energy attenuation members 605, including a front pad, a crown pad assembly, left and right car flap pad assemblies and right jaw flap pad assemblies, and rear pad assembly. It is understood that the crown pad assembly, the left and right car flap pad assemblies, the left and right jaw flap pad assemblies, and the rear pad assembly can include a number of distinct pad members formed from one or more energy absorbing materials. The energy attenuation assembly is described in at least U.S. patent application Ser. Nos. 16/691,436, 16/543,371, PCT Patent Application Serial Nos. PCT/US19/62697, PCT/US19/62700, U.S. Design patent application Ser. No. 29/671,111, and U.S. Provisional Patent Application Ser. Nos. 62/770,453, 62/719,130. As such, this disclosure will not be repeated herein.

G. Chinstrap Assembly

As shown in FIG. 141, the helmet 10 also includes a chinstrap assembly 700. The chinstrap assembly 700 includes a central member 702 and elongated straps 704*a*-704*d* that extend therefrom. Additional details about the chinstrap assembly 700 are disclosed within U.S. Pat. Nos. 9,622,532 and 9,756,889, both of which are hereby incorporated by reference. As such, this disclosure will not be repeated herein.

H. Industrial Application

In addition to applying to protective sports helmets for contact sports involving multiple players—namely, football, hockey and lacrosse helmets—the disclosure contained herein may be suitability modified by a skilled person having the requisite aptitude, knowledge and experience in the industry to design and develop helmets for: baseball player, cyclist, polo player, equestrian rider, rock climber, auto racer, motorcycle rider, motocross racer, skier, skater, ice skater, snowboarder, snow skier and other snow or water athletes, skydiver. The requisite aptitude, knowledge and experience should enable the skilled person to design and develop helmets that actually meet commercial and manufacturing requirements, as well as exceed industry safety certifications and performance standards, and the combinations thereof. Theoretical designs that are attempt to modify protective sports helmets are insufficient (and in some instances, woefully insufficient) because they amount to mere design exercises that are not tethered to the complex realities of designing, testing, manufacturing and certifying a protective sports helmet.

It is to be understood that the invention is not limited to the exact details of construction, operation, exact materials or embodiments shown and described, as obvious modifications and equivalents will be apparent to one skilled in the art. While the specific embodiments have been illustrated and described, numerous modifications come to mind without significantly departing from the spirit of the invention. Headings and subheadings, if any, are used for convenience only and are not limiting. The word exemplary is used to mean serving as an example or illustration. To the extent that the term includes, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

Numerous modifications to the present disclosure will be apparent to those skilled in the art in view of the foregoing description. Preferred embodiments of this disclosure are described herein, including the best mode known to the inventors for carrying out the disclosure. It should be understood that the illustrated embodiments are exemplary only, and should not be taken as limiting the scope of the disclosure.

The invention claimed is:

1. A protective sports helmet comprising:

(i) a visor attachment system that includes a helmet-based engagement means and a visor-based engagement means;

(ii) a shell having a frontal opening that through which a helmet wearer can view objects beyond the helmet and the helmet-based engagement means;

(iii) a lower chin bar assembly affixed to a lower extent of the shell and overlying a lower extent of the frontal opening, wherein the lower chin bar assembly includes a plurality of bar members; and (iv) a visor that includes the visor-based engagement means, and wherein: (a) the visor is configured to overlie an upper extent of the front opening, and (b) once the visor is removably coupled to the helmet shell via the interaction between the visor-based engagement means to the helmet-based engagement means, the visor remains stable and cannot be rotated relative to the helmet shell prior to an impact.

2. The protective sports helmet of claim 1, wherein an extent of the visor has a predefined curvature that substantially matches the curvature of the helmet shell.

3. The protective sports helmet of claim 2, wherein the visor is elastically deformed upon the application of on-center and off-center impacts to the helmet shell.

4. The protective sports helmet of claim 1, wherein the visor is not coupled to the lower chin bar assembly.

5. The protective sports helmet of claim 1, wherein the visor is removably secured to the helmet shell without the usage of a separate tool.

6. The protective sports helmet of claim 1, wherein the shell includes an impact attenuation system purposely engineered to adjust a specific portion of the helmet's behavior in response to an impact or series of impacts received by the helmet.

7. The protective sports helmet of claim 1, wherein the visor includes: (i) a main body portion, and (ii) an upper projection that extends upward from the main body, and wherein the visor-based engagement means extends outward and upwardly from a peripheral extent of the main body to couple with the helmet-based engagement means in a secured position.

8. The protective sports helmet of claim 7, wherein the helmet-based engagement means includes a housing and a housing engaging means that collectively interact to engage the visor-based engagement means to retain the visor in the secured position.

9. The protective sports helmet of claim 1, wherein the visor-based engagement means are not optically correct.

10. The protective sports helmet of claim 1, wherein the visor-based engagement means have an external surface that is offset from an external surface of a main body of the visor.

11. The protective sports helmet of claim 1, wherein the visor-based engagement means includes an opening configured to receive an extent of the helmet-based engagement means of the helmet shell in the secured position.

12. The protective sports helmet of claim 11, wherein the opening is defined by an edge that has a non-circular shape.

13. A visor for use with a protective sports helmet having a helmet shell with a frontal opening that through which a helmet wearer can view objects beyond the helmet, the visor comprising:

(i) a curvilinear main body portion, (ii) a plurality of upper projections that extend upwardly from the main body, (iii) opposed visor-based engagement means that: (a) extend outward and upwardly from a peripheral extent of the main body, (b) are adapted to be coupled with a helmet-based engagement means of the helmet shell in a secured position, and (c) includes an opening configured to receive an extent of the helmet-based engagement means of the helmet shell in the secured position.

14. The visor for use with a protective sports helmet of claim 13, wherein the visor further includes a plurality of gaps that are positioned between the plurality of upper projections and along an upper edge of the main body portion.

15. The visor for use with a protective sports helmet of claim 13, wherein the opposed visor-based engagement means are not optically correct.

16. The visor for use with a protective sports helmet of claim 13, wherein opposed visor-based engagement means have an external surface that is offset from an external surface of the main body.

17. The visor for use with a protective sports helmet of claim 13, wherein the opposed visor-based engagement means have a trapezoidal periphery with: (a) a substantially linear top edge, (b) a substantially linear rear edge, (c) a substantially linear bottom edge, and (d) a frontal edge that extends between the top edge and the bottom edge.

18. The visor for use with a protective sports helmet of claim 17, wherein an angle between 135 degrees and 185 degrees is formed between a top edge of the main body portion and the substantially linear top edge of the opposed visor-based engagement means.

19. The visor for use with a protective sports helmet of claim 17, wherein a beveled transition is positioned between the frontal edge of the opposed visor-based engagement means and the main body portion.

20. The visor for use with a protective sports helmet of claim 13, wherein the opening is defined by an edge that has a non-circular shape.

21. The visor for use with a protective sports helmet of claim 13, wherein the opening has a major axis that is oriented substantially perpendicular with a rear edge of the opposed visor-based engagement means in the secured position.

22. The visor for use with a protective sports helmet of claim 13, wherein the opposed visor-based engagement means are oriented angularly relative to the normal line of sight of the helmet wearer when the protective sports helmet is worn by said wearer.

* * * * *